United States Patent [19]

Takei et al.

[11] Patent Number: 4,845,001

[45] Date of Patent: Jul. 4, 1989

[54] LIGHT RECEIVING MEMBER FOR USE IN ELECTROPHOTOGRAPHY WITH A SURFACE LAYER COMPRISING NON-SINGLE-CRYSTAL MATERIAL CONTAINING TETRAHEDRALLY BONDED BORON NITRIDE

[75] Inventors: Tetsuya Takei; Keishi Saito; Tatsuyuki Aoike; Yasushi Fujioka, all of Nagahama, Japan

[73] Assignee: Canon Kabushiki Kaisha, Tokyo, Japan

[21] Appl. No.: 44,022

[22] Filed: Apr. 29, 1987

[30] Foreign Application Priority Data

| | | | |
|---|---|---|---|
| Apr. 30, 1986 | [JP] | Japan | 61-99598 |
| May 6, 1986 | [JP] | Japan | 61-103549 |
| May 7, 1986 | [JP] | Japan | 61-103105 |
| May 14, 1986 | [JP] | Japan | 61-108527 |
| May 14, 1986 | [JP] | Japan | 61-108528 |
| May 15, 1986 | [JP] | Japan | 61-109703 |

[51] Int. Cl.[4] ..... G03G 5/14; G03G 5/082

[52] U.S. Cl. ..... 430/66; 430/67

[58] Field of Search ..... 430/66, 67

[56] References Cited

U.S. PATENT DOCUMENTS

| | | | |
|---|---|---|---|
| 4,600,672 | 7/1986 | Fujimura et al. | 430/64 |
| 4,687,723 | 8/1987 | Ohshima et al. | 430/65 |
| 4,699,861 | 10/1987 | Mizukami | 430/64 |
| 4,704,343 | 11/1987 | Yoshizawa | 430/132 X |

*Primary Examiner*—Roland E. Martin

*Attorney, Agent, or Firm*—Fitzpatrick, Cella, Harper & Scinto

[57] ABSTRACT

Improved light receiving members which are characterized by having an special surface layer formed of a non-monocrystalline material containing tetrahedrally bonded boron nitride or a non-monocrystalline material containing said boron nitride and trihedrally bonded boron nitride in mingled state or by having an especial surface layer constituted with a lower layer formed of a non-monocrystalline material containing tetrahedrally bonded boron nitride and an upper layer formed of a non-monocrystalline material containing tetrahedrally bonded boron nitride and trihedrally bonded boron nitride in mingled state. The improved light receiving members excel particularly in moisture resistance, repeating use characteristic, electrical voltage withstanding property environmental use characteristic and durability.

And the improved light receiving member are particularly advantageous when used as an image-making member in electrophotography since they always exhibit substantially stable electric characteristics without depending upon the working circumstances, maintain a high photosensitivity and a high S/N ratio, do not invite any undesirable influence due to residual voltage even when used repeatedly for a long period of time, cause either defective image nor image flow and have a wealth of cleaning properties.

27 Claims, 5 Drawing Sheets

LIGHT RECEIVING MEMBER FOR USE IN ELECTROPHOTOGRAPHY WITH A SURFACE LAYER COMPRISING NON-SINGLE-CRYSTAL MATERIAL CONTAINING TETRAHEDRALLY BONDED BORON NITRIDE

FIELD OF THE INVENTION

This invention relates to the improvements in the light receiving member comprising a substrate and a light receiving layer having at least a photoconductive layer formed of an amorphous material containing silicon atom as the main layer constituent and a surface layer.

More particularly, it relates to an improved light receiving member suited especially for use in electrophotography which has a light receiving layer having a surface layer formed of an amorphous material containing tetrahedrally bonded boron nitride or both said boron nitride and trihedrally bonded boron nitride being disposed on said photoconductive layer.

BACKGROUND OF THE INVENTION

For the light receiving members for use in electrophotography and the like, the public attention has been focused on such light receiving members that have a photoconductive layer formed of an amorphous material containing silicon atom as the main layer constituent and hydrogen atom or/and halogen atom [hereinafter referred to as "A—Si(H,X)"] as disclosed in Unexamined Japanese Patent Publications Sho. 54(1979)-86341 and Sho. 56(1981)-83746, since said photoconductive layer has a high Vickers hardness in addition to having an excellent matching property in the photosensitive region in comparison with that in other kinds of light receiving member and it is not harmful to living things as well as man upon the use.

By the way, in any case, such light receiving member comprises a substrate and a photoconductive layer formed of A—Si(H,X). In this respect, it is known to provide a surface layer on the photoconductive layer, which functions to prevent the photoconductive layer from being injected by charges from its free surface side when it is engaged in charging process and to improve the moisture resistance, repeating use characteristics, breakdown voltage resistance, use environmental characteristics and durability of the photoconductive layer, and further in order to make it possible to maintain the quality of the images to be obtained for a long period of time.

And there have been made various proposals to form such surface layer using a high resistant and phototransmissive non-monocrystalline material such as amorphous material and polycrystalline material.

Among those proposals, there is a proposal to form such surface layer using a boron-nitrogen series amorphous material as disclosed in Unexamined Japanese Patent Publications Sho. 59(1984)12448 and Sho. 60(1985)-61760.

However, the boron(B)-nitrogen(N) series amorphous materials to form the foregoing surface layer which are disclosed in said publications are: boron atom and nitrogen atom are contained in unevenly distributed state and in addition, in large amount of hydrogen atom is contained; B—H bond, N—H bond and B—B bond are present in abundance; and the presence of B—N bond is slight and three dimensional structure by B—N bond is little present.

Because of this, for the light receiving members disclosed in said publications which has a surface layer formed of said boron-nitrogen series amorphous material, there are still unresolved problems that the surface layer is apt to be easily deteriorated not only with corona discharge in the charging process but also due to various mechanical actions during the contacts with a cleaning blade or other members of the device and as the layer deteriorates, it loses the functions required therefor. In addition to the above problems, the foregoing light receiving member has other problems that it is insufficient in charging efficiency so that it often brings about defective images such as those accompanied with undesired ghosts in the case where it is used in an image-making device.

SUMMARY OF THE INVENTION

This invention is aimed at eliminating the foregoing problems principally relative to the surface layer in the conventional light receiving member and providing an improved light receiving member having a desirable surface layer which can continuously exhibit the original functions required therefor without accompaniment of the foregoing problems even in repeating use for a long period of time.

Another object of this invention is to provide an improved light receiving member for use in electrophotography which always maintains a stable and effective charging efficiency and makes it possible to obtain high quality images even in the case of repeating use for a long period of time.

The present inventors have conducted extensive studies for overcoming the foregoing problems on the conventional light receiving members and attaining the objects as described above and, as a result, have accomplished this invention on the findings as below described.

That is, the present inventors have experimentally confirmed that the composition of the above mentioned surface layer formed of the foregoing boron-nitrogen series amorphous material is the very factor in order to solve the foregoing problems in the conventional light receiving member.

In view of the above, the present inventors have firstly investigated about the situation of influences of various boron nitrides in the cases when they are incorporated into a surface layer of a light receiving member for use in electrophotography.

As a result, the findings as below mentioned were obtained and on the basis of those findings, the present inventors have come to the result of acknowledging that not all but only limited kinds of boron nitride are effectively usable as the constituent of said surface layer.

That is, one finding is that the hexagonal system boron nitride of which cordination number being 3 is of the same structure as graphite, very soft, and 2 for Mohs hardness, and that in the case where the surface layer is formed of such boron nitride, the resultant light receiving member will become such that is weak against the impacts of active substances such as ion, ozone, electron etc. which will be generated by electric corona and that is apt to be easily deteriorated to lose the functions required therefor when it is mechanically damaged due to contacts with cleaning blade or other members of the electrophotographic copying system.

Further, since the hexagonal system boron nitride is of a relatively low electrical resistance, the light receiving member having a surface layer containing such boron nitride is undesirably low for the charging efficiency so that it often bring about defective images as such accompanied with undesired ghosts.

Another finding is that the cubic system boron nitride of which cordination number being 4 is of a large Mohs hardness, sufficiently resistant not only against the impacts of the above mentioned active substances but also against mechanical impacts and large enough for electrical resistance, and that in the case where the surface layer is formed of such cubic system boron nitride, the resultant light receiving member will become such desirable one that has a sufficient discharging efficiency and can make high quality images.

In view of the above, as far as the strength is concerned, it can be said that the surface layer is desirable to be formed of an amorphous material containing the hexagonal system boron nitride.

However, related various factors as below mentioned should be taken into consideration for the preparation of a desirable light receiving member particularly for use in electrophotography.

That is, the image-making process using a light receiving member in electrophotographic copying system comprises, typically, corona charging, image exposing, image developing with toner, image transferring to a paper and light receiving member cleaning. In this respect, the surface of the light receiving member will come to contact with plural members respectively of a different quality of the material in each step.

Therefore, the quality of an image to be transferred to a paper will largely depend upon whether the contact of the light receiving member with the respective members in the respective steps is suitable or not. For instance, in the case of the cleaning step using a blade, when the surface of the light receiving member is excessively hard, the blade will be worn away at an early stage and as a result, cleaning deficiency is apt to occur. And in that case, since the blade will be short-lived, the maintenance expenses of the copying system eventually become costly. On the other hand, in the case where the surface of the light receiving member is excessively soft, it is easily shaved by the blade to result in bringing about undesirable defects on an image to be made and other than this, the blade will be short-lived. Therefore, the maintenance expenses of the copying system eventually become costly also in this case.

In view of the above, it is necessary for the hardness of the surface of the light receiving member to be decided while having due regards on the harmonization thereof with the hardnesses of the respective members with which the light receiving member will contact in the respective steps of the above mentioned image-making process in electrophotographic copying system. Particularly in the case where the surface layer of the light receiving member is tried to form using the foregoing cubic system boron nitride, further appropriate improvements are required in the respective members in the respective steps of the above mentioned image-making process.

As a result of further continued studies on the basis of the above findings, the present inventors have come to obtain an acknowledge that either in the case where the surface layer of the light receiving member is made to be such that is formed of a non-monocrystalline material containing at least tetrahedrally bonded boron nitride or both tetrahedrally bonded boron nitride and trihedrally bonded boron nitride in mingled state or in the case where the surface layer is made to be such that is constituted with a lower layer formed of a non-monocrystalline material containing tetrahedrally bonded boron nitride and an upper layer formed of a non-monocrystalline material containing tetrahedrally bonded boron nitride and trihedrally bonded boron nitride in mingled state, the resultant light receiving member having any of the above surface layers becomes to have a desirable harmonization between the hardness of the surface of the light receiving member and the hardnesses of the respective members of the respective steps of the image-making process in electrophotographic copying system.

This invention has been completed based on the foregoing various findings, and it typically concerns an improved light receiving member comprising a substrate and a light receiving layer having at least a photoconductive layer formed of an amorphous material containing silicon atom as the main constituent atom and at least one kind atom selected from hydrogen atom and halogen atom and a surface layer, which is characterized in that said surface layer is formed of (1) a non-monocrystalline material containing tetrahedrally bonded boron nitride or (2) a non-monocrystalline material containing tetrahedrally bonded boron nitride and trihedrally bonded boron nitride, or is constituted with a lower layer formed of a non-monocrystalline material containing tetrahedrally bonded boron nitride and an upper layer formed of a non-monocrystalline material containing trihedrally bonded boron nitride in mingled state.

And in a preferred embodiment of the improved light receiving member according to this invention, the above mentioned surface layer may further contain dopants, either p-type or n-type. In that case, there is provided a further desirable light receiving member which can exhibit additional functions to prevent accumulation of charges in the surface layer after image exposure and also to further effectively prevent the occurrence of problems relative to image flow and residual voltage.

That is, in the case of the conventional light receiving member, the accumulation of charges often occurs in the surface layer after image exposure and the charges accumulated move horizontally near the interface between the surface layer and the photoconductive layer to thereby invite the occurrence of image flow on the resultant image. However, according to the light receiving member having of this invention which has such surface layer containing dopants, either p-type or n-type, charges which are moving into the surface layer after image exposure are mobilized to the free surface of the surface layer so that the occurrence of the problems relative to image flow and also to residual voltage which is often found on the conventional light receiving member can be effectively prevented.

BRIEF DESCRIPTION OF THE DRAWINGS

FIG. 1(A') through FIG. 1(I') are schematic views illustrating modifications of the light receiving members shown in FIG. 1(A) through FIG. 1(I).

DETAILED DESCRIPTION OF THE INVENTION

Figure 1A:
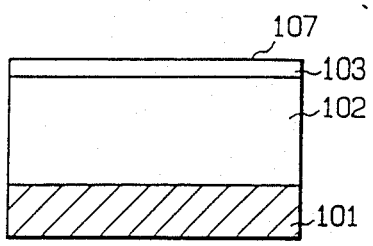
FIG. 1(A) through FIG. 1(I) are schematic views illustrating the typical layer constitution of a representative light receiving member according to this invention.
Figure 1A:
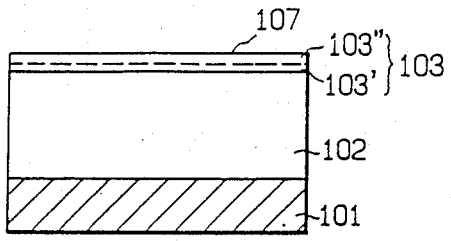

Representative embodiments of the light receiving member according to this invention will now be explained more specifically referring to the drawings. The description is not intended to limit the scope of this invention.

Representative light receiving members for use in electrophotography according to this invention are as shown in FIG. 1(A) through FIG. 1(I) and also in FIG. 1(A') through FIG. 1(I'), in which are shown substrate 101, photoconductive layer 102, surface layer 103, charge injection inhibition layer 104, long wavelength light absorptive layer (hereinafter referred to as "IR absorptive layer") 105, contact layer 106, free surface 107, intermediate layer 108, lower constituent layer of the surface layer (hereinafter referred to as "lower layer") 103' and upper constituent layer of the surface layer (hereinafter referred to as "upper layer") 103''.

FIG. 1(A) and FIG. 1(A') are schematic views illustrating typical representative layer constitutions of this invention, which are shown: (1) the light receiving member comprising the substrate 101 and the light receiving layer constituted by the photoconductive layer 102 and the surface layer 103 having the free surface 107 [FIG. 1(A)]; and (2) a modification of the light receiving member (1) of which surface layer 103 being constituted by lower layer 103' and upper layer 103'' having the free surface 107 [FIG. 1(A')].

Figure 1B:
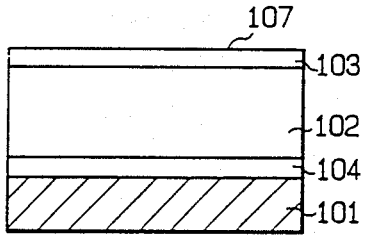
Figure 1B:
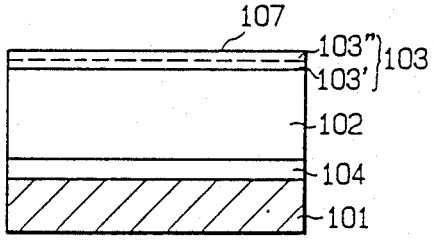

FIG. 1(B) and FIG. 1(B') are schematic views illustrating another representative layer constitutions of this invention, which are shown: (3) the light receiving member comprising the substrate 101 and the light receiving layer constituted by the charge injection inhibition layer 104, the photoconductive layer 102 and the surface layer 103 having the free surface 107 [FIG. 1(B)]; and (4) a modification of the light receiving member (3) of which surface layer 103 being constituted by lower layer 103' and upper layer 103'' having the free surface 107 [FIG. 1(B')].

Figure 1C:
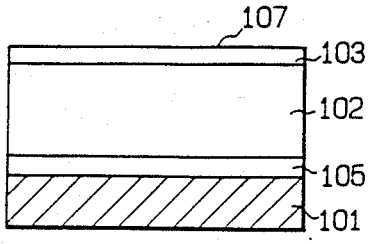
Figure 1C:
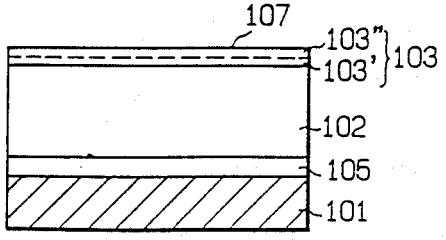

FIG. 1(C) and FIG. 1(C') are schematic views illustrating another representative layer constitutions of this invention, which are shown: (5) the light receiving member comprising the substrate 101 and the light receiving layer constituted by the IR absorptive layer 105, the photoconductive layer 102 and the surface layer 103 having the free surface 107 [FIG. 1(C)]; and (6) a modification of the light receiving member (5) of which surface layer 103 being constituted by lower layer 103' and upper layer 103'' having the free surface 107 [FIG. 1(C')].

Figure 1D:
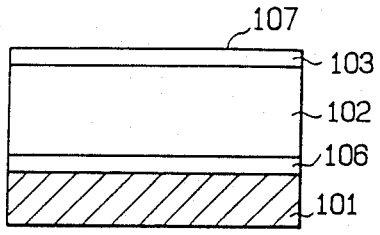
Figure 1D:
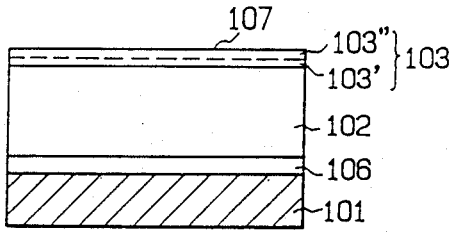

FIG. 1(D) and 1(D') are schematic views illustrating another representative layer constitutions of this invention, which are shown: (7) the light receiving member comprising the substrate 101 and the light receiving layer constituted by the contact layer 106, the photoconductive layer 102 and the surface layer 103 having the free surface 107 [FIG. 1(D)]; and (8) a modification of the light receiving member (7) of which surface layer being constituted by lower layer 103' and upper layer 103'' having the free surface 107 [FIG. 1(D')].

Figure 1E:
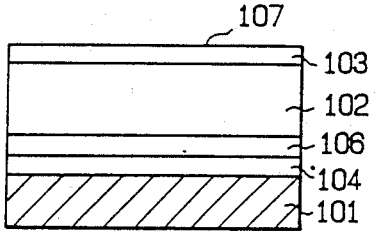
Figure 1E:
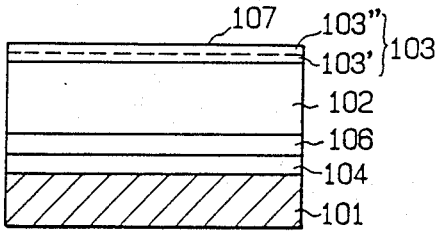

FIG. 1(E) and FIG. 1(E') are schematic views illustrating another representative layer constitutions of this invention, which are shown: (9) the light receiving member comprising the substrate 101 and the light receiving layer constituted by the charge injection inhibition layer 104, the contact layer 106, the photoconductive layer 102 and the surface layer 103 having the free surface 107 [FIG. 1(E)]; and (10) a modification of the light receiving member (9) of which surface layer being constituted by lower layer 103' and upper layer 103'' having the free surface 107 [FIG. 1(E')].

Figure 1F:
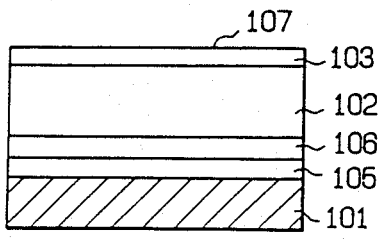
Figure 1F:
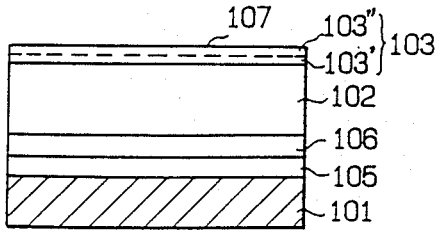

FIG. 1(F) and FIG. 1(F') are schematic views illustrating another representative layer constitutions of this invention, which are shown: (11) the light receiving member comprising the substrate 101 and the light receiving layer constituted by the IR absorptive layer 105, the contact layer 106, the photoconductive layer 102 and the surface layer 103 having the free surface 107 [FIG. 1(F)]; and (12) a modification of the light receiving member (11) of which surface layer being constituted by lower layer 103' and upper layer 103'' having the free surface 107 [FIG. 1(F')].

Figure 1G:
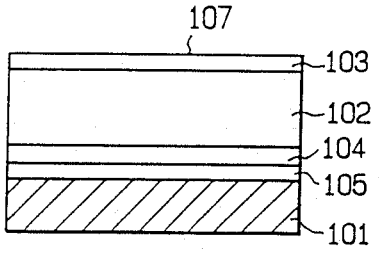
Figure 1G:
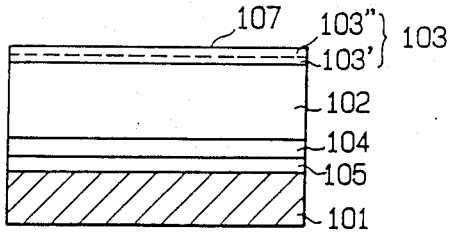

FIG. 1(G) and FIG. 1(G') are schematic views illustrating another representative layer constitutions of this invention, which are shown: (13) the light receiving member comprising the substrate 101 and the light receiving layer constituted by the IR absorptive layer 105, the charge injection inhibition layer 104, the photoconductive layer 102 and the surface layer 103 having the free surface 107 [FIG. 1(G)]; and (14) a modification of the light receiving member (13) of which surface layer 103 being lower layer 103' and upper layer 103'' having the free surface 107 [FIG. 1(G')].

Figure 1H:
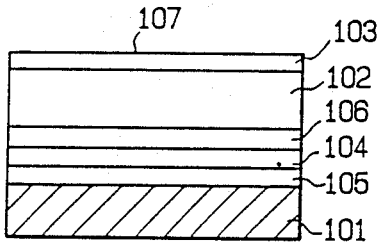
Figure 1H:
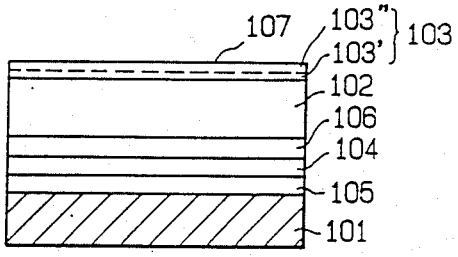

FIG. 1(H) and FIG. 1(H') are schematic views illustrating another representative layer constitutions of this invention, which are shown: (15) the light receiving member comprising the substrate 101 and the light receiving layer constituted by the IR absorptive layer 105, the charge injection inhibition layer 104, the contact layer 106, the photoconductive layer 102 and the surface layer 103 having the free surface 107 [FIG. 1(H)]; and (16) a modification of the light receiving member (15) of which surface layer 103 being constituted by lower layer 103' and upper layer 103'' having the free surface 107 [FIG. 1(H')].

Figure 1I:
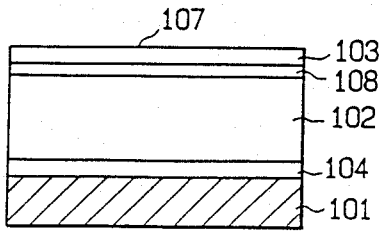
Figure 1I:
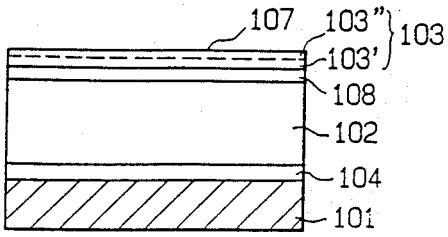

FIG. 1(I) and FIG. 1(I') are schematic views illustrating another representative layer constitutions of this invention, which are shown: (17) the light receiving member comprising the substrate 101 and the light receiving layer constituted by the charge injection inhibition layer 104, the photoconducting layer 102, the intermediate layer 108 and the surface layer 103 having the free surface 107 [FIG. 1(I)]; and (18) a modification of the light receiving member (17) of which surface layer 103 being constituted by lower layer 103' and upper layer 103'' having the free surface 107 [FIG. 1(I')].

SUBSTRATE 101

The substrate 101 for use in this invention may either be electroconductive or insulative. The electroconductive substrate can include, for example, metals such as NiCr, stainless steels, Al, Cr, Mo, Au, Nb, Ta, V, Ti Pt and Pb or the alloys thereof.

The electrically insulative substrate can include, for example, films or sheets of synthetic resins such as polyester, polyethylene, polycarbonate, cellulose acetate, polypropylene, polyvinyl chloride, polyvinylidene chloride, polystyrene, and polyamide, glass, ceramic and paper. It is preferred that the electrically insulative substrate is applied with electroconductive treatment to at least one of the surfaces thereof and disposed with a light receiving layer on the thus treated surface.

In the case of glass, for instance, electroconductivity is applied by disposing, at the surface thereof, a thin film made of NiCr, Al, Cr,, Mo, Au, Ir, Nb, Ta, V, Ti, Pt, Pd, $In_2O_3$, $SnO_2$, ITO ($In_2O_3$ +$SnO_2$), etc. In the case of the synthetic resin film such as a polyester film, the electroconductivity is provided to the surface by disposing a thin film of metal such as NiCr, Al, Ag, Pv, Zn, Ni, Au, Cr, Mo, Ir, Nb, Ta, V, Tl and Pt by means of vaccum deposition, electron beam vapor deposition, sputtering, etc., or applying lamination with the metal to the surface. The substrate may be of any configuration such as cylindrical belt-like or plate-like shape, which can be properly determined depending on the application uses.

The thickness of the substrate is properly determined so that the light receiving member as desired can be formed.

In the case where flexibility is required for the light receiving member, it can be made as thin as possible within a range capable of sufficiently providing the function as the substrate. However, the thickness is usually greater than 10 μm in view of the fabrication and handling or mechanical strength of the substrate.

And, it is possible for the surface of the substrate to be uneven in order to eliminate occurrence of defective images caused by a so-called interference fringe pattern being apt to appear in the formed images in the case where the image making process is conducted using coherent monochromatic light such as laser beams.

CHARGE INJECTION INHIBITION LAYER 104

The charge injection inhibition layer is to dispose under the photoconductive layer 102.

The charge injection inhibition layer in the light receiving member is constituted with an A—Si(H,X) material containing group III element as a p-type dopant or group V element as an n-type dopant [hereinafter referred to as "A—Si(III,V):(H,X)"], a poly-Si(H,X) material containing group III element or group V element [hereinafter referred to as "poly-Si(III,V):(H,X)"] or a non-monocrystalline material containing the above two materials [hereinafter referred to as "Non-Si(III,V):(H,X)"].

The charge injection inhibition layer in the light receiving member of this invention functons to maintain an electric charge at the time when the light receiving member is engaged in electrification process and also to contribute to improving the photoelectrographic characteristics of the light receiving member.

In view of the above, to incorporate either the group III element or the group V element into the charge injection inhibition layer is an important factor to efficiently exhibit the foregoing functions.

Specifically, the group III element can include B (boron), Al (aluminum), Ga (gallium), In (indium) and Tl (thallium). The group V element can include, for example, P (phosphor), As (arsenic), Sb (antimony) and Bi (bismuth). Among these elements, B, Ga, P and As are particularly preferred.

And the amount of either the group III element or the group V element to be incorporated into the charge injection inhibition layer is preferably 3 to $5\times10^4$ atomic ppm, more preferably 50 to $1\times10^4$ atomic ppm, and most preferably $1\times10^2$ to $5\times10^3$ atomic ppm.

As for the hydrogen atoms(H) and the halogen atoms(X) to be incorporated into the charge injection inhibition layer, the amount of the hydrogen atoms(H), the amount of the halogen atoms(X) or the sum of the amounts of the hydrogen atoms and the halogen atoms(H+X) is preferably $1\times10^3$ to $7\times10^5$ atomic ppm, and most preferably, $1\times10^3$ to $2\times10^5$ atomic ppm in the case where the charge injection inhibition layer is constituted with a poly-Si(III,V):(H,X) material and $1\times10^4$ to $6\times10^5$ atomic ppm in the case where the charge injection inhibition layer is constituted with an A—Si(III,V):(H,X) material.

Further, it is possible to incorporate at least one kind atoms selected from oxygen atoms, nitrogen atoms and carbon atoms into the charge injection inhibition layer aiming at improving the bondability of the charge injection inhibition layer not only with the substrate but also with other layer such as the photoconductive layer and also improving the matching of an optical band gap-(Egopt).

In this respect, the amount of at least one kind atoms selected from oxygen atoms, nitrogen atoms and carbon atoms to be incorporated into the charge injection inhibition layer is preferably $1\times10^{-3}$ to 50 atomic %, more preferably $2\times10^{-3}$ to 40 atomic %, and most preferably $3\times10^{-3}$ 30 atomic %.

The thickness of the charge injection inhibition layer in the light receiving member is an important factor also in order to make the layer to efficiently exhibit its functions.

In view of the above, the thickness of the charge injection inhibition layer is preferably 0.03 to 15 μm, more preferably 0.04 to 10 μm, and most preferably 0.05 to 8 μm.

IR ABSORPTIVE LAYER 105

The IR absorptive layer 105 in the light receiving member of this invention is to dispose under the photoconductive layer 102 or the charge injection inhibition layer 104.

The IR absorptive layer in the light receiving member of this invention functions to effectively absorb the long wavelength light remained unabsorbed in the photoconductive layer to thereby prevent the appearance of interference phenomena due to reflection of long wavelength light at the substrate surface.

The IR absorptive layer 105 is constituted with an A—Si(H,X) material containing germanium atoms(Ge) or/and tin atoms(Sn) [hereinafter referred to as "A—si(-Ge,Sn) (H,X)"], a poly—Si(H,X) material containing germanium atoms (Ge) or/and tin atoms(Sn) [hereinafter referred to as "poly—Si(Ge,Sn) (H,X)"]or a non-monocrystalline material containing at least one of the above two materials [hereinafter referred to as "Non—-Si(Ge,Sn) (H,X)"].

As for the germanium atoms(Ge) and the tin atoms(Sn) to be incorporated into the IR absorptive layer, the amount of the germanium atoms(Ge), the amount of the tin atoms(Sn) or the sum of the amounts of the germanium atoms and the tin atoms(Ge+Sn) is preferably 1 to $1\times10^6$ atomic ppm, more preferably $1\times10^2$ to $9\times10^5$ atomic ppm, and most preferably, $5\times10^2$ to $8\times10^5$ atomic ppm.

As for the hydrogen atoms(H) and the halogen atoms(X) to be incorporated into the IR absorptive layer, the amount of the hydrogen atoms(H), the amount of the halogen atoms(X) or the sum of the amounts of the hydrogen atoms and the halogen atoms(H+X) is preferably $1\times10^3$ to $3\times10^5$ atomic ppm, and most preferably, $1\times10^3$ to $2\times10^5$ atomic ppm in the case where it is constituted with a poly—Si(Ge,Sn) (H,X) material and $1\times10^4$ to $6\times10^5$ atomic ppm in the case where it is constituted with an A—Si(Ge,Sn) (H,X) material.

And, the thickness of the IR absorptive layer 105 is preferably 0.05 to 25 μm, more preferably 0.07 to 20 μm, and most preferably 0.1 to 15 μm.

CONTACT LAYER 106

The contact layer 106 in the light receiving member of this invention is to dispose under the photoconductive layer.

The main object of disposing the contact layer in the light receiving member of this invention is to enhance the bondability between the substrate and the photoconductive layer, between the charge injection inhibition layer and the photoconductive layer or between the IR absorptive layer and the photoconductive layer.

The contact layer 106 is constituted with an A—Si(H,X) material containing at least one kind atom selected from oxygen atom, carbon atom and nitrogen atom [hereinafter referred to as "A—Si(O,C,N) (H,X)"], a poly—Si(H,X) material containing at least one kind atom selected from oxygen atom, carbon atom and nitrogen atom [hereinafter referred to as "poly—Si(O,C,N) (H,X)"] or a Non—Si(H,X) material containing at least one kind atom selected from oxygen atom, carbon atom and nitrogen atom [hereinafter referred to as "Non—Si(O,C,N) (H,X)"].

In the light receiving member of this invention, the amount of nitrogen atoms, oxygen atoms, or carbon atoms to be incorporated in the contact layer is properly determined according to the use purposes.

However, the amount of one or more kind atoms of them to be contained in the contact layer is preferrably $1\times10^2$ to $9\times10^5$ atomic ppm and more preferrably $1\times10^2$ tp $4\times10^5$ atomic ppm.

As for the hydrogen atoms(H) and the halogen atoms(X) to be contained in the contact layer, the amount of the hydrogen atoms(H), the amount of the halogen atoms(X) or the sum of the amounts of the hydrogen atoms and the halogen atoms(H+X) is preferably 10 to $7\times10^5$ atomic ppm, and most preferably, 10 to $2\times10^5$ atomic ppm in the case where it is constituted with a poly—Si(O,C,N) (H,X) material, and $1\times10^3$ to $7\times10^5$ atomic ppm in the case where it is constituted with an A—Si(O,C,N) (H,X) material.

And the thickness of the contact layer 106 is preferably 20 Å to 5 μm, more preferably 50 Å to 3 μm, and most preferably, 100 Å to 1 μm.

By the way, in the light receiving member of this invention, it is possible to selectively combine the foregoing charge injection inhibition layer 104, IR absorptive layer 105 and contact layer 106.

Representative embodiments in that case are shown in FIG. 1(E) to 1(H) and FIGS. 1(E') to 1(H').

Further, in the light receiving member of this invention, it is possible to make the foregoing charge injection inhibition layer 104 or IR absorptive layer to be such that can function not only as that layer but also as the contact layer.

In that case, the object can be attained by incorporating at least one kind atom selected from oxygen atom, carbon atom and nitrogen atom into the corresponding layer.

Further in addition, it is also possible to make either the foregoing IR absorptive layer 105 or the foregoing charge injection inhibition layer to be such that can exhibit the functions of the two layers by incorporating the group III element or the group V element into the foregoing IR absorptive layer or by incorporating germanium atom or tin atom into the foregoing charge injection inhibition layer.

Now, for the formation of each of the above mentioned constitutent layers, that is, charge injection inhibition layer 104, IR absorptive layer 105 and contact layer 106 of the light receiving member of this invention, any of the known film forming processes such as thermal induced chemical vapor deposition process, plasma chemical vapor deposition process, reactive sputtering process and light induced chemical vapor deposition process can be selectively employed. And among these processes, the plasma chemical vapor deposition process is the most appropriate.

For instance, in the case of forming such layer constituted with a poly—Si(H,X) series material by means of plasma chemical vapor deposition (commonly abbreviated to "plasma CVD"), the layer forming operation is practiced while maintaining the substrate at a temperature from 400° to 450° C. in a deposition chamber.

In an alternative process, firstly, an amorphous-like film is formed on the substrate being maintained at about 250° C. in a deposition chamber by means of plasma CVD, and secondly the resultant film is annealed by heating the substrate at a temperature of 400° to 450° C. for about 20 minutes or by irradiating laser beam onto the substrate for about 20 minutes to thereby form said layer.

PHOTOCONDUCTIVE LAYER 102

The photoconductive layer in the light receiving member according to this invention is constituted with an A—Si(H,X) material or a germanium(Ge) or tin(Sn) containing A—Si(H,X) material [hereinafter referred to as "A—Si(Ge,Sn) (H,X)"]. The photoconductive layer 102 may contain the group III element or the group V element respectively having a relevant function to control the conductivity of the photoconductive layer, whereby the photosensitivity of the layer can be improved.

As the group III element or the group V element to be incorporated in the photoconductive layer 102, it is possible to use the same element as incorporated into the charge injection inhibition layer 104. It is also possible to use such element having an opposite polarity to that of the element to be incorporated into the charge injection inhibition layer. And, in the case where the element having the same polarity as that of the element to be incorporated into the charge injection inhibition layer is incorporated into the photoconductive layer 102, the amount may be lesser than that to be incorporated into the charge injection inhibition layer.

Specifically, the group III element can include B (boron), Al (aluminum), Ga (gallium), In (indium) and Ti (thallium), B and Ga being particularly preferred. The group V element can include, for example, P (phosphor), As (arsenic), Sb (antimony) and Bi (bismuth), P and Sb being particularly preferred.

The amount of the group III element or the group V element to be incorporated in the photoconductive layer 102 is preferably $1\times10^{-3}$ to $1\times10^3$ atomic ppm, more preferably, $5\times10^{-2}$ to $5\times10^2$ atomic ppm, and most preferably, $1\times10^{-1}$ to $2\times10^2$ atomic ppm.

The halogen atoms(X) to be incorporated in the layer in case where necessary can include fluorine, chlorine, bromine and iodine. And among these halogen atoms, fluorine and chlorine are particularly preferred. The amount of the hydrogen atoms(H), the amount of the halogen atoms(X) or the sum of the amounts for the hydrogen atoms and the haogen atoms(H+X) to be incorporate in the photoconductive layer is preferably 1 to $4\times10$ atomic %, more preferably, 5 to $3\times10$ atomic %.

Further, in order to improve the quality of the photoconductor layer and to increase it dark resistance, at least one kind atom selected from oxygen atom, carbon atom and nitrogen atom can be incorporated in the photoconductive layer. The amount of these atoms to be incorporated in the photoconductive layer is preferably $1\times10^{-3}$ to 50 atomic ppm, more preferably $2\times10^{-3}$ to 40 atomic ppm, and, most preferably, $3\times10^{-3}$ to 30 atomic ppm.

The sensitivity of the photoconductive layer 102 in the light receiving member of this invention against long wavelength light such as laser beam can be further improved by incorporating germanium atom(Ge) or/and tin atom(Sn) thereinto.

The amount of the germanium atom or/and the tin atoms in that case is preferred to be in the range of 1 to $9.5\times10^5$ atomic ppm.

The thickness of the photoconductive layer 102 is an important factor in order to effectively attain the object of this invention. The thickness of the photoconductive layer is, therefore, necessary to be carefully determined having due regards so that the resulting light receiving member becomes accompanied with desitred characteristics.

In view of the above, the thickness of the photoconductive layer 102 is preferably 3 to 100 μm, more preferably 5 to 80 μm, and most preferably 7 to 50 μm.

SURFACE LAYER 103

The surface layer 103 in the light receiving member of this invention has a free surface 107 and is disposed on the foregoing photoconductive layer 102.

And, the surface layer 103 in the light receiving member of this invention serves not only to improve various characteristics commonly required for a light receiving member such as the humidity resistance, deterioration resistance upon repeating use, breakdown voltage resistance, use-environmental characteristics and durability of the light receiving member but also to effectively prevent electric charges from being injected into the photoconductive layer 102 from the side of fthe free surface 107 at the time when the light receiving layer is engaged in the charging process.

The surface layer 103 in the light receiving member of this invention is formed of: (1) a non-monocrystalline material or a polycrystalline material respectively containing tetrahedrally bonded boron nitride [the former will be hereinafter referred to as "Non—BN" or "A—BN" and the latter will be hereinafter referred to as "poly—BN"] or (2) a Non—BN material containing trihedrally bonded boron nitride and tetrahedrally bonded boron nitride in mingled state, or (3) is constituted with a lower constituent layer 103' formed of a Non-BN material containing tetrahdedrally bonded boron nitride and an upper constituent layer 103'' containing trihedrally bonded boron nitride and tetrahedrally bonded boron nitride in mingled state.

The surface layer 103 in the light receiving member of this invention may contain hydrogen atom(H) or/and halogen atom(X) [hereinafter referred to as "A—BN(H,X)", "poly-BN(H,X)" or "Non—BN(H,X)"].

The surface layer 103 in the light receiving member of this invention may contain dopants, either p-type or n-type. In this case, the surface layer further effectively serves to mobilize charges which are moving thereinto after the image exposure to its free surface to thereby prevent the occurrence of the problems relative to image flow and also to residual voltage which is often found on the conventional light receiving member.

The p-type dopant can include germanium atom(Ge), zinc atom(Zn) and a mixture of them (Ge+Zn). And, the n-type dopant can include silicon atom (Si), tin atom (Sn) or a mixture of them (Si+Sn).

The amount of such dopant to be contained in the surface layer 103 is preferably less than $1\times10^3$ atomic ppm, more preferably less than $7\times10^2$ atomic ppm, and most preferably $5\times10^2$ atomic ppm.

Now, the foregoing Non—BN(H,X) of which the surface layer 103 is formed can be expressed by th formula: $[Bx(N_{1-x})]_{1-y}:(H,X)_y$ and the ratios of the layer constituents are desired to satisfy the following conditions:

(i) In the case of where the surface layer is formed of said Non—BN series material containing tetrahedrally bonded boron nitride; with respect to x;
preferably, $0.25\leqq x\leqq0.75$, more preferably, $0.3\leqq x\leqq0.7$, and most preferably, $0.4\leqq x\leqq0.6$, and with respect to y;
preferably, $0.004\leqq y\leqq0.4$, more preferably $0.005\leqq y\leqq0.3$ and most preferably $0.01\leqq y\leqq0.2$.

(ii) In the case where the surface layer is formed of said Non—BN series material containing trihedrally bonded boron nitride and tetrahedrally bonded boron nitride in mingled state; with respect to x;
preferably, $0.1\leqq x\leqq0.9$, more preferably, $0.2\leqq x\leqq0.8$, and most preferably, $0.3\leqq x\leqq0.7$, and
with respect to y;
preferably $0.004\leqq y\leqq0.4$, more preferably $0.005\leqq y\leqq0.3$, and most preferably, $0.01\leqq y\leqq0.2$.

The thickness of the surface layer 103 in the light receiving member of this invention is appropriately determined depending upon the desired purpose.

It is, however, also necessary that the thickness be determined in view of relative and organic relationship in accordance with the amounts of the constituent atoms to be contained in the layer or the characteristics required in the relationship with the thickness of other layer. Further, it should be determined also in economical viewpoints such as productivity or mass productivity.

In view of the above, the thickness of the surface layer 103 is preferably $3\times10^{-3}$ to 30 μm, more preferably, $4\times10^{-3}$ to 20 μm, and, most preferably, $5\times10^{-3}$ to 10 μm.

INTERMEDIATE LAYER 108

The intermediate layer 108 in the light receiving member of this invention is to dispose between the photoconductive layer 102 and the surface layer 103 and it principally serves to improve breakdown voltage resistance of the light receiving layer.

The intermediate layer 108 is formed of either an A—Si(H,X) material or a poly-Si(H,X) material respectively containing carbon atom in an amount of preferably 20 to 90 atomic %, more preferably 30 to 85 atomic %, and most preferably, 40 to 80 atomic %.

As for the hydrogen atom(H) and halogen atom(X) to be optionally contained in the intermediate layer, the amount of hydrogen atoms or halogen atoms, or the sum of the amount of hydrogen atoms and the amount of halogen atoms is preferably 1 to $7\times10$ atomic %, more preferably 2 to 65 atomic %, and most preferably, 5 to 60 atomic %.

The thickness of the intermediate layer 108 is preferably $3\times10^{-2}$ to 30 μm, more preferably $4\times10^{-2}$ to 20 μm, and most preferably, $5\times10^{-2}$ to 10 μm.

FORMATION OF LAYERS

The method of forming the light receiving layer of the light receiving member will be now explained.

Each layer to constitute the light receiving layer of the light receiving member of this invention can be properly prepared by vacuum deposition method utilizing the discharge phenomena such as glow discharging, reactive sputtering and ion plating processes wherein relevant raw material gases are selectively used.

These production methods are properly used selectively depending on the factors such as the manufacturing conditions, the installation cost required, production scale and properties required for the light receiving members to be prepared. The glow discharging method or sputtering method is suitable since the control for the condition upon preparing the light receiving members having desired properties are relatively easy, and hydrogen atoms, halogen atoms and other atoms can be introduced easily together with silicon atoms. The glow discharging method and the sputtering method may be used together in one identical system.

FORMATION OF SURFACE LAYER

Basically when a surface layer composed of Non—BH(H,X) is formed by the glow discharging process, a feed gas capable of supplying boron atoms(B), a feed gas capable of supplying nitrogen atoms(N) and an inert gas are introduced, if necessary, together with a feed gas for introducing hydrogen atoms(H) or/and a feed gas for introducing halogen atoms(X) into a deposition chamber the inner pressure of which can be reduced properly, glow discharge is generated in the deposition chamber, and a layer composed of Non—BN (H,X) to be the surface layer is formed on a substrate placed in the deposition chamber.

And in order to form a surface layer composed of a Non—BN(H,X) material containing dopants by the glow discharging process, basically, a feed gas to liberate boron atoms(B), a feed gas to liberate nitrogen atoms(N), either a feed gas to liberate silicon atoms(Si) or/and tin atoms (Sn) or a feed gas to liberate germanium atoms(Ge) or/and zinc atoms(Zn), and an inert gas are introduced, if necessary, together with a feed gas to liberate hydrogen atoms(H) or/and a feed gas to liberate halogen atoms(H) into a deposition chamber the inner pressure of which can be reduced properly, glow discharge is generated in the deposition chamber, and a layer composed of a Non—Bn(H,X) material containing dopants to be the surface layer is formed on a substrate placed in the deposition chamber.

The raw material for supplying B can include gaseous or gasifiable compounds such as $B_2H_6$, $B_4H_{10}$, $B_5H_9$, $B_5H_{11}$, $B_6H_{12}$, $BF_3$ and $Bcl_3$.

The raw material for supplying N can include gaseous or gasifiable compounds such as $N_2$, $NH_3$, $NF_2Cl$, $NFCl_2$, $NCl_3$, $N_2F_2$, $N_2F_4$, $NH_2Cl$, $NHF_2$ and $NH_2F$.

The raw material for supplying Si can include gaseous or gasifiable compounds such as $SiH_4$, $Si_2H_6$, $Si_3H_8$, $Si_4H_{10}$, $SiF_4$ and $Sicl_4$.

The raw material for supplying Sn can include gaseous or gasifiable compounds such as $SnH_4$, $SnF_4$ and $SnCl_4$.

The raw material for supplying Ge can include gaseous or gasificable germanium compounds such as $GeH_4$, $Ge_2H_6$ and $GeF_4$.

The raw material for supplying Zn can include gaseous or gasifiable zinc compounds such as $Zn(CH_3)_2$.

The raw material for supplying halogen atoms can include halogen gases such as $F_2$, $Cl_2$, $I_2$, $Br_2$ and FCl.

The raw material for supplying hydrogen atoms can include gaseous or gasifiable compounds such as HF, HCl, HBr, HI, $B_2H_6$, $B_4H_{10}$, $NH_3$, $SiH_4$, $Si_2H_6$, $SnH_4$, $GeH_4$ and $Ge_2H_6$.

In the case of forming a layer composed of a Non—BN (H,X) material containing tetrahedrally bonded boron nitride by the sputtering process, basically, a BN target is subjected to sputtering with gas plasmas in a gas atmosphere containing a raw material gas for supplying B which is diluted with an inert gas such as Ar gas in an appropriate sputtering deposition chamber the inner pressure of which can be reduced properly to thereby form said layer on a substrate placed in said chamber.

Further, the formation of a layer composed of a dopant containing Non—BN(H,X) material containing tetrahedrally bonded boron nitride may be practiced by using a BN target and by introducing a raw material gas for supplying Si or/and Sn or raw material gas for supplying Ge or/and Zn together with an inert gas such as Ar gas into the above sputtering deposition chamber to form plasma atmosphere and sputtering said BN target with the gas plasmas.

In the above case, it is possible to use a Zn target or a Ge target and to introduce a raw material gas for supplying B and a raw material gas for supplying N together with an inert gas such as Ar gas into the above sputtering deposition chamber.

The formation of a layer composed of a Non—BN(H,X) containing tetrahdedrally bonded boron nitride and trihedrally bonded boron nitride in mingled state by the sputtering process may be practiced by using a BN target and by introducing a raw material gas for supplying N together with an inert gas such as He gas into the foregoing sputtering deposition chamber to form plasma atmosphere and sputtering said BN target. In this case, it is possible to form said layer by using a B target and by introducing a large amount of a raw material gas for supplying N together with said inert gas to form plasma atmosphere and sputtering said B target with gas plasmas.

The formation of a layer composed of a dopant containing Non—BN(H,X) containing tetrahedrally bonded boron nitride and trihedrally bonded boron nitride in mingled state may be practiced by using a BN target and by introducing a raw material gas for supplying N and a raw material gas for supplying dopants together with an inert gas such as He gas into the foregoing sputtering deposition chamber to form plasma atmosphere and sputtering said BN target with gas plasmas. In this case, it is possible to form said layer by using a B target and introducing a large amount of a raw material gas for supplying N and a raw material gas for supplying dopants together with said inert gas into the foregoing sputtering deposition chamber to form plasma atmosphere and sputtering said B target with gas plasmas.

The conditions upon forming the surface layer 103 in the light receiving member of this invention, for example, the temperature of the substrate, the gas pressure in the deposition chamber and the electric discharging power are important factors for obtaining an objective surface layer having desired properties and they are properly selected while considering the functions of the layer to be formed. Further, since these layer forming conditions may be varied depending on the kind and the amount of each of the atoms contained in the layer, the conditions have to be determined also taking the kind or the amount of the atoms to be contained into consideration.

Specifically, in the case of forming a layer composed of a Non—BN(H,X) material containing tetrahedrally bonded boron nitride by plasma CVD method using high frequency of 13.56 MHz, the gas pressure in the deposition chamber is preferably $10^{-2}$ to 10 Torr, more preferably $5\times10^{-2}$ to 2 Torr, and most preferably, $1\times10^{-1}$ to 1 Torr. The temperature of the substrate is preferably 50° to 700° C., and more preferably, 50° to 400° C. in the case of forming a layer composed of a Non—BN(H,X) series material, and 200° to 700° C. in the case of forming a layer compoed of a poly—BN(H,X) series material.

As for the electrical discharging power, it is preferably 0.01 to 5W/cm$^2$, and most preferably, 0.02 to 2W/cm$^2$.

Further, as for the flow ratios relative to the raw material gas for supplying b, the raw material gas for supplying N and Ar gas, the flow ratio B/N is controlled to be preferably 1/5 to 100/1, and most preferably $\frac{1}{4}$ to 80/1, and at the same time, the flow ratio Ar/B+N is controlled to be preferably 1/10 to 100/1 and most preferably 1/7 to 80/1.

And in the case of forming the above mentioned layer by plasma CVD method using microwave of 2.45 GHz, the gas pressure in the deposition chamber is preferably $1\times10^{-4}$ to 2 Torr, more preferably $5\times10^{-4}$ to 1.0 Torr, and most preferably, $5\times10^{-4}$ to 0.7 Torr. The electrical discharging power is preferably 0.1 to 50 W/cm$^2$, and most preferably, 0.2 to 30 W/cm$^2$.

In this case, the temperature of the substrate and the flow ratios of the gases used are the same as those in the foregoing case using high frequency.

In the case of forming a layer composed of a Non—BN (H,X) material containing tetrahedrally bonded boron nitride by the sputtering process, the gas pressure in the deposition chamber is preferably $1\times10^{-4}$ to 1.0 Torr, and most preferably, $5\times10^{-4}$ to 0.7 Torr. The electrical charging power is preferably 0.01 to 10 W/cm$^2$, and most preferably, 0.05 to 8 W/cm$^2$.

In this case, the temperature of the substrate and the flow ratios of the gases used are the same as those in the foregoing case by plasma CVD method using high frequency.

In the case of forming a layer composed of a Non—BN (H,X) material containing tetrahedrally bonded boron nitride and trihedrally bonded boron nitride in mingled state by plasma CVD method using high frequency of 13.56 MHz, the gas pressure in the deposition chamber is preferably $1\times10^{-2}$ to 10 Torr, more preferably $5\times10^{-2}$ to 2 Torr, and most preferably, 0.1 to 1 Torr. The temperature of the substrate is preferably 50° to 700° C., and more preferably, 50° to 400° C. in the case of forming a layer composed of a Non—BN(H,X) material containing tetrahedrally bonded boron nitride and trihedrally bonded boron nitride in mingled state, and 200° to 700° C. in the case of forming a layer composed of a poly—BN(H,X) containing the above two kinds of boron nitride in mingled state. As for the electrical discharging power, it is preferably 0.05 to 5 W/cm$^2$, and most preferably, 0.02 to 2 W/cm$^2$. Further, as for the flow ratios relative to the raw material gas for supplying B, the raw material gas for supplying N and He gas, the ratio B/N is controlled to be preferably 1/100 to 5/1, and most preferably, 1/80 to 4/1, and at the same time, the flow ratio He/B+N is controlled to be 1/10 to 0.

In the case of forming a layer composed of a Non—BN (H,X) material containing tetrahedrally bonded boron nitride and trihedrally bonded boron nitride in mingled state by plasma CVD method using microwave of 2.45 GHz, the gas pressure in the deposition chamber is preferably $1\times10^{-4}$ to 2 Torr, more preferably $5\times10^{-4}$ to 1.0 Torr, and most preferably, $5\times10^{-4}$ to 0.7 Torr. The electrical discharging power is preferably 0.1 to 50 W/cm$^2$, and most preferably 0.2 to 30 W/cm$^2$. And, in this case, the temperature of the substrate and the flow ratios of the gases used are the same as those in the foregoing case using high frequency.

In addition, in the case of forming a layer composed of a Non—BN(H,X) material containing tetrahedrally bonded boron nitride and trihedrally bonded boron nitride in mingled state by the sputtering process, the gas pressure in the deposition chamber is preferably $1\times10^{-4}$ to 1.0 Torr, and most preferably, $5\times10^{-4}$ to 0.7 Torr. As for the electrical discharging power, it is preferably 0.01 to 10 W/cm$^2$ and most preferably, 0.05 to 8 W/cm$^2$. In this case, the temperature of the substrate and the flow ratios of the gases used are the same as those in the case by plasma CVD method using high frequency.

FORMATION OF OTHER LAYERS

Basically, when a layer constituted with a—Si(H,X) is formed, for example, by the glow discharging process, gaseous starting material capable of supplying silicon atoms(Si) is introduced together with gaseous starting material for introducing hydrogen atoms(H) and/or halogen atoms(X) into a deposition chamber the inside pressure of which can be reduced, glow discharge is generated in the deposition chamber, and a layer composed of a—Si(H,X) is formed on the surface of a predetermined substrate disposed previously at a predetermined position.

The gaseous starting material for supplying Si can include gaseous or gasifiable silicon hydrides (silanes) such as $SiH_4$, $Si_2H_6$, $Si_4H_{10}$, etc., $SiH_4$ and $Si_2H_6$ being particularly preferred in view of the easy layer forming work and the good efficiency for the supply of Si.

Further, various halogen compounds can be mentioned as the gaseous starting material for introducing the halogen atoms and gaseous or gasifiable halogen compounds, for example, gaseous halogen, halides, inter-halogen compunds and halogen-substituted silane derivatives are preferred. Specifically, they can include halogen gas such as of fluorine, chlorine, bromine, and iodine; inter-halogen compounds such as BrF, ClF, $ClF_3$, $BrF_2$, $BrF_3$, $IF_7$, IC1, IBr, etc.; and silicon halides such as $SiF_4$, $Si_2H_6$, $SiC_4$, and $SiBr_4$. The use of the gaseous or gasifiable silicon halide as described above is particularly advantageous since the layer constituted with halogen atom-containing a—Si can be formed with no additional use of the gaseous starting material for supplying Si.

The gaseous starting material usable for supplying hydrogen atoms can include those gaseous or gasifiable materials, for example, hydrogen gas halides such as HF, HCl, HBr, and HI, silicon hydrides such as $SiH_4$, $Si_2H_6$, $Si_3H_8$, and $Si_4O_{10}$, or halogen-substituted silicon hydrides such as $SiH_2F_2$, $SiH_2I_2$, $SiH_2Cl_2$, $SiHCl_3$, $SiH_2Br_2$, and $SiHBr_3$. The use of these gaseous starting material is advantageous since the content of the hydrogen atoms(H), which are extremely effective in view of the control for the electrical or photoelectronic properties, can be controlled with ease. Then, the use of the hydrogen halide or the halogen-substituted silicon hydride as described above is particularly advantageous since the hydrogen atoms(H) are also introduced together with the introduction of the halogen atoms.

In the case of forming a layer comprising a—Si(H,X) by means of the reactive sputtering process or ion plating process, for example, by the sputtering process, the halogen atoms are introduced by introducing gaseous halogen compounds or halogen atom-containing silicon compounds into a deposition chamber thereby forming a plasma atmosphere with the gas.

Further, in the case of introducing the hydrogen atoms, the gaseous starting material for introducing the hydrogen atoms, for example, $H_2$ or gaseous silanes are described above are introduced into the sputtering deposition chamber thereby forming a plasma atmosphere with the gas.

For instance, in the case of the reactive sputtering process, a layer comprising a—Si(H,X) is formed on the support by using an Si target and by introducing a halogen atom-introducing gas and $H_2$ together with an inert gas such as He or Ar as required into a deposition chamber thereby forming a plasma atmosphere and then sputtering the Si target.

To form the layer of a—SiGe(H,X) by the glow discharge process, a feed gas to liberate silicon atoms(Si), a feed gas to liberate germanium atoms, and a feed gas to liberate hydrogen atoms(H) and/or halogen atoms(X) are introduced into an evacuatable deposition chamber, in which the glow discharge is generated so that a layer of a—SiGe(H,X) is formed on the properly positioned support.

The feed gases to supply silicon atoms, halogen atoms, and hydrogen atoms are the same as those used to form the layer of a—Si(H,X) mentioned above.

The feed gas to liberate Ge includes gaseous or gasifiable germanium halides such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, and $Ge_9H_{20}$, with $GeH_4$, $Ge_2H_6$, and $Ge_3H_8$, being preferable on account of their ease of handling and the effective liberation of germanium atoms.

To form the layer of a—SiGe(H,X) by the sputtering process, two targets (a silicon target and a germanium target) or a single target composed of silicon and germanium is subjected to sputtering in a desired gas atmosphere.

To form the layer of a—SiGe(H,X) by the ion-plating process, the vapors of silicon and germanium are allowed to pass through a desired gas plasma atmosphere. The silicon vapor is produced by heating polycrystal silicon or single crystal silicon held in a boat, and the germanium vapor is produced by heating polycrystal germanium or single crystal germanium held in a boat. The heating is accomplished by resistance heating or electron beam method (E.B. method).

In either case where the sputtering process or the ion-plating process is employed, the layer may be incorporated with halogen atoms by introducing one of the above-mentioned gaseous halides or halogen-containing silicon compounds into the deposition chamber in which a plasma atmosphere of the gas is produced. In the case where the layer is incorporated with hydrogen atoms, a feed gas to liberate hydrogen is introduced into the deposition chamber in which a plasma atmosphere of the gas is produced. The feed gas may be gaseous hydrogen, silanes, and/or germanium hydrides. The feed gas to liberate halogen atoms includes the above-mentioned halogen-containing silicon compounds. Other examples of the feed gas include hydrogen halides such as HF, HCl, HBr and HI; halogen-substituted silanes such as $SiH_2F_2$, $SiH_2I_2$, $SiH_2Cl_2$, $SiHCl_3$, $SiH_2Br_2$, and $SiHBr_3$; germanium hydride halide such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, and $GeH_3I$; and germanium halides such as $GeF_4$, $GeCl_4$, $GeBr_4$, $GeI_4$, $GeF_2$, $GeCl_2$, $GeBr_2$, and $GeI_2$. They are in the gaseous form or gasifiable substances.

To form the light receiving layer composed of amorphous silicon containing tin atoms (hereinafter referred to as a—SiSn(H,X)) by the glow-discharge process, sputtering process, or ion-plating process, a starting material (feed gas) to release tin atoms(Sn) is used in place of the starting material to release germanium atoms which is used to form the layer composed of a—SiGe(H,X) as mentioned above. The process is properly controlled so that the layer contains a desired amount of tin atoms.

Examples of the feed gas to release tin atoms(Sn) include tin hydride($SnH_4$) and tin halides (such as $SnF_2$, $SnF_4$, $SnCl_2$, $SnCl_4$, $SnBr_2$, $SnBr_4$, $SnI_2$, and $SnI_4$) which are in the gaseous form or gasifiable. Tin halides are preferable because they form on the substrate a layer of a—Si containing halogen atoms. Among tin halides, $SnCl_4$, is particularly preferable because of its ease of handling and its efficient tin supply.

In the case where solid $SnCl_4$ is used as a starting material to supply tin atoms(Sn), it should preferably be gasified by blowing (bubbling) an inert gas (e.g., Ar and He) into it while heating. The gas thus generated is introduced, at a desired pressure, into the evacuated deposition chamber.

The layer may be formed from an amorphous material a—Si(H,X) or a—Si(Ge,Sn)(H,X) which further contains the group III atoms or group V atoms, nitrogen atoms, oxygen atoms, or carbon atoms, by the glow-discharge process, sputtering process, or ion-plating process. In this case, the above-mentioned starting material for a—Si(H,X) or a—Si(Ge,Sn)(H,X) is used in combination with the starting materials to introduce the group III atoms or group V atoms, nitrogen atoms, oxygen atoms, or carbon atoms. The supply of the starting materials should be properly controlled so that the layer contains a desired amount of the necessary atoms.

If, for example, the layer is to be formed by the glow-discharge process from a—Si(H,X) containing atoms (O,C,N) or from a—Si(Ge,Sn)(H,X) containing atoms (O,C,N), the starting material to form the layer of a—Si(H,X) or a—Si(Ge,Sn)(H,X) should be combined with the starting material used to introduce atoms (O,C,N). The supply of these starting materials should be properly controlled so that the layer contains a desired amount of the necessary atoms.

The starting material to introduce the atoms(O,C,N) may be any gaseous substance or gasifiable substance composed of any of oxygen, carbon, and nitrogen. Examples of the starting materials used to introduce oxygen atoms(O) include oxygen($O_2$), ozone($O_3$), nitrogen dioxide($NO_2$), nitrous oxide($N_2O$), dinitrogen trioxide($N_2O_3$), dinitrogen tetroxide($N_2O_4$), dinitrogen pentoxide($N_2O_5$), and nitrogen trioxide($NO_3$). Additional examples include lower siloxanes such as disiloxane($H_3SiOSiH_3$) and trisiloxane($H_3SiOSiH_2OSiH_3$) which are composed of silicon atoms(Si), oxygen atoms(O), and hydrogen atoms(H). Examples of the starting materials used to introduce carbon atoms include saturated hydrocarbons having 1 to 5 carbon atoms such as methane($CH_4$), ethane ($C_2H_6$), propane($C_3H_8$), n-butane(n—$C_4H_{10}$), and pentane($C_5H_{12}$); ethylenic hydrocarbons having 2 to 5 carbon atoms such as ethylene($C_2H_4$), propylene($C_3H_6$), butene—1($C_4H_8$), butene-2 ($C_4H_8$), isobutylene($C_4H_8$), and pentene($C_5H_{10}$); and acetylenic hydrocarbons having 2 to 4 carbon atoms such as acetylene ($C_2H_2$), methyl acetylene($C_3H_4$), and butine($C_4H_6$). Examples of the starting materials used to introduce nitrogen atoms include nitrogen($N_2$), ammonia($NH_3$), hydrazine($H_2NNH_2$), hydrogen azide($HN_3$), ammonium azide($NH_4N_3$), nitrogen trifluoride($F_3N$), and nitrogen tetrafluoride($F_4N$).

In the case of using the glow discharging process for forming the layer or layer region containing oxygen atoms, starting material for introducing the oxygen atoms is added to those selected from the starting materials as desired for forming the light receiving layer. As the starting material for introducing the oxygen atoms, most of those gaseous or gasifiable materials can be used that comprise at least oxygen atoms as the constituent atoms.

For instance, it is possible to use a mixture of gaseous starting material comprising silicon atoms(Si) as the constituent atoms, gaseous starting material comprising oxygen atoms(O) as the constituent atom and, as required, gaseous starting material comprising hydrogen atoms(H) and/or halogen atoms(X) as the constituent atoms in a desired mixing ratio, a mixture of gaseous starting material comprising silicon atoms(Si) as the constituent atoms and gaseous starting material comprising oxygen atoms(O) and hydrogen atoms(H) as the constituent atoms in a desired mixing ratio, or a mixture of gaseous starting material comprising silicon atoms(Si) as the constituent atoms and gaseous starting material comprising silicon atoms(Si), oxygen atoms(O) and hydrogen atoms(H) as the constituent atoms.

Further, it is also possible to use a mixture of gaseous starting material comprising silicon atoms (Si) and hydrogen atoms (H) as the constituent atoms and gaseous starting material comprising oxygen atoms (O) as the constituent atoms.

Specifically, there can be mentioned, for example, oxygen ($O_2$), ozone ($O_2$), nitrogen monoxide (NO), nitrogen dioxide ($NO_2$), dinitrogen oxide ($N_2O$), dinitrogen trioxide ($N_2O_3$), dinitrogen tetraoxide ($N_2O_4$), dinitrogen pentoxide ($N_2O_5$), nitrogen trioxide ($NO_3$), lower siloxanes comprising silicon atoms (Si), oxygen atoms (O) and hydrogen atoms (H) as the constituent atoms, for example, disiloxane ($H_3SiOSiH_3$) and trisiloxane ($H_3SiOSiH_2OSiH_3$), etc.

In the case of forming the layer or layer region containing oxygen atoms by way of the sputtering process, it may be carried out by sputtering a single crystal or polycrystalline Si wafer or $SiO_2$ wafer, or a wafer containing Si and $SiO_2$ in admixture is used as a target and sputtered in various gas atmospheres.

For instance, in the case of using the Si wafer as the target, a gaseous starting material for introducing oxygen atoms and, optionally, hydrogen atoms and/or halogen atoms is diluted as required with a dilution gas, introduced into a sputtering deposition chamber, gas plasmas with these gases are formed and the Si wafter is sputtered.

Alternatively, sputtering may be carried out in the atmosphere of a dilution gas or in a gas atmosphere containing at least hydrogen atoms (H) and/or halogen atoms (X) as constituent atoms as a sputtering gas by using individually Si and $SiO_2$ targets or a single Si and $SiO_2$ mixed target. As the gaseous starting material for introducing the oxygen atoms, the gaseous starting material for introducing the oxygen atoms shown in the examples for the glow discharging process as described above can be used as the effective gas also in the sputtering.

The light receiving layer containing carbon atoms, for example, may be formed through the glow discharging process, by using a mixture of gaseous starting material comprising silicon atoms (Si) as the constituent atoms, gaseous starting material comprising carbon atoms (C) as the constituent atoms and, optionally, gaseous starting material comprising hydrogen atoms (H) and/or halogen atoms (X) as the constituent atoms in a desired mixing ratio, a mixture of gaseous starting material comprising silicon atoms (Si) as the constituent atoms and gaseous starting material comprising carbon atoms (C) and hydrogen atoms (H) as the constituent atoms also in a desired mixing ratio, a mixture of gaseous starting material comprising silicon atoms (Si) as the constituent atoms and gaseous starting material comprising silicon atoms (Si), carbon atoms (C) and hydrogen atoms (H) as the constituent atoms, or a mixture of gaseous starting material comprising silicon atoms (Si) and hydrogen atoms (H) as the constituent atoms and gaseous starting material comprising carbon atoms (C) as constituent atoms.

Those gaseous starting materials that are effectively usable herein can include gaseous silicon hydrides comprising C and H as the constituent atoms, such as silanes, for example, $SiH_4$, $Si_2H_6$, $Si_3H_8$ and $Si_4H_{10}$, as well as those comprising C and H as the constituent atoms, for example, saturated hydrocarbons of 1 to 4 carbon atoms, ethylenic hydrocarbons of 2 to 4 carbon atoms and acetylenic hydrocarbons of 2 to 3 carbon atoms.

Specifically, the saturated hydrocarbons can include methane ($CH_4$), ethane ($C_2H_6$), propane ($C_3H_8$), n-butane (n—$C_4H_{10}$) and pentane ($C_5H_{12}$), the ethylenic hydrocarbons can include ethylene ($C_2H_4$), propylene ($C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$).

The gaseous starting material comprising Si, C and H as the constituent atoms can include silicided alkyls, for example, $Si(CH_3)_4$ and $Si(C_2H_5)_4$. In addition to these gaseous starting materials, $H_2$ can of course be used as the gaseous starting material for introducing H.

The layer or layer region constituted with a—SiC(H,X) may be formed through the sputtering process by using a single crystal or polycrystalline Si wafer, a C (graphite) wafer or a wafer containing a mixture of Si and C as a target and sputtering them in a desired gas atmosphere.

In the case of using, for example a Si wafer as a target, gaseous starting material for introducing carbon atoms, and hydrogen atoms and/or halogen atoms is introduced while being optionally diluted with a dilution gas such as Ar and He into a sputtering deposition chamber thereby forming gas plasmas with these gases and sputtering the Si wafer.

Alternatively, in the case of using Si and C as individual targets or as a single target comprising Si and C in admixture, gaseous starting material for introducing hydrogen atoms and/or halogen atoms as the sputtering gas is optionally diluted with a dilution gas, introduced into a sputtering deposition chamber thereby forming gas plasmas and sputtering is carried out. As the gaseous starting material for introducing each of the atoms used in the sputtering process, those gaseous starting materials used in the glow discharging process as described above may be used as they are.

In the case of using the glow discharging process for forming the layer or the layer region containing the nitrogen atoms, starting material for introducing nitrogen atoms is added to the material selected as required from the starting materials for forming the light receiving layer as described above. As the starting material for introducing the nitrogen atoms, most of gaseous or gasifiable materials can be used that comprise at least nitrogen atoms as the constituent atoms.

For instance, it is possible to use a mixture of gaseous starting material comprising silicon atoms (Si) as the constituent atoms, gaseous starting material comprising nitrogen atoms (N) as the constituent atoms and, optionally, gaseous starting material comprising hydrogen atoms (H) and/or halogen atoms (X) as the constituent atoms mixed in a desired mixing ratio, or a mixture of starting gaseous material comprising silicon atoms (Si) as the constituent atoms and gaseous starting material comprising nitrogen atoms (N) and hydrogen atoms (H) as the constituent atoms also in a desired mixing ratio.

Alternatively, it is also possible to use a mixture of gaseous starting material comprising nitrogen atoms (N) as the constituent atoms gaseous starting material comprising silicon atoms (Si) and hydrogen atoms (H) as the constituent atoms.

The starting material that can be used effectively as the gaseous starting material for introducing the nitrogen atoms (N) used upon forming the layer or layer region containing nitrogen atoms can include gaseous or gasifiable nitrogen, nitrides and nitrogen compounds such as azide compounds comprising N as the constituent atoms or N and H as the constituent atoms, for example, nitrogen ($N_2$), ammonia ($NH_3$), hydrazine ($H_2NNH_2$), hydrogen azide ($HN_3$) and ammonium azide ($NH_4N_3$). In addition, nitrogen halide compounds such as nitrogen trifluoride ($F_3N$) and nitrogen tetrafluoride ($F_4N_2$) can also be mentioned in that they can also introduce halogen atoms (X) in addition to the introduction of nitrogen atoms (N).

The layer or layer region containing the nitrogen atoms may be formed through the sputtering process by using a single crystal or polycrystalline Si wafer or $Si_3N_4$ wafer or a wafer containing Si and $Si_3N_4$ in admixture as a target and sputtering them in various gas atmospheres.

In the case of using a Si wafer as a target, for instance, gaseous starting material for introducing nitrogen atoms and, as required, hydrogen atoms and/or halogen atoms is diluted optionally with a dilution gas, introduced into a sputtering deposition chamber to form gas plasmas with these gases and the Si wafer is sputtered.

Alternatively, Si and $Si_3N_4$ may be used as individual targets or as a single target comprising Si and $Si_3N_4$ in admixture and then sputtered in the atmosphere of a dilution gas or in a gaseous atmosphere containing at least hydrogen atoms (H) and/or halogen atoms (X) as the constituent atoms as for the sputtering gas. As the gaseous starting material for introducing nitrogen atoms, those gaseous starting materials for introducing the nitrogen atoms described previously shown in the example of the glow discharging can be used as the effective gas also in the case of the sputtering.

In addition, in the case of forming a layer or layer region constituted with a—Si(H,X) containing the group III or group V atoms by using the glow discharging, sputtering or ion plating process, the starting material for introducing the group III or group V atoms are used together with the starting material for forming a—Si(H,X) upon forming the layer constituted with a—Si(H,X) as described above and they are incorporated while controlling the amount of them into the layer to be formed.

Referring specifically to the boron atom introducing materials as the starting material for introducing the group III atoms, they can include boron hydrides such as $B_2H_6$, $B_4H_{10}$, $B_5H_9$, $B_5H_{11}$, $B_6H_{10}$, $B_6H_{12}$ and $B_6H_{14}$ and boron halides such as $BF_3$, $BCl_3$ and $BBr_3$. In addition, $AlCl_3$, $CaCl_3$, $Ga(CH_3)_2$, $InCl_3$, $TlCl_3$ and the like can also be mentioned.

Referring to the starting material for introducing the group V atoms and, specifically to, the phosphor atom introducing materials, they can include, for example, phosphor hydrides such as $PH_3$ and $P_2H_6$ and phosphor halide such as $PH_4I$, $PF_3$, $PF_5$, $PCl_3$, $PCl_5$, $PBr_3$, $PBr_5$ and $PI_3$. In addition, $AsH_3$, $AsF_5$, $AsCl_3$, $AsBr_3$, $AsF_3$, $SbH_3$, $SbF_3$, $SbF_5$, $SbCl_3$, $SbCl_5$, $BiH_3$, $SiCl_3$ and $BiBr_3$ can also be mentioned to as the effective starting material for introducing the group V atoms.

In the case of forming the respective constituent layers other than the surface layer of the light receiving layer in the light receiving member of this invention by means of the glow discharging, reactive sputtering or ion plating process, the amount of each of the layer constituent atoms to be contained in a layer to be formed is controlled by appropriately regulating the flow rate of each of the raw material gases and the flow ratio among the raw material gases to be introduced into the deposition chamber.

The conditions upon forming each of such layers, for example, the temperature of the substrate, the gas pressure in the deposition chamber and the electrical discharging power are important factors for obtaining a light receiving member having desired properties and they are properly selected while considering the functions of the layer to be formed. Further, since these layer forming conditions may be varied depending on the kind and the amount of each of the atoms contained in the layer, the conditions have to be determined also taking the kind or the amount of the atoms to be contained into consideration.

Specifically, in the case of forming a layer composed of an A—Si(H,X) material containing nitrogen atom, oxygen atom, carbon atom, etc., the temperature of the substrate is preferably 50° to 350° C., and more preferably, 50° to 250° C. The gas pressure in the deposition chamber is preferably 0.01 to 1 Torr, and most preferably, 0.1 to 0.5 Torr. And, the electrical discharging power is preferably 0.005 to 50 W/cm$^2$, more preferably 0.01 to 30 W/cm$^2$, and most preferably, 0.01 to 20 W/cm$^2$.

And in the case of forming a layer composed of either an A—SiGe(H,X) material or an A—SiGe(M,X) containing the group III atom or the group V atom, the temperature of the substrate is preferably 50° to 350° C., more preferably, 50° to 300° C., and most preferably, 100° to 300° C. The gas pressure in the deposition chamber is preferably 0.01 to 5 Torr, more preferably 0.01 to 3 Torr, and most preferably, 0.01 to 1 Torr. And, the electrical discharging power is preferably 0.005 to 50 W/cm$^2$, more preferably 0.01 to 30 W/cm$^2$, and most preferably, 0.01 to 20 W/cm$^2$.

However, the actual conditions for forming the layer such as temperature of the substrate, discharging power and the gas pressure in the deposition chamber can not usually the determined with ease independent of each other. Accordingly, the conditions optimal to the layer formation are desirably determined based on relative and organic relationships for forming the amorphous material layer having desired properties.

DESCRIPTION OF THE PREFERRED EMBODIMENTS

The invention will be described more specifically while referring to Examples 1 through 312, but the invention is not intended to limit the scope only to these Examples.

Figure 2:
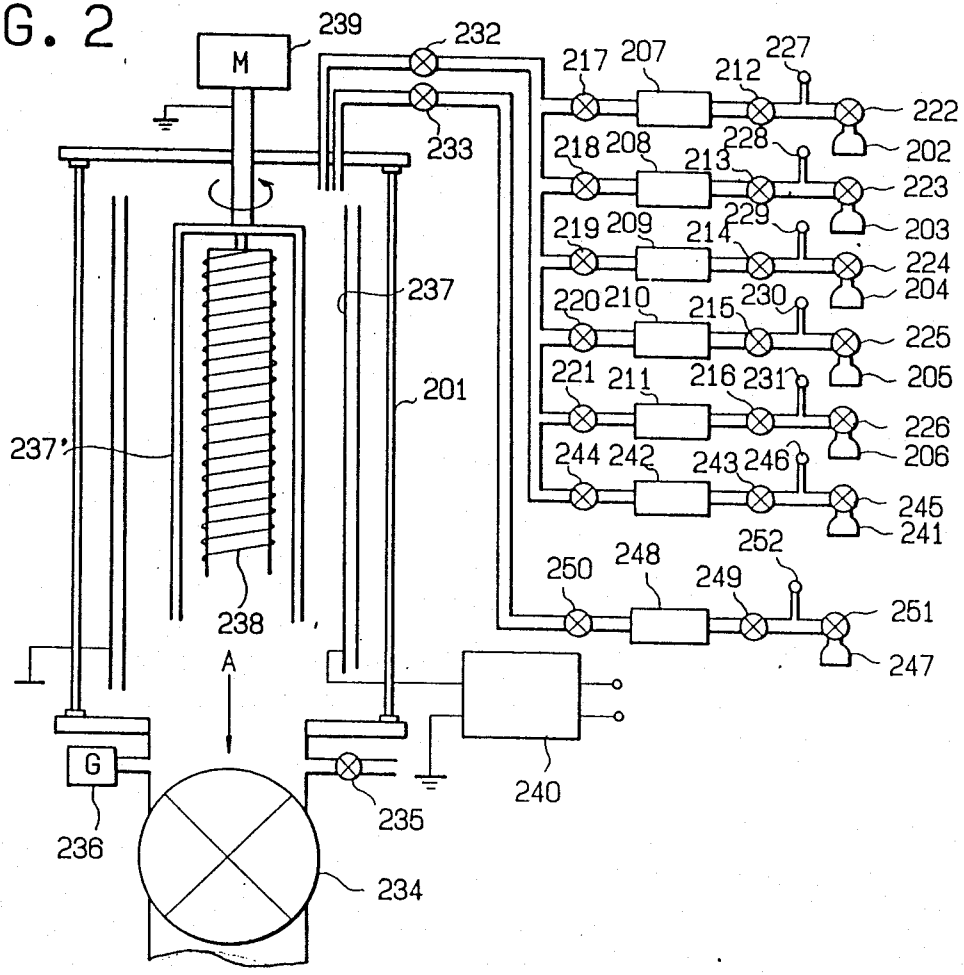
FIG. 2 is a schematic explanatory view of a glow discharging fabrication apparatus for preparing the light receiving member of this invention.

In each of the Examples, the light receiving layer was formed using the fabrication apparatus shown in FIG. 2 in accordance with the glow discharging process.

In the apparatus shown in FIG. 2, gas reservoirs 202, 203, 204, 205, 206, 241 and 247 are charged with raw material gases for forming the respective layers of the light receiving member of this invention, that is, for instance, $SiH_4$ gas (99.999% purity) in the reservoir 203, $B_2H_6$ gas diluted with $H_2$ gas (99.999% purity, hereinafter referred to as "$B_2H_6/H_2$ gas" in the reservoir 203, NO gas (99.5% purity) in the reservoir 204, $B_2H_6$ gas diluted with Ar gas (99.999% purity, hereinafter referred to as "$B_2H_6$/Ar gas") in the reservoir 205, $B_2H_6$ gas diluted with He gas (99.999% purity, hereinafter referred to as "$B_2H_6$/He gas") in the reservoir 206, $SiH_4$ gas diluted with He gas (99.999% purity, hereinafter referred to as "$SiH_4$/He gas") in the reservoir 241 and $NH_3$ gas (99.999% purity) in the reservoir 247.

In the case for introducing halogen atoms (X) into a layer, the reservoir for $SiH_4$ is replaced by another reservoir for $SiF_4$ gas for instance.

Prior to the entrance of these gases into a deposition chamber 201, it is confirmed that valves for the reservoirs 202 through 206, 241 and 247 and a leak valve 235 are closed and that exit valves 217 through 221, 244 and 250, and sub-valves 232 and 233 are opened. Then, a main valve 234 is at first opened to evacuate the inside of the deposition chamber 201 and gas pipings.

Then, upon observing that the reading on the vacuum gauge 236 became about $5\times10^{-6}$ Torr, the sub-valves 232 and 233 and the exit valves 217 through 221, 244 and 250.

Now, reference is made to an example in the case of forming a light receiving layer on an Al cylinder as a substrate 237.

$SiH_4$ gas from the reservoir 202, $B_2H_6/H_2$ gas from the reservoir 203 and NO gas from the reservoir 204 are caused to flow into the mass flow controllers 207, 208 and 209 respectively by opening the valves 222, 223 and 224, controlling the pressure of each of the exit pressure gauges 227, 228 and 229 to 1 kg/cm$^2$. Subsequently, the exit valves 217, 218 and 219, and the sub-valve are gradually opened to enter the raw material gases into the deposition chamber 201. In this case, the exit valves 217, 218 and 219 are adjusted so as to a desired value for the ratio among the $SiH_4$ gas, $B_2H_6/H_2$ gas and the NO gas.

The $SiH_4$ gas flow rate, the $B_2H_6/H_2$ gas flow rate and the NO gas flow rate, and the opening of the main valve 234 is adjusted while observing the reading on the vacuum gauge 236 so as to obtain a desired value for the pressure inside the deposition chamber 201. Then, after confirming that the temperature of the Al cylinder 237' on the substrate holder 237 has been set by a heater 238 within a range from 50° to 350° C., a power source 240 is set to a predetermined electrical power to cause glow discharging in the deposition chamber 201 while controlling the above gas flow rates to thereby form a layer to be the first layer on the Al cylinder 237'.

In the above case, it is possible to further improve the film forming speed by using appropriately selected raw material gases. For instance, in the case where $Si_2F_6$ gas is used in stead of the $SiH_4$ gas, the film forming speed will be raised by some holds in comparison with the above case.

In order to form a layer to be the second layer on the already formed first layer, closing the exit valves 217 through 221, 244 and 247 opening the subvalves 232 and 233 and entirely opening the main valve 234 to evacuate the inside of the deposition chamber 201 and the gas pipings to be a high vacuum, $B_2H_6$/Ar gas, $B_2H_6$/He gas, $NH_3$ gas, an appropriate dopant imparting raw material gas and $SiH_4$/He gas are fed into the deposition chamber 201 by operating the related valves in the same was as in the case of forming the first layer and the power source 240 is set to a predetermined electric power to cause glow discharging in the deposition chamber while controlling the flow rates of the raw material gases to thereby form the second layer.

In the case where the amount of hydrogen atom to be contained in the second layer is desired to be changed, it can be carried out by purposely adding $H_2$ gas to an appropiate raw material gas and by varying its flow rate as desired.

Further, in the case where hydrogen atom is desired to be introduced into the second layer, it can be carried out by feeding $NF_3$ gas together with an appropiate raw material gas into the deposition chamber 201.

All of the exit valves other than those required for upon forming the respective layers are of course closed. Further, upon forming the respective layers, the inside of the system is once evacuated to a high vacuum degree as required by closing the exit valves 217 through 221, 244 and 250 while opening the sub-valves 232 and 233 and fully opening the main valve 234 for avoiding that the gases having been used for forming the previous layer are left in the deposition chamber 201 and in the gas pipeways from the exit valves 217 through 221, 244 and 250 to the inside of the reaction chamber 201.

Further, during the film formation process for the respective layers, the substrate 237' is rotated at a predetermined rotation speed by operating motor 239 in order to attain the uniformness fo the layer to be formed.

EXAMPLE 1

A light receiving member for use in electrophotography having a light receiving layer disposed on an Al cylinder having a mirror grinded surface was prepared under the layer forming conditions shown in Table 1 using the fabrication apparatus shown in FIG. 2.

And samples were provided by forming only a surface layer on an aluminum plate and on a Si-monocrystal wafer respectively placed on the substrate holder in the same manner for forming the surface layer in the above case using the same kind fabrication apparatus as shown in FIG. 2.

For the resulting light receiving member (hereinafter this kind light receiving member is referred to as "drum"), it was set with the conventional electrophotographic copying machine, and electrophotographic characteristics such as initial electrification efficiency (initial charging efficiency), residual voltage and appearance of a ghost were examined, then decrease in the electrification efficiency, deterioration on photosensitivity and increase of defective images after 1,500 thousand times repeated shots were respectively examined.

Further, the situation of an image flow on the drum under high temperature and high humidity atmosphere at 35° C. and 85% humidity was also examined.

In addition, the situation of breakdown voltage for the drum was observed by applying a high direct current voltage onto the drum.

Further, in addition, the abrasion resistance of the drum was examined by wearing its surface using a metallic needle having a round top while applying a predetermined load thereon.

The results obtained were as shown in Table 2. As Table 2 illustrates, superiorities in every evaluation item of the initial electrification efficiency (initial charging efficiency), defective image, surface abrasion, breakdown voltage and abrasion resistance for the drum were acknowledged.

As for the samples, the cordination number of boron nitride contained therein was examined in accordance with EXAFS (extended X-ray absorption fine structure ). As a result, it was found that tetrahedrally bonded boron nitrides were contained therein.

EXAMPLE 2

The procedures of Example 1 were repeated under the conditions shown in Table 3 wherein $H_2$ gas is additionally used in the formation of a surface layer to thereby obtain a drum and samples. The resultant drum and samples were evaluated by the same manners as in Example 1.

The results obtained were as shown in Table 4.

And as a result of examining a cordination number of boron nitride contained in the samples, it was aknowledged that tetrahedrally bonded boron nitrides were contained therein.

EXAMPLE 3

The procedures of Example 1 were repeated under the same conditions as shown in the foregoing Table 1, except that the vias voltage of the aluminum cylinder was controlled to −150V, to thereby obtain a drum and samples. The resultant drum and samples were evaluated by the same manners as in Example 1.

The results obtained were as shown in Table 5. As Table 5 illustrates, desirable results as those in Example 1 were acknowledged. As for the boron nitrides contained in the surface layer, it was acknowledged that they were tetrahedrally bonded boron nitrides.

EXAMPLE 4

A drum having a charge injection inhibition layer, a photoconductive layer and a surface layer on an aluminum cylinder was prepared under the conditions shown in Table 6 and following the procedures of Example 1.

The resultant drum was evaluated by the same manners as in Example 1.

The results obtained were as shown in Table 7. As Table 7 illustrates, superiorities in respective evaluation items were acknowledged for the drum.

EXAMPLE 5

An aluminum cylinder was subjected to anodic oxidation to form an aluminum oxide ( $Al_2O_3$ ) layer to be a charge injection inhibition layer thereon, and a photoconductive layer then a surface layer were continuously formed on the previously formed charge injection inhibition layer under the conditions shown in Table 8 following the procedures of Example 1

The resultant drum was evaluated by the same manners as in Example 1. The results obtained were as shown in Table 9.

As Table 9 illustrates, superiorities in the respective evaluation items were acknowledged.

EXAMPLE 6

A drum having an IR absorptive layer, a photoconductive layer and a surface laywr was prepared under the conditions shown in Table 10 and following the procedures of Example 1. The resultant drum was evoluted by the same manners as in Example 1.

In addition, the drum was set with the conventional electrophotographic copying machine using a semiconductor laser beam of 785 nm in wavelengths as the light source for image exposure in order to examine whether an infringe pattern appears or not on an image to be made.

The results obtained were as shown in Table 11. As Table 11 illustrates, superiorities in the respective evaluation items were acknowledged, and it was found that any infringe pattern did not appear on an image to be made.

EXAMPLE 7

A drum having a contact layer, a photoconductive layer and a surface layer was prepared under the conditions shown in Table 12 and following the procedures of Example 1.

The resultant drum was evaluated by the same manners as in Example 1. The results obtained were as shown in Table 13.

As Table 13 illustrates, superiorities in the respective evaluation items were acknowledged.

EXAMPLE 8

A drum having an IR absorptive layer, a charge injection inhibition layer, a photoconductive layer and a surface layer was prepared under the conditions shown in Table 14 and following the procedures of Example 1. The resultant drum was evaluated in the same way as in Example 6. The results obtained were as shown in Table 15. As Table 15 illustrates, superiorities in the respective evaluation items were acknowledged.

EXAMPLE 9

A drum having a contact layer, a charge injection inhibition layer, a photoconductive layer and a surface layer was prepared under the conditions shown in Table 16 and following the procedures of Example 1. The resultant drum was evaluated in the same way as in Example 1. The results obtained were as shown in Table 17.

As Table 17 illustrates, superiorities in the respective evaluation items were acknowledged.

EXAMPLE 10

A drum having a contact layer, an IR absorptive layer, a charge injection inhibition layer, a photoconductive layer and a surface layer was prepared under the conditions shown in Table 18 and following the procedures of Example 1. The resultant drum was evaluated in the same way as in Example 6. The results obtained were as shown in Table 19. As Table 19 illustrates, superiorities in the respective evaluation items were acknowledged.

EXAMPLE 11

The procedures of Example 1 were repeated, except that the photoconductive layer forming conditions were changed as shown in Table 20, to thereby prepare multiple drums.

The resultant drums were evaluated in the same way as in Example 1. As a result, it was found that every drum was provided with practically applicable desired electrophotographic characteristics.

EXAMPLE 12

The procedures of Example 2 were repeated, except that the photoconductive layer forming conditions were changed as shown in Table 21,to thereby prepare multiple drums.

The resultant drums were evaluated in the same way as in Example 1. As a result, it was found that every drum was provided with practically applicable desired electrophotographic characteristics.

EXAMPLE 13

The procedures of Example 3 were repeated, except that the photoconductive layer forming conditions were changed as shown in Table 22, to thereby prepare multiple drums.

The resultant drums were evaluated in the same way as in Example 1. As a result, it was found that every drum was provided with practically applicable desired electrophotographic characteristics.

EXAMPLE 14

The procedures of Example 4 were repeated, except that the charge injection inhibition layer forming conditions were changed as shown in Table 23, to thereby prepare multiple drums.

The resultant drums were evaluated in the same way as in Example 1. As a result, it was found that every drum was provided with practically applicable desired electrophotographic characteristics.

EXAMPLE 15

The procedures of Example 4 were repeated, except that the charge injection inhibition layer forming conditions and the photoconductive layer forming conditions were changed respectively as shown in Table 24 and Table 25, to thereby prepare multiple drums as shown in Table 26.

The resultant drums were evaluated in the same way as in Example 1. As a result, it was found that every drum was provided with practically applicable desired electrophotographic characteristics.

EXAMPLE 16

The procedures of Example 4 were repeated, except that the charge injection inhibition layer forming conditions, the photoconductive layer forming conditions and the surface layer forming conditions were changed respectively as shown in Table 24, Table 27 and Table 28, to thereby prepare multiple drums as shown in Table 29.

The resultant drums were evaluated in the same way as in Example 1. As a result, it was found that every drum was provided with practically applicable desired electrophotographic characteristics.

EXAMPLE 17

The procedures of Example 4 were repeated, except that the charge injection inhibition layer forming conditions, the photoconductive layer forming conditions and the surface layer forming conditions were changed respectively as shown in Table 24, Table 27 and Table 30, to thereby prepare multiple drums as shown in Table 31.

The resultant drums were evaluated in the same way as in Example 1. As a result, it was found that every drum was provided with practically applicable desired electrophotographic characteristics.

EXAMPLE 18

The procedures of Example 5 were repeated, except that the photoconductive layer forming conditions were changed as shown in Table 25, to thereby prepare multiple drums.

The resultant drums were evaluated in the same way as in Example 1. As a result, it was found that every drum was provided with practically applicable desired electrophotographic characteristics.

EXAMPLE 19

The procedures of Example 5 were repeated, except that the photoconductive layer forming conditions and the surface layer forming conditions were changed respectively as shown in Table 27 and Table 28, to thereby prepare multiple drums as shown in Table 33.

The resultant drums were evaluated in the same way as in Example 1. As a result, it was found that every drum was provided with practically applicable desired electrophotographic characteristics.

EXAMPLE 20

The procedures of Example 5 were repeated, except that the photoconductive layer forming conditions and the surface layer forming conditions were changed respectively as shown in Table 27 and Table 30, to thereby prepare multiple drums as shown in Table 34.

The resultant drums were evaluated in the same way as in Example 1. As a result, it was found that every drum was provided with practically applicable desired electrophotographic characteristics.

EXAMPLE 21

The procedures of Example 6 were repeated, except that the IR absorptive layer forming conditions were changed as shown in Table 35 and Table 36, to thereby prepare multiple drums as shown in Table 37.

The resultant drums were evaluated in the same way as in Example 6. As a result, it was found that every drum was provided with practically applicable desired electrophotographic characteristics.

EXAMPLE 22

The procedures of Example 6 were repeated, except that the IR absorptive layer forming conditions were changed as shown in Table 35 and Table 38 and the photoconductive layer forming conditions were changed as shown in Table 25, to thereby prepare multiple drums as shown in Table 39.

The resultant drums were evaluated in the same way as in Example 6. As a result, it was found that every drum was provided with practically applicable desired electrophotographic characteristics.

EXAMPLE 23

The procedures of Example 6 were repeated, except that the IR absorptive layer forming conditions were changed as shown in Table 35 and Table 38, and the photoconductive layer forming conditions and the surface layer forming conditions were changed respectively as shown in Table 27 and Table 28, to thereby prepare multiple drums as shown in Table 40.

The resultant drums were evaluated in the same way as in Example 6. As a result, it was found that every drum was provided with practically applicable desired electrophotographic characteristics.

EXAMPLE 24

The procedures of Example 6 were repeated, except that the IR absorptive layer forming conditions were changed as shown in Table 35 and Table 38, and the photoconductive layer forming conditions and the surface layer forming conditions were changed respectively as shown in Table 27 and Table 30, to thereby prepare multiple drums as shown in Table 41.

The resultant drums were evaluated in the same way as in Example 6. As a result, it was found that every drum was provided with practically applicable desired electrophotographic characteristics.

EXAMPLE 25

The procedures of Example 7 were repeated, except that the contact layer forming conditions were changed as shown in Table 42, to thereby prepare multiple drums as shown in Table 43.

The resultant drums were evaluated in the same way as in Example 1. As a result, it was found that every drum was provided with practically applicable desired electrophotographic characteristics.

EXAMPLE 26

The procedures of Example 7 were repeated, except that the contact layer forming conditions and the photoconductive layer forming conditions were changed respectively as shown in Table 44 and Table 25, to thereby prepare multiple drums as shown in Table 45.

The resultant drums were evaluated in the same way as in Example 1. As a result, it was found that every drum was provided with practically applicable desired electrophotographic characteristics.

EXAMPLE 27

The procedures of Example 7 were repeated, except that the contact layer forming conditions, photoconductive layer forming conditions and the surface layer forming conditions were changed respectively as shown in Table 44, Table 27 and Table 28, to thereby prepare multiple drums as shown in Table 46.

The resultant drums were evluated in the same way as in Example 1. As a result, it was found that every drum was provided with practically applicable desired electrophotographic characteristics.

EXAMPLE 28

The procedures of Example 4 were repeated, except that the contact layer forming conditions, photoconductive layer forming conditions and the surface layer forming conditions were changed respectively as shown in Table 44, Table 27 and Table 30, to thereby prepare multiple drums as shown in Table 29.

The resultant drums were evaluated in the same way as in Example 1. As a result, it was found that every drum was provided with practically applicable desired electrophotographic characteristics.

EXAMPLE 29

The procedures of Example 8 were repeated, except that the IR absorptive layer forming conditions were changed as shown in Table 35 and Table 36, to thereby prepare multiple drums as shown in Table 48.

The resultant drums were evaluated in the same way as in Example 6. As a result, it was found that every drum was provided with practically applicable desired electrophotographic characteristics.

EXAMPLE 30

The procedures of Example 8 were repeated, except that the charge injection inhibition layer forming conditions were changed as shown in Table 49 and the IR absorptive layer forming conditions were changed as shown respectively in Table 35 and Table 38, to thereby prepare multiple drums as shown in Table 50.

The resultant drums were evaluated in the same way as in Example 6. As a result, it was found that every drum was provided with practically applicable desired electrophotographic characteristics.

EXAMPLE 31

The procedures of Example 8 were repeated, except that the charge injection inhibition layer forming conditions and the surface layer forming conditions were changed respectively as shown in Table 51 and Table 28, and the IR absorptive layer forming conditions were changed as shown in Table 35 and Table 38, to thereby prepare multiple drums as shown in Table 52.

The resultant drums were evaluated in the same way as in Example 6. As a result, it was found that every drum was provided with practically applicable desired electrophotographic characteristics.

EXAMPLE 32

The procedures of Example 8 were repeated, except that the charge injection inhibition layer forming conditions and the surface layer forming conditions were changed respectively as shown in Table 51 and Table 30, and the IR absorptive layer forming conditions were changed as shown in Table 35 and Table 38, to thereby prepare multiple drums as shown in Table 53.

The resultant drums were evaluated in the same way as in Example 6. As a result, it was found that every drum was provided with practically applicable desired electrophotographic characteristics.

EXAMPLE 33

The procedures of Example 9 were repeated, except that the contact layer forming conditions were changed as shown in Table 44 and Table 54, to thereby prepare multiple drums as shown in Table 55.

The resultant drums were evaluated in the same way as in Example 1. As a result, it was found that every drum was provided with practically applicable desired electrophotographic characteristics.

EXAMPLE 34

The procedures of Example 4 were repeated, except that the charge injection inhibition layer forming conditions were changed as shown in Table 56, and the contact layer forming conditions were changed as shown in Table 44 and Table 57, to thereby prepare multiple drums as shown in Table 58.

The resultant drums were evaluated in the same way as in Example 1. As a result, it was found that every drum was provided with practically applicable desired electrophotographic characteristics.

EXAMPLE 35

The procedures of Example 9 were repeated, except that the charge injection inhibition layer forming conditions and the surface layer forming conditions were changed respectively as shown in Table 24 and Table 28, and the contact layer forming conditions were changed as shown in Table 44 and Table 57, to thereby prepare multiple drums as shown in Table 59.

The resultant drums were evaluated in the same way as in Example 1. As a result, it was found that every drum was provided with practically applicable desired electrophotographic characteristics.

EXAMPLE 36

The procedures of Example 9 were repeated, except that the charge injection inhibition layer forming conditions and the surface layer forming conditions were changed respectively as shown in Table 24 and Table 30, and the contact layer forming conditions were changed as shown in Table 44 and Table 57, to thereby prepare multiple drums as shown in Table 60.

The resultant drums were evaluated in the same way as in Example 1. As a result, it was found that every drum was provided with practically applicable desired electrophotographic characteristics.

EXAMPLE 37

The procedures of Example 10 were repeated, except that the charge injection inhibition layer forming conditions were changed as shown in Table 61, to thereby prepare multiple drums as shown in Table 62.

The resultant drums wre evaluated in the same way as in Example 1. As a result, it was found that every drum was provided with practically applicable desired electrophotographic characteristics.

EXAMPLE 38

The procedures of Example 4 were repeated, except that the charge injection inhibition layer forming conditions and the photoconductive layer forming conditions were changed respectively as shown in Table 64 and Table 63, to thereby prepare multiple drums as shown in Table 65.

The resultant drums were evaluated in the same way as in Example 6. As a result, it was found that every drum was provided with practically applicable desired electrophotographic characteristics.

EXAMPLE 39

The procedures of Example 10 were repeated, except that the charge injection inhibition layer forming conditions, the photoconductive layer forming conditions and the surface layer forming conditions were changed respectively as shown in Table 64, Table 66 and Table 28, to thereby prepare multiple drums as shown in Table 67.

The resultant drums were evaluated in the same way as in Example 6. As a result, it was found that every drum was provided with practically applicable desired electrophotographic characteristics.

EXAMPLE 40

The procedures of Example 10 were repeated, except that the charge injection inhibition layer forming conditions, the photoconductive layer forming conditions and the surface layer forming conditions were changed respectively as shown in Table 64, Table 66 and Table 30, to thereby prepare multiple drums as shown in Table 68.

The resultant drums were evaluated in the same way as in Example 6. As a result, it was found that every drum was provided with practically applicable desired electrophotographic characteristics.

EXAMPLE 41

The procedures of Example 8 were repeated, except that the charge injection inhibition layer forming conditions, the photoconductive layer forming conditions and the surface layer forming conditions were changed respectively as shown in Table 51, Table 69 and Table 70, and the IR absorptive layer forming conditions were changed as shown in Table 35 and Table 38, to thereby prepare multiple drums as shown in Table 71.

The resultant drums were evaluated in the same way as in Example 6. As a result, it was found that every drum was provided with practically applicable desired electrophotographic characteristics.

EXAMPLE 42

The procedures of Example 8 were repeated, except that the charge injection inhibition layer forming conditions, the photoconductive layer forming conditions and the surface layer forming conditions were changed respectively as shown in Table 51, Table 72 and Table 70, and the IR absorptive layer forming conditions were changed as shown in Table 35 and Table 38, to thereby prepare multiple drums as shown in Table 73.

The resultant drums were evaluated in the same way as in Example 6. As a result, it was found that every drum was provided with practically applicable desired electrophotographic characteristics.

EXAMPLE 43

The procedures of Example 8 were repeated, except that the charge injection inhibition layer forming conditions, the photoconductive layer forming conditions and the surface layer forming conditions were changed respectively as shown in Table 51, Table 69 and Table 28, and the IR absorptive layer forming conditions were changed as shown in Table 35 and Table 38, to thereby prepare multiple drums as shown in Table 74.

The resultant drums were evaluated in the same way as in Example 6. As a result, it was found that every drum was provided with practically applicable desired electrophotographic characteristics.

EXAMPLE 44

The procedures of Example 8 were repeated, except that the charge injection inhibition layer forming conditions, the photoconductive layer forming conditions and the surface layer forming conditions were changed respectively as shown in Table 51, Table 72 and Table 28, and the IR absorptive layer forming conditions were changed as shown in Table 35 and Table 38, to thereby prepare multiple drums as shown in Table 75.

The resultant drums wre evaluated in the same way as in Example 6. As a result, it was found that every drum was provided with practically applicable desired electrophotographic characteristics.

EXAMPLE 45

The procedures of Example 8 were repeated, except that the charge injection inhibition layer forming conditions, the photoconductive layer forming conditions and the surface layer forming conditions were changed respectively as shown in Table 51, Table 69 and Table 30, and the IR absorptive layer forming conditions were changed as shown in Table 35 and Table 38, to thereby prepare multiple drums as shown in Table 76.

The resultant drums were evaluated in the same way as in Example 6. As a result, it was found that every drum was provided with practically applicable desired electrophotographic characteristics.

EXAMPLE 46

The procedures of Example 8 were repeated, except that the charge injection inhibition layer forming conditions, the photoconductive layer forming conditions and the surface layer forming conditions were changed respectively as shown in Table 51, Table 72 and Table 30, and the IR absorptive layer forming conditions were changed as shown in Table 35 and Table 38, to thereby prepare multiple drums as shown in Table 77.

The resultant drums were evaluated in the same way as in Example 6. As a result, it was found that every drum was provided with practically applicable desired electrophotographic characteristics.

EXAMPLE 47

The procedures of Example 4 were repeated, except that the charge injection inhibition layer forming conditions and the photoconductive layer forming conditions were changed as shown in Table 78 and the surface layer forming conditions were changed as shown in Table 79, to thereby prepare multiple drums as shown in Table 79.

The resultant drums were evaluated in the same way as in Example 1. As a result, it was found that every drum was provided with practically applicable desired electrophotographic characteristics.

EXAMPLE 48

The procedures of Example 8 were repeated, except that the IR absorptive layer forming conditions, the charge injection inhibition layer forming conditions and the photoconductive layer forming conditions were changed as shown in Table 80 and the surface layer forming conditions were changed as shown in Table 81, to thereby prepare multiple drums as shown in Table 81.

The resultant drums were evaluated in the same way as in Example 6. As a result, it was found that every drum was provided with practically applicable desired electrophotographic characteristics.

EXAMPLE 49

The procedures of Example 10 were repeated, except that the contact layer forming conditions, the IR absorptive layer forming conditions, the charge injection inhibition layer forming conditions and the photoconductive layer forming conditions were changed as shown in Table 82 and the surface layer forming conditions wre changed as shown in Table 83, to thereby prepare multiple drums.

The resultant drums were evaluated in the same way as in Example 6. As a result, it was found that every drum was provided with practically applicable desired electrophotographic characteristics.

EXAMPLE 50

A drum having a charge injection inhibition layer, a photoconductive layer, an intermediate layer and a surface layer was prepared under the conditions shown in Table 84 and following the procedures of Example 1.

The resultant drum was evaluated in the same way as in Example 1, superiorities in the respective evaluation items were acknowledged.

EXAMPLE 51

Figure 3:
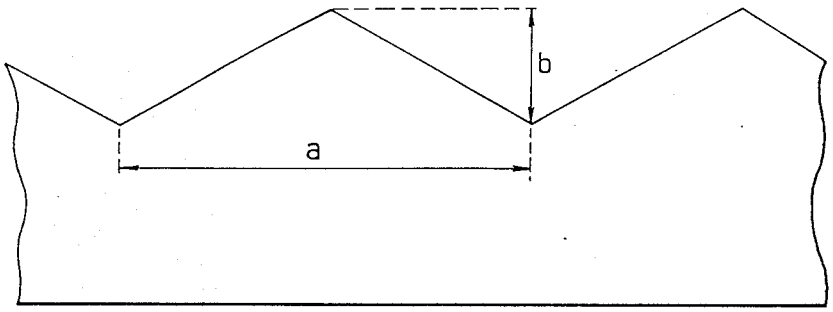
FIG. 3 and FIG. 4 are schematic fragmentary sectional views of a substrate which can be used in the light receiving member of this invention.

The mirror grinded cylinders were supplied for grinding process with cutting tool having various degrees. With the patterns of FIG. 3 and various cross section patterns as described in Table 85, multiple cylinders were provided. These cylinders were set to the fabrication apparatus of FIG. 2 accordingly, and used to prepare multiple drums under the same layer forming conditions of Example 1. The resulting drums were evaluated with the same procedures as in Example 1.

As a result, it was found that every drum was provided with practically applicable desired electrophotographic characteristics.

EXAMPLE 52

Figure 4:
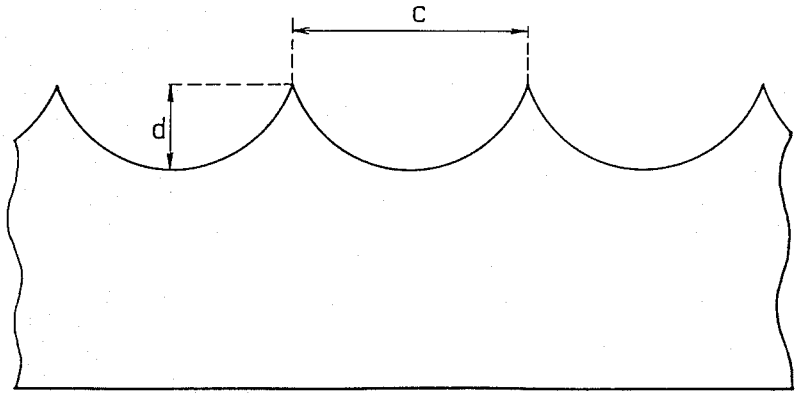

The surface of mirror grinded cylinder was treated by dropping lots of bearing balls thereto to thereby form uneven shape composed of a plurality of fine dimples at the surface, and multiple cylinders having a cross section form of FIG. 4 and of a cross section pattern of Table 86 were provided. These cylinders were set to the fabrication apparatus of FIG. 2 accordingly and used for the preparation of multiple drums under the same layer forming conditions of Example 1. The resulting drums were evaluated with the same procedures of Example 1.

As a result, it was found that every drum was provided with practically applicable desired electrophotographic characteristics.

EXAMPLE 53

A light receiving member for use in electrophotography having a light receiving layer disposed on Al cylinder having a mirror grinded surface was prepared under the layer forming conditions shown in Table 87 using the fabrication apparatus shown in FIG. 2.

And samples were provided by forming only a surface layer on an aluminum plate and on a Si-monocrystal wafer respectively placed on the substrate holder in the same manner for forming the surface layer in the above case using the same kind fabrication apparatus as shown in FIG. 2.

For the resulting light receiving member (hereinafter this kind light receiving member is referred to as "drum"), it was set with the conventional electrophotographic copying machine, and electrophotographic characteristics such as initial electrification efficiency (initial charging efficiency), residual voltage and appearance of a ghost were examined, then decrease in the electrification efficiency, the situation of surface abrasion and increase of defective image after 1,500 thousand times repeated shots were respecting examined.

Then, the situation of an image flow on the drum under high temperature and high humidity atmosphere at 35° C. and 85% humidity was also examined.

Further, the situation of superiority or inferiority in the cleaning property of the drum in accordance with the degree of background fogginess appearing on a blank image was examined by purposely replacing the original cleaning blade by another cleaning blade having a worn edge.

In addition, the situation of breakdown voltage for the drum was observed by applying a high direct current voltage onto the drum.

Further in addition, the abrasion resistance of the drum was examined by wearing its surface using a metallic needle having a round top while applying a predetermined load thereon.

The results obtained were as shown in Table 88.

As Table 88 illustrates, superiorities in the respective evaluation items, particularly of the items relative to defective image, image flow and cleaning property for the drum were acknowledged.

As for the samples, the cordination number of boron nitride contained therein was examined in accordance with EXAFS(extended X-ray absorption fine structure). As a result, it was found that there were contained tetrahedrally bonded boron nitride and trihedrally bonded boron nitride in mingled state.

Then, as for the sample on the Si-monocrystal wafer, the residual stress was observed by making stripes of □/mm in checker form on its surface and by peeling off the adhesive tape adhered thereon. As a result, it was found that the sample excels in the residual stress.

EXAMPLE 54

The procedures of Example 53 were repeated under the conditions shown in Table 89 wherein $H_2$ gas is additionally used in the formation of a surface layer to therby obtain a drum and samples. The resultant drum and samples were evaluated by the same manners as in Example 53.

The results obtained were as shown in Table 90. As Table 90 illustrates, superiorities in the respective evaluation items were acknowleged.

And, as a result of examining a cordination number of boron nitride contained in the samples, it was found that there are contained tetrahedrally bonded boron nitride and trihedrelly bonded boron nitridde in mingled state.

EXAMPLE 55

The procedures of Example 53 were repeated under the same conditions as shown in the foregoing Table 87, except that the vias voltage of the aluminum cylinder was controlled to +100 V, to thereby obtain a drum and samples. The resultant drum and samples were evaluated by the same manners as in Example 53.

The results obtained were shown in Table 91. As Table 91 illustrates, desirable results as those in Example 53 were acknowledged. As for the situations of tetrahedrally bonded boron nitride and trihedrally bonded boron nitride and trihedrally bonded boron nitride in the samples, it was found that both of them are contained in mingled state.

EXAMPLE 56

A drum having a charge injection inhibition layer, a photoconductive layer and a surface layer on an alminum cylinder was prepared under the conditions shown in Table 92 and following the procedures of Example 53.

The resultant drum was evaluated by the same manners as in Example 53.

The results obtained were as shown in Table 93. As Table 93 illustrates, superiorities in respective evaluation items were acknowledged for the drum.

EXAMPLE 57

An alminum cylinder was subjected to anodic oxidation to form an aluminum oxide ($Al_2O_3$) layer to be a charge injection inhibition layer thereon, and a photoconductive layer then a surface layer were continuously formed on the previously formed charge injection inhibition layer under the conditions shown in Table 44 following the procedures of Example 53.

The resultant drum was evaluated by the same manners as in Example 53. The results obtained were as shown in Table 95.

As Table 95 illustrates, superiorities in the respective evaluation items were acknowledged.

EXAMPLE 58

A drum having an IR absorptive layer, a photoconductive layer and a surface layer was prepared under the condition shown in Table 96 and following the procedures of Example 53.

In addition, the drum was set with the conventional electrophotographic copying machine using a semiconductor laser beam of 785 nm in wavelength as the light source for image exposure in order to examine whether an infringe pattern appears or not on an image to be made.

The results obtained were as shown in Table 97. As Table 97 illustrates, superiorities in the respective evaluation items were acknowledged, and it was found that any infringe pattern did not appear on an image to be made.

EXAMPLE 59

A drum having a contact layer, a photoconductive layer and a surface layer was prepared under the conditions shown in Table 98 and following the procedures of Example 53.

The resultant drum was evaluated by the same manners as in Example 53. The results obtained were as shown in Table 99.

As Table 99 illustrates, superiorities in the respective evaluation items were acknowledged.

EXAMPLE 60

A drum having an IR absorptive layer, a charge injection inhibition layer, a photoconductive layer and a surface layer was prepared under the conditions shown in Table 100 and following the procedures of Example 53.

The resultant drum was evaluated in the same way as in Example 58. The results obtained were as shown in Table 101. As Table 101 illustrates, superiorities in the respective evaluation items were acknowledged.

EXAMPLE 61

A drum having a contact layer, a charge injection inhibition layer, a photoconductive layer and a surface layer was prepared under the conditions shown in Table 102 and following the procedures of Example 53. The resultant drum was evaluated in the same way as in Example 53. The results obtained were as shown in Table 103.

As Table 103 illustrates, superiorities in the respective evaluation items were acknowledged.

EXAMPLE 62

A drum having a contact layer, an IR absorptive layer, a charge injection inhibition layer, a photoconductive layer and a surface layer was prepared under the conditions shown in Table 104 and following the procedures of Example 53. The resultant drum was evaluated in the same way as in Example 58. The results obtained were as shown in Table 105. As Table 105 illustrates, superiorities in the respective evaluation items were acknowledged.

EXAMPLE 63

The procedures of Example 53 were repeated, except that the photoconductive layer forming conditions were changed as shown in Table 20, to thereby prepare multiple drums.

The resultant drums were evaluated in the same way as in Example 53. As a result, it was found that every drum was provided with practically applicable desired electrophotographic characteristics.

EXAMPLE 64

The procedures of Example 54 were repeated, except that the photoconductive layer forming conditions were changed as shown in Table 21, to thereby prepare multiple drums.

The resultant drums were evaluated in the same way as in Example 53. As a result, it was found that every drum was provided with practically applicable desired electrophotographic characteristics.

EXAMPLE 65

The procedures of Example 55 were repeated, except that the photoconductive layer forming conditions were changed as shown in Table 22, to thereby prepare multiple drums.

The resultant drums were evaluated in the same way as in Example 53. As a result, it was found that every drum was provided with practically applicable desired electrophotographic characteristics.

EXAMPLE 66

The procedures of Example 56 were repeated, except that the charge injection inhibition layer forming conditions were changed as shown in Table 23, to thereby prepare multiple drums.

The resultant drums were evaluated in the same way as in Example 53. As a result, it was found that every drum was provided with practically applicable desired electrophotographic characteristics.

EXAMPLE 67

The procedures of Example 56 were repeated, except that the charge injection inhibition layer forming conditions and the photoconductive layer forming conditions were changed respectively as shown in Table 24 and Table 25, to thereby prepare multiple drums as shown in Table 106.

The resultant drums were evaluated in the same way as in Example 53. As a result, it was found that every drum was provided with practically applicable desired electrophotographic characteristics.

EXAMPLE 68

The procedures of Example 56 were repeated, except that the charge injection inhibition layer forming conditions, the photoconductive layer forming conditions and the surface layer forming conditions were changed respectively as shown in Table 24, Table 27 and Table 107, to thereby prepare multiple drums as shown in Table 108.

The resultant drums were evaluated in the same way as in Example 53. As a result, it was found that every drum was provided with practically applicable desired electrophotographic characteristics.

EXAMPLE 69

The procedures of Example 56 were repeated, except that the charge injection inhibition layer forming conditions, the photoconductive layer forming conditions and the surface layer forming conditions were changed respectively as shown in Table 24, Table 27 and Table 109, to thereby prepare multiple drums as shown in Table 110.

The resultant drums were evaluated in the same way as in Example 53. As a result, it was found that every drum was provided with practically applicable desired electrophotographic characteristics.

EXAMPLE 70

The procedures of Example 57 were repeated, except that the photoconductive layer forming conditions were changed as shown in Table 111, to thereby prepare multiple drums.

The resultant drums were evaluated in the same way as in Example 53. As a result, it was found that every drum was provided with practically applicable desired electrophotographic characteristics.

EXAMPLE 71

The procedures of Example 5 were repeated, except that the photoconductive layer forming conditions and the surface layer forming conditions were changed respectively as shown in Table 27 and Table 107, to thereby prepare multiple drums as shown in Table 112.

The resultant drums were evaluated in the same way as in Example 53. As a result, it was found that every drum was provided with practically applicable desired electrophotographic characteristics.

EXAMPLE 72

The procedures of Example 57 were repeated, except that the photoconductive layer forming conditions and the surface layer forming conditions were changed respectively as shown in Table 27 and Table 109, to thereby prepare multiple drums as shown in Table 113.

The resultant drums were evaluated in the same way as in Example 53. As a result, it was found that every drum was provided with practically applicable desired electrophotographic characteristics.

EXAMPLE 73

The procedures of Example 58 were repeated, except that the IR absorptive layer forming conditions were changed as shown in Table 35 and Table 36, to thereby prepare multiple drums as shown in Table 114.

The resultant drums were evaluated in the same way as in Example 58. As a result, it was found that every drum was provided with practically applicable desired electrophotographic characteristics.

EXAMPLE 74

The procedures of Example 58 were repeated, except that the IR absorptive layer forming conditions were changed as shown in Table 35 and Table 38 and the photoconductive layer forming conditions were changed as shown in Table 25, to thereby prepare multiple drums as shown in Table 115.

The resultant drums were evaluated in the same way as in Example 58. As a result, it was found that every drum was provided with practically applicable desired electrophotographic characteristics.

EXAMPLE 75

The procedures of Example 58 were repeated, except that the IR absorptive layer forming conditions were changed as shown in Table 35 and Table 38, and the photoconductive layer forming conditions and the surface layer forming conditions were changed respectively as shown in Table 27 and Table 107, to thereby prepare multiple drums as shown in Table 116.

The resultant drums were evaluated in the same way as in Example 58. As a result, it was found that every drum was provided with practically applicable desired electrophotographic characteristics.

EXAMPLE 76

The procedures of Example 6 were repeated, except that the IR absorptive layer forming conditions were changed as shown in Table 35 and Table 38, and the photoconductive layer forming conditions and the surface layer forming conditions were changed respectively as shown in Table 27 and Table 109, to thereby prepare multiple drums as shown in Table 117.

The resultant drums were evaluated in the same way as in Example 58. As a result, it was found that every drum was provided with practically applicable desired electrophotographic characteristics.

EXAMPLE 77

The procedures of Example 59 were repeated, except that the contact layer forming conditions were changed as shown in Table 42, to thereby prepare multiple drums as shown in Table 118.

The resultant drums were evaluated in the same way as in Example 53. As a result, it was found that every drum was provided with practically applicable desired electrophotographic characteristics.

EXAMPLE 78

The procedures of Example 59 were repeated, except that the contact layer forming conditions and the photoconductive layer forming conditions were changed respectively as shown in Table 44 and Table 25, to thereby prepare multiple drums as shown in Table 119.

The resultant drums were evaluated in the same way as in Example 53. As a result, it was found that every drum was provided with practically applicable desired electrophotographic characteristics.

EXAMPLE 79

The procedures of Example 59 were repeated, except that the contact layer forming conditions, photoconductive layer forming conditions and the surface layer forming conditions were changed respectively as shown in Table 44, Table 27 and Table 107, to thereby prepare multiple drums as shown in Table 120.

The resultant drums were evaluated in the same way as in Example 53. As a result, it was found that every drum was provided with practically applicable desired electrophotographic characteristics.

EXAMPLE 80

The procedures of Example 59 were repeated, except that the contact layer forming conditions, photoconductive layer forming conditions and the surface layer forming conditions were changed respectively as shown in Table 44, Table 27 and Table 109, to thereby prepare multiple drums as shown in Table 121.

The resultant drums were evaluated in the same way as in Example 53. As a result, it was found that every drum was provided with practically applicable desired electrophotographic characteristics.

EXAMPLE 81

The procedures of Example 60 were repeated, except that the IR absorptive layer forming conditions were changed as shown in Table 35 and Table 36, to thereby prepare multiple drums as shown in Table 122.

The resultant drums were evaluated in the same way as in Example 58. As a result, it was found that every drum was provided with practically applicable desired electrophotographic characteristics.

EXAMPLE 82

The procedures of Example 60 were repeated, except that the charge injection inhibition layer forming conditions were changed as shown in Table 49 and the IR absorptive layer forming conditions were changed as shown in Table 35 and Table 38, to thereby prepare multiple drums as shown in Table 153.

The resultant drums were evaluated in the same way as in Example 58. As a result, it was found that every drum was provided with practically applicable desired electrophotographic characteristics.

EXAMPLE 83

The procedures of Example 60 were repeated, except that the charge injection inhibition layer forming conditions and the surface layer forming conditions were changed respectively as shown in Table 51 and Table 107, and the IR absorptive layer forming conditions were changed as shown in Table 35 and Table 38, to thereby prepare multiple drums as shown in Table 124.

The resultant drums were evaluated in the same way as in Example 58. As a result, it was found that every drum was provided with practically applicable desired electrophotographic characteristics.

EXAMPLE 84

The procedures of Example 60 were repeated, except that the charge injection inhibition layer forming conditions and the surface layer forming conditions were changed respectively as shown in Table 51 and Table 125, and the IR absorptive layer forming conditions were changed as shown in Table 35 and Table 38, to thereby prepare multiple drums as shown in Table 125.

The resultant drums were evaluated in the same way as in Example 58. As a result, it was found that every drum was provided with practically applicable desired electrophotographic characteristics.

EXAMPLE 85

The procedures of Example 61 were repeated, except that the contact layer forming conditions were changed as shown in Table 44 and Table 54, to thereby prepare multiple drums as shown in Table 126.

The resultant drums were evaluated in the same way as in Example 53. As a result, it was found that every drum was provided with practically applicable desired electrophotographic characteristics.

EXAMPLE 86

The procedures of Example 61 were repeated, except that the charge injection inhibition layer forming conditions were changed as shown in Table 56, and the contact layer forming conditions were changed as shown in Table 44 and Table 57, to thereby prepare multiple drums as shown in Table 127.

The resultant drums were evaluated in the same way as in Example 53. As a result, it was found that every drum was provided with practically applicable desired electrophotographic characteristics.

EXAMPLE 87

The procedures of Example 61 were repeated, except that the charge injection inhibition layer forming conditions and the surface layer forming conditions were changed respectively as shown in Table 24 and Table 107, and the contact layer forming conditions were changed as shown in Table 44 and Table 57, to thereby prepare multiple drums as shown in Table 128.

The resultant drums were evaluated in the same way as in Example 53. As a result, it was found that every drum was provided with practically applicable desired electrophotographic characteristics.

EXAMPLE 88

The procedures of Example 61 were repeated, except that the charge injection inhibition layer forming conditions and the surface layer forming conditions were changed respectively as shown in Table 24 and Table 109, and the contact layer forming conditions were changed as shown in Table 44 and Table 57, to thereby prepare multiple drums as shown in Table 129.

The resultant drums were evaluated in the same way as in Example 53. As a result, it was found that every drum was provided with practically applicable desired electrophotographic characteristics.

EXAMPLE 89

The procedures of Example 62 were repeated, except that the charge injection inhibition layer forming conditions were changed as shown in Table 61, to thereby prepare multiple drums as shown in Table 130.

The resultant drums were evaluated in the same way as in Example 58. As a result, it was found that every drum was provided with practically applicable desired electrophotographic characteristics.

EXAMPLE 90

The procedures of Example 62 were repeated, except that the charge injection inhibition layer forming conditions and the photoconductive layer forming conditions were changed respectively as shown in Table 64 and Table 63, to thereby prepare multiple drums as shown in Table 131.

The resultant drums were evaluated in the same way as in Example 58. As a result, it was found that every drum was provided with practically applicable desired electrophotographic characteristics.

EXAMPLE 91

The procedures of Example 62 were repeated, except that the charge injection inhibition layer forming conditions, the photoconductive layer forming conditions and the surface layer forming conditions were changed respectively as shown in Table 64, Table 66 and Table 107, to thereby prepare multiple drums as shown in Table 132.

The resultant drums were evaluated in the same way as in Example 58. As a result, it was found that every drum was provided with practically applicable desired electrophotographic characteristics.

EXAMPLE 92

The procedures of Example 62 were repeated, except that the charge injection inhibition layer forming conditions, the photoconductive layer forming conditions and the surface layer forming conditions were changed respectively as shown in Table 64, Table 66 and Table 109, to thereby prepare multiple drums as shown in Table 133.

The resultant drums were evaluated in the same way as in Example 58. As a result, it was found that every drum was provided with practically applicable desired electrophotographic characteristics.

EXAMPLE 93

The procedures of Example 60 were repeated, except that the charge injection inhibition layer forming conditions, the photoconductive layer forming conditions and the surface layer forming conditions were changed respectively as shown in Table 51, Table 69 and Table 134, and the IR absorptive layer forming conditions were changed as shown in Table 35 and Table 38, to thereby prepare multiple drums as shown in Table 135.

The resultant drums were evaluated in the same way as in Example 58. As a result, it was found that every drum was provided with practically applicable desired electrophotographic characteristics.

EXAMPLE 94

The procedures of Example 60 were repeated, except that the charge injection inhibition layer forming conditions, the photoconductive layer forming conditions and the surface layer forming conditions were changed respectively as shown in Table 51, Table 72 and Table 134, and the IR absorptive layer forming conditions were changed as shown in Table 35 and Table 38, to thereby prepare multiple drums as shown in Table 136.

The resultant drums were evaluated in the same way as in Example 58. As a result, it was found that every drum was provided with practically applicable desired electrophotographic characteristics.

EXAMPLE 95

The procedures of Example 60 were repeated, except that the charge injection inhibition layer forming conditions, the photoconductive layer forming conditions and the surface layer forming conditions were changed respectively as shown in Table 51, Table 69 and Table 107, and the IR absorptive layer forming conditions were changed as shown in Table 35 and Table 38, to thereby prepare multiple drums as shown in Table 137.

The resultant drums were evaluated in the same way as in Example 58. As a result, it was found that every drum was provided with practically applicable desired electrophotographic characteristics.

EXAMPLE 96

The procedures of Example 60 were repeated, except that the charge injection inhibition layer forming conditions, the photoconductive layer forming conditions and the surface layer forming conditions were changed respectively as shown in Table 51, Table 72 and Table 107, and the IR absorptive layer forming conditions were changed as shown in Table 35 and Table 38, to thereby prepare multiple drums as shown in Table 138.

The resultant drums were evaluated in the same way as in Example 58. As a result, it was found that every drum was provided with practically applicable desired electrophotographic characteristics.

EXAMPLE 97

The procedures of Example 60 were repeated, except that the charge injection inhibition layer forming conditions, the photoconductive layer forming conditions and the surface layer forming conditions were changed respectively as shown in Table 51, Table 69 and Table 109, and the IR absorptive layer forming conditions were changed as shown in Table 35 and Table 38, to thereby prepare multiple drums as shown in Table 139.

The resultant drums were evaluated in the same way as in Example 58. As a result, it was found that every drum was provided with practically applicable desired electrophotographic characteristics.

EXAMPLE 98

The procedures of Example 60 were repeated, except that the charge injection inhibition layer forming conditions, the photoconductive layer forming conditions and the surface layer forming conditions were changed respectively as shown in Table 51, Table 72 and Table 109, and the IR absorptive layer forming conditions were changed as shown in Table 35 and Table 38, to thereby prepare multiple drums as shown in Table 140.

The resultant drums were evaluated in the same way as in Example 53. As a result, it was found that every drum was provided with practically applicable desired electrophotographic characteristics.

EXAMPLE 99

The procedures of Example 56 were repeated, except that the charge injection inhibition layer forming conditions and the photoconductive layer forming conditions were changed as shown in Table 78 and the surface layer forming conditions were changed as shown in Table 109, to thereby prepare multiple drums as shown in Table 141.

The resultant drums were evaluated in the same way as in Example 53. As a result, it was found that every drum was provided with practically applicable desired electrophotographic characteristics.

EXAMPLE 100

The procedures of Example 60 were repeated, except that the IR absorptive layer forming conditions, the charge injection inhibition layer forming conditions and the photoconductive layer forming conditions were changed as shown in Table 80 and the surface layer forming conditions were changed as shown in Table 107, to thereby prepare multiple drums as shown in Table 142.

The resultant drums were evaluated in the same way as in Example 58. As a result, it was found that every drum was provided with practically applicable desired electrophotographic characteristics.

EXAMPLE 101

The procedures of Example 62 were repeated, except that the contact layer forming conditions, the IR absorptive layer forming conditions, the charge injection inhibition layer forming conditions and the photoconductive layer forming conditions were changed as shown in Table 82 and the surface layer forming conditions were changed as shown in Table 109, to thereby prepare multiple drums, as shown in Table 143.

The resultant drums were evaluated in the same way as in Example 58. As a result, it was found that every drum was provided with practically applicable desired electrophotographic characteristics.

EXAMPLE 102

A drum having a charge injection inhibition layer, a photoconductive layer, an intermediate layer and a surface layer was prepared under the conditions shown in Table 144 and following the procedures of Example 53.

The resultant drum was evaluated in the same way as in Example 53. As a result, superiorities in the respective evaluation items were acknowledged.

EXAMPLE 103

The mirror grinded cylinders were supplied for grinding process with cutting tool having various degrees. With the patterns of FIG. 3 and various cross section patterns as described in Table 85, multiple cylinders were provided. These cylinders were set to the fabrication apparatus of FIG. 2 accordingly, and used to prepare multiple drums under the same layer forming conditions of Example 53. The resulting drums were evaluated with the same procedures as in Example 53.

As a result, it was found that every drum was provided with practically applicable desired electrophotographic characteristics.

EXAMPLE 104

The surface of mirror grinded cylinder was treated by dropping lots of bearing balls thereto to thereby form uneven shape composed of a plurality of fine dimples at the surface, and multiple cylinders having a cross section form of FIG. 4 and of a cross section pattern of Table 86 were provided These cylinders were set to the fabrication apparatus of FIG. 2 accordingly and used for the preparation of multiple drums under the same layer forming conditions of Example 53. The resulting drums were evaluated with the same procedures of Example 53.

As a result, it was found that every drum is provided with practically applicable desired electrophotographic characteristics.

EXAMPLE 105

A light receiving member for use in electrophotography having a light receiving layer disposed on an Al cylinder having a mirror grinded surface was prepared under the layer forming conditions shown in Table 145 using the fabrication apparatus shown in FIG. 2.

And samples were provided by forming only a surface layer comprising an upper layer and a lower layer on an aluminum plate and on a Si-monocrystal wafer respectively placed on the substrate holder in the same manner for forming the surface layer in the above case using the same kind fabrication apparatus as shown in FIG. 2.

For the resulting light receiving member (hereinafter this kind light receiving member is referred to as "drum"), it was set with the conventional electrophotographic copying machine, and electrophotographic characteristics such as initial electrification efficiency (initial charging efficiency), residual voltage and appearance of a ghost were examined, then decrease in the electrification efficiency, the situation of surface abrasion and increase of defective images after 1,500 thousand times repeated shots were respectively examined.

Then, the situation of an image flow of the drum under high temperature and high humidity atmosphere at 35° C. and 85% humidity was also examined.

Further, the situation of superiority or inferiority in the cleaning property of the drum in accordance with the degree of background fogginess appearity on a blank image was examined by purposely replacing the original cleaning blade by another cleaning blade having a worn edge.

In addition, the situation of breakdown voltage for the drum was observed by applying a high direct current voltage onto the drum.

Further in addition, the abrasion resistance of the drum was examined by wearing its surface using a metallic needle having a round top while applying a predetermined load thereon.

The results obtained were as shown in Table 146. As Table 146 illustrates, superiorities in the respective evaluation items, particularly of the items relative to defective image, image flow and cleaning property for the drum were acknowledged.

As for each of the samples, the cordination number of boron nitride contained in each of the upper and the lower layer was examined in accordance with EXAFS (extended X-ray absorption fine structure). As a result, it was found that there were contained tetrahedrally bonded boron nitride and trihedrally bonded boron nitride in mingled state in the upper layer and there was contained tetrahedrally bonded boron nitride in the lower layer.

EXAMPLE 106

The procedures of Example 105 were repeated under the conditions shown in Table 147 wherein $H_2$ gas is additionally used in the formation of a surface layer to therby obtain a drum and samples. The resultant drum and samples were evaluated by the same manners as in Example 105.

The results obtained were as shown in Table 148. As Table 148 illustrates, superiorities in the respective evaluation items were acknowledged.

And as a result of examining the cordination number of boron nitride contained in each of the samples, it was found that there were contained tetrahedrally bonded boron nitride and trihedrally bonded boron nitride in mingled state in the upper layer and there was contained tetrahedrally bonded boron nitride in the lower layer.

EXAMPLE 107

The procedures of Example 105 were repeated, except that the vias voltage of the cylinder in the case of forming a lower layer and the vias voltage in the case of forming an upper layer were controlled to be −150 V and +100 V respectively at the time of forming a surface layer, to thereby prepare a drum and samples.

The resultant drum and samples were evaluated by the same manners as in Example 105.

The results obtained were as shown in Table 149. As Table 149 illustrates, desirable results as those in Example 105 were acknowledged.

As for the situations of tetrahedrally bonded boron nitride and trihedrally bonded boron nitride in each of the samples, it was found that there were contained trihedrally bonded boron nitride and tetrahedrally bonded boron nitride in mingled state in the upper layer and there was contained tetrahedrally bonded boron nitride in the lower layer.

EXAMPLE 108

A drum having a charge injection inhibition layer, a photoconductive layer and a surface layer on an alminum cylinder was prepared under the conditions shown in Table 150 and following the procedures of Example 105.

The resultant drum was evaluated by the same manners as in Example 105.

The results obtained were as shown in Table 151. As Table 151 illustrates, superiorities in respective evaluation items were acknowledged for the drum.

EXAMPLE 109

An alminum cylinder was subjected to anodic oxidation to form an aluminum oxide ($Al_2O_3$) layer to be a charge injection inhibition layer thereon, and a photoconductive layer then a surface layer were continuously formed on the previously formed charge injection inhibition layer under the conditions shown in Table 152 following the procedures of Example 105.

The resultant drum was evaluated by the same manners as in Example105. The results obtained were as shown in Table 153.

As Table 153 illustrates, superiorities in the respective evaluation items were acknowledged.

EXAMPLE 110

A drum having an IR absorptive layer, a photoconductive layer and a surface layer was prepared under the conditions shown in Table 154 and following the procedures of Example 105.

The resultant drum was evaluated by the same manners as in Example 105.

In addition, the drum was set with the conventional electrophotographic copying machine using a semiconductor laser beam of 785 nm in wavelength as the light source for image exposure in order to examine whether an infringe pattern appears or not on an image to be made.

The results obtained were as shown in Table 155. As Table 155 illustrates, superiorities in the respective evaluation items were acknowledged, and it was found that any infringe pattern did not appear on an image to be made.

EXAMPLE 111

A drum having a contact layer, a photoconductive layer and a surface layer was prepared under the conditions shown in Table 156 and following the procedures of Example 105.

The resultant drum was evaluated by the same manners as in Example 105. The results obtained were as shown in Table 157.

As Table 157 illustrates, superiorities in the respective evaluation items were acknowledged.

EXAMPLE 112

A drum having an IR absorptive layer, a charge injection inhibition layer, a photoconductive layer and a surface layer was prepared under the conditions shown in Table 158 and following the procedures of Example 105. The resultant drum was evaluated in the same way as in Example 110. The results obtained were as shown in Table 159. As Table 159 illustrates, superiorities in the respective evaluation items were acknowledged.

EXAMPLE 113

A drum having a contact layer, a charge injection inhibition layer, a photoconductive layer and a surface layer was prepared under the conditions shown in Table 160 and following the procedures of Example 105. The resultant drum was evaluated in the same way as in Example 105. The results obtained were as shown in Table 161.

As Table 161 illustrates, superiorities in the respective evaluation items were acknowledged.

EXAMPLE 114

A drum having a contact layer, an IR absorptive layer, a charge injection inhibition layer, a photoconductive layer and a surface layer was prepared under the conditions shown in Table 162 and following the procedures of Example 105. The resultant drum was evaluated in the same way as in Example 110. The results obtained were as shown in Table 163. As Table 163 illustrates, superiorities in the respective evaluation items were acknowledged.

EXAMPLE 115

The procedures of Example 105 were repeated, except that the photoconductive layer forming conditions were changed as shown in Table 20, to thereby prepare multiple drums.

The resultant drums were evaluated in the same way as in Example 105. As a result, it was found that every drum was provided with practically applicable desired electrophotographic characteristics.

EXAMPLE 116

The procedures of Example 106 were repeated, except that the photoconductive layer forming conditions were changed as shown in Table 21, to thereby prepare multiple drums.

The resultant drums were evaluated in the same way as in Example 105. As a result, it was found that every drum was provided with practically applicable desired electrophotographic characteristics.

EXAMPLE 117

The procedures of Example 107 were repeated, except that the photoconductive layer forming conditions were changed as shown in Table 22, to thereby prepare multiple drums.

The resultant drums were evaluated in the same way as in Example 105. As a result, it was found that every drum was provided with practically applicable desired electrophotographic characteristics.

EXAMPLE 118

The procedures of Example 108 were repeated, except that the charge injection inhibition layer forming conditions were changed as shown in Table 23, to thereby prepare multiple drums.

The resultant drums were evaluated in the same way as in Example 105. As a result, it was found that every drum was provided with practically applicable desired electrophotographic characteristics.

EXAMPLE 119

The procedures of Example 108 were repeated, except that the charge injection inhibiton layer forming conditions and the photoconductive layer forming conditions were changed respectively as shown in Table 24 and Table 25, to thereby prepare multiple drums as shown in Table 164.

The resultant drums were evaluated in the same way as in Example 105. As a result, it was found that every drum was provided with practically applicable desired electrophotographic characteristics.

EXAMPLE 120

The procedures of Example 108 were repeated, except that the charge injection inhibition layer forming conditions, the photoconductive layer forming conditions and the surface layer forming conditions were changed respectively as shown in Table 24, Table 27 and Table 165, to thereby prepare multiple drums as shown in Table 166.

The resultant drums were evaluated in the same way as in Example 105. As a result, it was found that every drum was provided with practically applicable desired electrophotographic characteristics.

EXAMPLE 121

The procedures of Example 108 were repeated, except that the charge injection inhibition layer forming conditions, the photoconductive layer forming conditions and the surface layer forming conditions were changed respectively as shown in Table 24, Table 27 and Table 167, to thereby prepare multiple drums as shown in Table 168.

The resultant drums were evaluated in the same way as in Example 105. As a result, it was found that every drum was provided with practically applicable desired electrophotographic characteristics.

EXAMPLE 122

The procedures of Example 109 were repeated, except that the photoconductive layer forming conditions were changed as shown in Table 25, to thereby prepare multiple drums as shown in Table 169.

The resultant drums were evaluated in the same way as in Example 105. As a result, it was found that every drum was provided with practically applicable desired electrophotographic characteristics.

EXAMPLE 123

The procedure of Example 109 were repeated, except that the photoconductive layer forming conditions and the surface layer forming conditions were changed respectively as shown in Table 27 and Table 165, to thereby prepare multiple drums as shown in Table 170.

The resultant drums were evaluated in the same way as in Example 105. As a result, it was found that every drum was provided with practically applicable desired electrophotographic characteristics.

EXAMPLE 124

The procedures of Example 109 were repeated, except that the photoconductive layer forming conditions and the surface layer forming conditions were changed respectively as shown in Table 27 and Table 167, to thereby prepare multiple drums as shown in Table 171.

The resultant drums were evaluated in the same way as in Example 105. As a result, it was found that every drum was provided with practically applicable desired electrophotographic characteristics.

EXAMPLE 125

The procedures of Example 110 were repeated, except that the IR absorptive layer forming conditions were changed as shown in Table 35 and Table 36, to thereby prepare multiple drums as shown in Table 172.

The resultant drums were evaluated in the same way as in Example 110. As a result, it was found that every drum was provided with practically applicable desired electrophotographic characteristics.

EXAMPLE 126

The procedures of Example 110 were repeated, except that the IR absorptive layer forming conditions were changed as shown in Table 35 and Table 38 and the photoconductive layer forming conditions were changed as shown in Table 25, to thereby prepare multiple drums as shown in Table 173.

The resultant drums were evaluated in the same way as in Example 110. As a result, it was found that every drum was provided with practically applicable desired electrophotographic characteristics.

EXAMPLE 127

The procedures of Example 110 were repeated, except that the IR absorptive layer forming conditions were changed as shown in Table 35 and Table 38, and the photoconductive layer forming conditions and the surface layer forming conditions were changed respectively as shown in Table 27 and Table 165, to thereby prepare multiple drums as shown in Table 174.

The resultant drums were evaluated in the same way as in Example 110. As a result, it was found that every drum was provided with practically applicable desired electrophotographic characteristics.

EXAMPLE 128

The procedures of Example 110 were repeated, except that the IR absorptive layer forming conditions were changed as shown in Table 35 and Table 38, and the photoconductive layer forming conditions and the surface layer forming conditions were changed respectively as shown in Table 27 and Table 167, to thereby prepare multiple drums as shown in Table 175.

The resultant drums were evaluated in the same way as in Example 110. As a result, it was found that every drum was provided with practically applicable desired electrophotographic characteristics.

EXAMPLE 129

The procedures of Example 111 were repeated, except that the contact layer forming conditions were changed as shown in Table 42, to thereby prepare multiple drums as shown in Table 176.

The resulant drums were evaluated in the same way as in Example 105. As a result, it was found that every drum was provided with practically applicable desired electrophotographic characteristics.

EXAMPLE 130

The procedures of Example 111 were repeated, except that the contact layer forming conditions and the photoconductive layer forming conditions were changed respectively as shown in Table 44 and Table 25, to thereby prepare multiple drums as shown in Table 177.

The resultant drums were evaluated in the same way as in Example 105. As a result, it was found that every drum was provided with practically applicable desired electrophotographic characteristics.

EXAMPLE 131

The procedures of Example 111 were repeated, except that the contact layer forming conditions, photoconductive layer forming conditions and the surface layer forming conditions were changed respectively as shown in Table 44, Table 27 and Table 165, to thereby prepare multiple drums as shown in Table 178.

The resultant drums were evaluated in the same way as in Example 105. As a result, it was found that every drum was provided with practically applicable desired electrophotographic characteristics.

EXAMPLE 132

The procedures of Example 111 were repeated, except that the contact layer forming conditions, the photoconductive layer forming conditions and the surface layer forming conditions were changed respectively as shown in Table 44, Table 27 and Table 167, to thereby prepare multiple drums as shown in Table 179.

The resultant drums were evaluated in the same way as in Example 105. As a result, it was found that every drum was provided with practically applicable desired electrophotographic characteristics.

EXAMPLE 133

The procedures of Example 112 were repeated, except that the IR absorptive layer forming conditions were changed as shown in Table 35 and Table 36, to thereby prepare multiple drums as shown in Table 180.

The resultant drums were evaluated in the same way as in Example 110. As a result, it was found that every drum was provided with practically applicable desired electrophotographic characteristics.

EXAMPLE 134

The procedures of Example 112 were repeated, except that the charge injection inhibition layer forming conditions were changed as shown in Table 49 and the IR absorptive layer forming conditions were changed as shown in Table 35 and Table 38, to thereby prepare multiple drums as shown in Table 181.

The resultant drums were evaluated in the same way as in Example 110. As a result, it was found that every drum was provided with practically applicable desired electrophotographic characteristics.

EXAMPLE 135

The procedures of Example 112 were repeated, except that the charge injection inhibition layer forming conditions and the surface layer forming conditions were changed respectively as shown in Table 51 and Table 165, and the IR absorptive layer forming conditions were changed as shown in Table 35 and Table 38, to thereby prepare multiple drums as shown in Table 182.

The resultant drums were evaluated in the same way as in Example 110. As a result, it was found that every drum was provided with practically applicable desired electrophotographic characteristics.

EXAMPLE 136

The procedures of Example 112 were repeated, except that the charge injection inhibition layer forming conditions and the surface layer forming conditions were changed respectively as shown in Table 51 and Table 167, and the IR absorptive layer forming conditions were changed as shown in Table 35 and Table 38, to thereby prepare multiple drums as shown in Table 183.

The resultant drums were evaluated in the same way as in Example 110. As a result, it was found that every drum was provided with practically applicable desired electrophotographic characteristics.

EXAMPLE 137

The procedures of Example 113 were repeated, except that the contact layer forming conditions were changed as shown in Table 44 and Table 54, to thereby prepare multiple drums as shown in Table 184.

The resultant drums were evaluated in the same way as in Example 105. As a result, it was found that every drum was provided with practically applicable desired electrophotographic characteristics.

EXAMPLE 138

The procedures of Example 113 were repeated, except that the charge injection inhibition layer forming conditions were changed as shown in Table 56, and the contact layer forming conditions were changed as shown in Table 44 and Table 57, to thereby prepare multiple drums as shown in Table 185.

The resultant drums were evaluated in the same way as in Example 105. As a result, it was found that every drum was provided with practically applicable desired electrophotographic characteristics.

EXAMPLE 139

The procedures of Example 113 were repeated, except that the charge injection inhibition layer forming conditions and the surface layer forming conditions were changed respectively as shown in Table 24 and Table 165, and the contact layer forming conditions were changed as shown in Table 44 and Table 57, to thereby prepare multiple drums as shown in Table 186.

The resultant drums were evaluated in the same way as in Example 105. As a result, it was found that every drum was provided with practically applicable desired electrophotographic characteristics.

EXAMPLE 140

The procedures of Example 113 were repeated, except that the charge injection inhibition layer forming conditions and the surface layer forming conditions were changed respectively as shown in Table 24 and Table 167, and the contact layer forming conditions were changed as shown in Table 44 and Table 57, to thereby prepare multiple drums as shown in Table 187.

The resultant drums were evaluated in the same way as in Example 105. As a result, it was found that every drum was provided with practically applicable desired electrophotographic characteristics.

EXAMPLE 141

The procedures of Example 114 were repeated, except that the charge injection inhibition layer forming conditions were changed as shown in Table 61, to thereby prepare multiple drums as shown in Table 188. The resultant drums were evaluated in the same way as in Example 110. As a result, it was found that every drum was provided with practically applicable desired electrophotographic characteristics.

EXAMPLE 142

The procedures of Example 114 were repeated, except that the charge injection inhibition layer forming conditions and the photoconductive layer forming conditions were changed respectively as shown in Table 64 and Table 63, to thereby prepare multiple drums as shown in Table 189.

The resultant drums were evaluated in the same way as in Example 110. As a result, it was found that every drum was provided with practically applicable desired electrophotographic characteristics.

EXAMPLE 143

The procedures of Example 114 were repeated, except that the charge injection inhibition layer forming conditions, the photoconductive layer forming conditions and the surface layer forming conditions were changed respectively as shown in Table 64, Table 66 and Table 165, to thereby prepare multiple drums as shown in Table 190.

The resultant drums were evaluated in the same way as in Example 110. As a result, it was found that every drum was provided with practically applicable desired electrophotographic characteristics.

EXAMPLE 144

The procedures of Example 114 were repeated, except that the charge injection inhibition layer forming conditions, the photoconductive layer forming conditions and the surface layer forming conditions were changed respectively as shown in Table 64, Table 66 and Table 167, to thereby prepare multiple drums as shown in Table 191.

The resultant drums were evaluated in the same way as in Example 110. As a result, it was found that every drum was provided with practically applicable desired electrophotographic characteristics.

EXAMPLE 145

The procedures of Example 112 were repeated, except that the charge injection inhibition layer forming conditions, the photoconductive layer forming conditions and the surface layer forming conditions were changed respectively as shown in Table 51. Table 69 and Table 192, and the IR absorptive layer forming conditions were changed as shown in Table 35 and Table 38, to thereby prepare multiple drums as shown in Table 193.

The resultant drums were evaluated in the same way as in Example 110. As a result, it was found that every drum was provided with practically applicable desired electrophotographic characteristics.

EXAMPLE 146

The procedures of Example 112 were repeated, except that the charge injection inhibition layer forming conditions, the photoconductive layer forming conditions and the surface layer forming conditions were changed respectively as shown in Table 51, Table 72 and Table 192, and the IR absorptive layer forming conditions were changed as shown in Table 35 and Table 38, to thereby prepare multiple drums as shown in Table 194.

The resultant drums were evaluated in the same way as in Example 110. As a result, it was found that every drum was provided with practically applicable desired electrophotographic characteristics.

EXAMPLE 147

The procedures of Example 112 were repeated, except that the charge injection inhibition layer forming conditions, the photoconductive layer forming conditions and the surface layer forming conditions were changed respectively as shown in Table 51, Table 69 and Table 165, and the IR absorptive layer forming conditions were changed as shown in Table 35 and Table 38, to thereby prepare multiple drums as shown in Table 195.

The resultant drums were evaluated in the same way as in Example 110. As a result, it was found that every drum was provided with practically applicable desired electrophotographic characteristics.

EXAMPLE 148

The procedures of Example 112 were repeated, except that the charge injection inhibition layer forming conditions, the photoconductive layer forming conditions and the surface layer forming conditions were changed respectively as shown in Table 51, Table 72 and Table 165, and the IR absorptive layer forming conditions were changed as shown in Table 35 and Table 38, to thereby prepare multiple drums as shown in Table 196.

The resultant drums were evaluated in the same way as in Example 110. As a result, it was found that every drum was provided with practically applicable desired electrophotographic characteristics.

EXAMPLE 149

The procedures of Example 112 were repeated, except that the charge injection inhibition layer forming conditions, the photoconductive layer forming conditions and the surface layer forming conditions were changed respectively as shown in Table 51, Table 69 and Table 167, and the IR absorptive layer forming conditions were changed as shown in Table 35 and Table 38, to thereby prepare multiple drums as shown in Table 197.

The resultant drums were evaluated in the same way as in Example 110. As a result, it was found that every drum was provided with practically applicable desired electrophotographic characteristics.

EXAMPLE 150

The procedures of Example 112 were repeated, except that the charge injection inhibition layer forming conditions, the photoconductive layer forming conditions and the surface layer forming conditions were changed respectively as shown in Table 51, Table 72 and Table 167, and the IR absorptive layer forming conditions were changed as shown in Table 35 and Table 38, to thereby prepare multiple drums as shown in Table 198.

The resultant drums were evaluated in the same way as in Example 110. As a result, it was found that every drum was provided with practically applicable desired electrophotographic characteristics.

EXAMPLE 151

The procedures of Example 108 were repeated, except that the charge injection inhibition layer forming conditions and the photoconductive layer forming conditions were changed as shown in Table 78 and the surface layer forming conditions were changed as shown in Table 167, to thereby prepare multiple drums as shown in Table 199.

The resultant drums were evaluated in the same way as in Example 105. As a result, it was found that every drum was provided with practically applicable desired electrophotographic characteristics.

EXAMPLE 152

The procedures of Example 112 were repeated, except that the IR absorptive layer forming conditions, the charge injection inhibition layer forming conditions and the photoconductive layer forming conditions were changed as shown in Table 80 and the surface layer forming conditions were changed as shown in Table 167, to thereby prepare multiple drums as shown in Table 200.

The resultant drums were evaluated in the same way as in Example 110. As a result, it was found that every drum was provided with practically applicable desired electrophotographic characteristics.

EXAMPLE 153

The procedures of Example 114 were repeated, except that the contact layer forming conditions, the IR absorptive layer forming conditions, the charge injection inhibition layer forming conditions and the photoconductive layer forming conditions were changed as shown in Table 82 and the surface layer forming conditions were changed as shown in Table 167, to thereby prepare multiple drums as shown in Table 201.

The resultant drums were evaluated in the same way as in Example 110. As a result, it was found that every drum was provided with practically applicable desired electrophotographic characteristics.

EXAMPLE 154

A drum having a charge injection inhibition layer, a photoconductive layer, an intermediate layer and a surface layer was prepared under the conditions shown in Table 202 and following the procedures of Example 105.

The resultant drum was evaluated in the same way as in Example 105. As a result, superiorities in the respective evaluation items were acknowledged.

EXAMPLE 155

The mirror grinded cylinders were supplied for grinding process with cutting tool having various degrees. With the patterns of FIG. 3 and various cross section patterns as described in Table 85, multiple cylinders were provided. These cylinders were set to the fabrication apparatus of FIG. 2 accordingly, and used to prepare multiple drums under the same layer forming conditions of Example 105. The resulting drums were evaluated with the same procedures as in Example 105.

As a result, it was found that every drum was provided with practically applicable desired electrophotographic characteristics.

EXAMPLE 156

The surface of mirror grinded cylinder was treated by dropping lots of bearing balls thereto to thereby form uneven shape composed of a plurality of fine dimples at the surface, and multiple cylinders having a cross section form of FIG. 4 and of a cross section pattern of Table 86 were provided These cylinders were set to the fabrication apparatus of FIG. 2 accordingly and used for the preparation of multiple drums under the same layer forming conditions of Example 105. The resulting drums were evaluated with the same procedures of Example 105.

As a result, it was found that every drum was provided with practically applicable desired electrophotographic characteristics.

EXAMPLE 157

A light receiving member for use in electrophotography having a light receiving layer disposed on an Al cylinder having a mirror grinded surface was prepared under the layer forming conditions shown in Table 203(a) and Table 203(b) using the fabrication apparatus shown in FIG. 2.

And samples were provided by forming only a surface layer on an aluminum plate and on a Si-monocrystal wafer respectively placed on the substrate holder in the same manner for forming the surface layer in the above case using the same kind fabrication apparatus as shown in FIG. 2.

For the resulting light receiving member (hereinafter this kind light receiving member is referred to as "drum"), it was set with the conventional electrophotographic copying machine, and electrophotographic characteristics such as initial electrification efficiency (initial charging efficiency), residual voltage and appearance of a ghost were examined, then decrease in the electrification efficiency, the situation of surface abrasion and increase of defective images after 1,500 thousand times repeated shots were respectively examined.

Then, the situation of an image flow on the drum under high temperature and high humidity atmosphere at 35° C. and 85% humidity was also examined.

Further, the situation of superiority or inferiority in the cleaning property of the drum in accordance with the degree of background fogginess appearing on a blank image was examined by purposely replacing the original cleaning blade by another cleaning blade having a worn edge.

In addition, the situation of breakdown voltage for the drum was observed by applying a high direct current voltage onto the drum.

Further in addition, the abrasion resistance of the drum was examined by wearing its surface using a metallic needle having a round top while applying a predetermined load thereon.

The results obtained were as shown in Table 204. As Table 204 illustrates, extreme superiorities in every evaluation item of the initial electrification efficiency (initial charging efficiency), defective image, surface abrasion, breakdown voltage and abrasion resistance for the drum were acknowledged.

As for each of the samples, the cordination number of boron nitride contained therein was examined in accordance with EXAFS (extended X-ray absorption fine structure). As a result, it was found that every sample contained tetrahedrally bonded boron nitride.

EXAMPLE 158

The procedures of Example 157 were repeated under the conditions shown in Table 205(a) and Table 205(b) wherein $H_2$ gas is additionally used in the formation of a surface layer to thereby obtain a drum and samples. The resultant drum and samples were evaluated by the same manners as in Example 157.

The results obtained were as shown in Table 206. As Table 206 illustrates, superiorities in the respective evaluation items were acknowledged for the drum.

And, as for each of the samples, it was found that every sample contained tetrahedrally bonded boron nitride.

EXAMPLE 159

The procedures of Example 157 were repeated under the same conditions as shown in the foregoing Table 203(a) and Table 203(b), except that the vias voltage of the aluminum cylinder was controlled to −150 V, to thereby obtain a drum and samples. The resultant drum and samples were evaluated by the same manners as in Example 157.

The results obtained were shown in Table 207. As Table 207 illustrated, desirable results as those in Example 157 were acknowledged. As for the boron nitrides contained in the surface layer, it was acknowledged that every sample contained tetrahedrally bonded boron nitride.

EXAMPLE 160

A drum having a charge injection inhibition layer, a photoconductive layer and a surface layer on an aluminum cylinder was prepared under the conditions shown in Table 208(a) and Table 208(b) and following the procedures of Example 157.

The resultant drum was evaluated by the same manners a s in Example 157. The results obtained were as shown in Table 7. As Table 7 illustrates, superiorities in the respective evaluation items were acknowledged for the drum.

EXAMPLE 161

An aluminum cylinder was subjected to anodic oxidation to form an aluminum oxide ($Al_2O_3$) layer to be a charge injection inhibition layer thereon, and a photoconductive layer then a surface layer were continuously formed on the previously formed charge injection inhibition layer under the conditions shown in Table 210(a) and Table 210(b) following the procedures of Example 157.

The resultant drum was evaluated by the same manners as in Example 157. The results obtained were as shown in Table 211.

As Table 211 illustrates, superiorities in the respective evaluation items were acknowledged.

EXAMPLE 162

A drum having an IR absorptive layer, a photoconductive layer and a surface layer was prepared under the conditions shown in Table 212(a) and Table 212(b) and following the procedures of Example 157.

In addition, the drum was set with the conventional electrophotographic copying machine using a semiconductor laser beam of 785 nm in wavelength as the light source for image exposure in order to examine whether an infringe pattern appears or not on an image to be made.

The results obtained were as shown in Table 213. As Table 213 illustrates, superiorities in the respective evaluation items were acknowledged, and it was found that any infringe pattern did not appear on an image to be made.

EXAMPLE 163

A drum having a contact layer, a photoconductive layer and a surface layer was prepared under the conditions shown in Table 214(a) and Table 214(b) and following the procedures of Example 157.

The resultant drum was evaluated by the same manners as in Example 157. The results obtained were as shown in Table 215.

As Table 215 illustrates, superiorities in the respective evaluation items were acknowledged.

EXAMPLE 164

A drum having an IR absorptive layer, a charge injection inhibition layer, a photoconductive layer and a surface layer was prepared under the conditions shown in Table 216(a) and Table 216(b) and following the procedures of Example 157. The resultant drum was evaluated in the same way as in Example 162. The results obtained were as shown in Table 217. As Table 217 illustrates, superiorities in the respective evaluation items were acknowledged.

EXAMPLE 165

A drum having a contact layer, a charge injection inhibition layer, a photoconductive layer and a surface layer was prepared under the conditions shown in Table 218(a) and Table 218(b) and following the procedures of Example 157. The resultant drum was evaluated in the same way as in Example 157. The results obtained were as shown in Table 219.

As Table 219 illustrates, superiorities in the respective evaluation items were acknowledged.

EXAMPLE 166

A drum having a contact layer, an IR absorptive layer, a charge injection inhibition layer, a photoconductive layer and a surface layer was prepared under the conditions shown in Table 220(a) and Table 220(b) and following the procedures of Example 157. The resultant drum was evaluated in the same way as in Example 162. The results obtained were as shown in Table 221. As Table 221 illustrates, superiorities in the respective evaluation items were acknowledged.

EXAMPLE 167

The procedures of Example 157 were repeated, except that the photoconductive layer forming conditions were changed as shown in Table 222, to thereby prepare multiple drums.

The resultant drums were evaluated in the same way as in Example 157. As a result, it was found that every drum was provided with practically applicable desired electrophotographic characteristics.

EXAMPLE 168

The procedures of Example 158 were repeated, except that the photoconductive layer forming conditions were changed as shown in Table 223, to thereby prepare multiple drums.

The resultant drums were evaluated in the same way as in Example 157. As a result, it was found that every drum was provided with practically applicable desired electrophotographic characteristics.

EXAMPLE 169

The procedures of Example 159 were repeated, except that the photoconductive layer forming conditions were changed as shown in Table 224, to thereby prepare multiple drums.

The resultant drums were evaluated in the same way as in Example 157. As a result, it was found that every drum was provided with practically applicable desired electrophotographic characteristics.

EXAMPLE 170

The procedures of Example 160 were repeated, except that the charge injection inhibition layer forming conditions were changed as shown in Table 225, to thereby prepare multiple drums.

The resultant drums were evaluated in the same way as in Example 157. As a result, it was found that every drum was provided with practically applicable desired electrophotographic characteristics.

EXAMPLE 171

The procedures of Example 160 were repeated, except that the charge injection inhibition layer forming conditions and the photoconductive layer forming conditions were changed respectively as shown in Table 24 and Table 25, to thereby prepare multiple drums as shown in Table 226.

The resultant drums were evaluated in the same way as in Example 157. As a result, it was found that every drum was provided with practically applicable desired electrophotographic characteristics.

EXAMPLE 172

The procedures of Example 160 were repeated, except that the charge injection inhibition layer forming conditions, the photoconductive layer forming conditions and the surface layer forming conditions were changed respectively as shown in Table 24, Table 27 and Table 227, to thereby prepare multiple drums as shown in Table 228.

The resultant drums were evaluated in the same way as in Example 157. As a result, it was found that every drum was provided with practically applicable desired electrophotographic characteristics.

EXAMPLE 173

The procedures of Example 160 were repeated, except that the charge injection inhibition layer forming conditions, the photoconductive layer forming conditions and the surface layer forming conditions were changed respectively as shown in Table 24, Table 27 and Table 229, to thereby prepare multiple drums as shown in Table 230.

The resultant drums were evaluated in the same way as in Example 157. As a result, it was found that every drum was provided with practically applicable desired electrophotographic characteristics.

EXAMPLE 174

The procedures of Example 161 were repeated, except that the photoconductive layer forming conditions were changed as shown in Table 25, to thereby prepare multiple drums as shown in Table 231.

The resultant drums were evaluated in the same way as in Example 157. As a result, it was found that every drum was provided with practically applicable desired electrophotographic characteristics.

EXAMPLE 175

The procedures of Example 161 were repeated, except that the photoconductive layer forming conditions and the surface layer forming conditions were changed respectively as shown in Table 27 and Table 227, to thereby prepare multiple drums as shown in Table 232.

The resultant drums were evaluated in the same way as in Example 157. As a result, it was found that every drum was provided with practically applicable desired electrophotographic characteristics.

EXAMPLE 176

The procedures of Example 161 were repeated, except that the photoconductive layer forming conditions and the surface layer forming conditions were changed respectively as shown in Table 27 and Table 229, to thereby prepare multiple drums as shown in Table 233.

The resultant drums were evaluated in the same way as in Example 157. As a result, it was found that every drum was provided with practically applicable desired electrophotographic characteristics.

EXAMPLE 177

The procedures of Example 162 were repeated, except that the IR absorptive layer forming conditions were changed as shown in Table 35 and Table 36, to thereby prepare multiple drums as shown in Table 234.

The resultant drums were evaluated in the same way as in Example 162. As a result, it was found that every drum was provided with practically applicable desired electrophotographic characteristics.

EXAMPLE 178

The procedures of Example 162 were repeated, except that the IR absorptive layer forming conditions were changed as shown in Table 35 and Table 38 and the photoconductive layer forming conditions were changed as shown in Table 25, to thereby prepare multiple drums as shown in Table 235.

The resultant drums were evaluated in the same way as in Example 162. As a result, it was found that every drum was provided with practically applicable desired electrophotographic characteristics.

EXAMPLE 179

The procedures of Example 162 were repeated, except that the IR absorptive layer forming conditions were changed as shown in Table 35 and Table 38, and the photoconductive layer forming conditions and the surface layer forming conditions were changed respectively as shown in Table 27 and Table 227, to thereby prepare multiple drums as shown in Table 236.

The resultant drums were evaluated in the same way as in Example 162. As a result, it was found that every drum was provided with practically applicable desired electrophotographic characteristics.

EXAMPLE 180

The procedures of Example 162 were repeated, except that the IR absorptive layer forming conditions were changed as shown in Table 35 and Table 38 and the photoconductive layer forming conditions and the surface layer forming conditions were changed respectively as shown in Table 27 and Table 229, to thereby prepare multiple drums as shown in Table 237.

The resultant drums were evaluated in the same way as in Example 162. As a result, it was found that every drum was provided with practically applicable desired electrophotographic characteristics.

EXAMPLE 181

The procedures of Example 163 were repeated, except that the contact layer forming conditions were changed as shown in Table 163, to thereby prepare multiple drums as shown in Table 238.

The resultant drums were evaluated in the same way as in Example 157. As a result, it was found that every drum was provided with practically applicable desired electrophotographic characteristics.

EXAMPLE 182

The procedures of Example 163 were repeated, except that the contact layer forming conditions and the photoconductive layer forming conditions were changed respectively as shown in Table 44 and Table 25, to thereby prepare multiple drums as shown in Table 239.

The resultant drums were evaluated in the same way as in Example 157. As a result, it was found that every drum was provided with practically applicable desired electrophotographic characteristics.

EXAMPLE 183

The procedures of Example 163 were repeated, except that the contact layer forming conditions, photoconductive layer forming conditions and the surface layer forming conditions were changed respectively as shown in Table 44. Table 27 and Table 277, to thereby prepare multiple drums as shown in Table 240.

The resultant drums were evaluated in the same way as in Example 157. As a result, it was found that every drum was provided with practically applicable desired electrophotographic characteristics.

EXAMPLE 184

The procedures of Example 163 were repeated, except that the contact layer forming conditions, photoconductive layer forming conditions and the surface layer forming conditions were changed respectively as shown in Table 44, Table 27 and Table 279, to thereby prepare multiple drums as shown in Table 241.

The resultant drums were evaluated in the same way as in Example 157. As a result, it was found that every drum was provided with practically applicable desired electrophotographic characteristics.

EXAMPLE 185

The procedures of Example 164 were repeated, except that the IR absorptive layer forming conditions were changed as shown in Table 35 and Table 36, to thereby prepare multiple drums as shown in Table 242.

The resultant drums were evaluated in the same way as in Example 162. As a result, it was found that every drum was provided with practically applicable desired electrophotographic characteristics.

EXAMPLE 186

The procedures of Example 164 were repeated, except that the charge injection inhibition layer forming conditions were changed as shown in Table 49 and the IR absorptive layer forming conditions were changed as shown in Table 35 and Table 38, to thereby prepare multiple drums as shown in Table 243.

The resultant drums were evaluated in the same way as in Example 162. As a result, it was found that every drum was provided with practically applicable desired electrophotographic characteristics.

EXAMPLE 187

The procedures of Example 164 were repeated, except that the charge injection inhibition layer forming conditions and the surface layer forming conditions were changed respectively as shown in Table 51 and Table 227, and the IR absorptive layer forming conditions were changed as shown in Table 35 and Table 38, to thereby prepare multiple drums as shown in Table 244.

The resultant drums were evaluated in the same way as in Example 162. As a result, it was found that every drum was provided with practically applicable desired electrophotographic characteristics.

EXAMPLE 188

The procedures of Example 164 were repeated, except that the charge injection inhibition layer forming conditions and the surface layer forming conditions were changed respectively as shown in Table 51 and Table 229, and the IR absorptive layer forming conditions were changed as shown in Table 35 and Table 38, to thereby prepare multiple drums as shown in Table 245.

The resultant drums were evaluated in the same way as in Example 162. As a result, it was found that every drum was provided with practically applicable desired electrophotographic characteristics.

EXAMPLE 189

The procedures of Example 165 were repeated, except that the contact layer forming conditions were changed as shown in Table 44 and Table 54, to thereby prepare multiple drums as shown in Table 246.

The resultant drums were evaluated in the same way as in Example 157. As a result, it was found that every drum was provided with practically applicable desired electrophotographic characteristics.

EXAMPLE 190

The procedures of Example 165 were repeated, except that the charge injection inhibition layer forming conditions were changed as shown in Table 56, and the contact layer forming conditions were changed as shown in Table 44 and Table 57, to thereby prepare multiple drums as shown in Table 247.

The resultant drums were evaluated in the same way as in Example 157. As a result, it was found that every drum was provided with practically applicable desired electrophotographic characteristics.

EXAMPLE 191

The procedures of Example 165 were repeated, except that the charge injection inhibition layer forming conditions and the surface layer forming conditions were changed respectively as shown in Table 24 and Table 227, and the contact layer forming conditions were changed as shown in Table 44 and Table 57, to thereby prepare multiple drums as shown in Table 248.

The resultant drums were evaluated in the same way as in Example 157. As a result, it was found that every drum was provided with practically applicable desired electrophotographic characteristics.

EXAMPLE 192

The procedures of Example 165 were repeated, except that the charge injection inhibition layer forming conditions and the surface layer forming conditions were changed respectively as shown in Table 24 and Table 229, and the contact layer forming conditions were changed as shown in Table 44 and Table 57, to thereby prepare multiple drums as shown in Table 249.

The resultant drums were evaluated in the same way as in Example 157. As a result, it was found that every drum was provided with practically applicable desired electrophotographic characteristics.

EXAMPLE 193

The procedures of Example 166 were repeated, except that the charge injection inhibition layer forming conditions were changed as shown in Table 61, to thereby prepare multiple drums as shown in Table 250.

The resultant drums were evaluated in the same way as in Example 162. As a result, it was found that every drum was provided with practically applicable desired electrophotographic characteristics.

EXAMPLE 194

The procedures of Example 166 were repeated, except that the charge injection inhibition layer forming conditions and the photoconductive layer forming conditions were changed respectively as shown in Table 64 and Table 63, to thereby prepare multiple drums as shown in Table 251.

The resultant drums were evaluated in the same way as in Example 162. As a result, it was found that every drum was provided with practically applicable desired electrophotographic characteristics.

EXAMPLE 195

The procedures of Example 166 were repeated, except that the charge injection inhibition layer forming conditions, the photoconductive layer forming conditions and the surface layer forming conditions were changed respectively as shown in Table 64, Table 66 and Table 227, to thereby prepare multiple drums as shown in Table 252.

The resultant drums were evaluated in the same way as in Example 162. As a result, it was found that every drum was provided with practically applicable desired electrophotographic characteristics.

EXAMPLE 196

The procedures of Example 166 were repeated, except that the charge injection inhibition layer forming conditions, the photoconductive layer forming conditions and the surface layer forming conditions were changed respectively as shown in Table 64, Table 66 and Table 229, to thereby prepare multiple drums as shown in Table 253.

The resultant drums were evaluated in the same way as in Example 162. As a result, it was found that every drum was provided with practically applicable desired electrophotographic characteristics.

EXAMPLE 197

The procedures of Example 164 were repeated, except that the charge injection inhibition layer forming conditions, the photoconductive layer forming conditions and the surface layer forming conditions were changed respectively as shown in Table 51, Table 69 and Table 254, and the IR absorptive layer forming conditions were changed as shown in Table 35 and Table 38, to thereby prepare multiple drums as shown in Table 255.

The resultant drums were evaluated in the same way as in Example 162. As a result, it was found that every drum was provided with practically applicable desired electrophotographic characteristics.

EXAMPLE 198

The procedure of Example 164 were repeated, except that the charge injection inhibition layer forming conditions, the photoconductive layer forming conditions and the surface layer forming conditions were changed respectively as shown in Table 51, Table 72 and Table 254, and the IR absorptive layer forming conditions were changed as shown in Table 35 and Table 38, to thereby prepare multiple drums as shown in Table 256.

The resultant drums were evaluated in the same way as in Example 162. As a result, it was found that every drum was provided with practically applicable desired electrophotographic characteristics.

EXAMPLE 199

The procedures of Example 164 were repeated, except that the charge injection inhibition layer forming conditions, the photoconductive layer forming conditions and the surface layer forming conditions were changed respectively as shown in Table 51, Table 69 and Table 227, and the IR absorptive layer forming conditions were changed as shown in Table 35 and Table 38, to thereby prepare multiple drums as shown in Table 257.

The resultant drums were evauated in the same way as in Example 162. As a result, it was found that every drum was provided with practically applicable desired electrophotographic characteristics.

EXAMPLE 200

The procedures of Example 164 were repeated, except that the charge injection inhibition layer forming conditions, the photoconductive layer forming conditions and the surface layer forming conditions were changed respectively as shown in Table 51, Table 72 and Table 227, and the IR absorptive layer forming conditions were changed as shown in Table 35 and Table 38, to thereby prepare multiple drums as shown in Table 258.

The resultant drums were evaluated in the same way as in Example 162. As a result, it was found that every drum was provided with practically applicable desired electrophotographic characteristics.

EXAMPLE 201

The procedures of Example 164 were repeated, except that the charge injection inhibition layer forming conditions, the photoconductive layer forming conditions and the surface layer forming conditions were changed respectively as shown in Table 51, Table 69 and Table 229, and the IR absorptive layer forming conditions were changed as shown in Table 35 and Table 38, to thereby prepare multiple drums as shown in Table 259.

The resultant drums were evaluated in the same way as in Example 162. As a result, it was found that every drum was provided with practically applicable desired electrophotographic characteristics.

EXAMPLE 202

The procedures of Example 164 were repeated, except that the charge injection inhibition layer forming conditions, the photoconductive layer forming conditions and the surface layer forming conditions were changed respectively as shown in Table 51, Table 72 and Table 229, and the IR absorptive layer forming conditions were changed as shown in Table 35 and Table 38, to thereby prepare multiple drums as shown in Table 260.

The resultant drums were evaluated in the same way as in Example 162. As a result, it was found that every drum was provided with practically applicable desired electrophotographic characteristics.

EXAMPLE 203

The procedures of Example 160 were repeated, except that the charge injection inhibition layer forming conditions and the photoconductive layer forming conditions were changed as shown in Table 78 and the surface layer forming conditions were changed as shown in Table 227, to thereby prepare multiple drums as shown in Table 261.

The resultant drums were evaluated in the same way as in Example 157. As a result, it was found that every drum was provided with practically applicable desired electrophotographic characteristics.

EXAMPLE 204

The procedures of Example 164 were repeated, except that the IR absorptive layer forming conditions, the charge injection inhibition layer forming conditions and the photoconductive layer forming conditions were changed as shown in Table 80 and the surface layer forming conditions were changed as shown in Table 229, to thereby prepare multiple drums as shown in Table 262.

The resultant drums were evaluated in the same way as in Example 162. As a result, it was found that every drum was provided with practically applicable desired electrophotographic characteristics.

EXAMPLE 205

The procedures of Example 166 were repeated, except that the contact layer forming conditions, the IR absorptive layer forming conditions, the charge injection inhibition layer forming conditions and the photoconductive layer forming conditions were changed as shown in Table 82 and the surface layer forming conditions were changed as shown in Table 229, to thereby prepare multiple drums as shown in Table 263.

The resultant drums were evaluated in the same way as in Example 162. As a result, it was found that every drum was provided with practically applicable desired electrophotographic characteristics.

EXAMPLE 206

A drum having a charge injection inhibition layer, a photoconductive layer, an intermediate layer and a surface layer was prepared under the conditions shown in Table 264 and following the procedures of Example 157.

The resultant drum was evaluated in the same way as in Example 157, superiorities in the respective evaluation items were acknowledged.

EXAMPLE 207

The mirror grinded cylinders were supplied for grinding process with cutting tool having various degrees. With the patterns of FIG. 3 and various cross section patterns as described in Table 85, multiple cylinders were provided. These cylinders were set to the fabrication apparatus of FIG. 2 accordingly, and used to prepare multiple drums under the same layer forming conditions of Example 157. The resulting drums were evaluated with the same procedures as in Example 157.

As a result, it was found that every drum was provided with practically applicable desired electrophotographic characteristics.

EXAMPLE 208

The surface of mirror grinded cylinder was treated by dropping lots of bearing balls thereto to thereby form uneven shape composed of a plurality of fine dimples at the surface, and multiple cylinders having a cross section form of FIG. 4 and a cross section pattern of Table 86 were provided. These cylinders were set to the fabrication apparatus of FIG. 2 accordingly and used for the preparation of multiple drums under the same layer forming conditions of Example 157. The resulting drums were evaluated with the same procedures of Example 157.

As a result, it was found that every drum was provided with practically applicable desired electrophotographic characteristics.

EXAMPLE 209

A light receiving member for use in electrophotography having a light receiving layer disposed on an Al cylinder having a mirror grinded surface was prepared under the layer forming conditions shown in Table 265(a) and Table 265(b) using the fabrication apparatus shown in FIG. 2.

And samples were provided by forming only a surface layer on an aluminum plate and on a Si-monocrystal wafer respectively placed on the substrate holder in the same manner for forming the surface layer in the above case using the same kind fabrication apparatus as shown in FIG. 2.

For the resulting light receiving member (hereinafter this kind light receiving member is referred to as "drum"), it was set with the conventional electrophotographic copying machine, and electrophotographic characteristics such as initial electrification efficiency (initial charging efficiency), residual voltage and appearance of a ghost were examined, then decrease in the electrification efficiency, the situation of surface abrasion and increase of defective images after 1,500 thousand times repeated shots were respectively examined.

Then, the situation of an image flow on the drum under high temperature and high humidity atmosphere at 35° C. and 85% humidity was also examined.

Further, the situation of superiority or inferiority in the cleaning property of the drum in accordance with the degree of background fogginess appearing on a blank image was examined by purposely replacing the original cleaning blade by another cleaning blade having a worm edge.

In addition, the situation of breakdown voltage for the drum was observed by applying a high direct current voltage onto the drum.

Further in addition, the abrasion resistance of the drum was examined by wearing its surface using a metallic needle having a round top while applying a predetermined load thereon.

The results obtained were as shown in Table 266. As Table 266 illustrates, superiorities in the respective evaluation items, particularly of the items relative to defective image, image flow and cleaning property for the drum were acknowledged.

As for the samples, the cordination number of boron nitride contained therein was examined in accordance with EXAFS (extended X-ray absorption fine structure). As a result, it was found that there were contained tetrahedrally bonded boron nitrides and trihedrally bonded boron nitride in mingled state.

Then, as for the sample on the si-monocrystal wafer, the residual stress was observed by making stripes of □/mm in checker from on its surface and by peeling off the adhesive tape adhered thereon. As a result, it was found that the sample exceled in the residual stress.

EXAMPLE 210

The procedures of Example 209 were repeated under the conditions shown in Table 267(a) and Table 276(b) wherein $H_2$ gas is additionally used in the formation of a surface layer, to therby obtain a drum and samples. The resultant drum and samples were evaluated by the same manners as in Example 209.

The results obtained were as shown in Table 268. As Table 268 illustrates, superiorities in the respective evaluation items were acknowledged.

And as a result of examining the cordination number of boron nitride contained in each of the samples, it was found that there were contained tetrahedrally bonded boron nitride and trihedrally bonded boron nitride in mingled state.

EXAMPLE 211

The procedures of Example 209 were repeated under the same conditions as shown in the foregoing Table 265(a) and Table 265(b), except that the vias voltage of the aluminum cylinder was controlled to +100 V, to thereby obtain a drum and samples. The resultant drum and samples were evaluated by the same manners as in Example 209.

The results obtained were as shown in Table 269. As Table 269 illustrates, desirable results as those in Example 209 were acknowledged. As for the situations of tetrahedrally bonded boron nitride and trihedrally bonded boron nitride in each of the samples. It was found that both of them were contained in mingled state.

EXAMPLE 212

A drum having a charge injection inhibition layer, a photoconductive layer and a surface layer on an aluminum cylinder was prepared under the conditions shown in Table 270(a) and Table 270(b) and following the procedures of Example 209.

The resultant drum was evaluated by the same manners as in Example 209.

The results obtained were as shown in Table 271. As Table 271 illustrates, superiorities in respective evaluation items were acknowledged for the drum.

EXAMPLE 213

An aluminum cylinder was subjected to anodic oxidation to form an aluminium oxide ($Al_2O_3$) layer to be a charge injection inhibition layer thereon, and a photoconductive layer then a surface layer were continuously formed on the previously formed charge injection inhibition layer under the conditions shown in Table 272(a) and Table 272(b) following the procedures of Example 209.

The resultant drum was evaluated by the same manners as in Example 209. The results obtained were as shown in Table 273.

As Table 273 illustrates, superiorities in the respective evaluation items were acknowledged.

EXAMPLE 214

A drum having an IR absorptive layer, a photoconductive layer and a surface layer was prepared under the condition shown in Table 274(a) and Table 274(b) and following the procedures of Example 209.

In addition, the drum was set with the conventional electrophotographic copying machine using a semiconductor laser beam of 785 nm in wavelength as the light source for image exposure in order to examine whether an infringe pattern appears or not on an image to be made.

The results obtained were as shown in Table 275. As Table 275 illustrates, superiorities in the respective evaluation items were acknowledged, and it was found that many infringe pattern did not appear on an image to be made.

EXAMPLE 215

A drum having a contact layer, a photoconductive layer and a surface layer was prepared under the conditions shown in Table 276(a) and Table 276(b) and following the procedures of Example 209.

The resultant drum was evaluated by the same manners as in Example 209. The results obtained were as shown in Table 277.

As Table 277 illustrates, superiorities in the respective evaluation items were acknowledged.

EXAMPLE 216

A drum having an IR absorptive layer, a charge injection inhibition layer, a photoconductive layer and a surface layer was prepared under the conditions shown in Table 278(a) and Table 278(b) and following the procedures of Example 209. The resultant drum was evaluated in the same way as in Example 214. The results obtained were as shown in Table 279. As Table 279 illustrates, superiorities in the respective evaluation items were acknowledged.

EXAMPLE 217

A drum having a contact layer, a charge injection inhibition layer, a photoconductive layer and a surface layer was prepared under the conditions shown in Table 280(a) and Table 280(b) and following the procedures of Example 209. The resultant drum was evaluated in the same way as in Example 209. The results obtained were as shown in Table 281.

As Table 281 illustrates, superiorities in the respective evaluation items were acknowledged.

EXAMPLE 218

A drum having a contact layer, an IR absorptive layer, a charge injection inhibition layer, a photoconductive layer and a surface layer was prepared under the conditions shown in Table 282(a) and Table 282(b) and following the procedures of Example 209. The resultant drum was evaluated in the same way as in Example 214. The results obtained were as shown in Table 283. As Table 283 illustrates, superiorities in the respective evaluation items were acknowledged.

EXAMPLE 219

The procedures of Example 209 were repeated, except that the photoconductive layer forming conditions were changed as shown in Table 284, to thereby prepare multiple drum.

The resultant drums were evaluated in the same way as in Example 209. As a result, it was found that every drum was provided with practically applicable desired electrophotographic characteristics.

EXAMPLE 220

The procedures of Example 210 were repeated, except that the photoconductive layer forming conditions were changed as shown in Table 285, to thereby prepare multiple drums.

The resultant drums were evaluated in the same way as in Example 209. As a result, it was found that every drum was provided with practically applicable desired electrophotographic characteristics.

EXAMPLE 221

The procedures of Example 211 was repeated, except that the photoconductive layer forming conditions were changed as shown in Table 286, to thereby prepare multiple drums.

The resultant drums were evaluated in the same way as in Example 209. As a result, it was found that every drum was provided with practically applicable desired electrophotograhic characteristics.

EXAMPLE 222

The procedures of Example 212 were repeated, except that the charge injection inhibition layer forming conditions were changed as shown in Table 287, to thereby prepare multiple drums.

The resultant drums were evaluated in the same way as in Example 209. As a result, it was found that every drum was provided with practically applicable desired electrophotographic characteristics.

EXAMPLE 223

The procedures of Example 212 were repeated, except that the charge injection inhibition layer forming conditions and the photoconductive layer forming conditions were changed respectively as shown in Table 24 and Table 25, to thereby prepare multiple drums as shown in Table 288.

The resultant drums were evaluated in the same way as in Example 209. As a result, it was found that every drum was provided with practically applicable desired electrophotographic characteristics.

EXAMPLE 224

The procedures of Example 212 were repeated, except that the charge injection inhibition layer forming conditions, the photoconductive layer forming conditions and the surface layer forming conditions were changed respectively as shown in Table 24, Table 27 and Table 289, to thereby prepare multiple drums as shown in Table 290.

The resultant drums were evaluated in the same way as in Example 209. As a result, it was found that every drum was provided with practically applicable desired electrophotographic characteristics.

EXAMPLE 225

The procedures of Example 212 were repeated, except that the charge injection inhibition layer forming conditions, the photoconductive layer forming conditions and the surface layer forming conditions were changed respectively as shown in Table 24, Table 27 and Table 291, to thereby prepare multiple drums as shown in Table 292.

The resultant drums were evaluated in the same way as in Example 209. As a result, it was found that every drum was provided with practically applicable desired electrophotographic characteristics.

EXAMPLE 226

The procedures of Example 213 were repeated, except that the photoconductive layer forming conditions were changed as shown in Table 25, to thereby prepare multiple drums as shown in Table 293.

The resultant drums were evaluated in the same way as in Example 209. As a result, it was found that every drum was provided with practically applicable desired electrophotographic characteristics.

EXAMPLE 227

The procedures of Example 213 were repeated, except that the photoconductive layer forming conditions and the surface layer forming conditions were changed respectively as shown in Table 27 and Table 289, to thereby prepare multiple drums as shown in Table 294.

The resultant drums were evaluated in the same way as in Example 209. As a result, it was found that every drum was provided with practically applicable desired electrophotographic characteristics.

EXAMPLE 228

The procedures of Example 213 were repeated, except that the photoconductive layer forming conditions and the surface layer forming conditions were changed respectively as shown in Table 27 and Table 291, to thereby prepare multiple drums as shown in Table 295.

The resultant drums were evaluated in the same way as in Example 209. As a result, it was found that every drum was provided with practically applicable desired electrophotographic characteristics.

EXAMPLE 229

The procedures of Example 214 were repeated, except that the IR absorptive layer forming conditions were changed as shown in Table 35 and Table 36, to thereby prepare multiple drums as shown in Table 296.

The resultant drums were evaluated in the same way as in Example 214. As a result, it was found that every drum was provided with practically applicable desired electrophotographic characteristics.

EXAMPLE 230

The procedures of Example 214 were repeated, except that the IR absorptive layer forming conditions were changed as shown in Table 35 and Table 38 and the photoconductive layer forming conditions were changed as shown in Table 25, to thereby prepare multiple drums as shown in Table 297.

The resultant drums were evaluated in the same way as in Example 214. As a result, it was found that every drum was provided with practically applicable desired electrophotographic characteristics.

EXAMPLE 231

The procedures of Example 214 were repeated, except that the IR absorptive layer forming conditions were changed as shown in Table 35 and Table 38, and the photoconductive layer forming conditions and the surface layer forming conditions were changed respectively as shown in Table 27 and Table 289, to thereby prepare multiple drums as shown in Table 298.

The resultant drums were evaluated in the same way as in Example 214. As a result, it was found that every drum was provided with practically applicable desired electrophotographic characteristics.

EXAMPLE 232

The procedures of Example 214 were repeated, except that the IR absorptive layer forming conditions were changed as shown in Table 35 and Table 38, and the photoconductive layer forming conditions and the surface layer forming conditions were changed respectively as shown in Table 27 and Table 291. to thereby prepare multiple drums as shown in Table 299.

The resultant drums were evaluated in the same way as in Example 214. As a result, it was found that every drum was provided with practically applicable desired electrophotographic characteristics.

EXAMPLE 233

The procedures of Example 215 were repeated, except that the contact layer forming conditions were changed as shown in Table 42, to thereby prepare multiple drums as shown in Table 300.

The resultant drums were evaluated in the same way as in Example 209. As a result, it was found that every drum was provided with practically applicable desired electrophotographic characteristics.

EXAMPLE 234

The procedures of Example 215 were repeated, except that the contact layer forming conditions and the photoconductive layer forming conditions were changed respectively as shown in Table 44 and Table 25, to thereby prepare multiple drums as shown in Table 301.

The resultant drums were evaluated in the same way as in Example 209. As a result, it was found that every drum was provided with practically applicable desired electrophotographic characteristics.

EXAMPLE 235

The procedures of Example 215 were repeated, except that the contact layer forming conditions, photoconductive layer forming conditions and the surface layer forming conditions were changed respectively as shown in Table 44, Table 27 and Table 289, to thereby prepare multiple drums as shown in Table 302.

The resultant drums were evaluated in the same way as in Example 209. As a result, it was found that every drum was provided with practically applicable desired electophotographic characteristics.

EXAMPLE 236

The procedures of Example 215 were repeated except that the contact layer forming conditions, photoconductive layer forming conditions and the surface layer forming conditions were changed respectively as shown in Table 44, Table 27 and Table 291, to thereby prepare multiple drums as shown in Table 303.

The resultant drums were evaluated in the same way as in Example 209. As a result, it was found that every drum was provided with practically applicable desired electrophotographic characteristics.

EXAMPLE 237

The procedures of Example 216 were repeated, except that the IR absorptive layer forming conditions were changed as shown in Table 35 and Table 36, to thereby prepare multiple drums as shown in Table 304.

The resultant drums were evaluated in the same way as in Example 214. As a result, it was found that every drum was provided with practically applicable desired electrophotographic characteristics.

EXAMPLE 238

The procedures of Example 216 were repeated, except that the charge injection inhibition layer forming conditions were changed as shown in Table 49 and the IR absorptive layer forming conditions were changed as shown in Table 35 and Table 38, to thereby prepare multiple drums as shown in Table 305.

The resultant drums were evaluated in the same way as in Example 214. As a result, it was found that every drum was provided with practically applicable desired electrophotographic characteristics.

EXAMPLE 239

The procedures of Example 216 were repeated, except that the charge injection inhibition layer forming conditions and the surface layer forming conditions were changed respectively as shown in Table 51 and Table 289, and the IR absorptive layer forming conditions were changed as shown in Table 35 and Table 38, to thereby prepare multiple drums as shown in Table 306.

The resultant drums were evaluated in the same way as in Example 214. As a result, it was found that every drum was provided with practically applicable desired electrophotographic characteristics.

EXAMPLE 240

The procedures of Example 216 were repeated, except that the charge injection inhibition layer forming conditions and the surface layer forming conditions were changed respectively as shown in Table 51 and Table 291, and the IR absorptive layer forming conditions were changed as shown in Table 35 and Table 38, to thereby prepare multiple drums as shown in Table 307.

The resultant drums were evaluated in the same way as in Example 214. As a result, it was found that every drum was provided with practically applicable desired electrophotographic characteristics.

EXAMPLE 241

The procedures of Example 217 were repeated, except that the contact layer forming conditions were changed as shown in Table 44 and Table 54, to thereby prepare multiple drums as shown in Table 308.

The resultant drums were evaluated in the same way as in Example 209. As a result, it was found that every drum was provided with practically applicable desired electrophotographic characteristics.

EXAMPLE 242

The procedures of Example 217 were repeated, except that the charge injection inhibition layer forming conditions were changed as shown in Table 56, and the contact layer forming conditions were changed as shown in Table 44 and Table 57, to thereby prepare multiple drums as shown in Table 309.

The resultant drums were evaluated in the same way as in Example 209. As a result, it was found that every drum was provided with practically applicable desired electrophotographic characteristics.

EXAMPLE 243

The procedures of Example 217 were repeated, except that the charge injection inhibition layer forming conditions and the surface layer forming conditions were changed respectively as shown in Table 24 and Table 289, and the contact layer forming conditions were changed as shown in Table 44 and Table 57, to thereby prepare multiple drums as shown in Table 310.

The resultant drums were evaluated in the same way as in Example 209. As a result, it was found that every drum was provided with practically applicable desired electrophotographic characteristics.

EXAMPLE 244

The procedures of Example 217 were repeated, except that the charge injection inhibition layer forming conditions and the surface layer forming conditions were changed respectively as shown in Table 24 and Table 30, and the contact layer forming conditions were changed as shown in Table 44 and Table 57, to thereby prepare multiple drums as shown in Table 311.

The resultant drums were evaluated in the same way as in Example 209. As a result, it was found that every drum was provided with practically applicable desired electrophotographic characteristics.

EXAMPLE 245

The procedures of Example 218 were repeated, except that the charge injection inhibition layer forming conditions were changed as shown in Table 61, to thereby prepare multiple drums as shown in Table 312.

The resultant drums were evaluated in the same way as in Example 214. As a result, it was found that every drum was provided with practically applicable desired electrophotographic characteristics.

EXAMPLE 246

The procedures of Example 218 were repeated, except that the charge injection inhibition layer forming and Table 25, to thereby prepare multiple drums as shown in Table 288.

The resultant drums were evaluated in the same way as in Example 209. As a result, it was found that every drum was provided with practically applicable desired electrophotographic characteristics.

EXAMPLE 224

The procedures of Example 212 were repeated, except that the charge injection inhibition layer forming conditions, the photoconductive layer forming conditions and the surface layer forming conditions were changed respectively as shown in Table 24, Table 27 and Table 289, to thereby prepare multiple drums as shown in Table 290.

The resultant drums were evaluated in the same way as in Example 209. As a result, it was found that every drum was provided with practically applicable desired electrophotographic characteristics.

EXAMPLE 225

The procedures of Example 212 were repeated, except that the charge injection inhibition layer forming conditions, the photoconductive layer forming conditions and the surface layer forming conditions were changed respectively as shown in Table 24, Table 27 and Table 291, to thereby prepare multiple drums as shown in Table 292.

The resultant drums were evaluated in the same way as in Example 209. As a result, it was found that every drum was provided with practically applicable desired electrophotographic characteristics.

EXAMPLE 226

The procedures of Example 213 were repeated, except that the photoconductive layer forming conditions were changed as shown in Table 25, to thereby prepare multiple drums as shown in Table 293.

The resultant drums were evaluated in the same way as in Example 209. As a result, it was found that every drum was provided with practically applicable desired electrophotographic characteristics.

EXAMPLE 227

The procedures of Example 213 were repeated, except that the photoconductive layer forming conditions and the surface layer forming conditions were changed respectively as shown in Table 27 and Table 289, to thereby prepare multiple drums as shown in Table 294.

The resultant drums were evaluated in the same way as in Example 209. As a result, it was found that every drum was provided with practically applicable desired electrophotographic characteristics.

EXAMPLE 228

The procedures of Example 213 were repeated, except that the photoconductive layer forming conditions and the surface layer forming conditions were changed respectively as shown in Table 27 and Table 291, to thereby prepare multiple drums as shown in Table 295.

The resultant drums were evaluated in the same way as in Example 209. As a result, it was found that every drum was provided with practically applicable desired electrophotographic characteristics.

EXAMPLE 229

The procedures of Example 214 were repeated, except that the IR absorptive layer forming conditions were changed as shown in Table 35 and Table 36, to thereby prepare multiple drums as shown in Table 296.

The resultant drums were evaluated in the same way as in Example 214. As a result, it was found that every drum was provided with practically applicable desired electrophotographic characteristics.

EXAMPLE 230

The procedures of Example 214 were repeated, except that the IR absorptive layer forming conditions were changed as shown in Table 35 and Table 38 and the photoconductive layer forming conditions were changed as shown in Table 25, to thereby prepare multiple drums as shown in Table 297.

The resultant drums were evaluated in the same way as in Example 214. As a result, it was found that every drum was provided with practically applicable desired electrophotographic characteristics.

EXAMPLE 231

The procedures of Example 214 were repeated, except that the IR absorptive layer forming conditions were changed as shown in Table 35 and Table 38, and the photoconductive layer forming conditions and the surface layer forming conditions were changed respectively as shown in Table 27 and Table 289, to thereby prepare multiple drums as shown in Table 298.

The resultant drums were evaluated in the same way as in Example 214. As a result, it was found that every drum was provided with practically applicable desired electrophotographic characteristics.

EXAMPLE 232

The procedures of Example 214 were repeated, except that the IR absorptive layer forming conditions were changed as shown in Table 35 and Table 38, and the photoconductive layer forming conditions and the surface layer forming conditions were changed respectively as shown in Table 27 and Table 291. to thereby prepare multiple drums as shown in Table 299.

The resultant drums were evaluated in the same way as in Example 214. As a result, it was found that every drum was provided with practically applicable desired electrophotographic characteristics.

EXAMPLE 233

The procedures of Example 215 were repeated, except that the contact layer forming conditions were changed as shown in Table 42, to thereby prepare multiple drums as shown in Table 300.

The resultant drums were evaluated in the same way as in Example 209. As a result, it was found that every drum was provided with practically applicable desired electrophotographic characteristics.

EXAMPLE 234

The procedures of Example 215 were repeated, except that the contact layer forming conditions and the photoconductive layer forming conditions were changed respectively as shown in Table 44 and Table 25, to thereby prepare multiple drums as shown in Table 301.

The resultant drums were evaluated in the same way as in Example 209. As a result, it was found that every drum was provided with practically applicable desired electrophotographic characteristics.

EXAMPLE 235

The procedures of Example 215 were repeated, except that the contact layer forming conditions, photoconductive layer forming conditions and the surface layer forming conditions were changed respectively as shown in Table 44, Table 27 and Table 289, to thereby prepare multiple drums as shown in Table 302.

The resultant drums were evaluated in the same way as in Example 209. As a result, it was found that every drum was provided with practically applicable desired electophotographic characteristics.

EXAMPLE 236

The procedures of Example 215 were repeated except that the contact layer forming conditions, photoconductive layer forming conditions and the surface layer forming conditions were changed respectively as shown in Table 44, Table 27 and Table 291, to thereby prepare multiple drums as shown in Table 303.

The resultant drums were evaluated in the same way as in Example 209. As a result, it was found that every drum was provided with practically applicable desired electrophotographic characteristics.

EXAMPLE 237

The procedures of Example 216 were repeated, except that the IR absorptive layer forming conditions were changed as shown in Table 35 and Table 36, to thereby prepare multiple drums as shown in Table 304.

The resultant drums were evaluated in the same way as in Example 214. As a result, it was found that every drum was provided with practically applicable desired electrophotographic characteristics.

EXAMPLE 238

The procedures of Example 216 were repeated, except that the charge injection inhibition layer forming conditions were changed as shown in Table 49 and the IR absorptive layer forming conditions were changed as shown in Table 35 and Table 38, to thereby prepare multiple drums as shown in Table 305.

The resultant drums were evaluated in the same way as in Example 214. As a result, it was found that every drum was provided with practically applicable desired electrophotographic characteristics.

EXAMPLE 239

The procedures of Example 216 were repeated, except that the charge injection inhibition layer forming conditions and the surface layer forming conditions were changed respectively as shown in Table 51 and Table 289, and the IR absorptive layer forming conditions were changed as shown in Table 35 and Table 38, to thereby prepare multiple drums as shown in Table 306.

The resultant drums were evaluated in the same way as in Example 214. As a result, it was found that every drum was provided with practically applicable desired electrophotographic characteristics.

EXAMPLE 240

The procedures of Example 216 were repeated, except that the charge injection inhibition layer forming conditions and the surface layer forming conditions were changed respectively as shown in Table 51 and Table 291, and the IR absorptive layer forming conditions were changed as shown in Table 35 and Table 38, to thereby prepare multiple drums as shown in Table 307.

The resultant drums were evaluated in the same way as in Example 214. As a result, it was found that every drum was provided with practically applicable desired electrophotographic characteristics.

EXAMPLE 241

The procedures of Example 217 were repeated, except that the contact layer forming conditions were changed as shown in Table 44 and Table 54, to thereby prepare multiple drums as shown in Table 308.

The resultant drums were evaluated in the same way as in Example 209. As a result, it was found that every drum was provided with practically applicable desired electrophotographic characteristics.

EXAMPLE 242

The procedures of Example 217 were repeated, except that the charge injection inhibition layer forming conditions were changed as shown in Table 56, and the contact layer forming conditions were changed as shown in Table 44 and Table 57, to thereby prepare multiple drums as shown in Table 309.

The resultant drums were evaluated in the same way as in Example 209. As a result, it was found that every drum was provided with practically applicable desired electrophotographic characteristics.

EXAMPLE 243

The procedures of Example 217 were repeated, except that the charge injection inhibition layer forming conditions and the surface layer forming conditions were changed respectively as shown in Table 24 and Table 289, and the contact layer forming conditions were changed as shown in Table 44 and Table 57, to thereby prepare multiple drums as shown in Table 310.

The resultant drums were evaluated in the same way as in Example 209. As a result, it was found that every drum was provided with practically applicable desired electrophotographic characteristics.

EXAMPLE 244

The procedures of Example 217 were repeated, except that the charge injection inhibition layer forming conditions and the surface layer forming conditions were changed respectively as shown in Table 24 and Table 30, and the contact layer forming conditions were changed as shown in Table 44 and Table 57, to thereby prepare multiple drums as shown in Table 311.

The resultant drums were evaluated in the same way as in Example 209. As a result, it was found that every drum was provided with practically applicable desired electrophotographic characteristics.

EXAMPLE 245

The procedures of Example 218 were repeated, except that the charge injection inhibition layer forming conditions were changed as shown in Table 61, to thereby prepare multiple drums as shown in Table 312.

The resultant drums were evaluated in the same way as in Example 214. As a result, it was found that every drum was provided with practically applicable desired electrophotographic characteristics.

EXAMPLE 246

The procedures of Example 218 were repeated, except that the charge injection inhibition layer forming conditions and the photoconductive layer forming conditions were changed respectively as shown in Table 64 and Table 63, to thereby prepare multiple drums as shown in Table 313.

The resultant drums were evaluated in the same way as in Example 214. As a result, it was found that every drum was provided with practically applicable desired electrophotographic characteristics.

EXAMPLE 247

The procedures of Example 218 were repeated, except that the charge injection inhibition layer forming conditions, the photoconductive layer forming conditions and the surface layer forming conditions were changed respectively as shown in Table 64, Table 66 and Table 281, to thereby prepare multiple drums as shown in Table 314. The resultant drums were evaluated in the same way as in Example 214. As a result, it was found that every drum was provided with practically applicable desired electrophotographic characteristics.

EXAMPLE 248

The procedures of Example 218 were repeated, except that the charge injection inhibition layer forming conditions, the photoconductive layer forming conditions and the surface layer forming conditions were changed respectively as shown in Table 64, Table 66 and Table 291, to thereby prepare multiple drums as shown in Table 315. The resultant drums were evaluated in the same way as in Example 214. As a result, it was found that every drum was provided with practically applicable desired electrophotographic characteristics.

EXAMPLE 249

The procedures of Example 216 were repeated, except that the charge injection inhibition layer forming conditions, the photoconductive layer forming conditions and the surface layer forming conditions were changed respectively as shown in Table 51, Table 69 and Table 316, and the IR absorptive layer forming conditions were changed as shown in Table 35 and Table 38, to thereby prepare multiple drums as shown in Table 317.

The resultant drums were evaluated in the same way as in Example 214. As a result, it was found that every drum was provided with practically applicable desired electrophotographic characteristics.

EXAMPLE 250

The procedures of Example 216 were repeated, except that the charge injection inhibition layer forming conditions, the photoconductive layer forming conditions and the surface layer forming conditions were changed respectively as shown in Table 51, Table 72 and Table 316, and the IR absorptive layer forming conditions were changed as shown in Table 35 and Table 38, to thereby prepare multiple drums as shown in Table 318.

The resultant drums were evaluated in the same way as in Example 214. As a result, it was found that every drum was provided with practically applicable desired electrophotographic characteristics.

EXAMPLE 251

The procedures of Example 216 were repeated, except that the charge injection inhibition layer forming conditions, the photoconductive layer forming conditions and the surface layer forming conditions were changed respectively as shown in Table 51, Table 69 and Table 289, and the IR absorptive layer forming conditions were changed as shown in Table 35 and Table 38, to thereby prepare multiple drums as shown in Table 319.

The resultant drums were evaluated in the same way as in Example 214. As a result, it was found that every drum was provided with practically applicable desired electrophotographic characteristics.

EXAMPLE 252

The procedures of Example 216 were repeated, except that the charge injection inhibition layer forming conditions, the photoconductive layer forming conditions and the surface layer forming conditions were changed respectively as shown in Table 51, Table 72 and Table 289, and the IR absorptive layer forming conditions were changed as shown in Table 35 and Table 38, to thereby prepare multiple drums as shown in Table 320.

The resultant drums were evaluated in the same way as in Example 214. As a result, it was found that every drum was provided with practically applicable desired electrophotographic characteristics.

EXAMPLE 253

The procedures of Example 216 were repeated, except that the charge injection inhibition layer forming conditions, the photoconductive layer forming conditions and the surface layer forming conditions were changed respectively as shown in Table 51, Table 69 and Table 291, and the IR absorptive layer forming conditions were changed as shown in Table 35 and Table 38, to thereby prepare multiple drums as shown in Table 321.

The resultant drums were evaluated in the same way as in Example 214. As a result, it was found that every drum was provided with practically applicable desired electrophotographic characteristics.

EXAMPLE 254

The procedures of Example 216 were repeated, except that the charge injection inhibition layer forming conditions, the photoconductive layer forming conditions and the surface layer forming conditions were changed respectively as shown in Table 51, Table 72 and Table 291, and the IR absorptive layer forming conditions were changed as shown in Table 35 and Table 38, to thereby prepare multiple drums as shown in Table 322.

The resultant drums were evaluated in the same way as in Example 214. As a result, it was found that every drum was provided with practically applicable desired electrophotographic characteristics.

EXAMPLE 255

The procedures of Example 212 were repeated, except that the charge injection inhibition layer forming conditions and the photoconductive layer forming conditions were changed as shown in Table 78 and the surface layer forming conditions were changed as shown in Table 291, to thereby prepare multiple drums as shown in Table 323.

The resultant drums were evaluated in the same way as in Example 209. As a result, it was found that every drum was provided with practically applicable desired electophotographic characteristics.

EXAMPLE 256

The procedures of Example 216 were repeated, except that the IR absorptive layer forming conditions, the charge injection inhibition layer forming conditions and the photoconductive layer forming conditions were changed as shown in Table 80 and the surface layer forming conditions were changed as shown in Table 291, to thereby prepare multiple drums as shown in Table 324.

The resultant drums were evaluated in the same way as in Example 214. As a result, it was found that every drum was provided with practically applicable desired electrophotographic characteristics.

EXAMPLE 257

The procedures of Example 218 were repeated, except that the contact layer forming conditions, the IR absorptive layer forming conditions, the charge injection inhibition layer forming conditions and the photoconductive layer forming conditions were changed as shown in Table 82 and the surface layer forming conditions were changed as shown in Table 291, to thereby prepare multiple drums as shown in Table 325.

The resultant drums were evaluated in the same way as in Example 214. As a result, it was found that every drum was provided with practically applicable desired electrophotographic characteristics.

EXAMPLE 258

A drum having a charge injection inhibition layer, a photoconductive layer, an intermediate layer and a surface layer was prepared under the conditions shown in Table 326 and following the procedures of Example 209.

The resultant drum was evaluated in the same way as in Example 209, As a result superiorities in the respective evaluation items were acknowledged.

EXAMPLE 259

The mirror grinded cylinders were supplied for grinding process with cutting tool having various degrees. With the patterns of FIG. 3 and various cross section patterns as described in Table 85, multiple cylinders were provided. These cylinders were set to the fabrication apparatus of FIG. 2 accordingly, and used to prepare multiple drums under the same layer forming conditions of Example 209. The resulting drums were evaluated with the same procedures as in Example 209.

As a result, it was found that every drum was provided with practically applicable desired electrophotographic characteristics.

EXAMPLE 260

The surface of mirror grinded cylinder was treated by dropping lots of bearing balls thereto to thereby form uneven shape composed of a plurality of fine dimples at the surface, and multiple cylinders having a cross section form of FIG. 4 and of a cross section pattern of Table 86 were provided. These cylinders were set to the fabrication apparatus of FIG. 2 accordingly and used for the preparation of multiple drums under the same layer forming conditions of Example 209. The resulting drums were evaluated with the same procedures of Example 209.

As a result, it was found that every drum was provided with practically applicable desired electrophotographic characteristics.

EXAMPLE 261

A light receiving member for use in electrophotography having a light receiving layer disposed on an Al cylinder having a mirror grinded surface was prepared under the layer forming conditions shown in Table 327(a) and Table 327(b) using the fabrication apparatus shown in FIG. 2.

And samples were provided by forming only a surface layer comprising an upper layer and a lower layer on the aluminum plate and on a Si-monocrystal wafer respectively placed on the substrate holder in the same manner for forming the surface layer in the above case using the same kind fabrication apparatus as shown in FIG. 2.

For the resulting light receiving member (hereinafter this kind light receiving member is referred to as "drum"), it was set with the conventional electrophotographic copying machine, and electrophotographic characteristics such as initial electrification efficiency (initial charging efficiency), residual voltage and appearance of a ghost were examined, then decrease in the electrification efficiency, the situation of surface abration and increase of defective images after 1,500 thousand times repeated shots were respectively examined.

Then, the situation of an image flow on the drum under high temperature and high humidity atmosphere at 35° C. and 85% humidity was also examined.

Further, the situation of superiority or inferiority in the cleaning property of the drum in accordance with the degree of background fogginess appearing on a blank image was examined by purposely replacing the original cleaning blade by another cleaning blade having a worn edge.

In addition, the situation of breakdown voltage for the drum was observed by applying a high direct current voltage onto the drum.

Further in addition, the abrasion resistance of the drum was examined by wearing its surface using a metallic needle having a round top while applying a predetermined load thereon.

The results obtained were as shown in Table 328. As Table 328 illustrates, superiorities in the respective evaluation items, particularly of the items relative to defective image, image flow abrasion registance, breakdown voltage and cleaning property for the drum were acknowledged.

As for each of the samples, the cordination number of boron nitride contained in each of the upper layer and the lower layer was examined in accordance with EXAFS (extended X-ray absorption fine structure). As a result, it was found that there were contained tetrahedrally bonded boron nitride and trihedrally bonded boron nitride in mingled state in the upper layer and there was contained tetrahedrally bonded boron nitride in the lower layer.

EXAMPLE 262

The procedures of Example 261 were repeated under the conditions shown in Table 329(a) and Table 329(b) wherein $H_2$ gas is additionally used in the formation of a surface layer to thereby obtain a drum and samples. The resultant drum and samples were evaluated by the same manners as in Example 261.

The results obtained were as shown in Table 330. As Table 330 illustrates, superiorities in the respective evaluation items were acknowledged.

And as a result of examining a cordination number of boron nitride contained in each of the samples, it was found that there were contained tetrahedrally bonded boron nitride and trihedrally bonded boron nitride in mingled state in the upper layer and there was contained tetrahedrally bonded boron nitride in the lower layer.

EXAMPLE 263

The procedures of Example 261 were repeated, except that the vias voltage of the cylinder in the case of forming a lower layer and the vias voltage in the case of forming an upper layer were controlled to be −150 V and +100 V respectively at the time of forming a surface layer, to thereby prepare a drum and samples.

The resultant drum and samples were evaluated by the same manners as in Example 261.

The results obtained were shown in Table 331. As Table 331 illustrates, desirable results as those in Example 261 were acknowledged. As for the situation of tetrahedrally bonded boron nitride and trihedrally bonded boron nitride in each of the samples, it was found that there were contained trihedrally bonded boron nitride and tetrahedrally bonded boron nitride in mingled state in the upper layer and there was contained tetrahedrally bonded boron nitride in the lower layer.

EXAMPLE 264

A drum having a charge injection inhibition layer, a photoconductive layer and a surface layer on an aluminum cylinder was prepared under the conditions shown in Table 332(a) and Table 332(b) and following the procedures of Example 261.

The resultant drum was evaluated by the same manners as in Example 261.

The results obtained were as shown in Table 333. As Table 333 illustrates, superiorities in respective evaluation items were acknowledged for the drum.

EXAMPLE 265

An aluminum cylinder was subjected to anodic oxidation to form an aluminum oxide ($Al_2O_3$) layer to be a charge injection inhibition layer thereon, and a photoconductive layer then a surface layer were continuously formed on the previously formed charge injection inhibition layer under the conditions shown in Table 334(a) and Table 334(b) following the procedure of Example 261.

The resultant drum was evaluated by the same manners as in Example 261. The results obtained were as shown in Table 335.

As Table 335 illustrates, superiorities in the respective evaluation items were acknowledged.

EXAMPLE 266

A drum having an IR absorptive layer, a photoconductive layer and a surface layer was prepared under the condition shown in Table 336(a) and Table (b) and following the procedures of Example 261.

The resultant drum was evaluated by the same manners as in Example 261.

In addition, the drum was set with the conventional electrophotographic copying machine using a semiconductor laser beam of 785 nm in wavelength as the light source for image exposure in order to examine whether an infringe pattern appears or not on an image to be made.

The results obtained were as shown in Table 337. As Table 337 illustrates, superiorities in the respective evaluation items were acknowledged, and it was found that any infringe pattern did not appear on an image to be made.

EXAMPLE 267

A drum having a contact layer, a photoconductive layer and a surface layer was prepared under the conditions shown in Table 338(a) and Table 338(b) and following the procedures of Example 261.

The resultant drum was evaluated by the same manners as in Example 261. The results obtained were as shown in Table 339.

As Table 339 illustrates, superiorities in the respective evaluation items were acknowledged.

EXAMPLE 268

A drum having an IR absorptive layer, a charge injection inhibition layer, a photoconductive layer and a surface layer was prepared under the conditions shown in Table 340(a) and Table 340(b) and following the procedures of Example 261. The resultant drum was evaluated in the same way as in Example 266. The results obtained were as shown in Table 341. As Table 341 illustrates, superiorities in the respective evaluation items were acknowledged.

EXAMPLE 269

A drum having a contact layer, a charge injection inhibition layer, a photoconductive layer and a surface layer were prepared under the conditions shown in Table 342(a) and Table 342(b) and following the procedures of Example 261. The resultant drum was evaluated in the same way as in Example 261. The results obtained were as shown in Table 343.

As Table 343 illustrates, superiorities in the respective evaluation items were acknowledged.

EXAMPLE 270

A drum having a contact layer, an IR absorptive layer, a charge injection inhibition layer, a photoconductive layer and a surface layer was prepared under the conditions shown in Table 344(a) and Table 344(b) and following the procedures of Example 261. The resultant drum was evaluated in the same way as in Example 266. The results obtained were as shown in Table 345. As Table 345 illustrates, superiorities in the respective evaluation items were acknowledged.

EXAMPLE 271

The procedures of Example 261 were repeated, except that the photoconductive layer forming conditions were changed as shown in Table 346, to thereby prepare multiple drums.

The resultant drums were evaluated in the same way as in Example 261. As a result, it was found that every drum was provided with practically applicable desired electrophotographic characteristics.

EXAMPLE 272

The procedures of Example 262 were repeated, except that the photoconductive layer forming conditions were changed as shown in Table 347, to thereby prepare multiple drums.

The resultant drums were evaluated in the same way as in Example 261. As a result, it was found that every drum was provided with practically applicable desired electrophotographic characteristics.

EXAMPLE 273

The procedures of Example 263 were repeated, except that the photoconductive layer forming conditions were changed as shown in Table 348, to thereby prepare multiple drums.

The resultant drums were evaluated in the same way as in Example 261. As a result, it was found that every drum was provided with practically applicable desired electrophotographic characteristics.

EXAMPLE 274

The procedures of Example 264 were repeated, except that the charge injection inhibition layer forming conditions were changed as shown in Table 349, to thereby prepare multiple drums.

The resultant drums were evaluated in the same way as in Example 261. As a result, it was found that every drum was provided with practically applicable desired electrophotographic characteristics.

EXAMPLE 275

The procedures of Example 264 were repeated, except that the charge injection inhibition layer forming conditions and the photoconductive layer forming conditions were changed respectively as shown in Table 24 and Table 25, to thereby prepare multiple drums as shown in Table 350.

The resultant drums were evaluated in the same way as in Example 261. As a result, it was found that every drum was provided with practically applicable desired electrophotographic characteristics.

EXAMPLE 276

The procedures of Example 264 were repeated, except that the charge injection inhibition layer forming conditions, the photoconductive layer forming conditions and the surface layer forming conditions were changed respectively as shown in Table 24. Table 27 and Table 351, to thereby prepare multiple drums as shown in Table 352.

The resultant drums were evaluated in the same way as in Example 261. As a result, it was found that every drum was provided with practically applicable desired electrophotographic characteristics.

EXAMPLE 277

The procedures of Example 264 were repeated, except that the charge injection inhibition layer forming conditions, the photoconductive layer forming conditions and the surface layer forming conditions were changed respectively as shown in Table 24, Table 27 and Table 353, to thereby prepare multiple drums as shown in Table 354.

The resultant drums were evaluated in the same way as in Example 261. As a result, it was found that every drum was provided with practically applicable desired electrophotographic characteristics.

EXAMPLE 278

The procedures of Example 265 were repeated, except that the photoconductive layer forming conditions were changed as shown in Table 25, to thereby prepare multiple drums as shown in Table 354.

The resultant drums were evaluated in the same way as in Example 261. As a result, it was found that every drum was provided with practically applicable desired electrophotographic characteristics.

EXAMPLE 279

The procedures of Example 265 were repeated, except that the photoconductive layer forming conditions and the surface layer forming conditions were changed respectively as shown in Table 27 and Table 351, to thereby prepare multiple drums as shown in Table 356.

The resultant drums were evaluated in the same way as in Example 261. As a result, it was found that every drum was provided with practically applicable desired electrophotographic characteristics.

EXAMPLE 280

The procedures of Example 265 were repeated, except that the photoconductive layer forming conditions and the surface layer forming conditions were changed respectively as shown in Table 27 and Table 353, to thereby prepare multiple drums as shown in Table 357.

The resultant drums were evaluated in the same way as in Example 261. As a result, it was found that every drum was provided with practically applicable desired electrophotographic characteristics.

EXAMPLE 281

The procedures of Example 266 were repeated, except that the IR absorptive layer forming conditions were changed as shown in Table 35 and Table 36, to thereby prepare multiple drums as shown in Table 358.

The resultant drums were evaluated in the same way as in Example 266. As a result, it was found that every drum was provided with practically applicable desired electrophotographic characteristics.

EXAMPLE 282

The procedures of Example 266 were repeated, except that the IR absorptive layer forming conditions were changed as shown in Table 35 and Table 38 and the photoconductive layer forming conditions were changed as shown in Table 25, to thereby prepare multiple drums as shown in Table 359.

The resultant drums were evaluated in the same way as in Example 266. As a result, it was found that every drum was provided with practically applicable desired electrophotographic characteristics.

EXAMPLE 283

The procedures of Example 266 were repeated, except that the IR absorptive layer forming conditions were changed as shown in Table 35 and Table 38, and the photoconductive layer forming conditions and the surface layer forming conditions were changed respectively as shown in Table 27 and Table 351, to thereby prepare multiple drums as shown in Table 360.

The resultant drums were evaluated in the same way as in Example 266. As a result, it was found that every drum was provided with practically applicable desired electrophotographic characteristics.

EXAMPLE 284

The procedures of Example 266 were repeated, except that the IR absorptive layer forming conditions were changed as shown in Table 35 and Table 38, and the photoconductive layer forming conditions and the surface layer forming conditions were changed respectively as shown in Table 27 and Table 353, to thereby prepare multiple drums as shown in Table 361.

The resultant drums were evaluated in the same way as in Example 266. As a result, it was found that every drum was provided with practically applicable desired electrophotographic characteristics.

EXAMPLE 285

The procedures of Example 267 were repeated, except that the contact layer forming conditions were changed as shown in Table 42, to thereby prepare multiple drums as shown in Table 362.

The resultant drums were evaluated in the same way as in Example 261. As a result, it was found that every drum was provided with practically applicable desired electrophotographic characteristics.

EXAMPLE 286

The procedures of Example 267 were repeated, except that the contact layer forming conditions and the photoconductive layer forming conditions were changed respectively as shown in Table 44 and Table 25, to thereby prepare multiple drums as shown in Table 363.

The resultant drums were evaluated in the same way as in Example 261. As a result, it was found that every drum was provided with practically applicable desired electrophotographic characteristics.

EXAMPLE 287

The procedures of Example 267 were repeated, except that the contact layer forming conditions, photoconductive layer forming conditions and the surface layer forming conditions were changed respectively as shown in Table 44. Table 27 and Table 351, to thereby prepare multiple drums as shown in Table 364.

The resultant drums were evaluated in the same way as in Example 261. As a result, it was found that every drum was provided with practically applicable desired electrophotographic characteristics.

EXAMPLE 288

The procedures of Example 267 were repeated, except that the contact layer forming conditions, photoconductive layer forming conditions and the surface layer forming conditions were changed respectively as shown in Table 44, Table 27 and Table 353, to thereby prepare multiple drums as shown in Table 365.

The resultant drums were evaluated in the same way as in Example 261. As a result, it was found that every drum was provided with practically applicable desired electrophotographic characteristics.

EXAMPLE 289

The procedures of Example 268 were repeated, except that the IR absorptive layer forming conditions were changed as shown in Table 35 and Table 36, to thereby prepare multiple drums as shown in Table 366.

The resultant drums were evaluated in the same way as in Example 266. As a result, it was found that every drum was provided with practically applicable desired electrophotographic characteristics.

EXAMPLE 290

The procedures of Example 268 were repeated, except that the charge injection inhibition layer forming conditions were changed as shown in Table 49 and the IR absorptive layer forming conditions were changed as shown in Table 35 and Table 38, to thereby prepare multiple drums as shown in Table 367.

The resultant drums were evaluated in the same way as in Example 266. As a result, it was found that every drum was provided with practically applicable desired electrophotographic characteristics.

EXAMPLE 291

The procedures of Example 268 were repeated, except that the charge injection inhibition layer forming conditions and the surface layer forming conditions were changed respectively as shown in Table 51 and Table 351, and the IR absorptive layer forming conditions were changed as shown in Table 35 and Table 38, to thereby prepare multiple drums as shown in Table 368.

The resultant drums were evaluated in the same way as in Example 266. As a result, it was found that every drum was provided with practically applicable desired electrophotographic characteristics.

EXAMPLE 292

The procedures of Example 268 were repeated, except that the charge injection inhibition layer forming conditions and the surface layer forming conditions were changed respectively as shown in Table 51 and Table 353, and the IR absorptive layer forming conditions were changed as shown in Table 35 and Table 38, to thereby prepare multiple drums as shown in Table 369.

The resultant drums were evaluated in the same way as in Example 266. As a result, it was found that every drum was provided with practically applicable desired electrophotographic characteristics.

EXAMPLE 293

The procedures of Example 269 were repeated, except that the contact layer forming conditions were changed as shown in Table 44 and Table 54, to thereby prepare multiple drums as shown in Table 370.

The resultant drums were evaluated in the same way as in Example 261. As a result, it was found that every drum was provided with practically applicable desired electrophotographic characteristics.

EXAMPLE 294

The procedures of Example 269 were repeated, except that the change injection inhibition layer forming conditions were changed as shown in Table 56, and the contact layer forming conditions were changed as shown in Table 44 and Table 57, to thereby prepare multiple drums as shown in Table 371.

The resultant drums were evaluated in the same way as in Example 261. As a result, it was found that every drum was provided with practically applicable desired electrophotographic characteristics.

EXAMPLE 295

The procedures of Example 269 were repeated, except that the charge injection inhibition layer forming conditions and the surface layer forming conditions were changed respectively as shown in Table 24 and Table 351, and the contact layer forming conditions were changed as shown in Table 44 and Table 57, to thereby prepare multiple drums as shown in Table 372.

The resultant drums were evaluated in the same way as in Example 261. As a result, it was found that every drum was provided with practically applicable desired electrophotographic characteristics.

EXAMPLE 296

The procedures of Example 269 were repeated, except that the charge injection inhibition layer forming conditions and the surface layer forming conditions were changed respectively as shown in Table 24 and Table 353, and the contact layer forming conditions were changed as shown in Table 44 and Table 57, to thereby prepare multiple drums as shown in Table 373.

The resultant drums were evaluated in the same way as in Example 261. As a result, it was found that every drum was provided with practically applicable desired electrophotographic characteristics.

EXAMPLE 297

The procedures of Example 270 were repeated, except that the charge injection inhibition layer forming conditions were changed as shown in Table 61, to thereby prepare multiple drums as shown in Table 374. The resultant drums were evaluated in the same way as in Example 266. As a result, it was found that every drum was provided with practically applicable desired electrophotographic characteristics.

EXAMPLE 298

The procedures of Example 270 were repeated, except that the charge injection inhibition layer forming conditions and the photoconductive layer forming conditions were changed respectively as shown in Table 64 and Table 63, to thereby prepare multiple drums as shown in Table 375.

The resultant drums were evaluated in the same way as in Example 266. As a result, it was found that every drum was provided with practically applicable desired electrophotographic characteristics.

EXAMPLE 299

The procedures of Example 270 were repeated, except that the charge injection inhibition layer forming conditions, the photoconductive layer forming conditions and the surface layer forming conditions were changed respectively as shown in Table 64, Table 66 and Table 351, to thereby prepare multiple drums as shown in Table 376.

The resultant drums were evaluated in the same way as in Example 266. As a result, it was found that every drum was provided with practically applicable desired electrophotographic characteristics.

EXAMPLE 300

The procedures of Example 270 were repeated, except that the charge injection inhibition layer forming conditions, the photoconductive layer forming conditions and the surface layer forming conditions were changed respectively as shown in Table 64, Table 66 and Table 353, to thereby prepare multiple drums as shown in Table 377.

The resultant drums were evaluated in the same way as in Example 266. As a result, it was found that every drum was provided with practically applicable desired electrophotographic characteristics.

EXAMPLE 301

The procedures of Example 268 were repeated, except that the charge injection inhibition layer forming conditions, the photoconductive layer forming conditions and the surface layer forming conditions were changed respectively as shown in Table 51. Table 69 and Table 378, and the IR absorptive layer forming conditions were changed as shown in Table 35 and Table 38, to thereby prepare multiple drums as shown in Table 379.

The resultant drums were evaluated in the same way as in Example 266. As a result, it was found that every drum was provided with practically applicable desired electrophotographic characteristics.

EXAMPLE 302

The procedures of Example 268 were repeated, except that the charge injection inhibition layer forming conditions, the photoconductive layer forming conditions and the surface layer forming conditions were changed respectively as shown in Table 51, Table 72 and Table 378, and the IR absorptive layer forming conditions were changed as shown in Table 35 and Table 38, to thereby prepare multiple drums as shown in Table 380.

The resultant drums were evaluated in the same way as in Example 266. As a result, it was found that every drum was provided with practically applicable desired electrophotographic characteristics.

EXAMPLE 303

The procedures of Example 268 were repeated, except that the charge injection inhibition layer forming conditions, the photoconductive layer forming conditions and the surface layer forming conditions were changed respectively as shown in Table 51, Table 69 and Table 351, and the IR absorptive layer forming conditions were changed as shown in Table 35 and Table 38, to thereby prepare multiple drums as shown in Table 381.

The resultant drums were evaluated in the same way as in Example 266. As a result, it was found that every drum was provided with practically applicable desired electrophotographic characteristics.

EXAMPLE 304

The procedures of Example 268 were repeated, except that the charge injection inhibition layer forming conditions, the photoconductive layer forming conditions and the surface layer forming conditions were changed respectively as shown in Table 51, Table 72 and Table 351, and the IR absorptive layer forming conditions were changed as shown in Table 35 and Table 38, to thereby prepare multiple drums as shown in Table 382.

The resultant drums were evaluated in the same way as in Example 266. As a result, it was found that every drum was provided with practically applicable desired electrophotographic characteristics.

EXAMPLE 305

The procedures of Example 268 were repeated, except that the charge injection inhibition layer forming conditions, the photoconductive layer forming conditions and the surface layer forming conditions were changed respectively as shown in Table 51, Table 69 and Table 353,and the IR absorptive layer forming conditions were changed as shown in Table 35 and Table 38, to thereby prepare multiple drums as shown in Table 383.

The resultant drums were evaluated in the same way as in Example 266. As a result, it was found that every drum was provided with practically applicable desired electrophotographic characteristics.

EXAMPLE 306

The procedures of Example 268 were repeated, except that the charge injection inhibition layer forming conditions, the photoconductive layer forming conditions and the surface layer forming conditions were changed respectively as shown in Table 51, Table 72 and Table 353, and the IR absorptive layer forming conditions were changed as shown in Table 35 and Table 38, to thereby prepare multiple drums as shown in Table 384.

The resultant drums were evaluated in the same way as in Example 266. As a result, it was found that every drum was provided with practically applicable desired electrophotographic characteristics.

EXAMPLE 307

The procedures of Example 264 were repeated, except that the charge injection inhibition layer forming conditions and the photoconductive layer forming conditions were changed as shown in Table 78 and the surface layer forming conditions were changed as shown in Table 353, to thereby prepare multiple drums as shown in Table 385.

The resultant drums were evaluated in the same way as in Example 261. As a result, it was found that every drum was provided with practically applicable desired electrophotographic characteristics.

EXAMPLE 308

The procedures of Example 268 were repeated, except that the IR absorptive layer forming conditions, the charge injection inhibition layer forming conditions and the photoconductive layer forming conditions were changed as shown in Table 80 and the surface layer forming conditions were changed as shown in Table 353, to thereby prepare multiple drums as shown in Table 386.

The resultant drums were evaluated in the same way as in Example 266. As a result, it was found that every drum was provided with practically applicable desired electrophotographic characteristics.

EXAMPLE 309

The procedures of Example 270 were repeated, except that the contact layer forming conditions, the IR absorptive layer forming conditions, the charge injection inhibition layer forming conditions and the photoconductive layer forming conditions were changed as shown in Table 82 and the surface layer forming conditions were changed as shown in Table 353, to thereby prepare multiple drums as shown in Table 387.

The resultant drums were evaluated in the same way as in Example 266. As a result, it was found that every drum was provided with practically applicable desired electrophotographic characteristics.

EXAMPLE 310

A drum having a charge injection inhibition layer, a photoconductive layer, an intermediate layer and a surface layer was prepared under the conditions shown in Table 388 and following the procedures of Example 261.

The resultant drum was evaluated in the same way as in Example 261, superiorities in the respective evaluation items were acknowledged.

EXAMPLE 311

The mirror grinded cylinders were supplied for grinding process with cutting tool having various degrees. With the patterns of FIG. 3 and various cross section patterns as described in Table 85, multiple cylinders were provided. These cylinders were set to the fabrication apparatus of FIG. 2 accordingly, and used to prepare multiple drums under the same layer forming conditions of Example 261. The resulting drums were evaluated with the same procedures as in Example 261.

As a result, it was found that every drum was provided with practically applicable desired electrophotographic characteristics.

EXAMPLE 312

The surface of mirror grinded cylinder was treated by dropping lots of bearing balls thereto to thereby form uneven shape composed of a plurality of fine dimples at the surface, and multiple cylinders having a cross section form of FIG. 4 and of a cross section pattern of Table 86 were provided These cylinders were set to the fabrication apparatus of FIG. 2 accordingly and used for the preparation of multiple drums under the same layer forming conditions of Example 261. The resulting drums were evaluated with the same procedures of Example 261.

As a result, it was found that every drum was provided with practically applicable desired electrophotographic characteristics.

TABLE 1

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer | $B_2H_6$/Ar (20%) | 500 | 250 | 200 | 0.35 | 0.5 |
| | $NH_3$ | 100 | | | | |

TABLE 2

| Initial electrification efficiency | Residual voltage | Ghost | Defective image | Image flow | Increase of defective image | Surface abrasion | Break down voltage | Abrasion resistance |
|---|---|---|---|---|---|---|---|---|
| ○ | ○ | ◎ | ◎ | ○ | ○ | ◎ | ◎ | ◎ |

◎: Excellent
○: Good
Δ: Applicable for practical use
X: Poor

TABLE 3

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer | $B_2H_6$/Ar (20%) | 500 | 250 | 200 | 0.40 | 0.5 |
| | $H_2$ | 100 | | | | |
| | $NH_3$ | 100 | | | | |

TABLE 4

| Initial electrification efficiency | Residual voltage | Ghost | Defective image | Image flow | Increase of defective image | Surface abrasion | Break down voltage | Abrasion resistance |
|---|---|---|---|---|---|---|---|---|
| ○ | ○ | ◎ | ◎ | ○ | ○ | ◎ | ◎ | ◎ |

◎: Excellent
○: Good
Δ: Applicable for practical use
X: Poor

TABLE 5

| Initial electrification efficiency | Residual voltage | Ghost | Defective image | Image flow | Increase of defective image | Surface abrasion | Break down voltage | Abrasion resistance |
|---|---|---|---|---|---|---|---|---|
| ○ | ○ | ◎ | ◎ | ○ | ○ | ◎ | ◎ | ◎ |

◎: Excellent
○: Good
Δ: Applicable for practicle use
X: Poor

TABLE 6

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |

TABLE 7

| Initial electrification efficiency | Residual voltage | Ghost | Defective image | Image flow | Increase of defective image | Surface abrasion | Break down voltage | Abrasion resistance |
|---|---|---|---|---|---|---|---|---|
| ◎ | ○ | ◎ | ◎ | ○ | ○ | ◎ | ◎ | ◎ |

◎: Excellent
○: Good
Δ: Applicable for practical use
X: Poor

TABLE 8

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |

TABLE 9

| Initial electri-fication efficiency | Residual voltage | Ghost | Defective image | Image flow | Increase of defective image | Surface abrasion | Break down voltage | Abrasion resistance |
|---|---|---|---|---|---|---|---|---|
| ◎ | ○ | ◎ | ◎ | ○ | ○ | ◎ | ◎ | ◎ |

◎: Excellent
○: Good
Δ: Applicable for practical use
X: Poor

TABLE 10

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |

TABLE 11

| Initial electri-fication efficiency | Residual voltage | Ghost | Defective image | Image flow | Increase of defective image | Surface abrasion | Break down voltage | Abrasion resistance | Interference fringe |
|---|---|---|---|---|---|---|---|---|---|
| ○ | ○ | ◎ | ◎ | ○ | ○ | ◎ | ◎ | ◎ | ○ |

◎: Excellent
○: Good
Δ: Applicable for practical use
X Poor

TABLE 12

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 100 | 0.25 | 0.5 |
| | $N_2$ | 100 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |

TABLE 13

| Initial electri-fication efficiency | Residual voltage | Ghost | Defective image | Image flow | Increase of defective image | Surface abrasion | Break down voltage | Abrasion resistance |
|---|---|---|---|---|---|---|---|---|
| ◎ | ○ | ◎ | ◎ | ○ | ○ | ◎ | ◎ | ◎ |

◎: Excellent
○: Good
Δ: Applicable for practical use
X: Poor

TABLE 14

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |

TABLE 15

| Initial electrification efficiency | Residual voltage | Ghost | Defective image | Image flow | Increase of defective image | Surface abrasion | Break down voltage | Abrasion resistance | Interference fringe |
|---|---|---|---|---|---|---|---|---|---|
| ◎ | ○ | ◎ | ◎ | ○ | ○ | ◎ | ◎ | ◎ | ○ |

◎: Excellent
○: Good
Δ: Applicable for practical use
X: Poor

TABLE 16

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |

TABLE 17

| Initial electrification efficiency | Residual voltage | Ghost | Defective image | Image flow | Increase of defective image | Surface abrasion | Break down voltage | Abrasion resistance |
|---|---|---|---|---|---|---|---|---|
| ◎ | ○ | ◎ | ◎ | ◎ | ○ | ○ | ◎ | ◎ |

◎: Excellent
○: Good
Δ: Applicable for practical use
X: Poor

TABLE 18

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface | $B_2H_6$/Ar (20%) | 500 | 250 | 200 | 0.35 | 0.5 |

TABLE 18-continued

| Name of layer | Gas used and its flow rate (SCCM) | | Substrate temperature (°C.) | RF power (W) | Inner pressure (Torr) | Layer thickness (μm) |
|---|---|---|---|---|---|---|
| layer | $NH_3$ | 100 | | | | |

TABLE 19

| Intial electrification efficiency | Residual voltage | Ghost | Defective image | Image flow | Increase of defective image | Surface abrasion | Break down voltage | Abrasion resistance | Interference fringe |
|---|---|---|---|---|---|---|---|---|---|
| ◎ | ○ | ◎ | ◎ | ○ | ○ | ◎ | ◎ | ◎ | ○ |

◎: Excellent
○: Good
Δ: Applicable for practical use
X: Poor

TABLE 20

| Drum No. | Gas used and its flow rate (SCCM) | | Substrate temperature (°C.) | RF power (W) | Inner pressure (Torr) | Layer thickness (μm) |
|---|---|---|---|---|---|---|
| 1101 | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 1102 | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 1103 | $SiH_4$ | 200 | 250 | 300 | 0.40 | 20 |
| | $H_2$ | 200 | | | | |
| 1104 | $SiH_4$ | 200 | 250 | 250 | 0.40 | 20 |
| | Ar | 200 | | | | |
| 1105 | $SiH_4$ | 150 | 250 | 350 | 0.40 | 20 |
| | $SiF_4$ | 50 | | | | |
| | $H_2$ | 200 | | | | |

TABLE 21

| Drum No. | Gas used and its flow rate (SCCM) | | Substrate temperature (°C.) | RF power (W) | Inner pressure (Torr) | Layer thickness (μm) |
|---|---|---|---|---|---|---|
| 1201 | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 1202 | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 1203 | $SiH_4$ | 200 | 250 | 300 | 0.40 | 20 |
| | $H_2$ | 200 | | | | |
| 1204 | $SiH_4$ | 200 | 250 | 250 | 0.40 | 20 |
| | Ar | 200 | | | | |
| 1205 | $SiH_4$ | 150 | 250 | 350 | 0.40 | 20 |
| | $SiF_4$ | 50 | | | | |
| | $H_2$ | 200 | | | | |

TABLE 22

| Drum No. | Gas used and its flow rate (SCCM) | | Substrate temperature (°C.) | RF power (W) | Inner pressure (Torr) | Layer thickness (μm) |
|---|---|---|---|---|---|---|
| 1301 | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 1302 | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 1303 | $SiH_4$ | 200 | 250 | 300 | 0.40 | 20 |
| | $H_2$ | 200 | | | | |
| 1304 | $SiH_4$ | 200 | 250 | 250 | 0.40 | 20 |

TABLE 22-continued

| Drum No. | Gas used and its flow rate (SCCM) | | Substrate temperature (°C.) | RF power (W) | Inner pressure (Torr) | Layer thickness (μm) |
|---|---|---|---|---|---|---|
| | Ar | 200 | | | | |
| 1305 | $SiH_4$ | 150 | 250 | 350 | 0.40 | 20 |
| | $SiF_4$ | 50 | | | | |
| | $H_2$ | 200 | | | | |

TABLE 23

| Drum No. | Gas used and its flow rate (SCCM) | | Substrate temperature (°C.) | RF power (W) | Inner pressure (Torr) | Layer thickness (μm) |
|---|---|---|---|---|---|---|
| 1401 | $SiH_4$ | 100 | 250 | 150 | 0.35 | 3 |
| | $H_2$ | 100 | | | | |
| | $B_2H_6$ (against $SiH_4$) | 1000 ppm | | | | |
| | $GeH_4$ | 10 | | | | |
| | NO | 10 | | | | |
| 1402 | $SiH_4$ | 80 | 250 | 170 | 0.25 | 3 |
| | $SiF_4$ | 20 | | | | |
| | $B_2H_6$ (against $SiH_4$) | 1000 ppm | | | | |
| | $SnH_4$ | 5 | | | | |
| | NO | 5 | | | | |
| 1403 | $SiH_4$ | 100 | 250 | 130 | 0.25 | 3 |
| | $B_2H_6$ (against $SiH_4$) | 800 ppm | | | | |
| | NO | 4 | | | | |
| | $N_2$ | 4 | | | | |
| | $CH_4$ | 6 | | | | |
| 1404 | $SiH_4$ | 100 | 250 | 150 | 0.35 | 3 |
| | $H_2$ | 100 | | | | |
| | $PH_3$ (against $SiH_4$) | 800 ppm | | | | |
| 1405 | $SiH_4$ | 100 | 250 | 130 | 0.25 | 3 |
| | $PH_3$ (against $SiH_4$) | 800 ppm | | | | |
| | $GeH_4$ | 10 | | | | |
| | NO | 10 | | | | |
| 1406 | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO* | 10 | | | | |
| | NO** | 10→0 *** | | | | |

*Substrate side 2 μm
**Surface layer side 1 μm
***Constantly changed

TABLE 24

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge | $SiH_4$ | 100 | 250 | 150 | 0.35 | 3 |
| injection | $H_2$ | 100 | | | | |
| inhibition | $B_2H_6$ (against $SiH_4$) | 1000 ppm | | | | |
| layer 1 | NO | 10 | | | | |
| Charge | $SiH_4$ | 100 | 250 | 150 | 0.35 | 3 |
| injection | $H_2$ | 100 | | | | |
| inhibition | $B_2H_6$ (against $SiH_4$) | 1000 ppm | | | | |
| layer 2 | $GeH_4$ | 10 | | | | |
| | NO | 10 | | | | |
| Charge | $SiH_4$ | 80 | 250 | 170 | 0.25 | 3 |
| injection | $SiF_4$ | 20 | | | | |
| inhibition | $B_2H_6$ (against $SiH_4$) | 1000 ppm | | | | |
| layer 3 | $SnH_4$ | 5 | | | | |
| | NO | 5 | | | | |
| Charge | $SiH_4$ | 100 | 250 | 130 | 0.25 | 3 |
| injection | $B_2H_6$ (against $SiH_4$) | 800 ppm | | | | |
| inhibition | NO | 4 | | | | |
| layer 4 | $N_2$ | 4 | | | | |
| | $CH_4$ | 6 | | | | |
| Charge | $SiH_4$ | 100 | 250 | 150 | 0.35 | 3 |
| injection | $H_2$ | 100 | | | | |
| inhibition | $PH_3$ (against $SiH_4$) | 800 ppm | | | | |
| layer 5 | | | | | | |
| Charge | $SiH_4$ | 100 | 250 | 130 | 0.25 | 3 |
| injection | $PH_3$ (against $SiH_4$) | 800 ppm | | | | |
| inhibition | $GeH_4$ | 10 | | | | |
| layer 6 | NO | 10 | | | | |
| Charge | $SiH_4$ | 100 | 250 | 150 | 0.35 | 3 |
| injection | $H_2$ | 100 | | | | |
| inhibition | $B_2H_6$ (against $SiH_4$) | 1000 ppm | | | | |

TABLE 24-continued

| Name of layer | Gas used and its flow rate (SCCM) | | Substrate temperature (°C.) | RF power (W) | Inner pressure (Torr) | Layer thickness (μm) |
|---|---|---|---|---|---|---|
| layer 7 | NO* | 10 | | | | |
| | NO** | 10→0*** | | | | |

*substrate side 2 μm
**surface layer side 2 μm
***constantly changed

TABLE 25

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer 1 | $SiH_4$ | 200 | 250 | 250 | 0.35 | 20 |
| | $B_2H_6$ (against $SiH_4$) | 100 ppm | | | | |
| | NO | 4 | | | | |
| Photo-conductive layer 2 | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| Photo-conductive layer 3 | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| Photo-conductive layer 5 | $SiH_4$ | 200 | 250 | 250 | 0.40 | 20 |
| | Ar | 200 | | | | |
| Photo-conductive layer 6 | $SiH_4$ | 150 | 250 | 350 | 0.40 | 20 |
| | $SiF_4$ | 50 | | | | |
| | $H_2$ | 200 | | | | |

TABLE 26

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| Photo-conductive layer 1 | 1501 | 1506 | 1511 | 1516 | 1521 | 1526 | 1531 |
| Photo-conductive layer 2 | 1502 | 1507 | 1512 | 1517 | 1522 | 1527 | 1532 |
| Photo-conductive layer 3 | 1503 | 1508 | 1513 | 1518 | 1523 | 1528 | 1533 |
| Photo-conductive layer 5 | 1504 | 1509 | 1514 | 1519 | 1524 | 1529 | 1534 |
| Photo-conductive layer 6 | 1505 | 1510 | 1515 | 1520 | 1525 | 1530 | 1535 |

TABLE 27

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer 1 | $SiH_4$ | 200 | 250 | 250 | 0.35 | 20 |
| | $B_2H_6$ (against $SiH_4$) | 100 ppm | | | | |
| | NO | 4 | | | | |
| Photo-conductive layer 2 | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| Photo-conductive layer 3 | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| Photo-conductive layer 4 | $SiH_4$ | 200 | 250 | 300 | 0.40 | 20 |
| | $H_2$ | 200 | | | | |
| Photo-conductive layer 5 | $SiH_4$ | 200 | 250 | 250 | 0.40 | 20 |
| | Ar | 200 | | | | |

TABLE 27-continued

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer 6 | $SiH_4$ | 150 | 250 | 350 | 0.40 | 20 |
| | $SiF_4$ | 50 | | | | |
| | $H_2$ | 200 | | | | |

TABLE 28

| Name of layer | Gas used and its flow rate (SCCM) | | Substrate temperature (°C.) | RF power (W) | Inner pressure (Torr) | Layer thickness (μm) |
|---|---|---|---|---|---|---|
| Surface layer | $B_2H_6$/Ar (20%) | 500 | 250 | 200 | 0.40 | 0.5 |
| | $H_2$ | 100 | | | | |
| | $NH_3$ | 100 | | | | |

TABLE 29

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| Photo-conductive layer 1 | 1601 | 1607 | 1613 | 1619 | 1625 | 1631 | 1637 |
| Photo-conductive layer 2 | 1602 | 1608 | 1614 | 1620 | 1626 | 1632 | 1638 |
| Photo-conductive layer 3 | 1603 | 1609 | 1615 | 1621 | 1627 | 1633 | 1639 |
| Photo-conductive layer 4 | 1604 | 1610 | 1616 | 1622 | 1628 | 1634 | 1640 |
| Photo-conductive layer 5 | 1605 | 1611 | 1617 | 1623 | 1629 | 1635 | 1641 |
| Photo-conductive layer 6 | 1606 | 1612 | 1618 | 1624 | 1630 | 1636 | 1642 |

TABLE 30

| Name of layer | Gas used and its flow rate (SCCM) | | Substrate temperature (°C.) | RF power (W) | Inner pressure (Torr) | Layer thickness (μm) |
|---|---|---|---|---|---|---|
| Surface layer | $B_2H_6$/Ar (20%) | 500 | 250 | 200 | 0.35 | 0.5 |
| | $NH_3$ | 100 | | | | |
| | Bias voltage of the cyclinder-150 V | | | | | |

TABLE 31

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| Photo-conductive layer 1 | 1701 | 1707 | 1713 | 1719 | 1725 | 1731 | 1737 |
| Photo-conductive layer 2 | 1702 | 1708 | 1714 | 1720 | 1726 | 1732 | 1738 |
| Photo-conductive layer 3 | 1703 | 1709 | 1715 | 1721 | 1727 | 1733 | 1739 |
| Photo-conductive layer 4 | 1704 | 1710 | 1716 | 1722 | 1728 | 1734 | 1740 |
| Photo-conductive layer 5 | 1705 | 1711 | 1717 | 1723 | 1729 | 1735 | 1741 |
| Photo-conductive | 1706 | 1712 | 1718 | 1724 | 1730 | 1736 | 1742 |

TABLE 31-continued

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| layer 6 | | | | | | | |

TABLE 32

| | Photo-conductive Layer 1 | Photo-conductive Layer 2 | Photo-conductive Layer 3 | Photo-conductive Layer 5 | Photo-conductive Layer 6 |
|---|---|---|---|---|---|
| Drum | 1801 | 1802 | 1803 | 1804 | 1805 |

TABLE 32-continued

| | Photo-conductive Layer 1 | Photo-conductive Layer 2 | Photo-conductive Layer 3 | Photo-conductive Layer 5 | Photo-conductive Layer 6 |
|---|---|---|---|---|---|
| No. | | | | | |

TABLE 33

| | Photo-conductive Layer 1 | Photo-conductive Layer 2 | Photo-conductive Layer 3 | Photo-conductive Layer 4 | Photo-conductive Layer 5 | Photo-conductive Layer 6 |
|---|---|---|---|---|---|---|
| Drum No. | 1901 | 1902 | 1903 | 1904 | 1905 | 1906 |

TABLE 34

| | Photo-conductive Layer 1 | Photo-conductive Layer 2 | Photo-conductive Layer 3 | Photo-conductive Layer 4 | Photo-conductive Layer 5 | Photo-conductive Layer 6 |
|---|---|---|---|---|---|---|
| Drum No. | 2001 | 2002 | 2003 | 2004 | 2005 | 2006 |

TABLE 35

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer 1 | $SiH_4$ | 100 | 250 | 150 | 0.35 | 1 |
| | $GeH_4$ | 50 | | | | |
| | $H_2$ | 100 | | | | |
| IR absorptive layer 2 | $SiH_4$ | 100 | 250 | 150 | 0.35 | 1 |
| | $GeH_4$ | 50 | | | | |
| | NO | 10 | | | | |
| | $H_2$ | 100 | | | | |
| IR absorptive layer 3 | $SiH_4$ | 100 | 250 | 150 | 0.35 | 1 |
| | $SnH_4$ | 50 | | | | |
| | NO | 10 | | | | |
| | $H_2$ | 100 | | | | |
| IR absorptive layer 4 | $SiH_4$ | 100 | 250 | 150 | 0.35 | 1 |
| | $GeH_4$ | 50 | | | | |
| | $N_2$ | 4 | | | | |
| | NO | 4 | | | | |
| | $CH_4$ | 6 | | | | |
| IR absorptive layer 5 | $SiH_4$ | 100 | 250 | 150 | 0.35 | 1 |
| | $SnH_4$ | 50 | | | | |
| | $N_2$ | 4 | | | | |
| | NO | 4 | | | | |
| | $CH_4$ | 6 | | | | |
| IR absorptive layer 6 | $SiH_4$ | 100 | 250 | 150 | 0.35 | 1 |
| | $GeH_4$ | 50 | | | | |
| | $B_2H_6$ (against $SiH_4$) | 1000 ppm | | | | |
| | $H_2$ | 100 | | | | |
| IR absorptive layer 7 | $SiH_4$ | 100 | 250 | 150 | 0.35 | 1 |
| | $GeH_4$ | 50 | | | | |
| | $B_2H_6$ (against $SiH_4$) | 1000 ppm | | | | |
| | NO | 10 | | | | |
| | $CH_4$ | 100 | | | | |
| IR absorptive layer 8 | $SiH_4$ | 100 | 250 | 150 | 0.35 | 1 |
| | $GeH_4$ | 50 | | | | |
| | $B_2H_6$ (against $SiH_4$) | 1000 ppm | | | | |
| | $CH_4$ | 20 | | | | |
| | $H_2$ | 100 | | | | |
| IR absorptive layer 9 | $SiH_4$ | 100 | 250 | 150 | 0.35 | 1 |
| | $SnH_4$ | 50 | | | | |
| | $B_2H_6$ (against $SiH_4$) | 1000 ppm | | | | |
| | $H_2$ | 100 | | | | |
| IR absorptive | $SiH_4$ | 100 | 250 | 150 | 0.35 | 1 |
| | $GeH_4$ | 50 | | | | |

TABLE 35-continued

| Name of layer | Gas used and its flow rate (SCCM) | | Substrate temperature (°C.) | RF power (W) | Inner pressure (Torr) | Layer thickness (μm) |
|---|---|---|---|---|---|---|
| layer 10 | $B_2H_6$ (against $SiH_4$) | 1000 ppm | | | | |
| | NO | 4 | | | | |
| | $N_2$ | 4 | | | | |
| | $CH_4$ | 6 | | | | |

TABLE 36

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer 11 | $SiH_4$ | 100 | 250 | 150 | 0.35 | 1 |
| | $GeH_4$ | 50 | | | | |
| | $SiF_4$ | 10 | | | | |
| | $PH_3$ (against $SiH_4$) | 800 ppm | | | | |
| IR absorptive layer 12 | $SiH_4$ | 100 | 250 | 150 | 0.35 | 1 |
| | $GeH_4$ | 50 | | | | |
| | $PH_3$ (against $SiH_4$) | 800 ppm | | | | |
| | NO | 10 | | | | |
| IR absorptive layer 13 | $SiH_4$ | 100 | 250 | 150 | 0.35 | 1 |
| | $GeH_4$ | 50 | | | | |
| | $PH_3$ (against $SiH_4$) | 800 ppm | | | | |
| | $N_2$ | 10 | | | | |
| IR absorptive layer 14 | $SiH_4$ | 100 | 250 | 150 | 0.35 | 1 |
| | $SnH_4$ | 50 | | | | |
| | $PH_3$ (against $SiH_4$) | 800 ppm | | | | |
| | NO | 10 | | | | |
| IR absorptive layer 15 | $SiH_4$ | 100 | 250 | 170 | 0.35 | 1 |
| | $SnH_4$ | 50 | | | | |
| | $PH_3$ (against $SiH_4$) | 800 ppm | | | | |
| | NO | 4 | | | | |
| | $N_2$ | 4 | | | | |
| | $CH_4$ | 6 | | | | |
| IR absorptive layer 17 | $SiH_4$ | 100 | 250 | 150 | 0.35 | 1 |
| | $SnH_4$ | 50 | | | | |
| | $PH_3$ (against $SiH_4$) | 800 ppm | | | | |
| IR absorptive layer 18 | $SiH_4$ | 100 | 250 | 150 | 0.35 | 1 |
| | $GeH_4$ | 50 | | | | |
| | $SnH_4$ | 50 | | | | |
| | $H_2$ | 100 | | | | |
| IR absorptive layer 19 | $SiH_4$ | 100 | 250 | 150 | 0.35 | 1 |
| | $GeH_4$ | 50 | | | | |
| | $SnH_4$ | 50 | | | | |
| | NO | 4 | | | | |
| | $H_2$ | 100 | | | | |
| IR absorptive layer 20 | $SiH_4$ | 100 | 250 | 150 | 0.35 | 1 |
| | $GeH_4$* | 50 | | | | |
| | $GeH_4$** | 50 → 0*** | | | | |
| | $H_2$ | 100 | | | | |

*substrate side 0.7 μm
**surface layer side 0.3 μm
***constantly decreased

TABLE 37

| | Drum No. |
|---|---|
| IR Absorptive Layer 1 | 2101 |
| IR Absorptive Layer 2 | 2102 |
| IR Absorptive Layer 3 | 2103 |
| IR Absorptive Layer 4 | 2104 |
| IR Absorptive Layer 5 | 2105 |
| IR Absorptive Layer 6 | 2106 |
| Ir Absorptive Layer 7 | 2107 |
| IR Absorptive Layer 8 | 2108 |
| IR Absorptive Layer 9 | 2109 |
| IR Absorptive Layer 10 | 2110 |

TABLE 37-continued

| | Drum No. |
|---|---|
| IR Absorptive Layer 11 | 2111 |
| IR Absorptive Layer 12 | 2112 |
| IR Absorptive Layer 13 | 2113 |
| IR Absorptive Layer 14 | 2114 |
| IR Absorptive Layer 15 | 2115 |
| IR Absorptive Layer 17 | 2116 |
| IR Absorptive Layer 18 | 2117 |
| IR Absorptive Layer 19 | 2118 |
| IR Absorptive Layer 20 | 2119 |

TABLE 38

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer 11 | $SiH_4$ | 100 | 250 | 150 | 0.35 | 1 |
| | $GeH_4$ | 50 | | | | |
| | $SiF_4$ | 10 | | | | |
| | $PH_3$ (against $SiH_4$) | 800 ppm | | | | |
| IR absorptive layer 12 | $SiH_4$ | 100 | 250 | 150 | 0.35 | 1 |
| | $GeH_4$ | 50 | | | | |
| | $PH_3$ (against $SiH_4$) | 800 ppm | | | | |
| | NO | 10 | | | | |
| IR absorptive layer 13 | $SiH_4$ | 100 | 250 | 150 | 0.35 | 1 |
| | $GeH_4$ | 50 | | | | |
| | $PH_3$ (against $SiH_4$) | 800 ppm | | | | |
| | $N_2$ | 10 | | | | |
| IR absorptive layer 14 | $SiH_4$ | 100 | 250 | 150 | 0.35 | 1 |
| | $SnH_4$ | 50 | | | | |
| | $PH_3$ (against $SiH_4$) | 800 ppm | | | | |
| | NO | 10 | | | | |
| IR absorptive layer 15 | $SiH_4$ | 100 | 250 | 170 | 0.35 | 1 |
| | $SnH_4$ | 50 | | | | |
| | $PH_3$ (against $SiH_4$) | 800 ppm | | | | |
| | NO | 4 | | | | |
| | $N_2$ | 4 | | | | |
| | $CH_4$ | 6 | | | | |
| IR absorptive layer 16 | $SiH_4$ | 100 | 250 | 150 | 0.35 | 1 |
| | $GeH_4$ | 50 | | | | |
| | $B_2H_6$ (against $SiH_4$) | 1000 ppm | | | | |
| | NO | 10 | | | | |
| | $H_2$ | 100 | | | | |
| IR absorptive layer 17 | $SiH_4$ | 100 | 250 | 150 | 0.35 | 1 |
| | $SnH_4$ | 50 | | | | |
| | $PH_3$ (against $SiH_4$) | 800 ppm | | | | |
| IR absorptive layer 18 | $SiH_4$ | 100 | 250 | 150 | 0.35 | 1 |
| | $GeH_4$ | 50 | | | | |
| | $SnH_4$ | 50 | | | | |
| | $H_2$ | 100 | | | | |
| IR absorptive layer 19 | $SiH_4$ | 100 | 250 | 150 | 0.35 | 1 |
| | $GeH_4$ | 50 | | | | |
| | $SnH_4$ | 50 | | | | |
| | NO | 4 | | | | |
| | $H_2$ | 100 | | | | |
| IR absorptive layer 20 | $SiH_4$ | 100 | 250 | 150 | 0.35 | 1 |
| | $GeH_4$* | 50 | | | | |
| | $GeH_4$** | 50 → 0*** | | | | |
| | $H_2$ | 100 | | | | |

*substrate side 0.7 μm
**surface layer side 0.3 μm
***constantly decreased

TABLE 39

| Drum No. | Photo-con-ductive layer 1 | Photo-con-ductive layer 2 | Photo-con-ductive layer 3 | Photo-con-ductive layer 5 | Photo-con-ductive layer 6 |
|---|---|---|---|---|---|
| IR absorptive layer 1 | 2201 | 2221 | 2241 | 2261 | 2281 |
| IR absorptive layer 2 | 2202 | 2222 | 2242 | 2262 | 2282 |
| IR absorptive layer 3 | 2203 | 2223 | 2243 | 2263 | 2283 |
| IR absorptive layer 4 | 2204 | 2224 | 2244 | 2264 | 2284 |
| IR absorptive layer 5 | 2205 | 2225 | 2245 | 2265 | 2285 |
| IR absorptive layer 6 | 2206 | 2226 | 2246 | 2266 | 2286 |
| IR absorptive layer 7 | 2207 | 2227 | 2247 | 2267 | 2287 |
| IR absorptive layer 8 | 2208 | 2228 | 2248 | 2268 | 2288 |
| IR absorptive layer 9 | 2209 | 2229 | 2249 | 2269 | 2289 |
| IR absorptive layer 10 | 2210 | 2230 | 2250 | 2270 | 2290 |

TABLE 39-continued

| Drum No. | Photo-con-ductive layer 1 | Photo-con-ductive layer 2 | Photo-con-ductive layer 3 | Photo-con-ductive layer 5 | Photo-con-ductive layer 6 |
|---|---|---|---|---|---|
| IR absorptive layer 11 | 2211 | 2231 | 2251 | 2271 | 2291 |
| IR absorptive layer 12 | 2212 | 2232 | 2252 | 2272 | 2292 |
| IR absorptive layer 13 | 2213 | 2233 | 2253 | 2273 | 2293 |
| IR absorptive layer 14 | 2214 | 2234 | 2254 | 2274 | 2294 |
| IR absorptive layer 15 | 2215 | 2235 | 2255 | 2275 | 2295 |
| IR absorptive layer 16 | 2216 | 2236 | 2256 | 2276 | 2296 |
| IR absorptive layer 17 | 2217 | 2237 | 2257 | 2277 | 2297 |
| IR absorptive layer 18 | 2218 | 2238 | 2258 | 2278 | 2298 |
| IR absorptive layer 19 | 2219 | 2239 | 2259 | 2279 | 2299 |
| IR absorptive layer 20 | 2220 | 2240 | 2260 | 2280 | 22100 |

TABLE 40

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| IR absorptive layer 1 | 2301 | 2321 | 2341 | 2361 | 2381 | 23101 |
| IR absorptive layer 2 | 2302 | 2322 | 2342 | 2362 | 2382 | 23102 |
| IR absorptive layer 3 | 2303 | 2323 | 2343 | 2363 | 2383 | 23103 |
| IR absorptive layer 4 | 2304 | 2324 | 2344 | 2364 | 2384 | 23104 |
| IR absorptive layer 5 | 2305 | 2325 | 2345 | 2365 | 2385 | 23105 |
| IR absorptive layer 6 | 2306 | 2326 | 2346 | 2366 | 2386 | 23106 |
| IR absorptive layer 7 | 2307 | 2327 | 2347 | 2367 | 2387 | 23107 |
| IR absorptive layer 8 | 2308 | 2328 | 2348 | 2368 | 2388 | 23108 |
| IR absorptive layer 9 | 2309 | 2329 | 2349 | 2369 | 2389 | 23109 |
| IR absorptive layer 10 | 2310 | 2330 | 2350 | 2370 | 2390 | 23110 |
| IR absorptive layer 11 | 2311 | 2331 | 2351 | 2371 | 2391 | 23111 |
| IR absorptive layer 12 | 2312 | 2332 | 2352 | 2372 | 2392 | 23112 |
| IR absorptive layer 13 | 2313 | 2333 | 2353 | 2373 | 2393 | 23113 |
| IR absorptive layer 14 | 2314 | 2334 | 2354 | 2374 | 2394 | 23114 |
| IR absorptive layer 15 | 2315 | 2335 | 2355 | 2375 | 2395 | 23115 |
| IR absorptive layer 16 | 2316 | 2336 | 2356 | 2376 | 2396 | 23116 |
| IR absorptive layer 17 | 2317 | 2337 | 2357 | 2377 | 2397 | 23117 |
| IR absorptive layer 18 | 2318 | 2338 | 2358 | 2378 | 2398 | 23118 |
| IR absorptive layer 19 | 2319 | 2339 | 2359 | 2379 | 2399 | 23119 |
| IR absorptive layer 20 | 2320 | 2340 | 2360 | 2380 | 23100 | 23120 |

TABLE 41

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| IR absorptive layer 1 | 2401 | 2421 | 2441 | 2461 | 2481 | 24101 |
| IR absorptive layer 2 | 2402 | 2422 | 2442 | 2462 | 2482 | 24102 |
| IR absorptive layer 3 | 2403 | 2423 | 2443 | 2463 | 2483 | 24103 |
| IR absorptive layer 4 | 2404 | 2424 | 2444 | 2464 | 2484 | 24104 |
| IR absorptive layer 5 | 2405 | 2425 | 2445 | 2465 | 2485 | 24105 |
| IR absorptive layer 6 | 2406 | 2426 | 2446 | 2466 | 2486 | 24106 |
| IR absorptive layer 7 | 2407 | 2427 | 2447 | 2467 | 2487 | 24107 |
| IR absorptive layer 8 | 2408 | 2428 | 2448 | 2468 | 2488 | 24108 |
| IR absorptive layer 9 | 2409 | 2429 | 2449 | 2469 | 2489 | 24109 |
| IR absorptive layer 10 | 2410 | 2430 | 2450 | 2470 | 2490 | 24110 |
| Ir absorptive layer 11 | 2411 | 2431 | 2451 | 2471 | 2491 | 24111 |
| IR absorptive layer 12 | 2412 | 2432 | 2452 | 2472 | 2492 | 24112 |
| IR absorptive layer 13 | 2413 | 2433 | 2453 | 2473 | 2493 | 24113 |
| IR absorptive layer 14 | 2414 | 2434 | 2454 | 2474 | 2494 | 24114 |
| IR absorptive layer 15 | 2415 | 2435 | 2455 | 2475 | 2495 | 24115 |
| IR absorptive | 2416 | 2436 | 2456 | 2476 | 2496 | 24116 |

TABLE 41-continued

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| layer 16 | | | | | | |
| IR absorptive layer 17 | 2417 | 2437 | 2457 | 2477 | 2497 | 24117 |
| IR absorptive layer 18 | 2418 | 2438 | 2458 | 2478 | 2498 | 24118 |
| IR absorptive layer 19 | 2419 | 2439 | 2459 | 2479 | 2499 | 24119 |
| IR absorptive layer 20 | 2420 | 2440 | 2460 | 2480 | 21400 | 24120 |

TABLE 42

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer 2 | $SiH_4$ | 20 | 250 | 100 | 0.25 | 0.5 |
| | No | 20 | | | | |
| Contact layer 3 | $SiH_4$ | 20 | 250 | 150 | 0.25 | 0.5 |
| | $CH_4$ | 400 | | | | |
| | $H_2$ | 100 | | | | |
| Contact layer 4 | $SiH_4$ | 10 | 250 | 100 | 0.25 | 0.5 |
| | $SiF_4$ | 10 | | | | |
| | NO | 10 | | | | |
| | $N_2$ | 50 | | | | |
| | $CH_4$ | 200 | | | | |

TABLE 43

| | Contact Layer 2 | Contact Layer 3 | Contact Layer 4 |
|---|---|---|---|
| Drum No. | 2501 | 2502 | 2503 |

TABLE 44

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer 1 | $SiH_4$ | 20 | 250 | 100 | 0.25 | 0.5 |
| | $N_2$ | 100 | | | | |
| Contact layer 2 | $SiH_4$ | 20 | 250 | 100 | 0.25 | 0.5 |
| | NO | 10 | | | | |
| Contact layer 3 | $SiH_4$ | 20 | 250 | 150 | 0.25 | 0.5 |
| | $CH_4$ | 400 | | | | |
| | $H_2$ | 100 | | | | |
| Contact layer 4 | $SiH_4$ | 10 | 250 | 100 | 0.25 | 0.5 |
| | $SiF_4$ | 10 | | | | |
| | NO | 10 | | | | |
| | $N_2$ | 50 | | | | |
| | $CH_4$ | 200 | | | | |

TABLE 45

| Drum No. | Contact layer 1 | Contact layer 2 | Contact layer 3 | Contact layer 4 |
|---|---|---|---|---|
| Photo-conductive layer 1 | 2601 | 2607 | 2613 | 2619 |
| Photo-conductive layer 2 | 2602 | 2608 | 2614 | 2620 |
| Photo-conductive layer 3 | 2603 | 2609 | 2615 | 2621 |
| Photo-conductive layer 4 | 2604 | 2610 | 2616 | 2622 |
| Photo-conductive layer 5 | 2605 | 2611 | 2617 | 2623 |
| Photo-conductive | 2606 | 2612 | 2618 | 2624 |

TABLE 45-continued

| Drum No. | Contact layer 1 | Contact layer 2 | Contact layer 3 | Contact layer 4 |
|---|---|---|---|---|
| layer 6 | | | | |

TABLE 46

| Drum No. | Contact layer 1 | Contact layer 2 | Contact layer 3 | Contact layer 4 |
|---|---|---|---|---|
| Photo-conductive layer 1 | 2701 | 2707 | 2713 | 2719 |
| Photo-conductive layer 2 | 2702 | 2708 | 2714 | 2720 |
| Photo-conductive layer 3 | 2703 | 2709 | 2715 | 2721 |
| Photo-conductive layer 4 | 2704 | 2710 | 2716 | 2722 |
| Photo-conductive layer 5 | 2705 | 2711 | 2717 | 2723 |
| Photo-conductive | 2706 | 2712 | 2718 | 2724 |

TABLE 46-continued

| Drum No. | Contact layer 1 | Contact layer 2 | Contact layer 3 | Contact layer 4 |
|---|---|---|---|---|
| layer 6 | | | | |

TABLE 48-continued

| | Drum No. | | Drum No. |
|---|---|---|---|
| IR absorptive layer 10 | 2910 | | |

TABLE 49

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer 4 | $SiH_4$ | 100 | 250 | 130 | 0.25 | 3 |
| | $B_2H_6$ (against $SiH_4$) | 800 ppm | | | | |
| | NO | 4 | | | | |
| | $N_2$ | 4 | | | | |
| | $CH_4$ | 6 | | | | |
| Charge injection inhibition layer 5 | $SiH_4$ | 100 | 250 | 150 | 0.35 | 3 |
| | $H_2$ | 100 | | | | |
| | $PH_3$ (against $SiH_4$) | 800 ppm | | | | |
| Charge injection inhibition layer 7 | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO* | 10 | | | | |
| | NO** | 10 → 0*** | | | | |

*substrate side 2 μm
**surface layer side 2 μm
***constantly changed

TABLE 47

| Drum No. | Contact layer 1 | Contact layer 2 | Contact layer 3 | Contact layer 4 |
|---|---|---|---|---|
| Photo-conductive layer 1 | 2801 | 2807 | 2813 | 2819 |
| Photo-conductive layer 2 | 2802 | 2808 | 2814 | 2820 |
| Photo-conductive layer 3 | 2803 | 2809 | 2815 | 2821 |
| Photo-conductive layer 4 | 2804 | 2810 | 2816 | 2822 |
| Photo-conductive layer 5 | 2805 | 2811 | 2817 | 2823 |
| Photo-conductive layer 6 | 2806 | 2812 | 2818 | 2824 |

TABLE 48

| | Drum No. | | Drum No. |
|---|---|---|---|
| IR absorptive layer 1 | 2901 | IR absorptive layer 11 | 2911 |
| IR absorptive layer 2 | 2902 | IR absorptive layer 12 | 2912 |
| IR absorptive layer 3 | 2903 | IR absorptive layer 13 | 2913 |
| IR absorptive layer 4 | 2904 | IR absorptive layer 14 | 2914 |
| IR absorptive layer 5 | 2905 | IR absorptive layer 15 | 2915 |
| IR absorptive layer 6 | 2906 | IR absorptive layer 17 | 2917 |
| IR absorptive layer 7 | 2907 | IR absorptive layer 18 | 2918 |
| IR absorptive layer 8 | 2908 | IR absorptive layer 19 | 2919 |
| IR absorptive layer 9 | 2909 | IR absorptive layer 20 | 2920 |

TABLE 50

| Drum No. | Photo-conductive layer 4 | Photo-conductive layer 5 | Photo-conductive layer 7 |
|---|---|---|---|
| IR absorptive layer 1 | 3001 | 3021 | 3041 |
| IR absorptive layer 2 | 3002 | 3022 | 3042 |
| IR absorptive layer 3 | 3003 | 3023 | 3043 |
| IR absorptive layer 4 | 3004 | 3024 | 3044 |
| IR absorptive layer 5 | 3005 | 3025 | 3045 |
| IR absorptive layer 6 | 3006 | 3026 | 3046 |
| IR absorptive layer 7 | 3007 | 3027 | 3047 |
| IR absorptive layer 8 | 3008 | 3028 | 3048 |
| IR absorptive layer 9 | 3009 | 3029 | 3049 |
| IR absorptive layer 10 | 3010 | 3030 | 3050 |
| IR absorptive layer 11 | 3011 | 3031 | 3051 |
| IR absorptive layer 12 | 3012 | 3032 | 3052 |
| IR absorptive layer 13 | 3013 | 3033 | 3053 |
| IR absorptive layer 14 | 3014 | 3034 | 3054 |
| IR absorptive layer 15 | 3015 | 3035 | 3055 |
| IR absorptive layer 16 | 3016 | 3036 | 3056 |
| IR absorptive layer 17 | 3017 | 3037 | 3057 |
| IR absorptive layer 18 | 3018 | 3038 | 3058 |
| IR absorptive layer 19 | 3019 | 3039 | 3059 |
| IR absorptive layer 20 | 3020 | 3040 | 3060 |

TABLE 51

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer 1 | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Charge injection inhibition layer 4 | $SiH_4$ | 100 | 250 | 130 | 0.25 | 3 |
| | $B_2H_6$ (against $SiH_4$) | 800 ppm | | | | |
| | NO | 4 | | | | |
| | $N_2$ | 4 | | | | |
| | $CH_4$ | 6 | | | | |
| Charge injection inhibition layer 5 | $SiH_4$ | 100 | 250 | 150 | 0.35 | 3 |
| | $H_2$ | 100 | | | | |
| | $PH_3$ (against $SiH_4$) | 800 ppm | | | | |
| Charge injection inhibition layer 7 | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO* | 10 | | | | |
| | NO** | 10 → 0*** | | | | |

*substrate side 2 μm
**surface layer side 2 μm
***constantly changed

TABLE 52

| Drum No. | Photo-conductive layer 1 | Photo-conductive layer 4 | Photo-conductive layer 5 | Photo-conductive layer 7 |
|---|---|---|---|---|
| IR absorptive layer 1 | 3101 | 3121 | 3141 | 3161 |
| IR absorptive layer 2 | 3102 | 3122 | 3142 | 3162 |
| IR absorptive layer 3 | 3103 | 3123 | 3143 | 3163 |
| IR absorptive layer 4 | 3104 | 3124 | 3144 | 3164 |
| IR absorptive layer 5 | 3105 | 3125 | 3145 | 3165 |
| IR absorptive layer 6 | 3106 | 3126 | 3146 | 3166 |
| IR absorptive layer 7 | 3107 | 3127 | 3147 | 3167 |
| IR absorptive layer 8 | 3108 | 3128 | 3148 | 3168 |
| IR absorptive layer 9 | 3109 | 3129 | 3149 | 3169 |
| IR absorptive layer 10 | 3110 | 3130 | 3150 | 3170 |
| IR absorptive layer 11 | 3111 | 3131 | 3151 | 3171 |
| IR absorptive layer 12 | 3112 | 3132 | 3152 | 3172 |
| IR absorptive layer 13 | 3113 | 3133 | 3153 | 3173 |
| IR absorptive layer 14 | 3114 | 3134 | 3154 | 3174 |
| IR absorptive layer 15 | 3115 | 3135 | 3155 | 3175 |
| IR absorptive layer 16 | 3116 | 3136 | 3156 | 3176 |
| IR absorptive layer 17 | 3117 | 3137 | 3157 | 3177 |
| IR absorptive layer 18 | 3118 | 3138 | 3158 | 3178 |
| IR absorptive layer 19 | 3119 | 3139 | 3159 | 3179 |
| IR absorptive layer 20 | 3120 | 3140 | 3160 | 3180 |

TABLE 53

| Drum No. | Photo-conductive layer 1 | Photo-conductive layer 4 | Photo-conductive layer 5 | Photo-conductive layer 7 |
|---|---|---|---|---|
| IR absorptive layer 1 | 3201 | 3221 | 3241 | 3261 |
| IR absorptive layer 2 | 3202 | 3222 | 3242 | 3262 |

TABLE 53-continued

| Drum No. | Photo-conductive layer 1 | Photo-conductive layer 4 | Photo-conductive layer 5 | Photo-conductive layer 7 |
|---|---|---|---|---|
| IR absorptive layer 3 | 3203 | 3223 | 3243 | 3263 |
| IR absorptive layer 4 | 3204 | 3224 | 3244 | 3264 |
| IR absorptive layer 5 | 3205 | 3225 | 3245 | 3265 |
| IR absorptive layer 6 | 3206 | 3226 | 3246 | 3266 |
| IR absorptive layer 7 | 3207 | 3227 | 3247 | 3267 |
| IR absorptive layer 8 | 3208 | 3228 | 3248 | 3268 |
| IR absorptive layer 9 | 3209 | 3229 | 3249 | 3269 |
| IR absorptive layer 10 | 3210 | 3230 | 3250 | 3270 |
| IR absorptive layer 11 | 3211 | 3231 | 3251 | 3271 |
| IR absorptive layer 12 | 3212 | 3232 | 3252 | 3272 |
| IR absorptive layer 13 | 3213 | 3233 | 3253 | 3273 |
| IR absorptive layer 14 | 3214 | 3234 | 3254 | 3274 |
| IR absorptive layer 15 | 3215 | 3235 | 3255 | 3275 |
| IR absorptive layer 16 | 3216 | 3236 | 3256 | 3276 |
| IR absorptive layer 17 | 3217 | 3237 | 3257 | 3277 |
| IR absorptive layer 18 | 3218 | 3238 | 3258 | 3278 |
| IR absorptive layer 19 | 3219 | 3239 | 3259 | 3279 |
| IR absorptive layer 20 | 3220 | 3240 | 3260 | 3280 |

TABLE 54

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer 6 | $SiH_4$ | 20 | 250 | 50 | 0.05 | 0.5 |
| | NO | 2 | | | | |
| Contact layer 7 | $SiH_4$ | 20 | 250 | 50 | 0.05 | 0.5 |
| | $CH_4$ | 40 | | | | |
| | $H_2$ | 50 | | | | |

TABLE 54-continued

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer 8 | $SiH_4$ | 10 | 250 | 50 | 0.05 | 0.5 |
| | $SiF_4$ | 10 | | | | |
| | NO | 4 | | | | |
| | $N_2$ | 4 | | | | |
| | $CH_4$ | 6 | | | | |

TABLE 55

| | Contact Layer 1 | Contact Layer 2 | Contact Layer 3 | Contact Layer 4 | Contact Layer 6 | Contact Layer 7 | Contact Layer 8 |
|---|---|---|---|---|---|---|---|
| Drum No. | 3301 | 3302 | 3303 | 3304 | 3305 | 3306 | 3307 |

TABLE 56

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer 2 | $SiH_4$ | 100 | 250 | 150 | 0.35 | 3 |
| | $H_2$ | 100 | | | | |
| | $B_2H_6$ (against $SiH_4$) | 1000 ppm | | | | |
| | $GeH_4$ | 10 | | | | |
| | NO | 10 | | | | |
| Charge injection inhibition layer 3 | $SiH_4$ | 80 | 250 | 170 | 0.25 | 3 |
| | $SiF_4$ | 20 | | | | |
| | $B_2H_6$ (against $SiH_4$) | 1000 ppm | | | | |
| | $SnH_4$ | 5 | | | | |
| | NO | 5 | | | | |
| Charge injection inhibition layer 7 | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO* | 10 | | | | |
| | NO** | 10 → 0*** | | | | |

*substrate side 2 μm
**surface layer side 2 μm
***constantly changed

TABLE 57

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer 5 | $SiH_4$ | 20 | 250 | 50 | 0.05 | 0.5 |
| | $N_2$ | 10 | | | | |
| Contact layer 6 | $SiH_4$ | 20 | 250 | 50 | 0.05 | 0.5 |
| | NO | 2 | | | | |
| Contact layer 7 | $SiH_4$ | 20 | 250 | 50 | 0.05 | 0.5 |
| | $CH_4$ | 40 | | | | |
| | $H_2$ | 50 | | | | |
| Contact layer 8 | $SiH_4$ | 10 | 250 | 50 | 0.05 | 0.5 |
| | $SiF_4$ | 10 | | | | |
| | NO | 4 | | | | |
| | $N_2$ | 4 | | | | |
| | $CH_4$ | 6 | | | | |

TABLE 58

| Drum No. | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|
| Contact layer 1 | 3401 | 3409 | 3417 | 3425 | 3433 | 3441 |
| Contact layer 2 | 3402 | 3410 | 3418 | 3426 | 3434 | 3442 |
| Contact layer 3 | 3403 | 3411 | 3419 | 3427 | 3435 | 3443 |
| Contact layer 4 | 3404 | 3412 | 3420 | 3428 | 3436 | 3444 |
| Contact layer 5 | 3405 | 3413 | 3421 | 3429 | 3437 | 3445 |
| Contact layer 6 | 3406 | 3414 | 3422 | 3430 | 3438 | 3446 |
| Contact layer 7 | 3407 | 3415 | 3423 | 3431 | 3439 | 3447 |
| Contact layer 8 | 3408 | 3416 | 3424 | 3432 | 3440 | 3448 |

TABLE 59

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection layer 7 |
|---|---|---|---|---|---|---|---|
| Contact layer 1 | 3501 | 3509 | 3517 | 3525 | 3533 | 3541 | 3549 |
| Contact layer 2 | 3502 | 3510 | 3518 | 3526 | 3534 | 3542 | 3550 |
| Contact layer 3 | 3503 | 3511 | 3519 | 3527 | 3535 | 3543 | 3551 |
| Contact | 3504 | 3512 | 3520 | 3528 | 3536 | 3544 | 3552 |

TABLE 59-continued

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection layer 7 |
|---|---|---|---|---|---|---|---|
| layer 4 | | | | | | | |
| Contact layer 5 | 3505 | 3513 | 3521 | 3529 | 3537 | 3545 | 3553 |
| Contact layer 6 | 3506 | 3514 | 3522 | 3530 | 3538 | 3546 | 3554 |
| Contact layer 7 | 3507 | 3515 | 3523 | 3531 | 3539 | 3547 | 3555 |
| Contact layer 8 | 3508 | 3516 | 3524 | 3532 | 3540 | 3548 | 3556 |

TABLE 60

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| Contact layer 1 | 3601 | 3609 | 3617 | 3625 | 3633 | 3641 | 3649 |
| Contact layer 2 | 3602 | 3610 | 3618 | 3626 | 3634 | 3642 | 3650 |
| Contact layer 3 | 3603 | 3611 | 3619 | 3627 | 3635 | 3643 | 3651 |
| Contact layer 4 | 3604 | 3612 | 3620 | 3628 | 3636 | 3644 | 3652 |
| Contact layer 5 | 3605 | 3613 | 3621 | 3629 | 3637 | 3645 | 3653 |
| Contact layer 6 | 3606 | 3614 | 3622 | 3630 | 3638 | 3646 | 3654 |
| Contact layer 7 | 3607 | 3615 | 3623 | 3631 | 3639 | 3647 | 3655 |
| Contact layer 8 | 3608 | 3616 | 3624 | 3632 | 3640 | 3648 | 3656 |

TABLE 61

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer 4 | $SiH_4$ | 100 | 250 | 130 | 0.25 | 3 |
| | $B_2H_6$ (against $SiH_4$) | 800 ppm | | | | |
| | NO | 4 | | | | |
| | $N_2$ | 4 | | | | |
| | $CH_4$ | 6 | | | | |
| Charge injection inhibition layer 6 | $SiH_4$ | 100 250 | 130 | 0.25 | 3 | |
| | $PH_3$ (against $SiH_4$) | 800 ppm | | | | |
| | $GeH_4$ | 10 | | | | |
| | NO | 10 | | | | |
| Charge injection inhibition layer 7 | $SiH_4$ | 100 250 | 150 | 0.35 | 3 | |
| | $H_2$ | 100 | | | | |
| | $B_2H_6$(against $SiH_4$) | 1000 ppm | | | | |
| | NO* | 10 | | | | |
| | NO** | 10 → 0*** | | | | |

*substrate side 2 μm
**surface layer side 2 μm
***constantly changed

TABLE 62

| | Charge injection inhibition layer 4 | Charge injection inhibition layer 6 | Charge injection inhibition layer 7 |
|---|---|---|---|
| Drum No. | 3701 | 3702 | 3703 |

TABLE 63

| Name of layer | Gas used and its flow rate (SCCM) | | Substrate temperature (°C.) | RF power (W) | Inner pressure (Torr) | Layer thickness (μm) |
|---|---|---|---|---|---|---|
| Photoconductive layer 5 | $SiH_4$ | 200 | 250 | 250 | 0.40 | 20 |
| | Ar | 200 | | | | |
| Photoconductive layer 6 | $SiH_4$ | 150 | 250 | 350 | 0.40 | 20 |
| | $SiF_4$ | 50 | | | | |
| | $H_2$ | 200 | | | | |

TABLE 64

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer 1 | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Charge injection inhibition layer 4 | $SiH_4$ | 100 250 | 130 | 0.25 | 3 | |
| | $B_2H_6$ (against $SiH_4$) | 800 ppm | | | | |
| | NO | 4 | | | | |
| | $N_2$ | 4 | | | | |
| | $CH_4$ | 6 | | | | |
| Charge injection inhibition layer 6 | $SiH_4$ | 100 250 | 130 | 0.25 | 3 | |
| | $PH_3$ (against $SiH_4$) | 800 ppm | | | | |
| | $GeH_4$ | 10 | | | | |
| | NO | 10 | | | | |
| Charge injection inhibition layer 7 | $SiH_4$ | 100 250 | 150 | 0.35 | 3 | |
| | $H_2$ | 100 | | | | |
| | $B_2H_6$ (against $SiH_4$) | 1000 ppm | | | | |
| | NO* | 10 | | | | |
| | NO** | 10 → 0*** | | | | |

*substrate side 2 μm
**surface layer side 2 μm
***constantly changed

TABLE 65

| Drum No. | Charge injection inhibition layer 1 | Charge injection inhibition layer 4 | Charge injection inhibition layer 6 | Charge injection inhibition layer 7 |
|---|---|---|---|---|
| Photo-conductive layer 5 | 3801 | 3803 | 3805 | 3807 |
| Photo-conductive layer 6 | 3802 | 3804 | 3806 | 3808 |

TABLE 66

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer 4 | $SiH_4$ | 200 | 250 | 300 | 0.40 | 20 |
| | $H_2$ | 200 | | | | |
| Photo-conductive layer 5 | $SiH_4$ | 200 | 250 | 250 | 0.40 | 20 |
| | Ar | 200 | | | | |
| Photo-conductive layer 6 | $SiH_4$ | 150 | 250 | 350 | 0.40 | 20 |
| | $SiF_4$ | 50 | | | | |
| | $H_2$ | 200 | | | | |

TABLE 67

| Drum No. | Charge injection inhibition layer 1 | Charge injection inhibition layer 4 | Charge injection inhibition layer 6 | Charge injection inhibition layer 7 |
|---|---|---|---|---|
| Photo-conductive layer 4 | 3901 | 3904 | 3907 | 3910 |
| Photo-conductive layer 5 | 3902 | 3905 | 3908 | 3911 |
| Photo-conductive layer 6 | 3903 | 3906 | 3909 | 3912 |

| Drum No. | Charge injection inhibition layer 1 | Charge injection inhibition layer 4 | Charge injection inhibition layer 6 | Charge injection inhibition layer 7 |
|---|---|---|---|---|
| Photo-conductive layer 4 | 4001 | 4004 | 4007 | 4010 |
| Photo-conductive layer 5 | 4002 | 4005 | 4008 | 4011 |
| Photo-conductive layer 6 | 4003 | 4006 | 4009 | 4012 |

TABLE 70

| Name of layer | Gas used and its flow rate (SCCM) | | Substrate temperature (°C.) | RF power (W) | Inner pressure (Torr) | Layer thickness (μm) |
|---|---|---|---|---|---|---|
| Surface layer 1 | $B_2H_6$/Ar (20%) | 500 | 250 | 200 | 0.35 | 0.5 |
| | $NH_3$ | 100 | | | | |

TABLE 69

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.40 | 20 |
| | Ar | 200 | | | | |

TABLE 71

| Drum No. | Photo-conductive layer 1 | Photo-conductive layer 4 | Photo-conductive layer 5 | Photo-conductive layer 7 |
|---|---|---|---|---|
| IR absorptive layer 1 | 4101 | 4121 | 4141 | 4161 |
| IR absorptive layer 2 | 4102 | 4122 | 4142 | 4162 |
| IR absorptive layer 3 | 4103 | 4123 | 4143 | 4163 |
| IR absorptive layer 4 | 4104 | 4124 | 4144 | 4164 |
| IR absorptive layer 5 | 4105 | 4125 | 4145 | 4165 |
| IR absorptive layer 6 | 4106 | 4126 | 4146 | 4166 |
| IR absorptive layer 7 | 4107 | 4127 | 4147 | 4167 |
| IR absorptive layer 8 | 4108 | 4128 | 4148 | 4168 |
| IR absorptive layer 9 | 4109 | 4129 | 4149 | 4169 |
| IR absorptive layer 10 | 4110 | 4130 | 4150 | 4170 |
| IR absorptive layer 11 | 4111 | 4131 | 4151 | 4171 |
| IR absorptive layer 12 | 4112 | 4132 | 4152 | 4172 |
| IR absorptive layer 13 | 4113 | 4133 | 4153 | 4173 |
| IR absorptive layer 14 | 4114 | 4134 | 4154 | 4174 |
| IR absorptive layer 15 | 4115 | 4135 | 4155 | 4175 |
| IR absorptive layer 16 | 4116 | 4136 | 4156 | 4176 |
| IR absorptive layer 17 | 4117 | 4137 | 4157 | 4177 |
| IR absorptive layer 18 | 4118 | 4138 | 4158 | 4178 |
| IR absorptive layer 19 | 4119 | 4139 | 4159 | 4179 |
| IR absorptive layer 20 | 4120 | 4140 | 4160 | 4180 |

TABLE 72

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 150 | 250 | 350 | 0.40 | 20 |
| | $SiF_4$ | 50 | | | | |
| | $H_2$ | 200 | | | | |

TABLE 73

| Drum No. | Photo-conductive layer 1 | Photo-conductive layer 4 | Photo-conductive layer 5 | Photo-conductive layer 7 |
|---|---|---|---|---|
| IR absorptive layer 1 | 4201 | 4221 | 4241 | 4261 |
| IR absorptive layer 2 | 4202 | 4222 | 4242 | 4262 |
| IR absorptive layer 3 | 4203 | 4223 | 4243 | 4263 |
| IR absorptive layer 4 | 4204 | 4224 | 4244 | 4264 |
| IR absorptive layer 5 | 4205 | 4225 | 4245 | 4265 |
| IR absorptive layer 6 | 4206 | 4226 | 4246 | 4266 |
| IR absorptive layer 7 | 4207 | 4227 | 4247 | 4267 |
| IR absorptive layer 8 | 4208 | 4228 | 4248 | 4268 |
| IR absorptive layer 9 | 4209 | 4229 | 4249 | 4269 |
| IR absorptive layer 10 | 4210 | 4230 | 4250 | 4270 |
| IR absorptive layer 11 | 4211 | 4231 | 4251 | 4271 |

TABLE 73-continued

| Drum No. | Photo-conductive layer 1 | Photo-conductive layer 4 | Photo-conductive layer 5 | Photo-conductive layer 7 |
|---|---|---|---|---|
| IR absorptive layer 12 | 4212 | 4232 | 4252 | 4272 |
| IR absorptive layer 13 | 4213 | 4233 | 4253 | 4273 |
| IR absorptive layer 14 | 4214 | 4234 | 4254 | 4274 |
| IR absorptive layer 15 | 4215 | 4235 | 4255 | 4275 |
| IR absorptive layer 16 | 4216 | 4236 | 4256 | 4276 |
| IR absorptive layer 17 | 4217 | 4237 | 4257 | 4277 |
| IR absorptive layer 18 | 4218 | 4238 | 4258 | 4278 |
| IR absorptive layer 19 | 4219 | 4239 | 4259 | 4279 |
| IR absorptive layer 20 | 4220 | 4240 | 4260 | 4280 |

TABLE 74

| Drum No. | Photo-conductive layer 1 | Photo-conductive layer 4 | Photo-conductive layer 5 | Photo-conductive layer 7 |
|---|---|---|---|---|
| IR absorptive layer 1 | 4301 | 4321 | 4341 | 4361 |
| IR absorptive layer 2 | 4302 | 4322 | 4342 | 4362 |
| IR absorptive layer 3 | 4303 | 4323 | 4343 | 4363 |
| IR absorptive layer 4 | 4304 | 4324 | 4344 | 4364 |
| IR absorptive layer 5 | 4305 | 4325 | 4345 | 4365 |
| IR absorptive layer 6 | 4306 | 4326 | 4346 | 4366 |
| IR absorptive layer 7 | 4307 | 4327 | 4347 | 4367 |
| IR absorptive layer 8 | 4308 | 4328 | 4348 | 4368 |
| IR absorptive layer 9 | 4309 | 4329 | 4349 | 4369 |
| IR absorptive layer 10 | 4310 | 4330 | 4350 | 4370 |
| IR absorptive layer 11 | 4311 | 4331 | 4351 | 4371 |
| IR absorptive layer 12 | 4312 | 4332 | 4352 | 4372 |
| IR absorptive layer 13 | 4313 | 4333 | 4353 | 4373 |
| IR absorptive layer 14 | 4314 | 4334 | 4354 | 4374 |
| IR absorptive layer 15 | 4315 | 4335 | 4355 | 4375 |
| IR absorptive layer 16 | 4316 | 4336 | 4356 | 4376 |
| IR absorptive layer 17 | 4317 | 4337 | 4357 | 4377 |
| IR absorptive layer 18 | 4318 | 4338 | 4358 | 4378 |
| IR absorptive layer 19 | 4319 | 4339 | 4359 | 4379 |
| IR absorptive layer 20 | 4320 | 4340 | 4360 | 4380 |

TABLE 75

| Drum No. | Photo-conductive layer 1 | Photo-conductive layer 4 | Photo-conductive layer 5 | Photo-conductive layer 7 |
|---|---|---|---|---|
| IR absorptive layer 1 | 4401 | 4421 | 4441 | 4461 |
| IR absorptive layer 2 | 4402 | 4422 | 4442 | 4462 |
| IR absorptive layer 3 | 4403 | 4423 | 4443 | 4463 |
| IR absorptive layer 4 | 4404 | 4424 | 4444 | 4464 |
| IR absorptive layer 5 | 4405 | 4425 | 4445 | 4465 |
| IR absorptive layer 6 | 4406 | 4426 | 4446 | 4466 |
| IR absorptive layer 7 | 4407 | 4427 | 4447 | 4467 |
| IR absorptive layer 8 | 4408 | 4428 | 4448 | 4468 |
| IR absorptive layer 9 | 4409 | 4429 | 4449 | 4469 |
| IR absorptive layer 10 | 4410 | 4430 | 4450 | 4470 |
| IR absorptive layer 11 | 4411 | 4431 | 4451 | 4471 |
| IR absorptive layer 12 | 4412 | 4432 | 4452 | 4472 |
| IR absorptive layer 13 | 4413 | 4433 | 4453 | 4473 |
| IR absorptive layer 14 | 4414 | 4434 | 4454 | 4474 |
| IR absorptive layer 15 | 4415 | 4435 | 4455 | 4475 |
| IR absorptive layer 16 | 4416 | 4436 | 4456 | 4476 |
| IR absorptive layer 17 | 4417 | 4437 | 4457 | 4477 |
| IR absorptive layer 18 | 4418 | 4438 | 4458 | 4478 |
| IR absorptive layer 19 | 4419 | 4439 | 4459 | 4479 |
| IR absorptive layer 20 | 4420 | 4440 | 4460 | 4480 |

TABLE 76

| Drum No. | Photo-conductive layer 1 | Photo-conductive layer 4 | Photo-conductive layer 5 | Photo-conductive layer 7 |
|---|---|---|---|---|
| IR absorptive layer 1 | 4501 | 4521 | 4541 | 4561 |
| IR absorptive layer 2 | 4502 | 4522 | 4542 | 4562 |
| IR absorptive layer 3 | 4503 | 4523 | 4543 | 4563 |
| IR absorptive layer 4 | 4504 | 4524 | 4544 | 4564 |
| IR absorptive layer 5 | 4505 | 4525 | 4545 | 4565 |
| IR absorptive layer 6 | 4506 | 4526 | 4546 | 4566 |
| IR absorptive layer 7 | 4507 | 4527 | 4547 | 4567 |
| IR absorptive layer 8 | 4508 | 4528 | 4548 | 4568 |
| IR absorptive layer 9 | 4509 | 4529 | 4549 | 4569 |
| IR absorptive layer 10 | 4510 | 4530 | 4550 | 4570 |

TABLE 76-continued

| Drum No. | Photo-conductive layer 1 | Photo-conductive layer 4 | Photo-conductive layer 5 | Photo-conductive layer 7 |
|---|---|---|---|---|
| IR absorptive layer 11 | 4511 | 4531 | 4551 | 4571 |
| IR absorptive layer 12 | 4512 | 4532 | 4552 | 4572 |
| IR absorptive layer 13 | 4513 | 4533 | 4553 | 4573 |
| IR absorptive layer 14 | 4514 | 4534 | 4554 | 4574 |
| IR absorptive layer 15 | 4515 | 4535 | 4555 | 4575 |
| IR absorptive layer 16 | 4516 | 4536 | 4556 | 4576 |
| IR absorptive layer 17 | 4517 | 4537 | 4557 | 4577 |
| IR absorptive layer 18 | 4518 | 4538 | 4558 | 4578 |
| IR absorptive layer 19 | 4519 | 4539 | 4559 | 4579 |
| IR absorptive layer 20 | 4520 | 4540 | 4560 | 4580 |

TABLE 77

| Drum No. | Photo-conductive layer 1 | Photo-conductive layer 4 | Photo-conductive layer 5 | Photo-conductive layer 7 |
|---|---|---|---|---|
| IR absorptive layer 1 | 4601 | 4621 | 4641 | 4661 |
| IR absorptive layer 2 | 4602 | 4622 | 4642 | 4662 |
| IR absorptive layer 3 | 4603 | 4623 | 4643 | 4663 |
| IR absorptive layer 4 | 4604 | 4624 | 4644 | 4664 |
| IR absorptive layer 5 | 4605 | 4625 | 4645 | 4665 |
| IR absorptive layer 6 | 4606 | 4626 | 4646 | 4666 |
| IR absorptive layer 7 | 4607 | 4627 | 4647 | 4667 |
| IR absorptive layer 8 | 4608 | 4628 | 4648 | 4668 |
| IR absorptive layer 9 | 4609 | 4629 | 4649 | 4669 |
| IR absorptive layer 10 | 4610 | 4630 | 4650 | 4670 |
| IR absorptive layer 11 | 4611 | 4631 | 4651 | 4671 |
| IR absorptive layer 12 | 4612 | 4632 | 4652 | 4672 |
| IR absorptive layer 13 | 4613 | 4633 | 4653 | 4673 |
| IR absorptive layer 14 | 4614 | 4634 | 4654 | 4674 |
| IR absorptive layer 15 | 4615 | 4635 | 4655 | 4675 |
| IR absorptive layer 16 | 4616 | 4636 | 4656 | 4676 |
| IR absorptive layer 17 | 4617 | 4637 | 4657 | 4677 |
| IR absorptive layer 18 | 4618 | 4638 | 4658 | 4678 |
| IR absorptive layer 19 | 4619 | 4639 | 4659 | 4679 |
| IR absorptive layer 20 | 4620 | 4640 | 4660 | 4680 |

TABLE 78

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |

TABLE 78-continued

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 350 | 0.35 | 20 |
| | He | 200 | | | | |

TABLE 79

| Drum No. | Gas used and its flow rate (SCCM) | | Substrate temperature (°C.) | RF power (W) | Inner pressure (Torr) | Layer thickness (μm) |
|---|---|---|---|---|---|---|
| 4701 | $B_2H_6$/Ar (20%) | 500 | 250 | 200 | 0.35 | 0.5 |
| | $NH_3$ | 100 | | | | |
| 4702 | $B_2H_6$/Ar (20%) | 500 | 250 | 200 | 0.40 | 0.5 |
| | $H_2$ | 100 | | | | |
| | $NH_3$ | 100 | | | | |
| 4703 | $B_2H_6$/Ar (20%) | 500 | 250 | 200 | 0.35 | 0.5 |
| | $NH_3$ | 100 | | | | |
| | Bias voltage of the cylinder | 150 V | | | | |

TABLE 80

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 350 | 0.35 | 20 |
| | He | 200 | | | | |

TABLE 81

| Drum No. | Gas used and its flow rate (SCCM) | | Substrate temperature (°C.) | RF power (W) | Inner pressure (Torr) | Layer thickness (μm) |
|---|---|---|---|---|---|---|
| 4801 | $B_2H_6$/Ar (20%) | 500 | 250 | 200 | 0.35 | 0.5 |
| | $NH_3$ | 100 | | | | |
| 4802 | $B_2H_6$/Ar (20%) | 500 | 250 | 200 | 0.40 | 0.5 |
| | $H_2$ | 100 | | | | |
| | $NH_3$ | 100 | | | | |
| 4803 | $B_2H_6$/Ar (20%) | 500 | 250 | 200 | 0.35 | 0.5 |
| | $NH_3$ | 100 | | | | |
| | Bias voltage of the cylinder | −150 V | | | | |

TABLE 82

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 350 | 0.35 | 20 |
| | He | 200 | | | | |

TABLE 83

| Drum No. | Gas used and its flow rate (SCCM) | | Substrate temperature (°C.) | RF power (W) | Inner pressure (Torr) | Layer thickness (μm) |
|---|---|---|---|---|---|---|
| 4901 | $B_2H_6$/Ar (20%) | 500 | 250 | 200 | 0.35 | 0.5 |
| | $NH_3$ | 100 | | | | |
| 4902 | $B_2H_6$/Ar (20%) | 500 | 250 | 200 | 0.40 | 0.5 |
| | $H_2$ | 100 | | | | |
| | $NH_3$ | 100 | | | | |
| 4903 | $B_2H_6$/Ar (20%) | 500 | 250 | 200 | 0.35 | 0.5 |
| | $NH_3$ | 100 | | | | |
| | Bias voltage of the cylinder | −150 V | | | | |

TABLE 84

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Inter-mediate layer | $SiH_4$ | 10 | 250 | 150 | 0.35 | 0.3 |
| | $CH_4$ | 400 | | | | |
| Surface layer | $B_2H_6$/Ar (20%) | 500 | 250 | 200 | 0.35 | 0.5 |
| | $NH_3$ | 100 | | | | |

TABLE 85

| Drum No. | 5101 | 5102 | 5103 | 5104 | 5105 |
|---|---|---|---|---|---|
| a (μm) | 25 | 50 | 50 | 12 | 12 |
| b (μm) | 0.8 | 2.5 | 0.8 | 1.5 | 0.3 |

TABLE 86

| Drum No. | 5201 | 5202 | 5203 | 5204 | 5205 |
|---|---|---|---|---|---|
| c (μm) | 50 | 100 | 100 | 30 | 30 |
| d (μm) | 1.2 | 5 | 0.9 | 2.5 | 0.4 |

TALBE 87

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer | $B_2H_6$/He (20%) | 500 | 250 | 100 | 0.35 | 0.5 |
| | $NH_3$ | 100 | | | | |

TABLE 88

| Intial electri-fication efficiency | Residual voltage | Ghost | Defective image | Image flow | Increase defective image |
|---|---|---|---|---|---|
| ○ | ○ | ○ | ◎ | ◎ | ◎ |

TABLE 88-continued

| Surface abrasion | Break down voltage | Abrasion resistance | Degree of background fogginess | Degree of residual stress |
|---|---|---|---|---|
| | ○ | ○ | ◎ | ◎ |

◎: Excellent
○: Good

TABLE 89

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer | $B_2H_6$/He (20%) | 500 | 250 | 100 | 0.40 | 0.5 |
| | $H_2$ | 100 | | | | |
| | $NH_3$ | 300 | | | | |

TABLE 90

| Initial electri-fication efficiency | Residual voltage | Ghost | Defective image | Image flow | Increase of defective image |
|---|---|---|---|---|---|
| ○ | ○ | ○ | ◎ | ◎ | ○ |

| Surface | Break down | Abrasion | Degree of background | Degree of residual |
|---|---|---|---|---|

TABLE 90-continued

| abrasion | voltage | resistance | fogginess | stress |
|---|---|---|---|---|
| ○ | ○ | ○ | ◎ | ◎ |

◎: Excellent
○: Good

TABLE 91

| Initial electri-fication efficiency | Residual voltage | Ghost | Defective image | Image flow | Increase of defective image |
|---|---|---|---|---|---|
| ○ | ○ | ○ | ◎ | ◎ | ○ |

| Surface abrasion | Break down voltage | Abrasion resistance | Degree of background fogginess | Degree of residual stress |
|---|---|---|---|---|
| ○ | ○ | ○ | ◎ | ◎ |

○: Excellent
○: Good

TABLE 92

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |

TABLE 93

| Initial electri-fication efficiency | Residual voltage | Ghost | Defective image | Image flow | Increase of defective image |
|---|---|---|---|---|---|
| ◎ | ○ | ○ | ◎ | ◎ | ○ |

| Surface abrasion | Break down voltage | Abrasion resistance | Degree of background fogginess | Degree of residual stress |
|---|---|---|---|---|
| ○ | ○ | ○ | ◎ | ◎ |

TABLE 93-continued

| Initial electri-fication efficiency | Residual voltage | Ghost | Defective image | Image flow | Increase of defective image |
|---|---|---|---|---|---|
| ○ | ○ | ○ | ◎ | ◎ | ○ |

| Surface abrasion | Break down voltage | Abrasion resistance | Inter-ference fringe | Degree of background fogginess | Degree of residual stress |
|---|---|---|---|---|---|
| ○ | ○ | ○ | ○ | ◎ | ◎ |

◎: Excellent
○: Good

TABLE 94

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |

TABLE 95

| Initial electri-fication efficiency | Residual voltage | Ghost | Defective image | Image flow | Increase of defective image |
|---|---|---|---|---|---|
| ◎ | ○ | ○ | ◎ | ◎ | ○ |

| Surface abrasion | Break down voltage | Abrasion resistance | Degree of background fogginess | Degree of residual stress |
|---|---|---|---|---|
| ○ | ○ | ○ | ◎ | ◎ |

◎: Excellent
○: Good

TABLE 96

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |

TABLE 97

TABLE 97-continued

◎: Excellent
○: Good

TABLE 98

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 100 | 0.25 | 0.5 |
| | $N_2$ | 100 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |

TABLE 99

| Initial electri-fication efficiency | Residual voltage | Ghost | Defective image | Image flow | Increase of defective image |
|---|---|---|---|---|---|
| ◎ | ○ | ○ | ◎ | ◎ | ○ |

| Surface abrasion | Break down voltage | Abrasion resistance | Degree of background fogginess | Degree of residual stress |
|---|---|---|---|---|
| ○ | ○ | ○ | ◎ | ○ |

◎: Excellent
○: Good

TABLE 100

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |

TABLE 101

| Initial electri-fication | Residual | Defective | Image | Increase of defective |
|---|---|---|---|---|

TABLE 101-continued

| efficiency | voltage | Ghost | image | flow | image |
|---|---|---|---|---|---|
| ◎ | ○ | ○ | ◎ | ◎ | ○ |

| Surface | Break down | Abrasion | Inter-ference | Degree of background | Degree of residual |
|---|---|---|---|---|---|

| abrasion | voltage | resistance | fringe | fogginess | stress |
|---|---|---|---|---|---|
| ○ | ○ | ○ | ○ | ◎ | ◎ |

◎: Excellent
○: Good

TABLE 102

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |

TABLE 103

| Initial electri-fication efficiency | Residual voltage | Ghost | Defective image | Image flow | Increase of defective image |
|---|---|---|---|---|---|
| ◎ | ○ | ○ | ◎ | ◎ | ○ |

| Surface | Break down | Abrasion | Degree of background | Degree of residual |
|---|---|---|---|---|

| abrasion | voltage | resistance | fogginess | stress |
|---|---|---|---|---|
| ○ | ○ | ○ | ◎ | ◎ |

◎: Excellent
○: Good

TABLE 104

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_3H_6$/He (20%) | 500 | 250 | 100 | 0.35 | 0.5 |
| | $NH_3$ | 100 | | | | |

TABLE 105

| Initial electrification efficiency | Residual voltage | Ghost | Defective image | Image flow | Increase of defective image |
|---|---|---|---|---|---|
| ◎ | ○ | ○ | ◎ | ◎ | ○ |

| Surface abrasion | Breakdown voltage | Abrasion resistance | Interference fringe | Degree of background fogginess | Degree of residual stress |
|---|---|---|---|---|---|
| ○ | ○ | ○ | ○ | ◎ | ◎ |

◎: Excellent
○ : Good

TABLE 106

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| Photo-conductive layer 1 | 6701 | 6706 | 6711 | 6716 | 6721 | 6726 | 6731 |
| Photo-conductive layer 2 | 6702 | 6707 | 6712 | 6717 | 6722 | 6727 | 6732 |
| Photo-conductive layer 3 | 6703 | 6708 | 6713 | 6718 | 6723 | 6728 | 6733 |
| Photo-conductive layer 5 | 6704 | 6709 | 6714 | 6719 | 6724 | 6729 | 6734 |
| Photo-conductive layer 6 | 6705 | 6710 | 6715 | 6720 | 6725 | 6730 | 6735 |

TABLE 107

| Name of layer | Gas used and its flow rate (SCCM) | | Substrate temperature (°C.) | RF power (W) | Inner pressure (Torr) | Layer thickness (μm) |
|---|---|---|---|---|---|---|
| Surface layer | $B_2H_6$/He (20%) | 500 | 250 | 100 | 0.40 | 0.5 |
| | $H_2$ | 100 | | | | |
| | $NH_3$ | 300 | | | | |

TABLE 108

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| Photo-conductive layer 1 | 6801 | 6807 | 6813 | 6819 | 6825 | 6831 | 6837 |
| Photo-conductive layer 2 | 6802 | 6808 | 6814 | 6820 | 6826 | 6832 | 6838 |
| Photo- | 6803 | 6809 | 6815 | 6821 | 6827 | 6833 | 6839 |

TABLE 108-continued

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| conductive layer 3 | | | | | | | |
| Photo-conductive layer 4 | 6804 | 6810 | 6816 | 6822 | 6828 | 6834 | 6840 |
| Photo-conductive layer 5 | 6805 | 6811 | 6817 | 6823 | 6829 | 6835 | 6841 |
| Photo-conductive layer 6 | 6806 | 6812 | 6818 | 6824 | 6830 | 6836 | 6842 |

TABLE 109

| Name of layer | Gas used and its flow rate (SCCM) | | Substrate temperature (°C.) | Rf power (W) | Inner pressure (Torr) | Layer thickness (μm) |
|---|---|---|---|---|---|---|
| Surface layer | $B_2H_6$/He (20%) | 500 | 250 | 100 | 0.35 | 0.5 |
| | $NH_3$ | 100 | | | | |
| | Bias voltage of the cylinder | +150 V | | | | |

TABLE 110

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| Photo-conductive layer 1 | 6901 | 6907 | 6913 | 6919 | 6925 | 6931 | 6937 |
| Photo-conductive layer 2 | 6902 | 6908 | 6914 | 6920 | 6926 | 6932 | 6938 |
| Photo-conductive layer 3 | 6903 | 6909 | 6915 | 6921 | 6927 | 6933 | 6939 |
| Photo-conductive layer 4 | 6904 | 6910 | 6916 | 6922 | 6928 | 6934 | 6940 |
| Photo-conducitve layer 5 | 6905 | 6911 | 6917 | 6923 | 6929 | 6935 | 6941 |
| Photo-conductive layer 6 | 6906 | 6912 | 6918 | 6924 | 6930 | 6936 | 6942 |

TABLE 111

| | Photo-conductive Layer 1 | Photo-conductive Layer 2 | Photo-conductive Layer 3 | Photo-conductive Layer 5 | Photo-conductive Layer 6 |
|---|---|---|---|---|---|
| Drum No. | 7001 | 7002 | 7003 | 7004 | 7005 |

TABLE 112

| | Photo-layer 1 | Photo-layer 2 | Photo-layer 3 | Photo-layer 4 | Photo-layer 5 | Photo-layer 6 |
|---|---|---|---|---|---|---|
| Drum No. | 7101 | 7102 | 7103 | 7104 | 7105 | 7106 |

TABLE 113

| | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| Drum | 7201 | 7202 | 7203 | 7204 | 7205 | 7206 |

TABLE 113-continued

| | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| No. | | | | | | |

TABLE 114

| | Drum No. |
|---|---|
| IR Absorptive Layer 1 | 7301 |
| IR Absorptive Layer 2 | 7302 |
| IR Absorptive Layer 3 | 7303 |
| IR Absorptive Layer 4 | 7304 |
| IR Absorptive Layer 5 | 7305 |
| IR Absorptive Layer 6 | 7306 |
| IR Absorptive Layer 7 | 7307 |
| IR Absorptive Layer 8 | 7308 |
| IR Absorptive Layer 9 | 7309 |
| IR Absorptive Layer 10 | 7310 |

TABLE 114-continued

| | Drum No. |
|---|---|
| IR Absorptive Layer 11 | 7311 |
| IR Absorptive Layer 12 | 7312 |
| IR Absorptive Layer 13 | 7313 |
| IR Absorptive Layer 14 | 7314 |
| IR Absorptive Layer 15 | 7315 |
| IR Absorptive Layer 17 | 7316 |
| IR Absorptive Layer 18 | 7317 |
| IR Absorptive Layer 19 | 7318 |
| IR Absorptive Layer 20 | 7319 |

TABLE 115

| Drum No. | Photo-conductive layer 1 | Photo-conductive layer 2 | Photo-conductive layer 3 | Photo-conductive layer 5 | Photo-conductive layer 6 |
|---|---|---|---|---|---|
| IR absorptive layer 1 | 7401 | 7421 | 7441 | 7461 | 7481 |
| IR absorptive layer 2 | 7402 | 7422 | 7442 | 7462 | 7482 |
| IR absorptive layer 3 | 7403 | 7423 | 7443 | 7463 | 7483 |
| IR absorptive layer 4 | 7404 | 7424 | 7444 | 7464 | 7484 |
| IR absorptive layer 5 | 7405 | 7425 | 7445 | 7465 | 7485 |
| IR absorptive layer 6 | 7406 | 7426 | 7446 | 7466 | 7486 |
| IR absorptive layer 7 | 7407 | 7427 | 7477 | 7467 | 7487 |
| IR absorptive layer 8 | 7408 | 7428 | 7448 | 7468 | 7488 |
| IR absorptive layer 9 | 7409 | 7429 | 7449 | 7469 | 7489 |
| IR absorptive layer 10 | 7410 | 7430 | 7450 | 7470 | 7490 |
| IR absorptive layer 11 | 7411 | 7431 | 7451 | 7471 | 7491 |
| IR absorptive layer 12 | 7412 | 7432 | 7452 | 7472 | 7492 |
| IR absorptive layer 13 | 7413 | 7433 | 7453 | 7473 | 7493 |
| IR absorptive layer 14 | 7414 | 7434 | 7454 | 7474 | 7494 |
| IR absorptive layer 15 | 7415 | 7435 | 7455 | 7475 | 7495 |
| IR absorptive layer 16 | 7416 | 7436 | 7456 | 7476 | 7496 |
| IR absorptive layer 17 | 7417 | 7437 | 7457 | 7477 | 7497 |
| IR absorptive layer 18 | 7418 | 7438 | 7458 | 7478 | 7498 |
| IR absorptive layer 19 | 7419 | 7439 | 7459 | 7479 | 7499 |
| IR absorptive layer 20 | 7420 | 7440 | 7460 | 7480 | 74100 |

TABLE 116

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| IR absorptive layer 1 | 7501 | 7521 | 7541 | 7561 | 7581 | 75101 |
| IR absorptive layer 2 | 7502 | 7522 | 7542 | 7562 | 7582 | 75102 |
| IR absorptive layer 3 | 7503 | 7523 | 7543 | 7563 | 7583 | 75103 |
| IR absorptive layer 4 | 7504 | 7524 | 7544 | 7564 | 7584 | 75104 |
| IR absorptive layer 5 | 7505 | 7525 | 7545 | 7565 | 7585 | 75105 |
| IR absorptive layer 6 | 7506 | 7526 | 7546 | 7566 | 7586 | 75106 |
| IR absorptive layer 7 | 7507 | 7527 | 7547 | 7567 | 7587 | 75107 |
| IR absorptive layer 8 | 7508 | 7528 | 7548 | 7568 | 7588 | 75108 |
| IR absorptive layer 9 | 7509 | 7529 | 7549 | 7569 | 7589 | 75109 |
| IR absorptive layer 10 | 7510 | 7530 | 7550 | 7570 | 7590 | 75110 |
| IR absorptive layer 11 | 7511 | 7531 | 7551 | 7571 | 7591 | 75111 |
| IR absorptive layer 12 | 7512 | 7532 | 7552 | 7572 | 7592 | 75112 |
| IR absorptive layer 13 | 7513 | 7533 | 7553 | 7573 | 7593 | 75113 |
| IR absorptive layer 14 | 7514 | 7534 | 7554 | 7574 | 7594 | 75114 |
| IR absorptive layer 15 | 7515 | 7535 | 7555 | 7575 | 7595 | 75115 |
| IR absorptive layer 16 | 7516 | 7536 | 7556 | 7576 | 7596 | 75116 |
| IR absorptive layer 17 | 7517 | 7537 | 7557 | 7577 | 7597 | 75117 |
| IR absorptive layer 18 | 7518 | 7538 | 7558 | 7578 | 7598 | 75118 |
| IR absorptive layer 19 | 7519 | 7539 | 7559 | 7579 | 7599 | 75119 |
| IR absorptive layer 20 | 7520 | 7540 | 7560 | 7580 | 75100 | 75120 |

TABLE 117

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| IR absorptive layer 1 | 7601 | 7621 | 7641 | 7661 | 7681 | 76101 |
| IR absorptive layer 2 | 7602 | 7622 | 7642 | 7662 | 7682 | 76102 |
| IR absorptive layer 3 | 7603 | 7623 | 7643 | 7663 | 7683 | 76103 |
| IR absorptive layer 4 | 7604 | 7624 | 7644 | 7664 | 7684 | 76104 |
| IR absorptive layer 5 | 7605 | 7625 | 7645 | 7665 | 7685 | 76105 |
| IR absorptive layer 6 | 7606 | 7626 | 7646 | 7666 | 7686 | 76106 |
| IR absorptive layer 7 | 7607 | 7627 | 7647 | 7667 | 7687 | 76107 |
| IR absorptive layer 8 | 7608 | 7628 | 7648 | 7668 | 7688 | 76108 |
| IR absorptive layer 9 | 7609 | 7629 | 7649 | 7669 | 7689 | 76109 |
| IR absorptive layer 10 | 7610 | 7630 | 7650 | 7670 | 7690 | 76110 |
| IR absorptive layer 11 | 7611 | 7631 | 7651 | 7671 | 7691 | 76111 |
| IR absorptive layer 12 | 7612 | 7632 | 7652 | 7672 | 7692 | 76112 |
| IR absorptive layer 13 | 7613 | 7633 | 7653 | 7673 | 7693 | 76113 |
| IR absorptive layer 14 | 7614 | 7634 | 7654 | 7674 | 7694 | 76114 |
| IR absorptive layer 15 | 7615 | 7635 | 7655 | 7675 | 7695 | 76115 |
| IR absorptive | 7616 | 7636 | 7656 | 7676 | 7696 | 76116 |

TABLE 117-continued

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| layer 16 | | | | | | |
| IR absorptive layer 17 | 7617 | 7637 | 7657 | 7677 | 7697 | 76117 |
| IR absorptive layer 18 | 7618 | 7638 | 7658 | 7678 | 7698 | 76118 |
| IR absorptive layer 19 | 7619 | 7639 | 7659 | 7679 | 7699 | 76119 |
| IR absorptive layer 20 | 7620 | 7640 | 7660 | 7680 | 76100 | 76120 |

TABLE 118

| | Contact Layer 2 | Contact Layer 3 | Contact Layer 4 |
|---|---|---|---|
| Drum No. | 7701 | 7702 | 7703 |

TABLE 119

| Drum No. | Contact layer 1 | Contact layer 2 | Contact layer 3 | Contact layer 4 |
|---|---|---|---|---|
| Photo-conductive layer 1 | 7801 | 7807 | 7813 | 7819 |
| Photo-conductive layer 2 | 7802 | 7808 | 7814 | 7820 |
| Photo-conductive layer 3 | 7803 | 7809 | 7815 | 7821 |
| Photo-conductive layer 4 | 7804 | 7810 | 7816 | 7822 |
| Photo-conductive layer 5 | 7805 | 7811 | 7817 | 7823 |
| Photo-conductive layer 6 | 7806 | 7812 | 7818 | 7824 |

TABLE 120

| Drum No. | Contact layer 1 | Contact layer 2 | Contact layer 3 | Contact layer 4 |
|---|---|---|---|---|
| Photo-conductive layer 1 | 7901 | 7907 | 7913 | 7919 |
| Photo-conductive layer 2 | 7902 | 7908 | 7914 | 7920 |
| Photo-conductive layer 3 | 7903 | 7909 | 7915 | 7921 |
| Photo-conductive layer 4 | 7904 | 7910 | 7916 | 7922 |
| Photo-conductive layer 5 | 7905 | 7911 | 7917 | 7923 |
| Photo-conductive layer 6 | 7906 | 7912 | 7918 | 7924 |

TABLE 121

| Drum No. | Contact layer 1 | Contact layer 2 | Contact layer 3 | Contact layer 4 |
|---|---|---|---|---|
| Photo-conductive layer 1 | 8001 | 8007 | 8013 | 8019 |
| Photo-conductive layer 2 | 8002 | 8008 | 8014 | 8020 |

TABLE 121-continued

| Drum No. | Contact layer 1 | Contact layer 2 | Contact layer 3 | Contact layer 4 |
|---|---|---|---|---|
| Photo-conductive layer 3 | 8003 | 8009 | 8015 | 8021 |
| Photo-conductive layer 4 | 8004 | 8010 | 8016 | 8022 |
| Photo-conductive layer 5 | 8005 | 8011 | 8017 | 8023 |
| Photo-conductive layer 6 | 8006 | 8012 | 8018 | 8024 |

TABLE 122

| | Drum No. |
|---|---|
| IR absorptive layer 1 | 8101 |
| IR absorptive layer 2 | 8102 |
| IR absorptive layer 3 | 8103 |
| IR absorptive layer 4 | 8104 |
| IR absorptive layer 5 | 8105 |
| IR absorptive layer 6 | 8106 |
| IR absorptive layer 7 | 8107 |
| IR absorptive layer 8 | 8108 |
| IR absorptive layer 9 | 8109 |
| IR absorptive layer 10 | 8110 |
| IR absorptive layer 11 | 8111 |
| IR absorptive layer 12 | 8112 |
| IR absorptive layer 13 | 8113 |
| IR absorptive layer 14 | 8114 |
| IR absorptive layer 15 | 8115 |
| IR absorptive layer 17 | 8117 |
| IR absorptive layer 18 | 8118 |
| IR absorptive layer 19 | 8119 |
| IR absorptive layer 20 | 8120 |

TABLE 123

| Drum No. | Photo-conductive layer 4 | Photo-conductive layer 5 | Photo-conductive layer 7 |
|---|---|---|---|
| IR absorptive layer 1 | 8201 | 8221 | 8241 |
| IR absorptive layer 2 | 8202 | 8222 | 8242 |
| IR absorptive layer 3 | 8203 | 8223 | 8243 |
| IR absorptive layer 4 | 8204 | 8224 | 8244 |
| IR absorptive layer 5 | 8205 | 8225 | 8245 |
| IR absorptive layer 6 | 8206 | 8226 | 8246 |
| IR absorptive layer 7 | 8207 | 8227 | 8247 |
| IR absorptive layer 8 | 8208 | 8228 | 8248 |
| IR absorptive layer 9 | 8209 | 8229 | 8249 |
| IR absorptive layer 10 | 8210 | 8230 | 8250 |
| IR absorptive layer 11 | 8211 | 8231 | 8251 |
| IR absorptive layer 12 | 8212 | 8232 | 8252 |
| IR absorptive layer 13 | 8213 | 8233 | 8253 |
| IR absorptive layer 14 | 8214 | 8234 | 8254 |
| IR absorptive layer 15 | 8215 | 8235 | 8255 |
| IR absorptive layer 16 | 8216 | 8236 | 8256 |
| IR absorptive layer 17 | 8217 | 8237 | 8257 |
| IR absorptive layer 18 | 8218 | 8238 | 8258 |
| IR absorptive layer 19 | 8219 | 8239 | 8259 |
| IR absorptive layer 20 | 8220 | 8240 | 8260 |

TABLE 124

| Drum No. | Photo-conductive layer 1 | Photo-conductive layer 4 | Photo-conductive layer 5 | Photo-conductive layer 7 |
|---|---|---|---|---|
| IR absorptive layer 1 | 8301 | 8321 | 8341 | 8361 |
| IR absorptive layer 2 | 8302 | 8322 | 8342 | 8362 |
| IR absorptive layer 3 | 8303 | 8323 | 8343 | 8363 |
| IR absorptive layer 4 | 8304 | 8324 | 8344 | 8364 |
| IR absorptive layer 5 | 8305 | 8325 | 8345 | 8365 |
| IR absorptive layer 6 | 8306 | 8326 | 8346 | 8366 |
| IR absorptive layer 7 | 8307 | 8327 | 8347 | 8367 |
| IR absorptive layer 8 | 8308 | 8328 | 8348 | 8368 |
| IR absorptive layer 9 | 8309 | 8329 | 8349 | 8369 |
| IR absorptive layer 10 | 8310 | 8330 | 8350 | 8370 |
| IR absorptive layer 11 | 8311 | 8331 | 8351 | 8371 |
| IR absorptive layer 12 | 8312 | 8332 | 8352 | 8372 |

TABLE 124-continued

| Drum No. | Photo-conductive layer 1 | Photo-conductive layer 4 | Photo-conductive layer 5 | Photo-conductive layer 7 |
|---|---|---|---|---|
| IR absorptive layer 13 | 8313 | 8333 | 8353 | 8373 |
| IR absorptive layer 14 | 8314 | 8334 | 8354 | 8374 |
| IR absorptive layer 15 | 8315 | 8335 | 8355 | 8375 |
| IR absorptive layer 16 | 8316 | 8336 | 8356 | 8376 |
| IR absorptive layer 17 | 8317 | 8337 | 8357 | 8377 |
| IR absorptive layer 18 | 8318 | 8338 | 8358 | 8378 |
| IR absorptive layer 19 | 8319 | 8339 | 8359 | 8379 |
| IR absorptive layer 20 | 8320 | 8340 | 8360 | 8380 |

TABLE 125

| Drum No. | Photo-conductive layer 1 | Photo-conductive layer 4 | Photo-conductive layer 5 | Photo-conductive layer 7 |
|---|---|---|---|---|
| IR absorptive layer 1 | 8401 | 8421 | 8441 | 8461 |
| IR absorptive layer 2 | 8402 | 8422 | 8442 | 8462 |
| IR absorptive layer 3 | 8403 | 8423 | 8443 | 8463 |
| IR absorptive layer 4 | 8404 | 8424 | 8444 | 8464 |
| IR absorptive layer 5 | 8405 | 8425 | 8445 | 8465 |
| IR absorptive layer 6 | 8406 | 8426 | 8446 | 8466 |
| IR absorptive layer 7 | 8407 | 8427 | 8447 | 8467 |
| IR absorptive layer 8 | 8408 | 8428 | 8448 | 8468 |
| IR absorptive layer 9 | 8409 | 8429 | 8449 | 8469 |
| IR absorptive layer 10 | 8410 | 8430 | 8450 | 8470 |
| IR absorptive layer 11 | 8411 | 8431 | 8451 | 8471 |
| IR absorptive layer 12 | 8412 | 8432 | 8452 | 8472 |
| IR absorptive layer 13 | 8413 | 8433 | 8453 | 8473 |
| IR absorptive layer 14 | 8414 | 8434 | 8454 | 8474 |
| IR absorptive layer 15 | 8415 | 8435 | 8455 | 8475 |
| IR absorptive layer 16 | 8416 | 8436 | 8456 | 8476 |
| IR absorptive layer 17 | 8417 | 8437 | 8457 | 8477 |
| IR absorptive layer 18 | 8418 | 8438 | 8458 | 8478 |
| IR absorptive layer 19 | 8419 | 8439 | 8459 | 8479 |
| IR absorptive layer 20 | 8420 | 8440 | 8460 | 8480 |

TABLE 126

| | Contact Layer 1 | Contact Layer 2 | Contact Layer 3 | Contact Layer 4 | Contact Layer 6 | Contact Layer 7 | Contact Layer 8 |
|---|---|---|---|---|---|---|---|
| Drum No. | 8501 | 8502 | 8503 | 8504 | 8505 | 8506 | 8507 |

TABLE 127

| Drum No. | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|
| Contact layer 1 | 8601 | 8609 | 8617 | 8625 | 8633 | 8641 |
| Contact layer 2 | 8602 | 8610 | 8618 | 8626 | 8634 | 8642 |
| Contact layer 3 | 8603 | 8611 | 8619 | 8627 | 8635 | 8643 |
| Contact layer 4 | 8604 | 8612 | 8620 | 8628 | 8636 | 8644 |
| Contact layer 5 | 8605 | 8613 | 8621 | 8629 | 8637 | 8645 |
| Contact layer 6 | 8606 | 8614 | 8622 | 8630 | 8638 | 8646 |
| Contact layer 7 | 8607 | 8615 | 8623 | 8631 | 8639 | 8647 |
| Contact layer 8 | 8608 | 8616 | 8624 | 8662 | 8640 | 8648 |

TABLE 128

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| Contact layer 1 | 8701 | 8709 | 8717 | 8725 | 8733 | 8741 | 8749 |
| Contact layer 2 | 8702 | 8710 | 8718 | 8726 | 8734 | 8742 | 8750 |
| Contact layer 3 | 8703 | 8711 | 8719 | 8727 | 8735 | 8743 | 8751 |
| Contact layer 4 | 8704 | 8712 | 8720 | 8728 | 8736 | 8744 | 8752 |
| Contact layer 5 | 8705 | 8713 | 8721 | 8729 | 8737 | 8745 | 8753 |
| Contact layer 6 | 8706 | 8714 | 8722 | 8730 | 8738 | 8746 | 8754 |
| Contact layer 7 | 8707 | 8715 | 8723 | 8731 | 8739 | 8747 | 8755 |
| Contact layer 8 | 8708 | 8716 | 8724 | 8732 | 8740 | 8748 | 8756 |

TABLE 129

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| Contact layer 1 | 8801 | 8809 | 8817 | 8825 | 8833 | 8841 | 8849 |
| Contact layer 2 | 8802 | 8810 | 8818 | 8826 | 8834 | 8842 | 8850 |
| Contact layer 3 | 8803 | 8811 | 8819 | 8827 | 8835 | 8843 | 8851 |
| Contact layer 4 | 8804 | 8812 | 8820 | 8828 | 8836 | 8844 | 8852 |
| Contact layer 5 | 8805 | 8813 | 8821 | 8829 | 8837 | 8845 | 8853 |
| Contact layer 6 | 8806 | 8814 | 8822 | 8830 | 8838 | 8846 | 8854 |
| Contact layer 7 | 8807 | 8815 | 8823 | 8831 | 8839 | 8847 | 8855 |
| Contact layer 8 | 8808 | 8816 | 8824 | 8832 | 8840 | 8848 | 8856 |

TABLE 130

| | Charge injection inhibition layer 4 | Charge injection inhibition layer 6 | Charge injection inhibition layer 7 |
|---|---|---|---|
| Drum | 8901 | 8902 | 8903 |

TABLE 130-continued

| | Charge injection inhibition layer 4 | Charge injection inhibition layer 6 | Charge injection inhibition layer 7 |
|---|---|---|---|
| No. | | | |

TABLE 131

| Drum No. | Charge injection inhibition layer 1 | Charge injection inhibition layer 4 | Charge injection inhibition layer 6 | Charge injection inhibition layer 7 |
|---|---|---|---|---|
| Photo-conductive layer 5 | 9001 | 9003 | 9005 | 9007 |
| Photo-conductive layer 6 | 9002 | 9004 | 9006 | 9008 |

TABLE 132

| Drum No. | Charge injection inhibition layer 1 | Charge injection inhibition layer 4 | Charge injection inhibition layer 6 | Charge injection inhibition layer 7 |
|---|---|---|---|---|
| Photo-conductive layer 4 | 9101 | 9104 | 9107 | 9110 |
| Photo-conductive | 9102 | 9105 | 9108 | 9111 |

TABLE 132-continued

| Drum No. | Charge injection inhibition layer 1 | Charge injection inhibition layer 4 | Charge injection inhibition layer 6 | Charge injection inhibition layer 7 |
|---|---|---|---|---|
| layer 5 | | | | |
| Photo-conductive layer 6 | 9103 | 9106 | 9109 | 9112 |

TABLE 133

| Drum No. | Charge injection inhibition layer 1 | Charge injection inhibition layer 4 | Charge injection inhibition layer 6 | Charge injection inhibition layer 7 |
|---|---|---|---|---|
| Photo-conductive layer 4 | 9201 | 9204 | 9207 | 9210 |
| Photo-conductive layer 5 | 9202 | 9205 | 9208 | 9211 |
| Photo-conductive layer 6 | 9203 | 9206 | 9209 | 9212 |

TABLE 134

| Name of layer | Gas used and its flow rate (SCCM) | | Substrate temperature (°C.) | RF power (W) | Inner pressure (Torr) | Layer thickness (μm) |
|---|---|---|---|---|---|---|
| Surface layer 1 | $B_2H_6$/He (20%) | 500 | 250 | 100 | 0.35 | 0.5 |
| | $NH_3$ | 100 | | | | |

TABLE 135

| Drum No. | Photo-conductive layer 1 | Photo-conductive layer 4 | Photo-conductive layer 5 | Photo-conductive layer 7 |
|---|---|---|---|---|
| IR absorptive layer 1 | 9301 | 9321 | 9341 | 9361 |
| IR absorptive layer 2 | 9302 | 9322 | 9342 | 9362 |
| IR absorptive layer 3 | 9303 | 9323 | 9343 | 9363 |
| IR absorptive layer 4 | 9304 | 9324 | 9344 | 9364 |
| IR absorptive layer 5 | 9305 | 9325 | 9345 | 9365 |
| IR absorptive layer 6 | 9306 | 9326 | 9346 | 9366 |
| IR absorptive layer 7 | 9307 | 9327 | 9347 | 9367 |
| IR absorptive layer 8 | 9308 | 9328 | 9348 | 9368 |
| IR absorptive layer 9 | 9309 | 9329 | 9349 | 9369 |
| IR absorptive layer 10 | 9310 | 9330 | 9350 | 9370 |
| IR absorptive layer 11 | 9311 | 9331 | 9351 | 9371 |
| IR absorptive layer 12 | 9312 | 9332 | 9352 | 9372 |
| IR absorptive layer 13 | 9313 | 9333 | 9353 | 9373 |
| IR absorptive layer 14 | 9314 | 9334 | 9354 | 9374 |
| IR absorptive layer 15 | 9315 | 9335 | 9355 | 9375 |
| IR absorptive layer 16 | 9316 | 9336 | 9356 | 9376 |
| IR absorptive layer 17 | 9317 | 9337 | 9357 | 9377 |
| IR absorptive layer 18 | 9318 | 9338 | 9358 | 9378 |
| IR absorptive layer 19 | 9319 | 9339 | 9359 | 9379 |
| IR absorptive | 9320 | 9340 | 9360 | 9380 |

TABLE 135-continued

| Drum No. | Photo-conductive layer 1 | Photo-conductive layer 4 | Photo-conductive layer 5 | Photo-conductive layer 7 |
|---|---|---|---|---|
| layer 20 | | | | |

TABLE 136

| Drum No. | Photo-conductive layer 1 | Photo-conductive layer 4 | Photo-conductive layer 5 | Photo-conductive layer 7 |
|---|---|---|---|---|
| IR absorptive layer 1 | 9401 | 9421 | 9441 | 9461 |
| IR absorptive layer 2 | 9402 | 9422 | 9442 | 9462 |
| IR absorptive layer 3 | 9403 | 9423 | 9443 | 9463 |
| IR absorptive layer 4 | 9404 | 9424 | 9444 | 9464 |
| IR absorptive layer 5 | 9405 | 9425 | 9445 | 9465 |
| IR absorptive layer 6 | 9406 | 9426 | 9446 | 9466 |
| IR absorptive layer 7 | 9407 | 9427 | 9447 | 9467 |
| IR absorptive layer 8 | 9408 | 9428 | 9448 | 9468 |
| IR absorptive layer 9 | 9409 | 9429 | 9449 | 9469 |
| IR absorptive layer 10 | 9410 | 9430 | 9450 | 9470 |
| IR absorptive layer 11 | 9411 | 9431 | 9451 | 9471 |
| IR absorptive layer 12 | 9412 | 9432 | 9452 | 9472 |
| IR absorptive layer 13 | 9413 | 9433 | 9453 | 9473 |
| IR absorptive layer 14 | 9414 | 9434 | 9454 | 9474 |
| IR absorptive layer 15 | 9415 | 9435 | 9455 | 9475 |
| IR absorptive layer 16 | 9416 | 9436 | 9456 | 9476 |
| IR absorptive layer 17 | 9417 | 9437 | 9457 | 9477 |
| IR absorptive layer 18 | 9418 | 9438 | 9458 | 9478 |
| IR absorptive layer 19 | 9419 | 9439 | 9459 | 9479 |
| IR absorptive layer 20 | 9420 | 9440 | 9460 | 9480 |

TABLE 137

| Drum No. | Photo-conductive layer 1 | Photo-conductive layer 4 | Photo-conductive layer 5 | Photo-conductive layer 7 |
|---|---|---|---|---|
| IR absorptive layer 1 | 9501 | 9521 | 9541 | 9561 |
| IR absorptive layer 2 | 9502 | 9522 | 9542 | 9562 |
| IR absorptive layer 3 | 9503 | 9523 | 9543 | 9563 |
| IR absorptive layer 4 | 9504 | 9524 | 9544 | 9564 |
| IR absorptive layer 5 | 9505 | 9525 | 9545 | 9565 |
| IR absorptive layer 6 | 9506 | 9526 | 9546 | 9566 |
| IR absorptive | 9507 | 9527 | 9547 | 9567 |

TABLE 137-continued

| Drum No. | Photo-conductive layer 1 | Photo-conductive layer 4 | Photo-conductive layer 5 | Photo-conductive layer 7 |
|---|---|---|---|---|
| layer 7 | | | | |
| IR absorptive layer 8 | 9508 | 9528 | 9548 | 9568 |
| IR absorptive layer 9 | 9509 | 9529 | 9549 | 9569 |
| IR absorptive layer 10 | 9510 | 9530 | 9550 | 9570 |
| IR absorptive layer 11 | 9511 | 9531 | 9551 | 9571 |
| IR absorptive layer 12 | 9512 | 9532 | 9552 | 9572 |
| IR absorptive layer 13 | 9513 | 9533 | 9553 | 9573 |
| IR absorptive layer 14 | 9514 | 9534 | 9554 | 9574 |
| IR absorptive layer 15 | 9515 | 9535 | 9555 | 9575 |
| IR absorptive layer 16 | 9516 | 9536 | 9556 | 9576 |
| IR absorptive layer 17 | 9517 | 9537 | 9557 | 9577 |
| IR absorptive layer 18 | 9518 | 9538 | 9558 | 9578 |
| IR absorptive layer 19 | 9519 | 9539 | 9559 | 9579 |
| IR absorptive layer 20 | 9520 | 9540 | 9560 | 9580 |

TABLE 138

| Drum No. | Photo-conductive layer 1 | Photo-conductive layer 4 | Photo-conductive layer 5 | Photo-conductive layer 7 |
|---|---|---|---|---|
| IR absorptive layer 1 | 9601 | 9621 | 9641 | 9661 |
| IR absorptive layer 2 | 9602 | 9622 | 9642 | 9662 |
| IR absorptive layer 3 | 9603 | 9623 | 9643 | 9663 |
| IR absorptive layer 4 | 9604 | 9624 | 9644 | 9664 |
| IR absorptive layer 5 | 9605 | 9625 | 9645 | 9665 |
| IR absorptive layer 6 | 9606 | 9626 | 9646 | 9666 |
| IR absorptive layer 7 | 9607 | 9627 | 9647 | 9667 |
| IR absorptive layer 8 | 9608 | 9628 | 9648 | 9668 |
| IR absorptive layer 9 | 9609 | 9629 | 9649 | 9669 |
| IR absorptive layer 10 | 9610 | 9630 | 9650 | 9670 |
| IR absorptive layer 11 | 9611 | 9631 | 9651 | 9671 |
| IR absorptive layer 12 | 9612 | 9632 | 9652 | 9672 |
| IR absorptive layer 13 | 9613 | 9633 | 9653 | 9673 |
| IR absorptive layer 14 | 9614 | 9634 | 9654 | 9674 |
| IR absorptive layer 15 | 9615 | 9635 | 9655 | 9675 |
| IR absorptive layer 16 | 9616 | 9636 | 9656 | 9676 |
| IR absorptive layer 17 | 9617 | 9637 | 9657 | 9677 |
| IR absorptive layer 18 | 9618 | 9638 | 9658 | 9678 |
| IR absorptive layer 19 | 9619 | 9639 | 9659 | 9679 |
| IR absorptive layer 20 | 9620 | 9640 | 9660 | 9680 |

TABLE 139

| Drum No. | Photo-conductive layer 1 | Photo-conductive layer 4 | Photo-conductive layer 5 | Photo-conductive layer 7 |
|---|---|---|---|---|
| IR absorptive layer 1 | 9701 | 9721 | 9741 | 9761 |
| IR absorptive layer 2 | 9702 | 9722 | 9742 | 9762 |
| IR absorptive layer 3 | 9703 | 9723 | 9743 | 9763 |
| IR absorptive layer 4 | 9704 | 9724 | 9744 | 9764 |
| IR absorptive layer 5 | 9705 | 9725 | 9745 | 9765 |
| IR absorptive layer 6 | 9706 | 9726 | 9746 | 9766 |
| IR absorptive layer 7 | 9707 | 9727 | 9747 | 9767 |
| IR absorptive layer 8 | 9708 | 9728 | 9748 | 9768 |
| IR absorptive layer 9 | 9709 | 9729 | 9749 | 9769 |
| IR absorptive layer 10 | 9710 | 9730 | 9750 | 9770 |
| IR absorptive layer 11 | 9711 | 9731 | 9751 | 9771 |
| IR absorptive layer 12 | 9712 | 9732 | 9752 | 9772 |
| IR absorptive layer 13 | 9713 | 9733 | 9753 | 9773 |
| IR absorptive layer 14 | 9714 | 9734 | 9754 | 9774 |
| IR absorptive layer 15 | 9715 | 9735 | 9755 | 9775 |
| IR absorptive layer 16 | 9716 | 9736 | 9756 | 9776 |
| IR absorptive layer 17 | 9717 | 9737 | 9757 | 9777 |
| IR absorptive layer 18 | 9718 | 9738 | 9758 | 9778 |
| IR absorptive layer 19 | 9719 | 9739 | 9759 | 9779 |
| IR absorptive layer 20 | 9720 | 9740 | 9760 | 9780 |

TABLE 140

| Drum No. | Photo-conductive layer 1 | Photo-conductive layer 4 | Photo-conductive layer 5 | Photo-conductive layer 7 |
|---|---|---|---|---|
| IR absorptive layer 1 | 9801 | 9821 | 9841 | 9861 |
| IR absorptive layer 2 | 9802 | 9822 | 9842 | 9862 |
| IR absorptive layer 3 | 9803 | 9823 | 9843 | 9863 |
| IR absorptive layer 4 | 9804 | 9824 | 9844 | 9864 |
| IR absorptive layer 5 | 9805 | 9825 | 9845 | 9865 |
| IR absorptive layer 6 | 9806 | 9826 | 9846 | 9866 |
| IR absorptive layer 7 | 9807 | 9827 | 9847 | 9867 |
| IR absorptive layer 8 | 9808 | 9828 | 9848 | 9868 |
| IR absorptive layer 9 | 9809 | 9829 | 9849 | 9869 |
| IR absorptive layer 10 | 9810 | 9830 | 9850 | 9870 |
| IR absorptive layer 11 | 9811 | 9831 | 9851 | 9871 |
| IR absorptive layer 12 | 9812 | 9832 | 9852 | 9872 |
| IR absorptive layer 13 | 9813 | 9833 | 9853 | 9873 |
| IR absorptive layer 14 | 9814 | 9834 | 9854 | 9874 |
| IR absorptive layer 15 | 9815 | 9835 | 9855 | 9875 |
| IR absorptive | 9816 | 9836 | 9856 | 9876 |

TABLE 140-continued

| Drum No. | Photo-conductive layer 1 | Photo-conductive layer 4 | Photo-conductive layer 5 | Photo-conductive layer 7 |
|---|---|---|---|---|
| layer 16 | | | | |
| IR absorptive layer 17 | 9817 | 9837 | 9857 | 9877 |
| IR absorptive layer 18 | 9818 | 9038 | 9858 | 9878 |
| IR absorptive layer 19 | 9819 | 9839 | 9859 | 9879 |
| IR absorptive layer 20 | 9820 | 9840 | 9860 | 9880 |

TABLE 141

| Drum No. | Gas used and its flow rate (SCCM) | | Substrate temperature (°C.) | RF power (W) | Inner pressure (Torr) | Layer thickness (μm) |
|---|---|---|---|---|---|---|
| 9901 | $B_2H_6$/He (20%) | 500 | 250 | 100 | 0.35 | 0.5 |
| | $NH_3$ | 100 | | | | |
| 9902 | $B_2H_6$/He (20%) | 500 | 250 | 100 | 0.40 | 0.5 |
| | $H_2$ | 100 | | | | |
| | $NH_3$ | 300 | | | | |
| 9903 | $B_2H_6$/He (20%) | 500 | 250 | 100 | 0.35 | 0.5 |
| | $NH_3$ | 100 | | | | |
| | Bias voltage of the cylinder +100 V | | | | | |

TABLE 142

| Drum No. | Gas used and its flow rate (SCCM) | | Substrate temperature (°C.) | RF power (W) | Inner pressure (Torr) | Layer thickness (μm) |
|---|---|---|---|---|---|---|
| 10001 | $B_2H_6$/He (20%) | 500 | 250 | 100 | 0.35 | 0.5 |
| | $NH_3$ | 100 | | | | |
| 10002 | $B_2H_6$/He (20%) | 500 | 250 | 100 | 0.40 | 0.5 |
| | $H_2$ | 100 | | | | |
| | $NH_3$ | 300 | | | | |
| 10003 | $B_2H_6$/He (20%) | 500 | 250 | 100 | 0.35 | 0.5 |
| | $NH_3$ | 100 | | | | |
| | Bias voltage of the cylinder +100 V | | | | | |

TABLE 143

| Drum No. | Gas used and its flow rate (SCCM) | | Substrate temperature (°C.) | RF power (W) | Inner pressure (Torr) | Layer thickness (μm) |
|---|---|---|---|---|---|---|
| 10101 | $B_2H_6$/He (20%) | 500 | 250 | 100 | 0.35 | 0.5 |
| | $NH_3$ | 100 | | | | |
| 10102 | $B_2H_6$/He (20%) | 500 | 250 | 100 | 0.40 | 0.5 |
| | $H_2$ | 100 | | | | |
| | $NH_3$ | 300 | | | | |
| 10103 | $B_2H_6$/He (20%) | 500 | 250 | 100 | 0.35 | 0.5 |
| | $NH_3$ | 100 | | | | |
| | Bias voltage of the cylinder +100 V | | | | | |

TABLE 144

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $B_2H_6$ (against $SiH_4$) 1000 ppm | | | | | |
| | NO | 10 | | | | |
| Photo-conductive layer | $SiH_4$ | 200 | 250 | 300 | 0.40 | 20 |
| | $H_2$ | 200 | | | | |
| Inter-mediate layer | $SiH_4$ | 10 | 250 | 150 | 0.35 | 0.3 |
| | $CH_4$ | 400 | | | | |
| Surface layer | $B_2H_6$He (20%) | 500 | 250 | 100 | 0.35 | 0.5 |
| | $NH_3$ | 100 | | | | |

TABLE 145

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer (lower layer) | $B_2H_6$ /Ar (20%) | 500 | 250 | 200 | 0.35 | 0.3 |
| | $NH_3$ | 100 | | | | |
| Surface layer (upper layer) | $B_2H_6$/He (20%) | 500 | 250 | 100 | 0.35 | 0.3 |
| | $NH_3$ | 100 | | | | |

TABLE 146

| Initial electri-fication efficiency | Residual voltage | Ghost | Defective image | Image flow |
|---|---|---|---|---|
| ○ | ○ | ○ | ◎ | ◎ |

| Increase of defective image | Surface abrasion | Break down voltage | Abrasion resistance | Degree of background fogginess |
|---|---|---|---|---|
| ○ | ○ | ◎ | ◎ | ◎ |

◎: Excellent
○: Good
Δ: Applicable for practical use
X: Poor

TABLE 147

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer (lower layer) | $B_2H_6$/Ar (20%) | 500 | 250 | 200 | 0.40 | 0.3 |
| | $H_2$ | 100 | | | | |
| | $NH_3$ | 100 | | | | |
| Surface layer (upper layer) | $B_2H_6$/He (20%) | 500 | 250 | 100 | 0.40 | 0.3 |
| | $H_2$ | 100 | | | | |
| | $NH_3$ | 300 | | | | |

TABLE 148

| Initial electri-fication efficiency | Residual voltage | Ghost | Defective image | Image flow |
|---|---|---|---|---|
| ◎ | ○ | ○ | ◎ | ◎ |

TABLE 148-continued

| Increase of defective image | Surface abrasion | Break down voltage | Abrasion resistance | Degree of background fogginess |
|---|---|---|---|---|
| ○ | ○ | ◎ | ◎ | ○ |

◎: Excellent
○: Good
Δ: Applicable for practical use
X: Poor

TABLE 149

| Intial electrification efficiency | Residual voltage | Ghost | Defective image | Image flow |
|---|---|---|---|---|
| ○ | ○ | ○ | ◎ | ◎ |

| Increase of defective image | Surface abrasion | Breakdown voltage | Abrasion resistance | Degree of background fogginess |
|---|---|---|---|---|
| ○ | ○ | ◎ | ◎ | ◎ |

◎Excellent
○ Good
Δ Applicable for practical use
X Poor

TABLE 150

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer (lower | $B_2H_6$/Ar (20%) | 500 | 250 | 200 | 0.35 | 0.3 |
| | $NH_3$ | 100 | | | | |

TABLE 150-continued

| Name of layer | Gas used and its flow rate (SCCM) | | Substrate temperature (°C.) | RF power (W) | Inner pressure (Torr) | Layer thickness (μm) |
|---|---|---|---|---|---|---|
| layer) | | | | | | |
| Surface layer (upper layer) | $B_2H_6$/He (20%)<br>$NH_3$ | 500<br>100 | 250 | 100 | 0.35 | 0.3 |

TABLE 151

| Intial electrification efficiency | Residual voltage | Ghost | Defective image | Image flow |
|---|---|---|---|---|
| ◎ | ○ | ○ | ◎ | ◎ |

| Increase of defective image | Surface abrasion | Breakdown voltage | Abrasion resistance | Degree of background fogginess |
|---|---|---|---|---|
| ○ | ○ | ◎ | ◎ | ◎ |

◎ Excellent
○ Good
Δ Applicable for practical use
X Poor

TABLE 153

| Intial electrification efficiency | Residual voltage | Ghost | Defective image | Image flow |
|---|---|---|---|---|
| ◎ | ○ | ○ | ◎ | ◎ |

| Increase of defective image | Surface abrasion | Breakdown voltage | Abrasion resistance | Degree of background fogginess |
|---|---|---|---|---|
| ○ | ○ | ◎ | ◎ | ◎ |

◎ Excellent
○ Good
Δ Applicable for practical use
X Poor

TABLE 152

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$<br>$H_2$ | 200<br>200 | 250 | 300 | 0.40 | 20 |
| Surface layer (lower layer) | $B_2H_6$/Ar (20%)<br>$NH_3$ | 500<br>100 | 250 | 200 | 0.35 | 0.3 |
| Surface layer (upper layer) | $B_2H_6$He (20%)<br>$NH_3$ | 500<br>100 | 250 | 100 | 0.35 | 0.3 |

TABLE 154

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$<br>$H_2$<br>$GeH_4$<br>$B_2H_6$ (against $SiH_4$)<br>NO | 100<br>100<br>50<br>1000 ppm<br>10 | 250 | 150 | 0.35 | 1 |
| Photo-conductive layer | $SiH_4$<br>$H_2$ | 200<br>200 | 250 | 300 | 0.40 | 20 |
| Surface layer (lower layer) | $B_2H_6$/Ar (20%)<br>$NH_3$ | 500<br>100 | 250 | 200 | 0.35 | 0.3 |
| Surface layer (upper layer) | $B_2H_6$/He (20%)<br>$NH_3$ | 500<br>100 | 250 | 100 | 0.35 | 0.3 |

TABLE 155

| Intial electrification efficiency | Residual voltage | Ghost | Defective image | Image flow | Increase of defective image |
|---|---|---|---|---|---|
| ○ | ○ | ○ | ◎ | ◎ | ○ |

| Surface abrasion | Breakdown voltage | Abrasion resistance | Interference fringe | Degree of background fogginess |
|---|---|---|---|---|
| ○ | ◎ | ◎ | ○ | ◎ |

◎ Excellent
○ Good

TABLE 156

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 100 | 0.25 | 0.5 |
| | $N_2$ | 100 | | | | |
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| Surface layer (upper layer) | $B_2H_6$/He (20%) | 500 | 250 | 100 | 0.35 | 0.3 |
| | $NH_3$ | 100 | | | | |

TABLE 157

| Intial electrification efficiency | Residual voltage | Ghost | Defective image | Image flow |
|---|---|---|---|---|
| ◎ | ○ | ○ | ◎ | ◎ |

| Increase of | Surface | Breakdown | Abrasion | Degree of background |
|---|---|---|---|---|

TABLE 157-continued

| defective image | abrasion | voltage | resistance | fogginess |
|---|---|---|---|---|
| ○ | ○ | ◎ | ◎ | ◎ |

◎ Excellent
○ Good
Δ Applicable for practical use
X Poor

TABLE 158

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| Surface layer (upper layer) | $B_2H_6$/He (20%) | 500 | 250 | 100 | 0.35 | 0.3 |
| | $NH_3$ | 100 | | | | |

TABLE 159

| Intial electrification efficiency | Residual voltage | Ghost | Defective image | Image flow | Increase of defective image |
|---|---|---|---|---|---|
| ◎ | ○ | ○ | ◎ | ◎ | ○ |

| Surface abrasion | Breakdown voltage | Abrasion resistance | Interference fringe | Degree of background fogginess |
|---|---|---|---|---|
| ○ | ◎ | ◎ | ○ | ◎ |

◎ Excellent
○ Good

TABLE 160

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |

TABLE 160-continued

| Name of layer | Gas used and its flow rate (SCCM) | | Substrate temperature (°C.) | RF power (W) | Inner pressure (Torr) | Layer thickness (μm) |
|---|---|---|---|---|---|---|
| | NO | 10 | | | | |
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| Surface layer (upper layer) | $B_2H_6$/He (20%) | 500 | 250 | 100 | 0.35 | 0.3 |
| | $NH_3$ | 100 | | | | |

TABLE 161

| Intial electrification efficiency | Residual voltage | Ghost | Defective image | Image flow |
|---|---|---|---|---|
| ◎ | ○ | ○ | ◎ | ◎ |

| Increase of defective image | Surface abrasion | Breakdown voltage | Abrasion resistance | Degree of background fogginess |
|---|---|---|---|---|
| ○ | ○ | ◎ | ◎ | ◎ |

◎Excellent
○ Good
Δ Applicable for practical use
X Poor

TABLE 163

| Initial electri-fication efficiency | Residual voltage | Ghost | Defective image | Image flow | Increase of defective image |
|---|---|---|---|---|---|
| ○ | ◎ | ○ | ◎ | ◎ | ○ |

| Surface abrasion | Break down voltage | Abrasion resistance | Interference fringe | Degree of background fogginess |
|---|---|---|---|---|
| ○ | ◎ | ◎ | ○ | ◎ |

◎ Excellent
○: Good

TABLE 162

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| Surface layer (upper layer) | $B_2H_6$/He (20%) | 500 | 250 | 100 | 0.35 | 0.3 |
| | $NH_3$ | 100 | | | | |

TABLE 164

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| Photo-conductive layer 1 | 11901 | 11906 | 11911 | 11916 | 11921 | 11926 | 11931 |
| Photo-conductive layer 2 | 11902 | 11907 | 11912 | 11917 | 11922 | 11927 | 11932 |
| Photo-conductive layer 3 | 11903 | 11908 | 11913 | 11918 | 11923 | 11928 | 11933 |
| Photo-conductive | 11904 | 11909 | 11914 | 11919 | 11924 | 11929 | 11934 |

TABLE 164-continued

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| layer 5 | | | | | | | |
| Photo-conductive layer 6 | 11905 | 11910 | 11915 | 11920 | 11925 | 11930 | 11935 |

TABLE 165

| Name of layer | Gas used and its flow rate (SCCM) | | Substrate temperature (°C.) | RF power (W) | Inner pressure (Torr) | Layer thickness (μm) |
|---|---|---|---|---|---|---|
| Surface layer (lower layer) | $B_2H_6$/Ar (20%) | 500 | 250 | 200 | 0.40 | 0.3 |
| | $H_2$ | 100 | | | | |
| | $NH_3$ | 100 | | | | |
| Surface layer (upper layer) | $B_2H_6$/He (20%) | 500 | 250 | 100 | 0.40 | 0.3 |
| | $H_2$ | 100 | | | | |
| | $NH_3$ | 300 | | | | |

TABLE 166

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| Photo-conductive layer 1 | 12001 | 12007 | 12013 | 12019 | 12025 | 12031 | 12037 |
| Photo-conductive layer 2 | 12002 | 12008 | 12014 | 12020 | 12026 | 12032 | 12038 |
| Photo-conductive layer 3 | 12003 | 12009 | 12015 | 12021 | 12027 | 12033 | 12039 |
| Photo-conductive layer 4 | 12004 | 12010 | 12016 | 12022 | 12028 | 12034 | 12040 |
| Photo-conductive layer 5 | 12005 | 12011 | 12017 | 12023 | 12029 | 12035 | 12041 |
| Photo-conductive layer 6 | 12006 | 12012 | 12018 | 12024 | 12030 | 12036 | 12042 |

TABLE 167

| Name of layer | Gas used and its flow rate (SCCM) | | Substrate temperature (°C.) | RF power (W) | Inner pressure (Torr) | Layer thickness (μm) |
|---|---|---|---|---|---|---|
| Surface layer (lower layer) | $B_2H_6$/Ar (20%) | 500 | 250 | 200 | 0.35 | 0.3 |
| | $NH_3$ | 100 | | | | |
| | Bias voltage of the cylinder | −150 V | | | | |
| Surface layer (upper layer) | $B_2H_6$/He (20%) | 500 | 250 | 100 | 0.35 | 0.3 |
| | $NH_3$ | 100 | | | | |
| | Bias voltage of the cylinder | +150 V | | | | |

TABLE 168

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| Photo-conductive layer 1 | 12101 | 12107 | 12113 | 12119 | 12125 | 12131 | 12137 |
| Photo-conductive layer 2 | 12102 | 12108 | 12114 | 12120 | 12126 | 12132 | 12138 |
| Photo-conductive | 12103 | 12109 | 12115 | 12121 | 12127 | 12133 | 12139 |

TABLE 168-continued

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| layer 3 | | | | | | | |
| Photo-conductive layer 4 | 12104 | 12110 | 12116 | 12122 | 12128 | 12134 | 12140 |
| Photo-conductive layer 5 | 12105 | 12111 | 12117 | 12123 | 12129 | 12135 | 12141 |
| Photo-conductive layer 6 | 12106 | 12112 | 12118 | 12124 | 12130 | 12136 | 12142 |

TABLE 169

| | Photo-con-ductive Layer 1 | Photo-con-ductive Layer 2 | Photo-con-ductive Layer 3 | Photo-con-ductive Layer 5 | Photo-con-ductive Layer 6 |
|---|---|---|---|---|---|
| Drum No. | 12201 | 12202 | 12203 | 12204 | 12205 |

TABLE 170

| | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| Drum No. | 12301 | 12302 | 12303 | 12304 | 12305 | 12306 |

TABLE 171

| | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| Drum No. | 12401 | 12402 | 12403 | 12404 | 12405 | 12406 |

TABLE 172

| | Drum No. |
|---|---|
| IR Absorptive Layer 1 | 12501 |
| IR Absorptive Layer 2 | 12502 |
| IR Absorptive Layer 3 | 12503 |
| IR Absorptive Layer 4 | 12504 |
| IR Absorptive Layer 5 | 12505 |
| IR Absorptive Layer 6 | 12506 |
| IR Absorptive Layer 7 | 12507 |

TABLE 172-continued

| | Drum No. |
|---|---|
| IR Absorptive Layer 8 | 12508 |
| IR Absorptive Layer 9 | 12509 |
| IR Absorptive Layer 10 | 12510 |
| IR Absorptive Layer 11 | 12511 |
| IR Absorptive Layer 12 | 12512 |
| IR Absorptive Layer 13 | 12513 |
| IR Absorptive Layer 14 | 12514 |
| IR Absorptive Layer 15 | 12515 |
| IR Absorptive Layer 17 | 12516 |
| IR Absorptive Layer 18 | 12517 |
| IR Absorptive Layer 19 | 12518 |
| IR Absorptive Layer 20 | 12519 |

TABLE 173

| Drum No. | Photo-conductive layer 1 | Photo-conductive layer 2 | Photo-conductive layer 3 | Photo-conductive layer 5 | Photo-conductive layer 6 |
|---|---|---|---|---|---|
| IR absorptive layer 1 | 12601 | 12621 | 12641 | 12661 | 12681 |
| IR absorptive layer 2 | 12602 | 12622 | 12642 | 12662 | 12682 |
| IR absorptive layer 3 | 12603 | 12623 | 12643 | 12663 | 12683 |
| IR absorptive layer 4 | 12604 | 12624 | 12644 | 12664 | 12684 |
| IR absorptive layer 5 | 12605 | 12625 | 12645 | 12665 | 12685 |
| IR absorptive | 12606 | 12626 | 12646 | 12666 | 12686 |

TABLE 173-continued

| Drum No. | Photo-conductive layer 1 | Photo-conductive layer 2 | Photo-conductive layer 3 | Photo-conductive layer 5 | Photo-conductive layer 6 |
|---|---|---|---|---|---|
| layer 6 | | | | | |
| IR absorptive layer 7 | 12607 | 12627 | 12647 | 12667 | 12687 |
| IR absorptive layer 8 | 12608 | 12628 | 12648 | 12668 | 12688 |
| IR absorptive layer 9 | 12609 | 12629 | 12649 | 12669 | 12689 |
| IR absorptive layer 10 | 12610 | 12630 | 12650 | 12670 | 12690 |
| IR absorptive layer 11 | 12611 | 12631 | 12651 | 12671 | 12691 |
| IR absorptive layer 12 | 12612 | 12632 | 12652 | 12672 | 12692 |
| IR absorptive layer 13 | 12613 | 12633 | 12653 | 12673 | 12693 |
| IR absorptive layer 14 | 12614 | 12634 | 12654 | 12674 | 12694 |
| IR absorptive layer 15 | 12615 | 12635 | 12655 | 12675 | 12695 |
| IR absorptive layer 16 | 12616 | 12636 | 12656 | 12676 | 12696 |
| IR absorptive layer 17 | 12617 | 12637 | 12657 | 12677 | 12697 |
| IR absorptive layer 18 | 12618 | 12638 | 12658 | 12678 | 12698 |
| IR absorptive layer 19 | 12619 | 12639 | 12659 | 12979 | 12699 |
| IR absorptive layer 20 | 12620 | 12640 | 12660 | 12680 | 126100 |

TABLE 174

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| IR absorptive layer 1 | 12701 | 12721 | 12741 | 12761 | 12781 | 127101 |
| IR absorptive layer 2 | 12702 | 12722 | 12742 | 12762 | 12782 | 127102 |
| IR absorptive layer 3 | 12703 | 12723 | 12743 | 12763 | 12783 | 127103 |
| IR absorptive layer 4 | 12704 | 12724 | 12744 | 12764 | 12784 | 127104 |
| IR absorptive layer 5 | 12705 | 12725 | 12745 | 12765 | 12785 | 127105 |
| IR absorptive layer 6 | 12706 | 12726 | 12746 | 12766 | 12786 | 127106 |
| IR absorptive layer 7 | 12707 | 12727 | 12747 | 12767 | 12787 | 127107 |
| IR absorptive layer 8 | 12708 | 12728 | 12748 | 12768 | 12788 | 127108 |
| IR absorptive layer 9 | 12709 | 12729 | 12749 | 12769 | 12789 | 127109 |
| IR absorptive layer 10 | 12710 | 12730 | 12750 | 12770 | 12790 | 127110 |
| IR absorptive layer 11 | 12711 | 12731 | 12751 | 12771 | 12791 | 127111 |
| IR absorptive layer 12 | 12712 | 12732 | 12752 | 12772 | 12792 | 127112 |
| IR absorptive layer 13 | 12713 | 12733 | 12753 | 12773 | 12793 | 127113 |
| IR absorptive layer 14 | 12714 | 12734 | 12754 | 12774 | 12794 | 127114 |
| IR absorptive layer 15 | 12715 | 12735 | 12755 | 12775 | 12795 | 127115 |
| IR absorptive layer 16 | 12716 | 12736 | 12756 | 12776 | 12796 | 127116 |
| IR absorptive layer 17 | 12717 | 12737 | 12757 | 12777 | 12797 | 127117 |
| IR absorptive layer 18 | 12718 | 12738 | 12758 | 12778 | 12798 | 127118 |
| IR absorptive layer 19 | 12719 | 12739 | 12759 | 12779 | 12799 | 127119 |
| IR absorptive layer 20 | 12720 | 12740 | 12760 | 12780 | 12700 | 127120 |

TABLE 175

| Drum No. | Photo-conductive layer 1 | Photo-conductive layer 2 | Photo-conductive layer 3 | Photo-conductve layer 4 | Photo-conductive layer 5 | Photo-conductive layer 6 |
|---|---|---|---|---|---|---|
| IR absorptive layer 1 | 12801 | 12821 | 18241 | 12861 | 12881 | 128101 |
| IR absorptive layer 2 | 12802 | 12822 | 12842 | 12862 | 12882 | 128102 |
| IR absorptive layer 3 | 12803 | 12823 | 12843 | 12863 | 12883 | 128103 |
| IR absorptive layer 4 | 12804 | 12824 | 12844 | 12864 | 12884 | 128104 |
| IR absorptive layer 5 | 12805 | 12825 | 12845 | 12865 | 12885 | 128105 |
| IR absorptive layer 6 | 12806 | 12826 | 12846 | 12866 | 12886 | 128106 |
| IR absorptive layer 7 | 12807 | 12827 | 12847 | 12867 | 12887 | 128107 |
| IR absorptive layer 8 | 12808 | 12828 | 12848 | 12868 | 12888 | 128108 |
| IR absorptive layer 9 | 12809 | 12829 | 12849 | 12869 | 12889 | 128109 |
| IR absorptive layer 10 | 12810 | 12830 | 12850 | 12870 | 12890 | 128110 |
| IR absorptive layer 11 | 12811 | 12831 | 12851 | 12871 | 12891 | 128111 |
| IR absorptive layer 12 | 12812 | 12832 | 12852 | 12872 | 12892 | 128112 |
| IR absorptive layer 13 | 12813 | 12833 | 12853 | 12873 | 12893 | 128113 |
| IR absorptive layer 14 | 12814 | 12834 | 12854 | 12874 | 12894 | 128114 |
| IR absorptive layer 15 | 12815 | 12835 | 12855 | 12875 | 12895 | 128115 |
| IR absorptive layer 16 | 12816 | 12836 | 12856 | 12876 | 12896 | 128116 |
| IR absorptive layer 17 | 12817 | 12837 | 12857 | 12877 | 12897 | 128117 |
| IR absorptive layer 18 | 12818 | 12838 | 12858 | 12878 | 12898 | 128118 |
| IR absorptive layer 19 | 12819 | 12839 | 12879 | 12879 | 12899 | 128119 |
| IR absorptive layer 20 | 12820 | 12840 | 12860 | 12880 | 128100 | 128120 |

TABLE 176

| | Contact Layer 2 | Contact Layer 3 | Contact Layer 4 |
|---|---|---|---|
| Drum No. | 12901 | 12902 | 12903 |

TABLE 177

| Drum No. | Contact layer 1 | Contact layer 2 | Contact layer 3 | Contact layer 4 |
|---|---|---|---|---|
| Photo-conductive layer 1 | 13001 | 13007 | 13013 | 13019 |
| Photo-conductive layer 2 | 13002 | 13008 | 13014 | 13020 |
| Photo-conductive layer 3 | 13003 | 13009 | 13015 | 13021 |
| Photo-conductive layer 4 | 13004 | 13010 | 13016 | 13022 |
| Photo-conductive layer 5 | 13005 | 13011 | 13017 | 13023 |
| Photo-conductive layer 6 | 13006 | 13012 | 13018 | 13024 |

TABLE 178

| Drum No. | Contact layer 1 | Contact layer 2 | Contact layer 3 | Contact layer 4 |
|---|---|---|---|---|
| Photo-conductive layer 1 | 13101 | 13107 | 13113 | 13119 |
| Photo-conductive layer 2 | 13102 | 13108 | 13114 | 13120 |
| Photo-conductive layer 3 | 13103 | 13109 | 13115 | 13121 |
| Photo-conductive layer 4 | 13104 | 13110 | 13116 | 13122 |
| Photo-conductive layer 5 | 13105 | 13111 | 13117 | 13123 |
| Photo-conductive layer 6 | 13106 | 13112 | 13118 | 13124 |

TABLE 179

| Drum No. | Contact layer 1 | Contact layer 2 | Contact layer 3 | Contact layer 4 |
|---|---|---|---|---|
| Photo-conductive layer 1 | 13201 | 13207 | 13213 | 13219 |
| Photo-conductive layer 2 | 13202 | 13208 | 13214 | 13220 |
| Photo-conductive | 13203 | 13209 | 13215 | 13221 |

TABLE 179-continued

| Drum No. | Contact layer 1 | Contact layer 2 | Contact layer 3 | Contact layer 4 |
|---|---|---|---|---|
| layer 3 | | | | |
| Photo-conductive layer 4 | 13204 | 13210 | 13216 | 13222 |
| Photo-conductive layer 5 | 13205 | 13211 | 13217 | 13223 |
| Photo-conductive layer 6 | 13206 | 13212 | 13218 | 13224 |

TABLE 180

| | Drum No. |
|---|---|
| IR absorptive layer 1 | 13301 |
| IR absorptive layer 2 | 13302 |
| IR absorptive layer 3 | 13303 |
| IR absorptive layer 4 | 13304 |
| IR absorptive layer 5 | 13305 |
| IR absorptive layer 6 | 13306 |
| IR absorptive layer 7 | 13307 |
| IR absorptive layer 8 | 13308 |
| IR absorptive layer 9 | 13309 |
| IR absorptive layer 10 | 13310 |
| IR absorptive layer 11 | 13311 |
| IR absorptive layer 12 | 13312 |
| IR absorptive layer 13 | 13313 |
| IR absorptive layer 14 | 13314 |
| IR absorptive layer 15 | 13315 |
| IR absorptive layer 17 | 13317 |
| IR absorptive layer 18 | 13318 |
| IR absorptive layer 19 | 13319 |
| IR absorptive layer 20 | 13320 |

TABLE 181

| Drum No. | Photo-conductive layer 4 | Photo-conductive layer 5 | Photo-conductive layer 7 |
|---|---|---|---|
| IR absorptive layer 1 | 13401 | 13421 | 13441 |
| IR absorptive layer 2 | 13402 | 13422 | 13442 |
| IR absorptive layer 3 | 13403 | 13423 | 13443 |
| IR absorptive layer 4 | 13404 | 13424 | 13444 |
| IR absorptive layer 5 | 13405 | 13425 | 13445 |
| IR absorptive layer 6 | 13406 | 13426 | 13446 |
| IR absorptive layer 7 | 13407 | 13427 | 13447 |
| IR absorptive layer 8 | 13408 | 13428 | 13448 |
| IR absorptive layer 9 | 13409 | 13429 | 13449 |

TABLE 181-continued

| Drum No. | Photo-conductive layer 4 | Photo-conductive layer 5 | Photo-conductive layer 7 |
|---|---|---|---|
| IR absorptive layer 10 | 13410 | 13430 | 13450 |
| IR absorptive layer 11 | 13411 | 13431 | 13451 |
| IR absorptive layer 12 | 13412 | 13432 | 13452 |
| IR absorptive layer 13 | 13413 | 13433 | 13453 |
| IR absorptive layer 14 | 13414 | 13434 | 13454 |
| IR absorptive layer 15 | 13415 | 13435 | 13455 |
| IR absorptive layer 16 | 13416 | 13436 | 13456 |
| IR absorptive layer 17 | 13417 | 13437 | 13457 |
| IR absorptive layer 18 | 13418 | 13438 | 13458 |
| IR absorptive layer 19 | 13419 | 13439 | 13459 |
| IR absorptive layer 20 | 13420 | 13440 | 13460 |

TABLE 182

| Drum No. | Photo-conductive layer 1 | Photo-conductive layer 4 | Photo-conductive layer 5 | Photo-conductive layer 7 |
|---|---|---|---|---|
| IR absorptive layer 1 | 13501 | 13521 | 13541 | 13561 |
| IR absorptive layer 2 | 13502 | 13522 | 13542 | 13562 |
| IR absorptive layer 3 | 13503 | 13523 | 13543 | 13563 |
| IR absorptive layer 4 | 13504 | 13524 | 13544 | 13564 |
| IR absorptive layer 5 | 13505 | 13525 | 13545 | 13565 |
| IR absorptive layer 6 | 13506 | 13526 | 13546 | 13566 |
| IR absorptive layer 7 | 13507 | 13527 | 13547 | 13567 |
| IR absorptive layer 8 | 13508 | 13528 | 13548 | 13568 |
| IR absorptive layer 9 | 13509 | 13529 | 13549 | 13569 |
| IR absorptive layer 10 | 13510 | 13530 | 13550 | 13570 |
| IR absorptive layer 11 | 13511 | 13531 | 13551 | 13571 |
| IR absorptive layer 12 | 13512 | 13532 | 13552 | 13572 |
| IR absorptive layer 13 | 13513 | 13533 | 13553 | 13573 |
| IR absorptive layer 14 | 13514 | 13534 | 13554 | 13574 |
| IR absorptive layer 15 | 13515 | 13535 | 13555 | 13575 |
| IR absorptive layer 16 | 13516 | 13536 | 13556 | 13576 |
| IR absorptive layer 17 | 13517 | 13537 | 13557 | 13577 |
| IR absorptive layer 18 | 13518 | 13538 | 13558 | 13578 |
| IR absorptive layer 19 | 13519 | 13539 | 13559 | 13579 |
| IR absorptive layer 20 | 13520 | 13540 | 13560 | 13580 |

TABLE 183

| Drum No. | Photo-conductive layer 1 | Photo-conductive layer 4 | Photo-conductive layer 5 | Photo-conductive layer 7 |
|---|---|---|---|---|
| IR absorptive layer 1 | 13601 | 13621 | 13641 | 13661 |

TABLE 183-continued

| Drum No. | Photo-conductive layer 1 | Photo-conductive layer 4 | Photo-conductive layer 5 | Photo-conductive layer 7 |
|---|---|---|---|---|
| IR absorptive layer 2 | 13602 | 13622 | 13642 | 13662 |
| IR absorptive layer 3 | 13603 | 13623 | 13643 | 13663 |
| IR absorptive layer 4 | 13604 | 13624 | 13644 | 13664 |
| IR absorptive layer 5 | 13605 | 13625 | 13645 | 13665 |
| IR absorptive layer 6 | 13606 | 13626 | 13646 | 13666 |
| IR absorptive layer 7 | 13607 | 13627 | 13647 | 13667 |
| IR absorptive layer 8 | 13608 | 13628 | 13648 | 13668 |
| IR absorptive layer 9 | 13609 | 13629 | 13649 | 13669 |
| IR absorptive layer 10 | 13610 | 13630 | 13650 | 13670 |
| IR absorptive layer 11 | 13611 | 13631 | 13651 | 13671 |
| IR absoprtive layer 12 | 13612 | 13632 | 13652 | 13672 |
| IR absorptive layer 13 | 13613 | 13633 | 13653 | 13673 |
| IR absorptive layer 14 | 13614 | 13634 | 13654 | 13674 |
| IR absorptive layer 15 | 13615 | 13635 | 13655 | 13675 |
| IR absorptive layer 16 | 13616 | 13636 | 13656 | 13676 |
| IR absorptive layer 17 | 13617 | 13637 | 13657 | 13677 |
| IR absorptive layer 18 | 13618 | 13638 | 13658 | 13678 |
| IR absorptive layer 19 | 13619 | 13639 | 13659 | 13679 |
| IR absorptive layer 20 | 13620 | 13640 | 13660 | 13680 |

TABLE 184

| | Contact Layer 1 | Contact Layer 2 | Contact Layer 3 | Contact Layer 4 | Contact Layer 6 | Contact Layer 7 | Contact Layer 8 |
|---|---|---|---|---|---|---|---|
| Drum No. | 13701 | 13702 | 13703 | 13704 | 13705 | 13706 | 13707 |

TABLE 185

| Drum No. | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|
| Contact layer 1 | 13801 | 13809 | 13817 | 13825 | 13833 | 13841 |
| Contact layer 2 | 13802 | 13810 | 13818 | 13826 | 13834 | 13842 |
| Contact layer 3 | 13803 | 13811 | 13819 | 13827 | 13835 | 13843 |
| Contact layer 4 | 13804 | 13812 | 13820 | 13828 | 13836 | 13844 |
| Contact layer 5 | 13805 | 13813 | 13821 | 13829 | 13837 | 13845 |
| Contact layer 6 | 13806 | 13814 | 13822 | 13830 | 13838 | 13846 |
| Contact layer 7 | 13807 | 13815 | 13823 | 13831 | 13839 | 13847 |
| Contact layer 8 | 13808 | 13816 | 13824 | 13832 | 13840 | 13848 |

TABLE 186

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| Contact layer 1 | 13901 | 13909 | 13917 | 13925 | 13933 | 13941 | 13949 |
| Contact layer 2 | 13902 | 13910 | 13918 | 13926 | 13934 | 13942 | 13950 |
| Contact layer 3 | 13903 | 13911 | 13919 | 13927 | 13935 | 13943 | 13951 |
| Contact layer 4 | 13904 | 13912 | 13920 | 13928 | 13936 | 13944 | 13952 |
| Contact layer 5 | 13905 | 13913 | 13921 | 13929 | 13937 | 13945 | 13953 |
| Contact layer 6 | 13906 | 13914 | 13922 | 13930 | 13938 | 13946 | 13954 |
| Contact layer 7 | 13907 | 13915 | 13923 | 13931 | 13939 | 13947 | 13955 |
| Contact layer 8 | 13908 | 13916 | 13924 | 13932 | 13940 | 13948 | 13956 |

TABLE 187

| Drum No. | Charge injection inhibition layer 1 | Charge injection inhibition layer 2 | Charge injection inhibition layer 3 | Charge injection inhibition layer 4 | Charge injection inhibition layer 5 | Charge injection inhibition layer 6 | Charge injection inhibition layer 7 |
|---|---|---|---|---|---|---|---|
| Contact layer 1 | 14001 | 14009 | 14017 | 14025 | 14033 | 14041 | 14049 |
| Contact layer 2 | 14002 | 14010 | 14018 | 14026 | 14034 | 14042 | 14050 |
| Contact layer 3 | 14003 | 14011 | 14019 | 14027 | 14035 | 14043 | 14051 |
| Contact layer 4 | 14004 | 14012 | 14020 | 14028 | 14036 | 14044 | 14052 |
| Contact layer 5 | 14005 | 14013 | 14021 | 14029 | 14037 | 14045 | 14053 |
| Contact layer 6 | 14006 | 14014 | 14022 | 14030 | 14038 | 14046 | 14054 |
| Contact layer 7 | 14007 | 14015 | 14023 | 14031 | 14039 | 14047 | 14055 |
| Contact layer 8 | 14008 | 14016 | 14024 | 14032 | 14040 | 14048 | 14056 |

TABLE 188

| Drum No. | Charge injection inhibition layer 4 14101 | Charge injection inhibition layer 6 14102 | Charge injection inhibition 7 14103 |
|---|---|---|---|

TABLE 189

| Drum No. | Charge injection inhibition layer 1 | Charge injection inhibition layer 4 | Charge injection inhibition layer 6 | Charge injection inhibition layer 7 |
|---|---|---|---|---|
| Photo-conductive layer 5 | 14201 | 14203 | 14205 | 14207 |
| Photo-conductive layer 6 | 14202 | 14204 | 14206 | 14208 |

TABLE 190

| Drum No. | Charge injection inhibition layer 1 | Charge injection inhibition layer 4 | Charge injection inhibition layer 6 | Charge injection inhibition layer 7 |
|---|---|---|---|---|
| Photo-conductive layer 4 | 14301 | 14304 | 14307 | 14310 |
| Photo-conductive layer 5 | 14302 | 14305 | 14308 | 14311 |
| Photo-conductive layer 6 | 14303 | 14306 | 14309 | 14312 |

TABLE 191

| Drum No. | Charge injection inhibition layer 1 | Charge injection inhibition layer 4 | Charge injection inhibition layer 6 | Charge injection inhibition layer 7 |
|---|---|---|---|---|
| Photo-conductive layer 4 | 14401 | 14404 | 14407 | 14410 |
| Photo-conductive layer 5 | 14402 | 14405 | 14408 | 14411 |
| Photo-conductive layer 6 | 14403 | 14406 | 14409 | 14412 |

TABLE 192

| Name of layer | Gas used and its flow rate (SSCM) | | Substrate temperature (°C.) | RF power (W) | Inner pressure (Torr) | Layer thickness (μm) |
|---|---|---|---|---|---|---|
| Surface layer (lower layer) | $B_2H_6$/Ar (20%)<br>$NH_3$ | 500<br>100 | 250 | 200 | 0.35 | 0.3 |
| Surface layer (upper layer) | $B_2H_6$/He (20%)<br>$NH_3$ | 500<br>100 | 250 | 100 | 0.35 | 0.3 |

TABLE 193

| Drum No. | Photo-conductive layer 1 | Photo-conductive layer 4 | Photo-conductive layer 5 | Photo-conductive layer 7 |
|---|---|---|---|---|
| IR absorptive layer 1 | 14501 | 14521 | 14541 | 14561 |
| IR absorptive layer 2 | 14502 | 14522 | 14542 | 14562 |
| IR absorptive layer 3 | 14503 | 14523 | 14543 | 14563 |
| IR absorptive layer 4 | 14504 | 14524 | 14544 | 14564 |
| IR absorptive layer 5 | 14505 | 14525 | 14545 | 14565 |
| IR absorptive layer 6 | 14506 | 14526 | 14546 | 14566 |
| IR absorptive layer 7 | 14507 | 14527 | 14547 | 14567 |
| IR absorptive layer 8 | 14508 | 14528 | 14548 | 14568 |
| IR absorptive layer 9 | 14509 | 14529 | 14549 | 14569 |
| IR absorptive layer 10 | 14510 | 14530 | 14550 | 14570 |
| IR absorptive | 14511 | 14531 | 14551 | 14571 |

TABLE 193-continued

| Drum No. | Photo-conductive layer 1 | Photo-conductive layer 4 | Photo-conductive layer 5 | Photo-conductive layer 7 |
|---|---|---|---|---|
| layer 11 | | | | |
| IR absorptive layer 12 | 14512 | 14532 | 14552 | 14572 |
| IR absorptive layer 13 | 14513 | 14533 | 14553 | 14573 |
| IR absorptive layer 14 | 14514 | 14534 | 14554 | 14574 |
| IR absorptive layer 15 | 14515 | 14535 | 14555 | 14575 |
| IR absorptive layer 16 | 14516 | 14536 | 14556 | 14576 |
| IR absorptive layer 17 | 14517 | 14537 | 14557 | 14577 |
| IR absorptive layer 18 | 14518 | 14538 | 14558 | 14578 |
| IR absorptive layer 19 | 14519 | 14539 | 14559 | 14579 |
| IR absorptive layer 20 | 14520 | 14540 | 14560 | 14580 |

TABLE 194

| Drum No. | Photo-conductive layer 1 | Photo-conductive layer 4 | Photo-conductive layer 5 | Photo-conductive layer 7 |
|---|---|---|---|---|
| IR absorptive layer 1 | 14601 | 14621 | 14641 | 14661 |
| IR absorptive layer 2 | 14602 | 14622 | 14642 | 14662 |
| IR absorptive layer 3 | 14603 | 14623 | 14643 | 14663 |
| IR absortive layer 4 | 14604 | 14624 | 14644 | 14664 |
| IR absorptive layer 5 | 14605 | 14625 | 14645 | 14665 |
| IR absorptive layer 6 | 14606 | 14626 | 14646 | 14666 |
| IR absorptive layer 7 | 14607 | 14627 | 14647 | 14667 |
| IR absorptive layer 8 | 14608 | 14628 | 14648 | 14668 |
| IR absorptive layer 9 | 14609 | 14629 | 14649 | 14669 |
| IR absorptive layer 10 | 14610 | 14630 | 14650 | 14670 |
| IR absorptive layer 11 | 14611 | 14631 | 14651 | 14671 |
| IR absorptive layer 12 | 14612 | 14632 | 14652 | 14672 |
| IR absorptive layer 13 | 14613 | 14633 | 14653 | 14673 |
| IR absorptive layer 14 | 14614 | 14634 | 14654 | 14674 |
| IR absorptive layer 15 | 14615 | 14635 | 14655 | 14675 |
| IR absorptive layer 16 | 14616 | 14636 | 14656 | 14676 |
| IR absorptive layer 17 | 14617 | 14637 | 14657 | 14677 |
| IR absorptive layer 18 | 14618 | 14638 | 14658 | 14678 |
| IR absorptive layer 19 | 14619 | 14639 | 14659 | 14679 |
| IR absorptive layer 20 | 14620 | 14640 | 14660 | 14680 |

TABLE 195

| Drum No. | Photo-conductive layer 1 | Photo-conductive layer 4 | Photo-conductive layer 5 | Photo-conductive layer 7 |
|---|---|---|---|---|
| IR absorptive layer 1 | 14701 | 14721 | 14741 | 14761 |
| IR absorptive layer 2 | 14702 | 14722 | 14742 | 14762 |
| IR absorptive | 14703 | 14723 | 14743 | 14763 |

TABLE 195-continued

| Drum No. | Photo-conductive layer 1 | Photo-conductive layer 4 | Photo-conductive layer 5 | Photo-conductive layer 7 |
|---|---|---|---|---|
| layer 3 | | | | |
| IR absorptive layer 4 | 14704 | 14724 | 14744 | 14764 |
| IR absorptive layer 5 | 14705 | 14725 | 14745 | 14765 |
| IR absorptive layer 6 | 14706 | 14726 | 14746 | 14766 |
| IR absorptive layer 7 | 14707 | 14727 | 14747 | 14767 |
| IR absorptive layer 8 | 14708 | 14728 | 14748 | 14768 |
| IR absorptive layer 9 | 14709 | 14729 | 14749 | 14769 |
| IR absorptive layer 10 | 14710 | 14730 | 14750 | 14770 |
| IR absorptive layer 11 | 14711 | 14731 | 14751 | 14771 |
| IR absorptive layer 12 | 14712 | 14732 | 14752 | 14772 |
| IR absorptive layer 13 | 14713 | 14733 | 14753 | 14773 |
| IR absorptive layer 14 | 14714 | 14734 | 14754 | 14774 |
| IR absorptive layer 15 | 14715 | 14735 | 14755 | 14775 |
| IR absorptive layer 16 | 14716 | 14736 | 14756 | 14776 |
| IR absorptive layer 17 | 14717 | 14737 | 14757 | 14777 |
| IR absorptive layer 18 | 14718 | 14738 | 14758 | 14778 |
| IR absorptive layer 19 | 14719 | 14739 | 14759 | 14779 |
| IR absorptive layer 20 | 14720 | 14740 | 14760 | 14780 |

TABLE 196

| Drum No. | Photo-conductive layer 1 | Photo-conductive layer 4 | Photo-conductive layer 5 | Photo-conductive layer 7 |
|---|---|---|---|---|
| IR absorptive layer 1 | 14801 | 14821 | 14841 | 14861 |
| IR absorptive layer 2 | 14802 | 14822 | 14842 | 14862 |
| IR absorptive layer 3 | 14803 | 14823 | 14843 | 14863 |
| IR absorptive layer 4 | 14804 | 14824 | 14844 | 14864 |
| IR absorptive layer 5 | 14805 | 14825 | 14845 | 14865 |
| IR absorptive layer 6 | 14806 | 14826 | 14846 | 14866 |
| IR absorptive layer 7 | 14807 | 14827 | 14847 | 14867 |
| IR absorptive layer 8 | 14808 | 14828 | 14848 | 14868 |
| IR absorptive layer 9 | 14809 | 14829 | 14849 | 14869 |
| IR absorptive layer 10 | 14810 | 14830 | 14850 | 14870 |
| IR absorptive layer 11 | 14811 | 14831 | 14851 | 14871 |
| IR absorptive layer 12 | 14812 | 14832 | 14852 | 14872 |
| IR absorptive layer 13 | 14813 | 14833 | 14853 | 14873 |
| IR absorptive layer 14 | 14814 | 14834 | 14854 | 14874 |
| IR absorptive layer 15 | 14815 | 14835 | 14855 | 14875 |
| IR absorptive layer 16 | 14816 | 14836 | 14856 | 14876 |
| IR absorptive layer 17 | 14817 | 14837 | 14857 | 14877 |
| IR absorptive layer 18 | 14818 | 14838 | 14858 | 14878 |

TABLE 196-continued

| Drum No. | Photo-conductive layer 1 | Photo-conductive layer 4 | Photo-conductive layer 5 | Photo-conductive layer 7 |
|---|---|---|---|---|
| IR absorptive layer 19 | 14819 | 14839 | 14859 | 14879 |
| IR absorptive layer 20 | 14820 | 14840 | 14860 | 14880 |

TABLE 197

| Drum No. | Photo-conductive layer 1 | Photo-conductive layer 4 | Photo-conductive layer 5 | Photo-conductive layer 7 |
|---|---|---|---|---|
| IR absorptive layer 1 | 14901 | 14921 | 14941 | 14961 |
| IR absorptive layer 2 | 14902 | 14922 | 14942 | 14962 |
| IR absorptive layer 3 | 14903 | 14923 | 14943 | 14963 |
| IR absorptive layer 4 | 14904 | 14924 | 14944 | 14964 |
| IR absorptive layer 5 | 14905 | 14925 | 14945 | 14965 |
| IR absorptive layer 6 | 14906 | 14926 | 14946 | 14966 |
| IR absorptive layer 7 | 14907 | 14927 | 14947 | 14967 |
| IR absorptive layer 8 | 14908 | 14928 | 14948 | 14968 |
| IR absorptive layer 9 | 14909 | 14929 | 14949 | 14969 |
| IR absorptive layer 10 | 14910 | 14990 | 14950 | 14970 |
| IR absorptive layer 11 | 14911 | 14931 | 14951 | 14971 |
| IR absorptive layer 12 | 14912 | 14932 | 14952 | 14972 |
| IR absorptive layer 13 | 14913 | 14933 | 14953 | 14973 |
| IR absorptive layer 14 | 14914 | 14934 | 14954 | 14974 |
| IR absorptive layer 15 | 14915 | 14935 | 14955 | 14975 |
| IR absorptive layer 16 | 14916 | 14936 | 14956 | 14996 |
| IR absorptive layer 17 | 14917 | 14937 | 14957 | 14977 |
| IR absorptive layer 18 | 14918 | 14938 | 14958 | 14978 |
| IR absorptive layer 19 | 14919 | 14939 | 14959 | 14979 |

TABLE 197-continued

| Drum No. | Photo-conductive layer 1 | Photo-conductive layer 4 | Photo-conductive layer 5 | Photo-conductive layer 7 |
|---|---|---|---|---|
| IR absorptive layer 20 | 14920 | 14940 | 14960 | 14980 |

TABLE 198

| Drum No. | Photo-conductive layer 1 | Photo-conductive layer 4 | Photo-conductive layer 5 | Photo-conductive layer 7 |
|---|---|---|---|---|
| IR absorptive layer 1 | 15051 | 15021 | 15041 | 15061 |
| IR absorptive layer 2 | 15002 | 15022 | 15042 | 15062 |
| IR absorptive layer 3 | 15003 | 15023 | 15043 | 15063 |
| IR absorptive layer 4 | 15004 | 15024 | 15044 | 15064 |
| IR absorptive layer 5 | 15005 | 15025 | 15045 | 15065 |
| IR absorptive layer 6 | 15006 | 15026 | 15046 | 15066 |
| IR absorptive layer 7 | 15007 | 15027 | 15047 | 15067 |
| IR absorptive layer 8 | 15008 | 15028 | 15048 | 15068 |
| IR absorptive layer 9 | 15009 | 15029 | 15049 | 15069 |
| IR absorptive layer 10 | 15010 | 15030 | 15050 | 15070 |
| IR absorptive layer 11 | 15011 | 15031 | 15051 | 15071 |
| IR absorptive layer 12 | 15012 | 15032 | 15052 | 15072 |
| IR absorptive layer 13 | 15013 | 15033 | 15053 | 15073 |
| IR absorptive layer 14 | 15014 | 15034 | 15054 | 15074 |
| IR absorptive layer 15 | 15015 | 15035 | 15055 | 15075 |
| IR absorptive layer 16 | 15016 | 15036 | 15056 | 15076 |
| IR absorptive layer 17 | 15017 | 15037 | 15057 | 15077 |
| IR absorptive layer 18 | 15018 | 15038 | 15058 | 15078 |
| IR absorptive layer 19 | 15019 | 15039 | 15059 | 15079 |
| IR absorptive layer 20 | 15020 | 15040 | 15060 | 15080 |

TABLE 199

| Drum No. | | Gas used and its flow rate (SSCM) | | Substrate temperature (°C.) | RF power (W) | Inner pressure (Torr) | Layer thickness (μm) |
|---|---|---|---|---|---|---|---|
| 15101 | Lower layer | $B_2H_6$/AR (20%) | 500 | 250 | 200 | 0.35 | 0.3 |
| | | $NH_3$ | 100 | | | | |
| | Upper layer | $B_2H_6$/He (20%) | 500 | 250 | 100 | 0.35 | 0.3 |
| | | $NH_3$ | 100 | | | | |
| 15102 | Lower layer | $B_2H_6$/Ar (20%) | 500 | 250 | 200 | 0.40 | 0.3 |
| | | $H_2$ | 100 | | | | |
| | | $NH_3$ | 100 | | | | |
| | Upper layer | $B_2H_6$/He (20%) | 500 | 250 | 100 | 0.40 | 0.3 |
| | | $H_2$ | 100 | | | | |
| | | $NH_3$ | 300 | | | | |
| 15103 | Lower layer | $B_2H_6$/Ar (20%) | 500 | 250 | 200 | 0.35 | 0.3 |
| | | $NH_3$ | 100 | | | | |
| | | Bias voltage of the cylinder | −150 V | | | | |
| | Upper layer | $B_2H_6$/He (20%) | 500 | 250 | 100 | 0.35 | 0.3 |
| | | $NH_3$ | 100 | | | | |
| | | Bias voltage of the cylinder | +100 V | | | | |

TABLE 200

| Drum No. | | Gas used and its flow rate (SCCM) | | Substrate temperature (°C.) | RF power (W) | Inner pressure (Torr) | Layer thickness (μm) |
|---|---|---|---|---|---|---|---|
| 15201 | Lower layer | $B_2H_6$/Ar (20%) | 500 | 250 | 200 | 0.35 | 0.3 |
| | | $NH_3$ | 100 | | | | |
| | Upper layer | $B_2H_6$/He (20%) | 500 | 250 | 100 | 0.35 | 0.3 |
| | | $NH_3$ | 100 | | | | |
| 15202 | Lower layer | $B_2H_6$/Ar (20%) | 500 | 250 | 200 | 0.40 | 0.3 |
| | | $H_2$ | 100 | | | | |
| | | $NH_3$ | 100 | | | | |
| | Upper layer | $B_2H_6$/He (20%) | 500 | 250 | 100 | 0.40 | 0.3 |
| | | $H_2$ | 100 | | | | |
| | | $NH_3$ | 300 | | | | |
| 15203 | Lower layer | $B_2H_6$/Ar (20%) | 500 | 250 | 200 | 0.35 | 0.3 |
| | | $NH_3$ | 100 | | | | |
| | | Bias voltage of the cylinder | −150 V | | | | |
| | Upper layer | $B_2H_6$/He (20%) | 500 | 250 | 100 | 0.35 | 0.3 |
| | | $NH_3$ | 100 | | | | |
| | | Bias voltage of the cylinder | +100 V | | | | |

TABLE 201

| Drum No. | | Gas used and its flow rate (SCCM) | | Substrate temperature (°C.) | RF power (W) | Inner pressure (Torr) | Layer thickness (μm) |
|---|---|---|---|---|---|---|---|
| 15301 | Lower layer | $B_2H_6$/Ar (20%) | 500 | 250 | 200 | 0.35 | 0.3 |
| | | $NH_3$ | 100 | | | | |
| | Upper layer | $B_2H_6$/He (20%) | 500 | 250 | 100 | 0.35 | 0.3 |
| | | $NH_3$ | 100 | | | | |
| 15302 | Lower layer | $B_2H_6$/Ar (20%) | 500 | | | | |
| | | $H_2$ | 100 | 250 | 200 | 0.40 | 0.3 |
| | | $NH_3$ | 100 | | | | |
| | Upper layer | $B_2H_6$/He (20%) | 500 | 250 | 100 | 0.40 | 0.3 |
| | | $H_2$ | 100 | | | | |
| | | $NH_3$ | 300 | | | | |
| 15303 | Lower layer | $B_2H_6$/Ar (20%) | 500 | 250 | 200 | 0.35 | 0.3 |
| | | $NH_3$ | 100 | | | | |
| | | Bias voltage of the cylinder | −150 V | | | | |
| | Upper layer | $B_2H_6$/He (20%) | 500 | 250 | 100 | 0.35 | 0.3 |
| | | $NH_3$ | 100 | | | | |
| | | Bias voltage of the cylinder | +100 V | | | | |

TABLE 202

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Inter-mediate layer | $SiH_4$ | 10 | 250 | 150 | 0.35 | 0.3 |
| | $CH_4$ | 400 | | | | |
| Surface layer (lower layer) | $B_2H_6$/Ar (20%) | 500 | 250 | 200 | 0.35 | 0.3 |
| | $NH_3$ | 100 | | | | |
| Surface layer (upper layer) | $B_2H_6$/He (20%) | 500 | 250 | 100 | 0.35 | 0.3 |
| | $NH_3$ | 100 | | | | |

TABLE 203 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive | $SiH_4$ | 200 | 250 | 250 | 0.35 | 20 |
| | $B_2H_6$ (against $SiH_4$) | 100 ppm | | | | |

TABLE 203 (a)-continued

| Name of layer | Gas used and its flow rate (SCCM) | | Substrate temperature (°C.) | RF power (W) | Inner pressure (Torr) | Layer thickness (μm) |
|---|---|---|---|---|---|---|
| layer | NO | 4 | | | | |
| Surface layer | $B_2H_6$/Ar (20%) | 500 | 250 | 200 | 0.35 | 0.5 |
| | $NH_3$ | 100 | | | | |
| | $SiH_4$ (against $B_2H_6 + NH_3$) | 100 ppm | | | | |

TABLE 203 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer | $B_2H_6$/Ar (20%) | 500 | 250 | 200 | 0.35 | 0.5 |
| | $NH_3$ | 100 | | | | |
| | $GeH_4$ (against $B_2H_6 + NH_3$) | 100 ppm | | | | |

TABLE 204

| Drum No. | Intial electrification efficiency | Residual voltage | Ghost | Defective image | Image flow |
|---|---|---|---|---|---|
| (a) | ○ | ◎ | ◎ | ◎ | ○ |
| (b) | ○ | ◎ | ◎ | ◎ | ○ |

| Drum No. | Increase of defective image | Surface abrasion | Breakdown voltage | Abrasion resistance |
|---|---|---|---|---|
| (a) | ○ | ◎ | ◎ | ◎ |
| (b) | ○ | ◎ | ◎ | ◎ |

◎: Excellent
○: Good

TABLE 207

| Drum No. | Initial electrification efficiency | Residual voltage | Ghost | Defective image | Image flow |
|---|---|---|---|---|---|
| (a) | ○ | ◎ | ◎ | ◎ | ○ |
| (b) | ○ | ◎ | ◎ | ◎ | ○ |

| Drum No. | Increase of defective image | Surface abrasion | Break down voltage | Abrasion resistance |
|---|---|---|---|---|
| (a) | ○ | ◎ | ◎ | ◎ |
| (b) | ○ | ◎ | ◎ | ◎ |

◎: Excellent
○: Good

TABLE 205 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer | $B_2H_6$/Ar (20%) | 500 | 250 | 200 | 0.40 | 0.5 |
| | $H_2$ | 100 | | | | |
| | $NH_3$ | 100 | | | | |
| | $SiH_4$ (against $B_2H_6 + NH_3$) | 50 ppm | | | | |

TABLE 205 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer | $B_2H_6$/Ar (20%) | 500 | 250 | 200 | 0.40 | 0.5 |
| | $H_2$ | 100 | | | | |
| | $NH_3$ | 100 | | | | |
| | $GeH_4$ (against $B_2H_6 + NH_3$) | 50 ppm | | | | |

TABLE 206

| Drum No. | Initial electrification efficiency | Residual voltage | Ghost | Defective image | Image flow |
|---|---|---|---|---|---|
| (a) | ○ | ◎ | ◎ | ◎ | ○ |
| (b) | ○ | ◎ | ◎ | ◎ | ○ |

TABLE 206-continued

| Drum No. | Increase of defective image | Surface abrasion | Break down voltage | Abrasion resistance |
|---|---|---|---|---|
| (a) | ○ | ◎ | ◎ | ◎ |
| (b) | ○ | ◎ | ◎ | ◎ |

◎: Excellent
○: Good

TABLE 208 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |
| | $SiH_4$ (against $B_2H_6$ + $NH_3$) | 100 ppm | | | | |

TABLE 208 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $PH_3$ (against $SiH_4$) | 800 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |
| | $GeH_4$ (against $B_2H_6$+ $NH_3$) | 100 ppm | | | | |

TABLE 209

| Drum No. | Initial electri-fication efficiency | Residual voltage | Ghost | Defective image | Image flow |
|---|---|---|---|---|---|
| (a) | ◎ | ◎ | ◎ | ◎ | ○ |
| (b) | ◎ | ◎ | ◎ | ◎ | ○ |

| Drum No. | Increase of defective image | Surface abrasion | Break down voltage | Abrasion resistance |
|---|---|---|---|---|
| (a) | ○ | ◎ | ◎ | ◎ |
| (b) | ○ | ◎ | ◎ | ◎ |

◎: Excellent
○ : Good

TABLE 211

| Drum No. | Initial electri-fication efficiency | Residual voltage | Ghost | Defective image | Image flow |
|---|---|---|---|---|---|
| (a) | ◎ | ◎ | ◎ | ◎ | ○ |
| (b) | ◎ | ◎ | ◎ | ◎ | ○ |

| Drum No. | Increase of defective image. | Surface abrasion | Break down voltage | Abrasion resistance |
|---|---|---|---|---|
| (a) | ○ | ◎ | ◎ | ◎ |
| (b) | ○ | ◎ | ◎ | ◎ |

◎: Excellent
○ : Good

TABLE 210 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |
| | $SiH_4$ (against $B_2H_6$+ $NH_3$) | 100 ppm | | | | |

TABLE 210 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |
| | $GeH_4$ (against $B_2H_6$+ $NH_3$) | 100 ppm | | | | |

TABLE 212 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |
| | $SiH_4$ (against $B_2H_6$+ $NH_3$) | 100 ppm | | | | |

TABLE 212 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $PH_3$ (against $SiH_4$) | 800 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |
| | $GeH_4$ (against $B_2H_6$+ $NH_3$) | 100 ppm | | | | |

TABLE 213

| Drum No. | Initial electrification efficiency | Residual voltage | Ghost | Defective image | Image flow |
|---|---|---|---|---|---|
| (a) | ○ | ◉ | ◉ | ◉ | ○ |
| (b) | ○ | ◉ | ◉ | ◉ | ○ |

TABLE 213-continued

| Drum No. | Increase of defective image | Surface abrasion | Break down voltage | Abrasion resistance | Interference fringe |
|---|---|---|---|---|---|
| (a) | ○ | ◉ | ◉ | ◉ | ○ |
| (b) | ○ | ◉ | ◉ | ◉ | ○ |

◉: Excellent
○: Good

TABLE 214 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 100 | 0.25 | 0.5 |
| | $N_2$ | 100 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |
| | $SiH_4$ (against $B_2H_6$+ $NH_3$) | 100 ppm | | | | |

TABLE 214 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 100 | 0.25 | 0.5 |
| | $N_2$ | 100 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |
| | $GeH_4$ (against $B_2H_6$+ $NH_3$) | 100 ppm | | | | |

TABLE 215

| Drum No. | Initial electrification efficiency | Residual voltage | Ghost | Defective image | Image flow |
|---|---|---|---|---|---|
| (a) | ◉ | ◉ | ◉ | ◉ | ○ |
| (b) | ◉ | ◉ | ◉ | ◉ | ○ |

TABLE 215-continued

| Drum No. | Increase of defective image | Surface abrasion | Break down voltage | Abrasion resistance |
|---|---|---|---|---|
| (a) | ○ | ◎ | ◎ | ◎ |
| (b) | ○ | ◎ | ◎ | ◎ |

◎: Exellent
○ : Good

TABLE 216 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |
| | $SiH_4$ (against $B_2H_6 + NH_3$) | 100 ppm | | | | |

TABLE 216 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $PH_3$ (against $SiH_4$) | 800 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $PH_3$ (against $SiH_4$) | 800 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |
| | $GeH_4$ (against $B_2H_6 + NH_3$) | 100 ppm | | | | |

TABLE 217

| Drum No. | Initial electrification efficiency | Residual voltage | Ghost | Defective image | Image flow |
|---|---|---|---|---|---|
| (a) | ◎ | ◎ | ◎ | ◎ | ○ |
| (b) | ◎ | ◎ | ◎ | ◎ | ○ |

TABLE 217-continued

| Drum No. | Increase of defective image | Surface abrasion | Break down voltage | Abrasion resistence | Interference fringe |
|---|---|---|---|---|---|
| (a) | ○ | ◎ | ◎ | ◎ | ○ |
| (b) | ○ | ◎ | ◎ | ◎ | ○ |

◎: Excellent
○ : Good

TABLE 218 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |
| | $SiH_4$ (against $B_2H_6 + NH_3$) | 100 ppm | | | | |

TABLE 218 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| Charge injection inhibition layer | $SiH_4$ | 100 | 250 | 150 | 0.35 | 3 |
| | $H_2$ | 100 | | | | |
| | $PH_3$ (against $SiH_4$) | 800 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |
| | $GeH_4$ (against $B_2H_6 + NH_3$) | 100 ppm | | | | |

TABLE 219

| Drum No. | Initial electrification efficiency | Residual voltage | Ghost | Defective image | Image flow |
|---|---|---|---|---|---|
| (a) | ○ | ◉ | ◉ | ◉ | ◉ |
| (b) | ○ | ◉ | ◉ | ◉ | ◉ |

TABLE 219-continued

| Drum No. | Increase of defective image | Surface abrasion | Break down voltage | Abrasion resistance |
|---|---|---|---|---|
| (a) | ○ | ○ | ◉ | ◉ |
| (b) | ○ | ○ | ◉ | ◉ |

◉: Excellent
○ : Good

TABLE 220 (a)

| Name of layer | Gas used and its flow rate (SCCM) | | Substrate temperatrue (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |
| | $SiH_4$ (against $B_2H_6 + NH_3$) | 100 ppm | | | | |

TABLE 220 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| IR absorptive layer | $SiH_4$ | 100 | 250 | 150 | 0.35 | 1 |
| | $H_2$ | 100 | | | | |
| | $GeH_4$ | 50 | | | | |
| | $PH_3$ (against $SiH_4$) | 800 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $PH_3$ (against $SiH_4$) | 800 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/Ar (20%) | 500 | 250 | 200 | 0.35 | 0.5 |
| | $NH_3$ | 100 | | | | |
| | $GeH_4$ (against $B_2H_6 + NH_3$) | 100 ppm | | | | |

TABLE 221

| Drum No. | Initial electrification efficiency | Residual voltage | Ghost | Defective image | Image flow |
|---|---|---|---|---|---|
| (a) | ◉ | ◉ | ◉ | ◉ | ○ |
| (b) | ◉ | ◉ | ◉ | ◉ | ○ |

TABLE 221-continued

| Drum No. | Increase of defective image | Surface abrasion | Break down voltage | Abrasion resistance | Interference fringe |
|---|---|---|---|---|---|
| (a) | ○ | ◎ | ◎ | ◎ | ○ |
| (b) | ○ | ◎ | ◎ | ◎ | ○ |

◎: Excellent
○ : Good

TABLE 222

| Drum No. | Gas used and its flow rate (SCCM) | | Substrate temperature (°C.) | RF power (W) | Inner pressure (Torr) | Layer thickness (μm) |
|---|---|---|---|---|---|---|
| 16701 | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 16702 | $SiF_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 16703 | $SiH_4$ | 200 | 250 | 300 | 0.40 | 20 |
| | $H_2$ | 200 | | | | |
| 16704 | $SiH_4$ | 200 | 250 | 250 | 0.40 | 20 |
| | Ar | 200 | | | | |
| 16705 | $SiH_4$ | 150 | 250 | 350 | 0.40 | 20 |
| | $SiF_4$ | 50 | | | | |
| | $H_2$ | 200 | | | | |
| 16706* | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 16707* | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 16708* | $SiH_4$ | 200 | 250 | 300 | 0.40 | 20 |
| | $H_2$ | 200 | | | | |
| 16709* | $SiH_4$ | 200 | 250 | 250 | 0.40 | 20 |
| | Ar | 200 | | | | |
| 16710* | $SiH_4$ | 150 | 250 | 350 | 0.40 | 20 |
| | $SiF_4$ | 50 | | | | |
| | $H_2$ | 200 | | | | |

*surface layer followed Table 203 (b)
markless case: followed Table 203 (a)

TABLE 223

| Drum No. | Gas used and its flow rate (SCCM) | | Substrate temperature (°C.) | RF power (W) | Inner pressure (Torr) | Layer thickness (μm) |
|---|---|---|---|---|---|---|
| 16801 | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 16802 | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 16803 | $SiH_4$ | 200 | 250 | 300 | 0.40 | 20 |
| | $H_2$ | 200 | | | | |
| 16804 | $SiH_4$ | 200 | 250 | 250 | 0.40 | 20 |
| | Ar | 200 | | | | |
| 16805 | $SiH_4$ | 150 | 250 | 350 | 0.40 | 20 |
| | $SiF_4$ | 50 | | | | |
| | $H_2$ | 200 | | | | |
| 16806* | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 16807* | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 16808* | $SiH_4$ | 200 | 250 | 300 | 0.40 | 20 |
| | $H_2$ | 200 | | | | |
| 16809* | $SiH_4$ | 200 | 250 | 250 | 0.40 | 20 |
| | Ar | 200 | | | | |
| 16810* | $SiH_4$ | 150 | 250 | 350 | 0.40 | 20 |
| | $SiF_4$ | 50 | | | | |

TABLE 223-continued

| Drum No. | Gas used and its flow rate (SCCM) | | Substrate temperature (°C.) | RF power (W) | Inner pressure (Torr) | Layer thickness (μm) |
|---|---|---|---|---|---|---|
| | $H_2$ | 200 | | | | |

*surface layer followed Table 205 (b)
markless case: followed Table 205 (a)

TABLE 224

| Drum No. | Gas used and its flow rate (SCCM) | | Substrate temperature (°C.) | RF power (W) | Inner pressure (Torr) | Layer thickness (μm) |
|---|---|---|---|---|---|---|
| 16901 | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 16902 | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 16903 | $SiH_4$ | 200 | 250 | 300 | 0.40 | 20 |
| | $H_2$ | 200 | | | | |
| 16304 | $SiH_4$ | 200 | 250 | 250 | 0.40 | 20 |
| | Ar | 200 | | | | |
| 16905 | $SiH_4$ | 150 | 250 | 350 | 0.40 | 20 |
| | $SiF_4$ | 50 | | | | |
| | $H_2$ | 200 | | | | |
| 16906* | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 16907* | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 16908* | $SiH_4$ | 200 | 250 | 300 | 0.40 | 20 |
| | $H_2$ | 200 | | | | |
| 16309* | $SiH_4$ | 200 | 250 | 250 | 0.40 | 20 |
| | Ar | 200 | | | | |
| 16910* | $SiH_4$ | 150 | 250 | 350 | 0.40 | 20 |
| | $SiF_4$ | 50 | | | | |
| | $H_2$ | 200 | | | | |

*surface layer followed Table 203 (b)
markless case: followed Table 203 (a)

TABLE 225

| Drum No. | Gas used and its flow rate (SCCM) | | Substrate temperature (°C.) | RF power (W) | Inner pressure (Torr) | Layer thickness (μm) |
|---|---|---|---|---|---|---|
| 17001 | $SiH_4$ | 100 | 250 | 150 | 0.35 | 3 |
| | $H_2$ | 100 | | | | |
| | $B_2H_6$ (against $SiH_4$) | 1000 ppm | | | | |
| | $GeH_4$ | 10 | | | | |
| | NO | 10 | | | | |
| 17002 | $SiH_4$ | 80 | 250 | 170 | 0.25 | 3 |
| | $SiF_4$ | 20 | | | | |
| | $B_2H_6$ (against $SiH_4$) | 1000 ppm | | | | |
| | $SnH_4$ | 5 | | | | |
| | NO | 5 | | | | |
| 17003 | $SiH_4$ | 100 | 250 | 130 | 0.25 | 3 |
| | $B_2H_6$ (against $SiH_4$) | 800 ppm | | | | |
| | NO | 4 | | | | |
| | $N_2$ | 4 | | | | |
| | $CH_4$ | 6 | | | | |
| 17004* | $SiH_4$ | 100 | 250 | 150 | 0.35 | 3 |
| | $H_2$ | 100 | | | | |
| | $PH_3$ (against $SiH_4$) | 800 ppm | | | | |
| 17005* | $SiH_4$ | 100 | 250 | 130 | 0.25 | 3 |
| | $PH_3$ (against $SiH_4$) | 800 ppm | | | | |
| | $GeH_4$ | 10 | | | | |
| | NO | 10 | | | | |
| 17006 | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO** | 10 | | | | |

TABLE 225-continued

| Drum No. | Gas used and its flow rate (SCCM) | Substrate temperature (°C.) | RF power (W) | Inner pressure (Torr) | Layer thickness (μm) |
|---|---|---|---|---|---|
| NO*** | 10 → 0**** | | | | |

*surface layer followed Table 208(b)
markless case: followed Table 208(a)
**Substrate side 2 μm
***Surface layer side 1 μm
****Constantly changed

TABLE 226

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Photo-conductive layer 1 | 17101 | 17106 | 17111 | 17116 | 17121 | 17126 | 17131 |
| Photo-conductive layer 2 | 17102 | 17107 | 17112 | 17117 | 17122 | 17127 | 17132 |
| Photo-conductive layer 3 | 17103 | 17108 | 17113 | 17118 | 17123 | 17128 | 17133 |
| Photo-conductive layer 5 | 17104 | 17109 | 17114 | 17119 | 17124 | 17129 | 17134 |
| Photo-conductive layer 6 | 17105 | 17110 | 17115 | 17120 | 17125 | 17130 | 17135 |

*surface layer followed Table 6 ( b)
markless case: followed Table 6 (a)

TABLE 227

| Name of layer | Gas used and its flow rate (SCCM) | | Substrate temperature (°C.) | RF power (W) | Inner pressure (Torr) | Layer thickness (μm) |
|---|---|---|---|---|---|---|
| Surface* layer A | $B_2H_6$/Ar (20%) | 500 | 250 | 200 | 0.40 | 0.5 |
| | $H_2$ | 100 | | | | |
| | $NH_3$ | 100 | | | | |
| | $SiH_4$ (against $B_2H_6 + NH_3$) | 50 ppm | | | | |
| Surface* layer B | $B_2H_6$/Ar (20%) | 500 | 250 | 200 | 0.40 | 0.5 |
| | $H_2$ | 100 | | | | |
| | $NH_3$ | 100 | | | | |
| | $GeH_4$ (against $B_2H_6 + NH_3$) | 50 ppm | | | | |

*each of the surface layers A and B is individually used in accordance with the kind of the lower layer

TABLE 228

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Photo-conductive layer 1 | 17201 | 17207 | 17213 | 17219 | 17225 | 17231 | 17237 |
| Photo-conductive layer 2 | 17202 | 17208 | 17214 | 17220 | 17226 | 17232 | 17238 |
| Photo-conductive layer 3 | 17203 | 17209 | 17215 | 17221 | 17227 | 17233 | 17239 |
| Photo-conductive layer 4 | 17204 | 17210 | 17216 | 17222 | 17228 | 17234 | 17240 |
| Photo-conductive layer 5 | 17205 | 17211 | 17217 | 17223 | 17229 | 17235 | 17241 |
| Photo-conductive layer 6 | 17206 | 17212 | 17218 | 17224 | 17230 | 17236 | 17242 |

*surface layer B was used
markless case: surface layer A was used

TABLE 229

| Name of layer | Gas used and its flow rate (SCCM) | | Substrate temperature (°C.) | RF power (W) | Inner pressure (Torr) | Layer thickness (μm) |
|---|---|---|---|---|---|---|
| Surface* layer A | $B_2H_6$/Ar (20%) | 500 | 250 | 200 | 0.35 | 0.5 |
| | $NH_3$ | 100 | | | | |
| | $SiH_4$ (against $B_2H_6$ + $NH_3$) | 100 ppm | | | | |
| | Bias voltage of the cylinder | −150 V | | | | |
| Surface* layer B | $B_2H_6$/Ar (20%) | 500 | 250 | 200 | 0.35 | 0.5 |
| | $NH_3$ | 100 | | | | |
| | $GeH_4$ (against $B_2H_6$ + $NH_3$) | 100 ppm | | | | |
| | Bias voltage of the cylinder | −150 V | | | | |

*each of the surface layers A and B is individually used in accordance with the kind of the lower layer

TABLE 230

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Photo-conductive layer 1 | 17301 | 17307 | 17313 | 17319 | 17325 | 17331 | 17337 |
| Photo-conductive layer 2 | 17302 | 17308 | 17314 | 17320 | 17326 | 17362 | 17338 |
| Photo-conductive layer 3 | 17303 | 17309 | 17315 | 17321 | 17327 | 17333 | 17339 |
| Photo-conductive layer 4 | 17304 | 17310 | 17316 | 17322 | 17328 | 17334 | 17340 |
| Photo-conductive layer 5 | 17305 | 17311 | 17317 | 17323 | 17329 | 17335 | 17341 |
| Photo-conductive layer 6 | 17306 | 17312 | 17318 | 17324 | 17330 | 17336 | 17342 |

*surface layer B was used
markless case: surface layer A was used

TABLE 231

| | Photo-con-ductive Layer 1 | Photo-conductive Layer 2 | Photo-con-ductive Layer 3 | Photo-conductive Layer 5 | Photo-con-ductive Layer 6 |
|---|---|---|---|---|---|
| Drum No. | 17401<br>17406* | 17402<br>17407* | 17403<br>17408* | 17404<br>17409* | 17405<br>17410* |

*Surface layer followed Table 210 (b)
Markless case: followed Table 210 (a)

TABLE 232

| | Photo-con-ductive layer 1 | Photo-con-ductive layer 2 | Photo-con-ductive layer 3 | Photo-con-ductive layer 4 | Photo-con-ductive layer 5 | Photo-con-ductive layer 6 |
|---|---|---|---|---|---|---|
| Drum No. | 17501<br>17507* | 17502<br>17508* | 17503<br>17509* | 17504<br>17510* | 17505<br>17511* | 17506<br>17512* |

*surface layer B was used.
markless case: surface layer A was used.

TABLE 233

| | Photo-con-ductive layer 1 | Photo-con-ductive layer 2 | Photo-con-ductive layer 3 | Photo-con-ductive layer 4 | Photo-con-ductive layer 5 | Photo-con-ductive layer 6 |
|---|---|---|---|---|---|---|
| Drum No. | 17601<br>17607* | 17602<br>17608* | 17603<br>17609* | 17604<br>17610* | 17605<br>17611* | 17606<br>17612* |

*surface layer B was used.
*markless case: surface layer A was used.

TABLE 234

| | Drum No. | |
|---|---|---|
| IR Absorptive Layer 1 | 17701 | 17720* |
| IR Absorptive Layer 2 | 17702 | 17721* |
| IR Absorptive Layer 3 | 17703 | 17722* |
| IR Absorptive Layer 4 | 17704 | 17723* |
| IR Absorptive Layer 5 | 17705 | 17724* |
| IR Absorptive Layer 6 | 17706 | — |
| IR Absorptive Layer 7 | 17707 | — |
| IR Absorptive Layer 8 | 17708 | — |
| IR Absorptive Layer 9 | 17709 | — |
| IR Absorptive Layer 10 | 17710 | — |
| IR Absorptive Layer 11 | 17711 | — |
| IR Absorptive Layer 12 | 17712 | — |
| IR Absorptive Layer 13 | 17713 | — |
| IR Absorptive Layer 14 | 17714 | — |
| IR Absorptive Layer 15 | 17715 | — |
| IR Absorptive Layer 17 | 17716 | — |
| IR Absorptive | 17717 | 17725* |

TABLE 234-continued

| | Drum No. | |
|---|---|---|
| Layer 18 | | |
| IR Absorptive | 17718 | 17726* |
| Layer 19 | | |
| IR Absorptive | 17719 | 17727* |
| Layer 20 | | |

*:Surface layer followed Table 212(b)
Markless case:followed 212(a).

TABLE 235

| Drum No. | Photo-conductive layer 1 | Photo-conductive layer 2 | Photo-conductive layer 3 | Photo-conductive layer 5 | Photo-conductive layer 6 |
|---|---|---|---|---|---|
| IR absorptive layer 1 | 17801 | 17821 | 17841 | 17861 | 17881 |
| IR absorptive layer 2 | 17802 | 17822 | 17842 | 17862 | 17882 |
| IR absorptive layer 3 | 17803 | 17823 | 17843 | 17863 | 17883 |
| IR absorptive layer 4 | 17804 | 17824 | 17844 | 17864 | 17884 |
| IR absorptive layer 5 | 17805 | 17825 | 17845 | 17865 | 17885 |
| IR absorptive layer 6 | 17806 | 17826 | 17846 | 17866 | 17886 |
| IR absorptive layer 7 | 17807 | 17827 | 17847 | 17867 | 17887 |
| IR absorptive layer 8 | 17808 | 17828 | 17848 | 17868 | 17888 |
| IR absorptive layer 9 | 17809 | 17829 | 17849 | 17869 | 17889 |
| IR absorptive layer 10 | 17810 | 17830 | 17850 | 17870 | 17890 |
| IR absorptive layer 11* | 17811 | 17831 | 17851 | 17871 | 17891 |
| IR absorptive layer 12* | 17812 | 17832 | 17852 | 17872 | 17892 |
| IR absorptive layer 13* | 17813 | 17833 | 17853 | 17873 | 17893 |
| IR absorptive layer 14* | 17814 | 17834 | 17854 | 17874 | 17894 |
| IR absorptive layer 15* | 17815 | 17835 | 17855 | 17875 | 17895 |
| IR absorptive layer 16 | 17816 | 17836 | 17856 | 17876 | 17896 |
| IR absorptive layer 17* | 17817 | 17837 | 17857 | 17877 | 17897 |
| IR absorptive layer 18 | 17818 | 17838 | 17858 | 17878 | 17898 |
| IR absorptive layer 19 | 17819 | 17839 | 17859 | 17879 | 17899 |
| IR absorptive layer 20 | 17820 | 17840 | 17860 | 17880 | 178100 |

*: surface layer followed Table 212(b)
markless case: followed Table 212(a)

TABLE 236

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| IR absorptive layer 1 | 17901 | 17921 | 17941 | 17961 | 17981 | 179101 |
| IR absorptive layer 2 | 17902 | 17922 | 17942 | 17962 | 17982 | 179102 |
| IR absorptive layer 3 | 17903 | 17923 | 17943 | 17963 | 17983 | 179103 |
| IR absorptive layer 4 | 17904 | 17924 | 17944 | 17964 | 17984 | 179104 |
| IR absorptive layer 5 | 17905 | 17925 | 17945 | 17965 | 17985 | 179105 |
| IR absorptive layer 6 | 17906 | 17926 | 17946 | 17966 | 17986 | 179106 |
| IR absorptive layer 7 | 17907 | 17927 | 17947 | 17967 | 17987 | 179107 |
| IR absorptive layer 8 | 17908 | 17928 | 17948 | 17968 | 17988 | 179108 |
| IR absorptive layer 9 | 17909 | 17929 | 17949 | 17969 | 17989 | 179109 |
| IR absorptive | 17910 | 17930 | 17950 | 17970 | 17990 | 179110 |

TABLE 236-continued

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| layer 10 | | | | | | |
| IR absorptive layer 11* | 17911 | 17931 | 17951 | 17971 | 17991 | 179111 |
| IR absorptive layer 12* | 17912 | 17932 | 17952 | 17972 | 17992 | 179112 |
| IR absorptive layer 13* | 17913 | 17933 | 17953 | 17973 | 17993 | 179113 |
| IR absorptive layer 14* | 17914 | 17934 | 17954 | 17974 | 17994 | 179114 |
| IR absorptive layer 15* | 17915 | 17935 | 17955 | 17975 | 17995 | 179115 |
| IR absorptive layer 16 | 17916 | 17936 | 17956 | 17976 | 17996 | 179116 |
| IR absorptive layer 17* | 17917 | 17937 | 17957 | 17977 | 17997 | 179117 |
| IR absorptive layer 18 | 17918 | 17938 | 17958 | 17978 | 17998 | 179118 |
| IR absorptive layer 19 | 17919 | 17939 | 17959 | 17979 | 17999 | 179119 |
| IR absorptive layer 20 | 17920 | 17940 | 17960 | 17980 | 179100 | 179120 |

*: surface layer B was used
markless case: surface layer A was used

TABLE 237

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| IR absorptive layer 1 | 18001 | 18021 | 18041 | 18061 | 18081 | 180101 |
| IR absorptive layer 2 | 18002 | 18022 | 18042 | 18062 | 18082 | 180102 |
| IR absorptive layer 3 | 18003 | 18023 | 18043 | 18063 | 18083 | 180103 |
| IR absorptive layer 4 | 18004 | 18024 | 18044 | 18064 | 18084 | 180104 |
| IR absorptive layer 5 | 18005 | 18025 | 18045 | 18065 | 18085 | 180105 |
| IR absorptive layer 6 | 18006 | 18026 | 18046 | 18066 | 18086 | 180106 |
| IR absorptive layer 7 | 18007 | 18027 | 18047 | 18067 | 18087 | 180107 |
| IR absorptive layer 8 | 18008 | 18028 | 18048 | 18068 | 18088 | 180108 |
| IR absorptive layer 9 | 18009 | 18029 | 18049 | 18069 | 18089 | 180109 |
| IR absorptive layer 10 | 18010 | 18030 | 18050 | 18070 | 18090 | 180110 |
| IR absorptive layer 11* | 18011 | 18031 | 18051 | 18071 | 18091 | 180111 |
| IR absorptive layer 12* | 18012 | 18032 | 18052 | 18072 | 18092 | 180112 |
| IR absorptive layer 13* | 18013 | 18033 | 18053 | 18073 | 18093 | 180113 |
| IR absorptive layer 14* | 18014 | 18034 | 18054 | 18074 | 18094 | 180114 |
| IR absorptive layer 15* | 18015 | 18035 | 18055 | 18075 | 18095 | 180115 |
| IR absorptive layer 16 | 18016 | 18036 | 18056 | 18076 | 18096 | 180116 |
| IR absorptive layer 17* | 18017 | 18037 | 18057 | 18077 | 18097 | 180117 |
| IR absorptive layer 18 | 18018 | 18038 | 18058 | 18078 | 18098 | 180118 |
| IR absorptive layer 19 | 18019 | 18039 | 18059 | 18079 | 18099 | 180119 |
| IR absorptive layer 20 | 18020 | 18040 | 18060 | 18080 | 180100 | 180120 |

*: surface layer B was used
markless case: surface layer A was used

TABLE 238

| | Contact Layer 2 | Contact Layer 3 | Contact Layer 4 |
|---|---|---|---|
| Drum No. | 18101<br>18104* | 18102<br>18105* | 18103<br>18106* |

*Surface layer followed Table 214 (b)
Markless case: followed Table 214 (a)

TABLE 239

| Drum No. | Contact layer 1 | Contact layer 2 | Contact layer 3 | Contact layer 4 |
|---|---|---|---|---|
| Photo-conductive layer 1 | 18201 | 18207* | 18213 | 18219 |
| Photo-conductive layer 2 | 18202 | 18208 | 18214* | 18220 |
| Photo-conductive layer 3 | 18203* | 18209 | 18215 | 18221 |
| Photo-conductive layer 4 | 18204 | 18210 | 18216 | 18222* |
| Photo-conductive layer 5 | 18205 | 18211 | 18217* | 18223 |
| Photo-conductive layer 6 | 18206 | 18212* | 18218 | 18224 |

*surface layer followed Table 214 (b)
markless case: followed Table 214 (a)

TABLE 240

| Drum No. | Contact layer 1 | Contact layer 2 | Contact layer 3 | Contact layer 4 |
|---|---|---|---|---|
| Photo-conductive layer 1 | 18301 | 18307 | 18313* | 18319 |
| Photo-conductive layer 2 | 18302 | 18308* | 18314 | 18320 |
| Photo-conductive layer 3 | 18303 | 18309 | 18315 | 18321* |
| Photo-conductive layer 4 | 18304* | 18310 | 18316 | 18322 |
| Photo-conductive layer 5 | 18305 | 18311* | 18317 | 18323 |
| Photo-conductive layer 6 | 18306 | 18312 | 18318* | 18324 |

*surface layer B was used
markless case: surface layer A was used

TABLE 241

| Drum No. | Contact layer 1 | Contact layer 2 | Contact layer 3 | Contact layer 4 |
|---|---|---|---|---|
| Photo-conductive layer 1 | 18402* | 18407 | 18413 | 18419 |
| Photo-conductive layer 2 | 18402 | 18408 | 18414* | 18420 |
| Photo-conductive layer 3 | 18403 | 18409 | 18415 | 18421* |
| Photo-conductive layer 4 | 18404 | 18410* | 18416 | 18422 |
| Photo-conductive layer 5 | 18405 | 18411 | 18417 | 18423* |
| Photo-conductive layer 6 | 18406* | 18412 | 18418 | 18424 |

TABLE 241-continued

| Drum No. | Contact layer 1 | Contact layer 2 | Contact layer 3 | Contact layer 4 |
|---|---|---|---|---|
| | | | | |

*surface layer B was used
markless case: surface layer A was used

TABLE 242

| | Drum No. | |
|---|---|---|
| IR absorptive layer 1 | 18501 | 18521 * |
| IR absorptive layer 2 | 18502 | 18522 * |
| IR absorptive layer 3 | 18503 | 18523 * |
| IR absorptive layer 4 | 18504 | 18524 * |
| IR absorptive layer 5 | 18505 | 18526 * |
| IR absorptive layer 6 | 18506 | 18526 * |
| IR absorptive layer 7 | 18507 | 18527 * |
| IR absorptive layer 8 | 18508 | 18528 * |
| IR absorptive layer 9 | 18509 | 18529 * |
| IR absorptive layer 10 | 18510 | 18530 * |
| IR absorptive layer 11 | 18511 | 18531 * |
| IR absorptive layer 12 | 18512 | 18532 * |
| IR absorptive layer 13 | 18513 | 18533 * |
| IR absorptive layer 14 | 18514 | 18534 * |
| IR absorptive layer 15 | 18515 | 18535 * |
| IR absorptive layer 16 | 18516 | 18536 * |
| IR absorptive layer 17 | 18517 | 18537 * |
| IR absorptive layer 18 | 18518 | 18538 * |
| IR absorptive layer 19 | 18519 | 18539 * |
| IR absorptive layer 20 | 18520 | 18540 * |

*Charge injection inhibition layer and surface layer followed Table 216(b)
markless case: followed Table 216(a)

TABLE 243

| Drum No. | Photo-conductive layer 4 | Photo-conductive layer 5* | Photo-conductive layer 7 |
|---|---|---|---|
| IR absorptive layer 1 | 18601 | 18621 | 18641 |
| IR absorptive layer 2 | 18602 | 18622 | 18642 |
| IR absorptive layer 3 | 18603 | 18623 | 18643 |
| IR absorptive layer 4 | 18604 | 18624 | 18644 |
| IR absorptive layer 5 | 18605 | 18625 | 18645 |
| IR absorptive layer 6 | 18606 | 18626 | 18646 |
| IR absorptive layer 7 | 18607 | 18627 | 18647 |
| IR absorptive layer 8 | 18608 | 18628 | 18648 |
| IR absorptive layer 9 | 18609 | 18629 | 18649 |
| IR absorptive layer 10 | 18610 | 18630 | 18650 |
| IR absorptive | 18611 | 18631 | 18651 |

TABLE 243-continued

| Drum No. | Photo-conductive layer 4 | Photo-conductive layer 5* | Photo-conductive layer 7 |
|---|---|---|---|
| layer 11 | | | |
| IR absorptive layer 12 | 18612 | 18632 | 18652 |
| IR absorptive layer 13 | 18613 | 18633 | 18653 |
| IR absorptive layer 14 | 18614 | 18634 | 18654 |
| IR absorptive layer 15 | 18615 | 18635 | 18655 |
| IR absorptive layer 16 | 18616 | 18636 | 18656 |
| IR absorptive layer 17 | 18617 | 18637 | 18657 |
| IR absorptive layer 18 | 18618 | 18638 | 18658 |
| IR absorptive layer 19 | 18619 | 18639 | 18659 |
| IR absorptive layer 20 | 18620 | 18640 | 18660 |

*surface layer followed Table 216(b)
markless case: followed Table 216(a)

TABLE 244

| Drum No. | Photo-conductive layer 1 | Photo-conductive layer 4 | Photo-conductive layer 5* | Photo-conductive layer 7 |
|---|---|---|---|---|
| IR absorptive layer 1 | 18701 | 18721 | 18741 | 18761 |
| IR absorptive layer 2 | 18702 | 18722 | 18742 | 18762 |
| IR absorptive layer 3 | 18703 | 18723 | 18743 | 18763 |
| IR absorptive layer 4 | 18704 | 18724 | 18744 | 18764 |
| IR absorptive layer 5 | 18705 | 18725 | 18745 | 18765 |
| IR absorptive layer 6 | 18706 | 18726 | 18746 | 18766 |
| IR absorptive layer 7 | 18707 | 18727 | 18747 | 18767 |
| IR absorptive layer 8 | 18708 | 18728 | 18748 | 18768 |
| IR absorptive layer 9 | 18709 | 18729 | 18749 | 18769 |
| IR absorptive layer 10 | 18710 | 18730 | 18750 | 18770 |
| IR absorptive layer 11 | 18711 | 18731 | 18751 | 18771 |
| IR absorptive layer 12 | 18712 | 18732 | 18752 | 18772 |
| IR absorptive layer 13 | 18713 | 18733 | 18753 | 18773 |
| IR absorptive layer 14 | 18714 | 18734 | 18754 | 18774 |
| IR absorptive layer 15 | 18715 | 18735 | 18755 | 18775 |
| IR absorptive layer 16 | 18716 | 18736 | 18756 | 18776 |

TABLE 244-continued

| Drum No. | Photo-conductive layer 1 | Photo-conductive layer 4 | Photo-conductive layer 5* | Photo-conductive layer 7 |
|---|---|---|---|---|
| IR absorptive layer 17 | 18717 | 18737 | 18757 | 18777 |
| IR absorptive layer 18 | 18718 | 18738 | 18758 | 18778 |
| IR absorptive layer 19 | 18719 | 18739 | 18759 | 18779 |
| IR absorptive layer 20 | 18720 | 18740 | 18760 | 18780 |

*surface layer B was used
markless case: surface layer A was used

TABLE 245

| Drum No. | Photo-conductive layer 1 | Photo-conductive layer 4 | Photo-conductive layer 5* | Photo-conductive layer 7 |
|---|---|---|---|---|
| IR absorptive layer 1 | 18801 | 18821 | 18841 | 18861 |
| IR absorptive layer 2 | 18802 | 18822 | 18842 | 18862 |
| IR absorptive layer 3 | 18803 | 18823 | 18843 | 18863 |
| IR absorptive layer 4 | 18804 | 18824 | 18844 | 18864 |
| IR absorptive layer 5 | 18805 | 18825 | 18845 | 18865 |
| IR absorptive layer 6 | 18806 | 18826 | 18846 | 18866 |
| IR absorptive layer 7 | 18807 | 18827 | 18847 | 18867 |
| IR absorptive layer 8 | 18808 | 18828 | 18848 | 18868 |
| IR absorptive layer 9 | 18809 | 18829 | 18849 | 18869 |
| IR absorptive layer 10 | 18810 | 18830 | 18850 | 18870 |
| IR absorptive layer 11 | 18811 | 18831 | 18851 | 18871 |
| IR absorptive layer 12 | 18812 | 18832 | 18852 | 18872 |
| IR absorptive layer 13 | 18813 | 18833 | 18853 | 18873 |
| IR absorptive layer 14 | 18814 | 18834 | 18854 | 18874 |
| IR absorptive layer 15 | 18815 | 18835 | 18855 | 18875 |
| IR absorptive layer 16 | 18816 | 18836 | 18856 | 18876 |
| IR absorptive layer 17 | 18817 | 18837 | 18857 | 18877 |
| IR absorptive layer 18 | 18818 | 18838 | 18858 | 18878 |
| IR absorptive layer 19 | 18819 | 18839 | 18859 | 18879 |
| IR absorptive layer 20 | 18820 | 18840 | 18860 | 18880 |

*surface layer B was used
markless case: surface layer A was used

TABLE 246

| | Contact Layer 1 | Contact Layer 2 | Contact Layer 3 | Contact Layer 4 | Contact Layer 6 | Contact Layer 7 | Contact Layer 8 |
|---|---|---|---|---|---|---|---|
| Drum | 18901 | 18902 | 18903 | 18904 | 18905 | 18906 | 18907 |
| No. | 18908* | 18909* | 18910* | 18911* | 18912* | 18913* | 18914* |

*Charge injection inhibition layer and surface layer followed Table 218 (b)
Markless case: followed Table 218 (a)

TABLE 247

| Drum No. | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|
| Contact | 19001 | 19009 | 19017 | 19025 | 19033 | 19041 |

TABLE 247-continued

| Drum No. | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|
| layer 1 | | | | | | |
| Contact layer 2 | 19002 | 19010 | 19018 | 19026 | 19034 | 19042 |
| Contact layer 3 | 19003 | 19011 | 19019 | 19027 | 19035 | 19043 |
| Contact layer 4 | 19004 | 19012 | 19020 | 19028 | 19036 | 19044 |
| Contact layer 5 | 19005 | 19013 | 19021 | 19029 | 19037 | 19045 |
| Contact layer 6 | 19006 | 19014 | 19022 | 19030 | 19038 | 19046 |
| Contact layer 7 | 19007 | 19015 | 19023 | 19031 | 19039 | 19047 |
| Contact layer 8 | 19008 | 19016 | 19024 | 19032 | 19040 | 19048 |

*surface layer followed Table 218 (b)
markless case: followed Table 218 (a)

TABLE 248

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Contact layer 1 | 19101 | 19109 | 19117 | 19125 | 19133 | 19141 | 19149 |
| Contact layer 2 | 19102 | 19110 | 19118 | 19126 | 19134 | 19142 | 19150 |
| Contact layer 3 | 19103 | 19111 | 19119 | 19127 | 19135 | 19143 | 19151 |
| Contact layer 4 | 19104 | 19112 | 19120 | 19128 | 19136 | 19144 | 19152 |
| Contact layer 5 | 19105 | 19113 | 19121 | 19129 | 19137 | 19145 | 19153 |
| Contact layer 6 | 19106 | 19114 | 19122 | 19130 | 19138 | 19146 | 19154 |
| Contact layer 7 | 19107 | 19115 | 19123 | 19131 | 19139 | 19147 | 19155 |
| Contact layer 8 | 19108 | 19116 | 19124 | 19132 | 19140 | 19148 | 19156 |

*surface layer B was used
markless case: surface layer A was used

TABLE 249

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Contact layer 1 | 19201 | 19209 | 19217 | 19225 | 19233 | 19241 | 19249 |
| Contact layer 2 | 19202 | 19210 | 19218 | 19226 | 19234 | 19242 | 19250 |
| Contact layer 3 | 19203 | 19211 | 19219 | 19227 | 19235 | 19243 | 19251 |
| Contact layer 4 | 19204 | 19212 | 19220 | 19228 | 19236 | 19244 | 19252 |
| Contact layer 5 | 19205 | 19213 | 19221 | 19229 | 19237 | 19245 | 19253 |
| Contact layer 6 | 19206 | 19214 | 19222 | 19230 | 19238 | 19246 | 19254 |
| Contact layer 7 | 19207 | 19215 | 19223 | 19231 | 19239 | 19247 | 19255 |
| Contact layer 8 | 19208 | 19216 | 19224 | 19232 | 19240 | 19248 | 19256 |

*surface layer B was used
markless case: surface layer A was used

TABLE 250

| | Charge injection inhibition layer 4 | Charge injection inhibition layer 6* | Charge injection inhibition layer 7 |
|---|---|---|---|
| Drum No. | 19301 | 19302 | 19303 |

*surface layer followed Table 220 (b)
markless case: followed Table 220 (a)

TABLE 251

| Drum No. | Charge injection inhibition layer 1 | Charge injection inhibition layer 4 | Charge injection inhibition layer 6* | Charge injection inhibition layer 7 |
|---|---|---|---|---|
| Photo-conductive layer 5 | 19401 | 19403 | 19405 | 19407 |
| Photo-conductive layer 6 | 19402 | 19404 | 19406 | 19408 |

*surface layer followed Table 220 (b)
markless case: followed Table 220 (a)

TABLE 252

| Drum No. | Charge injection inhibition layer 1 | Charge injection inhibition layer 4 | Charge injection inhibition layer 6* | Charge injection inhibition layer 7 |
|---|---|---|---|---|
| Photo-conductive layer 4 | 19501 | 19504 | 19507 | 19510 |
| Photo-conductive layer 5 | 19502 | 19505 | 19508 | 19511 |
| Photo-conductive layer 6 | 19503 | 19506 | 19509 | 19512 |

*surface layer B was used
markless case: surface layer A was used

TABLE 253

| Drum No. | Charge injection inhibition layer 1 | Charge injection inhibition layer 4 | Charge injection inhibition layer 6* | Charge injection inhibition layer 7 |
|---|---|---|---|---|
| Photo-conductive layer 4 | 19601 | 19604 | 19607 | 19610 |
| Photo-conductive layer 5 | 19602 | 19605 | 19608 | 19611 |
| Photo-conductive layer 6 | 19603 | 19606 | 19609 | 19612 |

*surface layer B was used
markless case: surface layer A was used

TABLE 255

| Drum No. | Photo-conductive layer 1 | Photo-conductive layer 4 | Photo-conductive layer 5* | Photo-conductive layer 7 |
|---|---|---|---|---|
| IR absorptive layer 1 | 19701 | 19721 | 19741 | 19761 |
| IR absorptive layer 2 | 19702 | 19722 | 19742 | 19762 |
| IR absorptive layer 3 | 19703 | 19723 | 19743 | 19763 |
| IR absorptive layer 4 | 19704 | 19724 | 19744 | 19764 |
| IR absorptive layer 5 | 19705 | 19725 | 19745 | 19765 |
| IR absorptive layer 6 | 19706 | 19726 | 19746 | 19766 |
| IR absorptive layer 7 | 19707 | 19727 | 19747 | 19767 |
| IR absorptive layer 8 | 19708 | 19728 | 19748 | 19768 |
| IR absorptive layer 9 | 19709 | 19729 | 19749 | 19769 |
| IR absorptive layer 10 | 19710 | 19730 | 19750 | 19770 |
| IR absorptive layer 11 | 19711 | 19731 | 19751 | 19771 |
| IR absorptive layer 12 | 19712 | 19732 | 19752 | 19772 |
| IR absorptive layer 13 | 19713 | 19733 | 19753 | 19773 |
| IR absorptive layer 14 | 19714 | 19734 | 19754 | 19774 |
| IR absorptive layer 15 | 19715 | 19735 | 19755 | 19775 |
| IR absorptive layer 16 | 19716 | 19736 | 19756 | 19776 |
| IR absorptive layer 17 | 19717 | 19737 | 19757 | 19777 |
| IR absorptive layer 18 | 19718 | 19738 | 19758 | 19778 |
| IR absorptive layer 19 | 19719 | 19739 | 19759 | 19779 |
| IR absorptive layer 20 | 19720 | 19740 | 19760 | 19780 |

*surface layer B was used
markless case: surface layer A was used

TABLE 256

| Drum No. | Photo-conductive layer 1 | Photo-conductive layer 4 | Photo-conductive layer 5* | Photo-conductive layer 7 |
|---|---|---|---|---|
| IR absorptive layer 1 | 19801 | 19821 | 19841 | 19861 |
| IR absorptive layer 2 | 19802 | 19822 | 19842 | 19862 |
| IR absorptive layer 3 | 19803 | 19823 | 19843 | 19863 |
| IR absorptive layer 4 | 19804 | 19824 | 19844 | 19864 |
| IR absorptive layer 5 | 19805 | 19825 | 19845 | 19865 |
| IR absorptive layer 6 | 19806 | 19826 | 19846 | 19866 |
| IR absorptive layer 7 | 19807 | 19827 | 19847 | 19867 |
| IR absorptive layer 8 | 19808 | 19828 | 19848 | 19868 |

TABLE 254

| Name of layer | Gas used and its flow rate (SCCM) | | Substrate temperature (°C.) | RF power (W) | Inner pressure (Torr) | Layer thickness (μm) |
|---|---|---|---|---|---|---|
| Surface layer A | $B_2H_6$/Ar (20%) | 500 | 250 | 200 | 0.35 | 0.5 |
| | $NH_3$ | 100 | | | | |
| | $SiH_4$ (against $B_2H_6$ + $NH_3$) | 100 ppm | | | | |
| Surface layer B | $B_2H_6$/Ar (20%) | 500 | 250 | 200 | 0.35 | 0.5 |
| | $NH_3$ | 100 | | | | |
| | $GeH_4$ (against $B_2H_6$ + $NH_3$) | 100 ppm | | | | |

TABLE 256-continued

| Drum No. | Photo-conductive layer 1 | Photo-conductive layer 4 | Photo-conductive layer 5* | Photo-conductive layer 7 |
|---|---|---|---|---|
| IR absorptive layer 9 | 19809 | 19829 | 19849 | 19869 |
| IR absorptive layer 10 | 19810 | 19830 | 19850 | 19870 |
| IR absorptive layer 11 | 19811 | 19831 | 19851 | 19871 |
| IR absorptive layer 12 | 19812 | 19832 | 19852 | 19872 |
| IR absorptive layer 13 | 19813 | 19833 | 19853 | 19873 |
| IR absorptive layer 14 | 19814 | 19834 | 19854 | 19874 |
| IR absorptive layer 15 | 19815 | 19835 | 19855 | 19875 |
| IR absorptive layer 16 | 19816 | 19836 | 19856 | 19876 |
| IR absorptive layer 17 | 19817 | 19837 | 19857 | 19877 |
| IR absorptive layer 18 | 19818 | 19838 | 19858 | 19878 |
| IR absorptive layer 19 | 19819 | 19839 | 19859 | 19879 |
| IR absorptive layer 20 | 19820 | 19840 | 19860 | 19880 |

*surface layer B was used
markless case: surface layer A was used

TABLE 257

| Drum No. | Photo-conductive layer 1 | Photo-conductive layer 4 | Photo-conductive layer 5* | Photo-conductive layer 7 |
|---|---|---|---|---|
| IR absorptive layer 1 | 19901 | 19921 | 19941 | 19961 |
| IR absorptive layer 2 | 19902 | 19922 | 19942 | 19962 |
| IR absorptive layer 3 | 19903 | 19923 | 19943 | 19963 |
| IR absorptive layer 4 | 19904 | 19924 | 19944 | 19964 |
| IR absorptive layer 5 | 19905 | 19925 | 19945 | 19965 |
| IR absorptive layer 6 | 19906 | 19926 | 19946 | 19966 |
| IR absorptive layer 7 | 19907 | 19927 | 19947 | 19967 |
| IR absorptive layer 8 | 19908 | 19928 | 19948 | 19968 |
| IR absorptive layer 9 | 19909 | 19929 | 19949 | 19969 |
| IR absorptive layer 10 | 19910 | 19930 | 19950 | 19970 |
| IR absorptive layer 11 | 19911 | 19931 | 19951 | 19971 |
| IR absorptive layer 12 | 19912 | 19932 | 19952 | 19972 |
| IR absorptive layer 13 | 19913 | 19933 | 19953 | 19973 |
| IR absorptive layer 14 | 19914 | 19934 | 19954 | 19974 |
| IR absorptive layer 15 | 19915 | 19935 | 19955 | 19975 |
| IR absorptive layer 16 | 19916 | 19936 | 19956 | 19976 |
| IR absorptive layer 17 | 19917 | 19937 | 19957 | 19977 |
| IR absorptive layer 18 | 19918 | 19938 | 19958 | 19978 |
| IR absorptive layer 19 | 19919 | 19938 | 19959 | 19979 |
| IR absorptive layer 20 | 19920 | 19940 | 19960 | 19980 |

*surface layer B was used
markless case: surface layer A was used

TABLE 258

| Drum No. | Photo-conductive layer 1 | Photo-conductive layer 4 | Photo-conductive layer 5* | Photo-conductive layer 7 |
|---|---|---|---|---|
| IR absorptive layer 1 | 20001 | 20021 | 20041 | 20061 |
| IR absorptive layer 2 | 20002 | 20022 | 20042 | 20062 |
| IR absorptive layer 3 | 20003 | 20023 | 20043 | 20063 |
| IR absorptive layer 4 | 20004 | 20024 | 20044 | 20064 |
| IR absorptive layer 5 | 20005 | 20025 | 20045 | 20065 |
| IR absorptive layer 6 | 20006 | 20026 | 20046 | 20066 |
| IR absorptive layer 7 | 20007 | 20027 | 20047 | 20067 |
| IR absorptive layer 8 | 20008 | 20028 | 20048 | 20068 |
| IR absorptive layer 9 | 20009 | 20029 | 20049 | 20069 |
| IR absorptive layer 10 | 20010 | 20030 | 20050 | 20070 |
| IR absorptive layer 11 | 20011 | 20031 | 20051 | 20071 |
| IR absorptive layer 12 | 20012 | 20032 | 20052 | 20072 |
| IR absorptive layer 13 | 20013 | 20033 | 20053 | 20073 |
| IR absorptive layer 14 | 20014 | 20034 | 20054 | 20074 |
| IR absorptive layer 15 | 20015 | 20035 | 20055 | 20075 |
| IR absorptive layer 16 | 20016 | 20036 | 20056 | 20076 |
| IR absorptive layer 17 | 20017 | 20037 | 20057 | 20078 |
| IR absorptive layer 18 | 20018 | 20038 | 20058 | 20078 |
| IR absorptive layer 19 | 20019 | 20039 | 20059 | 20079 |
| IR absorptive layer 20 | 20020 | 20040 | 20060 | 20080 |

*surface layer B was used
markless case: surface layer A was used

TABLE 259

| Drum No. | Photo-conductive layer 1 | Photo-conductive layer 4 | Photo-conductive layer 5* | Photo-conductive layer 7 |
|---|---|---|---|---|
| IR absorptive layer 1 | 20101 | 20121 | 20141 | 20161 |
| IR absorptive layer 2 | 20102 | 20122 | 20142 | 20162 |
| IR absorptive layer 3 | 20103 | 20123 | 20143 | 20163 |
| IR absorptive layer 4 | 20104 | 20124 | 20144 | 20164 |
| IR absorptive layer 5 | 20105 | 20125 | 20145 | 20165 |
| IR absorptive layer 6 | 20106 | 20126 | 20146 | 20166 |
| IR absorptive layer 7 | 20107 | 20127 | 20147 | 20167 |
| IR absorptive layer 8 | 20108 | 20128 | 20148 | 20168 |
| IR absorptive layer 9 | 20109 | 20129 | 20149 | 20169 |
| IR absorptive layer 10 | 20110 | 20130 | 20150 | 20170 |
| IR absorptive layer 11 | 20111 | 20131 | 20151 | 20171 |
| IR absorptive layer 12 | 20112 | 20132 | 20152 | 20172 |
| IR absorptive layer 13 | 20113 | 20133 | 20153 | 20173 |
| IR absorptive layer 14 | 20114 | 20134 | 20154 | 20174 |
| IR absorptive | 20115 | 20135 | 20155 | 20175 |

TABLE 259-continued

| Drum No. | Photo-conductive layer 1 | Photo-conductive layer 4 | Photo-conductive layer 5* | Photo-conductive layer 7 |
|---|---|---|---|---|
| layer 15 | | | | |
| IR absorptive layer 16 | 20116 | 20136 | 20156 | 20176 |
| IR absorptive layer 17 | 20117 | 20137 | 20157 | 20177 |
| IR absorptive layer 18 | 20118 | 20138 | 20158 | 20178 |
| IR absorptive layer 19 | 20119 | 20139 | 20159 | 20179 |
| IR absorptive layer 20 | 20120 | 20140 | 20160 | 20180 |

*surface layer B was used
markless case: surface layer A was used

TABLE 260

| Drum No. | Photo-conductive layer 1 | Photo-conductive layer 4 | Photo-conductive layer 5* | Photo-conductive layer 7 |
|---|---|---|---|---|
| IR absorptive layer 1 | 20201 | 20221 | 20241 | 20261 |
| IR absorptive layer 2 | 20202 | 20222 | 20242 | 20262 |
| IR absorptive layer 3 | 20203 | 20223 | 20243 | 20263 |
| IR absorptive layer 4 | 20204 | 20224 | 20244 | 20264 |
| IR absorptive layer 5 | 20205 | 20225 | 20245 | 20265 |
| IR absorptive | 20206 | 20226 | 20246 | 20266 |

TABLE 260-continued

| Drum No. | Photo-conductive layer 1 | Photo-conductive layer 4 | Photo-conductive layer 5* | Photo-conductive layer 7 |
|---|---|---|---|---|
| layer 6 | | | | |
| IR absorptive layer 7 | 20207 | 20227 | 20247 | 20267 |
| IR absorptive layer 8 | 20208 | 20228 | 20248 | 20268 |
| IR absorptive layer 9 | 20209 | 20229 | 20249 | 20269 |
| IR absorptive layer 10 | 20210 | 20230 | 20250 | 20270 |
| IR absorptive layer 11 | 20211 | 20231 | 20251 | 20271 |
| IR absorptive layer 12 | 20212 | 20232 | 20252 | 20272 |
| IR absorptive layer 13 | 20213 | 20233 | 20253 | 20273 |
| IR absorptive layer 14 | 20214 | 20234 | 20254 | 20274 |
| IR absorptive layer 15 | 20215 | 20235 | 20255 | 20275 |
| IR absorptive layer 16 | 20216 | 20236 | 20256 | 20276 |
| IR absorptive layer 17 | 20217 | 20237 | 20257 | 20277 |
| IR absorptive layer 18 | 20218 | 20238 | 20258 | 20278 |
| IR absorptive layer 19 | 20219 | 20239 | 20259 | 20279 |
| IR absorptive layer 20 | 20220 | 20240 | 20260 | 20280 |

*surface layer B was used
markless case: surface layer A was used

TABLE 261

| Drum No. | Gas used and its flow rate (SCCM) | | Substrate temperature (°C.) | RF power (W) | Inner pressure (Torr) | Layer thickness (μm) |
|---|---|---|---|---|---|---|
| 20301 | $B_2H_6$/Ar (20%) | 500 | 250 | 200 | 0.35 | 0.5 |
| | $SiH_4$ (against $B_2H_6 + NH_3$) | 100 ppm | | | | |
| | $NH_3$ | 100 | | | | |
| 20302 | $B_2H_6$/Ar (20%) | 500 | 250 | 200 | 0.40 | 0.5 |
| | $SiH_4$ (against $B_2H_6 + NH_3$) | 50 ppm | | | | |
| | $H_2$ | 100 | | | | |
| | $NH_3$ | 100 | | | | |
| 20303 | $B_2H_6$/Ar (20%) | 500 | 250 | 200 | 0.35 | 0.5 |
| | $SiH_4$ (against $B_2H_6 + NH_3$) | 100 ppm | | | | |
| | $NH_3$ | 100 | | | | |
| | Bias voltage of the cylinder | −150 V | | | | |

TABLE 262

| Drum No. | Gas used and its flow rate (SCCM) | | Substrate temperature (°C.) | RF power (W) | Inner pressure (Torr) | Layer thickness (μm) |
|---|---|---|---|---|---|---|
| 20401 | $B_2H_6$/Ar (20%) | 500 | 250 | 200 | 0.35 | 0.5 |
| | $SiH_4$ (against $B_2H_6 + NH_3$) | 100 ppm | | | | |
| | $NH_3$ | 100 | | | | |
| 20402 | $B_2H_6$/Ar (20%) | 500 | 250 | 200 | 0.40 | 0.5 |
| | $SiH_4$ (against $B_2H_6 + NH_3$) | 50 ppm | | | | |
| | $H_2$ | 100 | | | | |
| | $NH_3$ | 100 | | | | |
| 20403 | $B_2H_6$/Ar (20%) | 500 | 250 | 200 | 0.35 | 0.5 |
| | $SiH_4$ (against $B_2H_6 + NH_3$) | 100 ppm | | | | |
| | $NH_3$ | 100 | | | | |
| | Bias voltage of the cylinder | −150 V | | | | |

TABLE 263

| Drum No. | Gas used and its flow rate (SCCM) | | Substrate temperature (°C.) | RF power (W) | Inner pressure (Torr) | Layer thickness (μm) |
|---|---|---|---|---|---|---|
| 20501 | $B_2H_6$/Ar (20%) | 500 | 250 | 200 | 0.35 | 0.5 |
| | $SiH_4$ (against $B_2H_6 + NH_3$) | 100 ppm | | | | |

TABLE 263-continued

| Drum No. | Gas used and its flow rate (SCCM) | | Substrate temperature (°C.) | RF power (W) | Inner pressure (Torr) | Layer thickness (μm) |
|---|---|---|---|---|---|---|
| | $NH_3$ | 100 | | | | |
| 20502 | $B_2H_6$/Ar (20%) | 500 | 250 | 200 | 0.40 | 0.5 |
| | $SiH_4$ (against $B_2H_6$ + $NH_3$) | 50 ppm | | | | |
| | $H_2$ | 100 | | | | |
| | $NH_3$ | 100 | | | | |
| 20503 | $B_2H_6$/Ar (20%) | 500 | 250 | 200 | 0.35 | 0.5 |
| | $SiH_4$ (against $B_2H_6$ + $NH_3$) | 100 ppm | | | | |
| | $NH_3$ | 100 | | | | |
| | Bias voltage of the cylinder | −150 V | | | | |

TABLE 264

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Inter-mediate layer | $SiH_4$ | 10 | 250 | 150 | 0.35 | 0.3 |
| | $CH_4$ | 400 | | | | |
| Surface layer | $B_2H_6$/Ar (20%) | 500 | 250 | 200 | 0.35 | 0.5 |
| | $NH_3$ | 100 | | | | |
| | $SiH_4$ (against $B_2H_6$ + $NH_3$) | 100 ppm | | | | |

TABLE 265 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer | $B_2H_6$/He (20%) | 500 | 250 | 100 | 0.35 | 0.5 |
| | $NH_3$ | 100 | | | | |
| | $SiH_4$ (against $B_2H_6$ + $NH_3$) | 100 ppm | | | | |

TABLE 265 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer | $B_2H_6$/He (20%) | 500 | 250 | 100 | 0.35 | 0.5 |
| | $NH_3$ | 100 | | | | |
| | $GeH_4$ (against $B_2H_6$ + $NH_3$) | 100 ppm | | | | |

TABLE 266

| Drum No. | Initial electri-fication efficiency | Residual voltage | Ghost | Defec-tive image | Image flow | Increase of defective image |
|---|---|---|---|---|---|---|
| (a) | ○ | ◎ | ○ | ◎ | ◎ | ○ |
| (b) | ○ | ◎ | ○ | ◎ | ◎ | ○ |
| | | Break | | Degree of | | Degree of |

TABLE 266-continued

| Drum No. | Surface abrasion | down voltage | Abrasion resistance | background fogginess | residual stress |
|---|---|---|---|---|---|
| (a) | ○ | ○ | ○ | ◎ | ◎ |
| (b) | ○ | ○ | ○ | ◎ | ◎ |

◎: Excellent
○: Good

TABLE 267 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |

TABLE 267 (a)-continued

| Name of layer | Gas used and its flow rate (SCCM) | | Substrate temperature (°C.) | RF power (W) | Inner pressure (Torr) | Layer thickness (μm) |
|---|---|---|---|---|---|---|
| Surface layer | $B_2H_6$/He (20%) | 500 | 250 | 100 | 0.40 | 0.5 |
| | $H_2$ | 100 | | | | |
| | $NH_3$ | 300 | | | | |
| | $SiH_4$ (against $B_2H_6 + NH_3$) | 50 ppm | | | | |

TABLE 267 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer | $B_2H_6$/He (20%) | 500 | 250 | 100 | 0.40 | 0.5 |
| | $H_2$ | 100 | | | | |
| | $NH_3$ | 300 | | | | |
| | $GeH_4$ (against $B_2H_6 + NH_3$) | 50 ppm | | | | |

TABLE 268

| Drum No. | Initial electrification efficiency | Residual voltage | Ghost | Defective image | Image flow | Increase of defective image |
|---|---|---|---|---|---|---|
| (a) | ○ | ◎ | ○ | ◎ | ◎ | ○ |
| (b) | ○ | ◎ | ○ | ◎ | ◎ | ○ |

| Drum No. | Surface abrasion | Break down voltage | Abrasion resistance | Degree of background fogginess | Degree of residual stress |
|---|---|---|---|---|---|
| (a) | ○ | ○ | ○ | ◎ | ◎ |
| (b) | ○ | ○ | ○ | ◎ | ◎ |

TABLE 269-continued

| No. | efficiency | voltage | Ghost | image | flow | image |
|---|---|---|---|---|---|---|
| (a) | ○ | ◎ | ○ | ◎ | ◎ | ○ |
| (b) | ○ | ◎ | ○ | ◎ | ◎ | ○ |

| Drum No. | Surface abrasion | Break down voltage | Abrasion resistance | Degree of background fogginess | Degree of residual stress |
|---|---|---|---|---|---|
| (a) | ○ | ○ | ○ | ◎ | ◎ |
| (b) | ○ | ○ | ○ | ◎ | ◎ |

◎: Excellent
○: Good

TABLE 270 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |
| | $SiH_4$ (against $B_2H_6 + NH_3$) | 100 ppm | | | | |

TABLE 270 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $PH_3$ (against $SiH_4$) | 800 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |
| | $GeH_4$ (against $B_2H_6 + NH_3$) | 100 ppm | | | | |

◎: Excellent
○: Good

TABLE 269

| Drum | Initial electrification | Residual | Defective | Image | Increase of defective |
|---|---|---|---|---|---|

TABLE 271

| Drum No. | Initial electrification efficiency | Residual voltage | Ghost | Defective image | Image flow | Increase of defective image |
|---|---|---|---|---|---|---|
| (a) | ◎ | ◎ | ○ | ◎ | ◎ | ○ |

TABLE 271-continued

| Drum No. | Surface abrasion | Break down voltage | Abrasion resistance | Degree of background fogginess | Degree of residual stress |
|---|---|---|---|---|---|
| (b) | ◎ | ◎ | ○ | ◎ | ◎ | ○ |
| (a) | ○ | ○ | ○ | ◎ | ◎ |
| (b) | ○ | ○ | ○ | ◎ | ◎ |

◎: Excellent
○: Good

TABLE 273-continued

| Drum No. | Surface abrasion | Break down voltage | Abrasion resistance | Degree of background fogginess | Degree of residual stress |
|---|---|---|---|---|---|
| (b) | ◎ | ◎ | ○ | ◎ | ◎ | ○ |
| (a) | ○ | ○ | ○ | ◎ | ◎ |
| (b) | ○ | ○ | ○ | ◎ | ◎ |

◎: Excellent
○: Good

TABLE 272 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |
| | $SiH_4$ (against $B_2H_6$ + $NH_3$) | 100 ppm | | | | |

TABLE 272 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |
| | $GeH_4$ (against $B_2H_6$ + $NH_3$) | 100 ppm | | | | |

TABLE 274 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |
| | $SiH_4$ (against $B_2H_6$ + $NH_3$) | 100 ppm | | | | |

TABLE 274 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $PH_3$ (against $SiH_4$) | 800 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |
| | $GeH_4$ (against $B_2H_6$ + $NH_3$) | 100 ppm | | | | |

TABLE 273

| Drum No. | Initial electrification efficiency | Residual voltage | Ghost | Defective image | Image flow | Increase of defective image |
|---|---|---|---|---|---|---|
| (a) | ◎ | ◎ | ○ | ◎ | ◎ | ○ |

TABLE 275

| Drum No. | Initial electrification efficiency | Residual voltage | Ghost | Defective image | Image flow | Increase of defective image |
|---|---|---|---|---|---|---|
| (a) | ○ | ◎ | ○ | ◎ | ◎ | ○ |

TABLE 275-continued

| | | | | | |
|---|---|---|---|---|---|
| (b) | ○ | ◎ | ○ | ◎ | ◎ | ○ |

| Drum No. | Surface abrasion | Break down voltage | Abrasion resistance | Degree of background fogginess | Degree of residual stress |
|---|---|---|---|---|---|
| (a) | ○ | ○ | ○ | ◎ | ◎ |
| (b) | ○ | ○ | ○ | ◎ | ◎ |

◎: Excellent
○ : Good

TABLE 277-continued

| Drum No. | electri-fication efficiency | Residual voltage | Ghost | Defec-tive image | Image flow | of defective image |
|---|---|---|---|---|---|---|
| (a) | ◎ | ◎ | ○ | ◎ | ◎ | ○ |
| (b) | ◎ | ◎ | ○ | ◎ | ◎ | ○ |

| Drum No. | Surface abrasion | Break down voltage | Abrasion resistance | Degree of background fogginess | Degree of residual stress |
|---|---|---|---|---|---|
| (a) | ○ | ○ | ○ | ◎ | ◎ |
| (b) | ○ | ○ | ○ | ◎ | ◎ |

TABLE 276 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 100 | 0.25 | 0.5 |
| | $N_2$ | 100 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |
| | $SiH_4$ (against $B_2H_6 + NH_3$) | 100 ppm | | | | |

TABLE 276 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 100 | 0.25 | 0.5 |
| | $N_2$ | 100 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |
| | $GeH_4$ (against $B_2H_6 + NH_3$) | 100 ppm | | | | |

TABLE 277

| | Initial | Increase |
|---|---|---|
| (b) | ○ | ○ | ○ | ◎ | ◎ |

◎: Excellent
○ : Good

TABLE 278 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |
| | $SiH_4$ (against $B_2H_6 + NH_3$) | 100 ppm | | | | |

TABLE 278 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $PH_3$ (against $SiH_4$) | 800 ppm | | | | |
| | NO | 10 | | | | |
| Charge injection inhibition | $SiH_4$ | 100 | 250 | 150 | 0.35 | 3 |
| | $H_2$ | 100 | | | | |
| | $PH_3$ (against $SiH_4$) | 800 ppm | | | | |

TABLE 278 (b)-continued

| Name of layer | Gas used and its flow rate (SCCM) | | Substrate temperature (°C.) | RF power (W) | Inner pressure (Torr) | Layer thickness (μm) |
|---|---|---|---|---|---|---|
| layer | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |
| | $GeH_4$ (against $B_2H_6$ + $NH_3$) | 100 ppm | | | | |

TABLE 279

| Drum No. | Initial electrification efficiency | Residual voltage | Ghost | Defective image | Image flow | Increase of defective image |
|---|---|---|---|---|---|---|
| (a) | ◎ | ◎ | ○ | ◎ | ◎ | ○ |
| (b) | ◎ | ◎ | ○ | ◎ | ◎ | ○ |

| Drum No. | Surface abrasion | Break down voltage | Abrasion resistance | Degree of background fogginess | Degree of residual stress |
|---|---|---|---|---|---|
| (a) | ○ | ○ | ○ | ◎ | ◎ |
| (b) | ○ | ○ | ○ | ◎ | ◎ |

◎:Excellent
○ :Good

TABLE 281

| Drum No. | Initial electrification efficiency | Residual voltage | Ghost | Defective image | Image flow | Increase of defective image |
|---|---|---|---|---|---|---|
| (a) | ◎ | ◎ | ○ | ◎ | ◎ | ○ |
| (b) | ◎ | ◎ | ○ | ◎ | ◎ | ○ |

| Drum No. | Surface abrasion | Break down voltage | Abrasion resistance | Degree of background fogginess | Degree of residual stress |
|---|---|---|---|---|---|
| (a) | ○ | ○ | ○ | ◎ | ◎ |
| (b) | ○ | ○ | ○ | ◎ | ◎ |

◎:Excellent
○ :Good

TABLE 280 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |
| | $SiH_4$ (against $B_2H_6$ + $NH_3$) | 100 ppm | | | | |

TABLE 280 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| Charge injection inhibition layer | $SiH_4$ | 100 | 250 | 150 | 0.35 | 3 |
| | $H_2$ | 100 | | | | |
| | PH 3 (against $SiH_4$) | 800 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |
| | $GeH_4$ (against $B_2H_6$ + $NH_3$) | 100 ppm | | | | |

TABLE 282 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |

TABLE 282 (a)-continued

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |
| | $SiH_4$ (against $B_2H_6 + NH_3$) | 100 ppm | | | | |

TABLE 282 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| IR absorptive layer | $SiH_4$ | 100 | 250 | 150 | 0.35 | 1 |
| | $H_2$ | 100 | | | | |
| | $GeH_4$ | 50 | | | | |
| | $PH_3$ (against $SiH_4$) | 800 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $PH_3$ (against $SiH_4$) | 800 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer | $B_2H_6$/He (20%) | 500 | 250 | 100 | 0.35 | 0.5 |
| | $NH_3$ | 100 | | | | |
| | $GeH_4$ (against $B_2H_6 + NH_3$) | 100 ppm | | | | |

TABLE 283

| Drum No. | Initial electrification efficiency | Residual voltage | Ghost | Defective image | Image flow | Increase of defective image |
|---|---|---|---|---|---|---|
| (a) | ◉ | ◉ | ○ | ◉ | ◉ | ○ |
| (b) | ◉ | ◉ | ○ | ◉ | ◉ | ○ |

TABLE 283-continued

| Drum No. | Surface abrasion | Break down voltage | Abrasion resistance | Degree of background fogginess | Degree of residual stress |
|---|---|---|---|---|---|
| (a) | ○ | ○ | ○ | ◉ | ◉ |
| (b) | ○ | ○ | ○ | ◉ | ◉ |

◉:Excellent
○ :Good

TABLE 284

| Drum No. | Gas used and its flow rate (SCCM) | | Substrate temperature (°C.) | RF power (W) | Inner pressure (Torr) | Layer thickness (μm) |
|---|---|---|---|---|---|---|
| 21901 | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 21902 | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 21903 | $SiH_4$ | 200 | 250 | 300 | 0.40 | 20 |
| | $H_2$ | 200 | | | | |
| 21904 | $SiH_4$ | 200 | 250 | 250 | 0.40 | 20 |
| | Ar | 200 | | | | |
| 21905 | $SiH_4$ | 150 | 250 | 350 | 0.40 | 20 |
| | $SiF_4$ | 50 | | | | |
| | $H_2$ | 200 | | | | |
| 21906* | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 21907* | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 21908* | $SiH_4$ | 200 | 250 | 300 | 0.40 | 20 |

TABLE 284-continued

| Drum No. | Gas used and its flow rate (SCCM) | | Substrate temperature (°C.) | RF power (W) | Inner pressure (Torr) | Layer thickness (μm) |
|---|---|---|---|---|---|---|
| | $H_2$ | 200 | | | | |
| 21909* | $SiH_4$ | 200 | 250 | 250 | 0.40 | 20 |
| | Ar | 200 | | | | |
| 21910* | $SiH_4$ | 150 | 250 | 350 | 0.40 | 20 |
| | $SiF_4$ | 50 | | | | |
| | $H_2$ | 200 | | | | |

*surface layer followed Table 265 (b)
markless case: followed Table 265 (a)

TABLE 285

| Drum No. | Gas used and its flow rate (SCCM) | | Substrate temperature (°C.) | RF power (W) | Inner pressure (Torr) | Layer thickness (μm) |
|---|---|---|---|---|---|---|
| 22001 | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 22002 | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 22003 | $SiH_4$ | 200 | 250 | 300 | 0.40 | 20 |
| | $H_2$ | 200 | | | | |
| 22004 | $SiH_4$ | 200 | 250 | 250 | 0.40 | 20 |
| | Ar | 200 | | | | |
| 22005 | $SiH_4$ | 150 | 250 | 350 | 0.40 | 20 |
| | $SiF_4$ | 50 | | | | |
| | $H_2$ | 200 | | | | |
| 22006* | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 22007* | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 22008* | $SiH_4$ | 200 | 250 | 300 | 0.40 | 20 |
| | $H_2$ | 200 | | | | |
| 22009* | $SiH_4$ | 200 | 250 | 250 | 0.40 | 20 |
| | Ar | 200 | | | | |
| 22010* | $SiH_4$ | 150 | 250 | 350 | 0.40 | 20 |
| | $SiF_4$ | 50 | | | | |
| | $H_2$ | 200 | | | | |

*surface layer followed Table 267 (b)
markless case: followed Table 267 (a)

TABLE 286

| Drum No. | Gas used and its flow rate (SCCM) | | Substrate temperature (°C.) | RF power (W) | Inner pressure (Torr) | Layer thickness (μm) |
|---|---|---|---|---|---|---|
| 22101 | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 22102 | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 22103 | $SiH_4$ | 200 | 250 | 300 | 0.40 | 20 |
| | $H_2$ | 200 | | | | |
| 22104 | $SiH_4$ | 200 | 250 | 250 | 0.40 | 20 |
| | Ar | 200 | | | | |
| 22105 | $SiH_4$ | 150 | 250 | 350 | 0.40 | 20 |
| | $SiF_4$ | 50 | | | | |
| | $H_2$ | 200 | | | | |
| 22106* | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 22107* | $SiH_4$ | 150 | 250 | 350 | 0.40 | 20 |
| | $SiF_4$ | 50 | | | | |

TABLE 286-continued

| Drum No. | Gas used and its flow rate (SCCM) | | Substrate temperature (°C.) | RF power (W) | Inner pressure (Torr) | Layer thickness (μm) |
|---|---|---|---|---|---|---|
| | $H_2$ | 200 | | | | |
| | $B_2H_6$ (against $SiH_4$) | 100 ppm | | | | |
| | NO | 6 | | | | |
| 22108* | $SiH_4$ | 200 | 250 | 300 | 0.40 | 20 |
| | $H_2$ | 200 | | | | |
| 22109* | $SiH_4$ | 200 | 250 | 250 | 0.40 | 20 |
| | Ar | 200 | | | | |
| 22110* | $SiH_4$ | 150 | 250 | 350 | 0.40 | 20 |
| | $SiF_4$ | 50 | | | | |
| | $H_2$ | 200 | | | | |

*surface layer followed Table 265 (b)
markless case: followed Table 265 (a)

TABLE 287

| Drum No. | Gas used and its flow rate (SCCM) | | Substrate temperature (°C.) | RF Power (W) | Inner pressure (Torr) | Layer thickness (μm) |
|---|---|---|---|---|---|---|
| 22201 | $SiH_4$ | 100 | 250 | 150 | 0.35 | 3 |
| | $H_2$ | 100 | | | | |
| | $B_2H_6$ (against $SiH_4$) | 1000 ppm | | | | |
| | $GeH_4$ | 10 | | | | |
| | NO | 10 | | | | |
| 22202 | $SiH_4$ | 80 | 250 | 170 | 0.25 | 3 |
| | $SiF_4$ | 20 | | | | |
| | $B_2H_6$ (against $SiH_4$) | 1000 ppm | | | | |
| | $SnH_4$ | 5 | | | | |
| | NO | 5 | | | | |
| 22203 | $SiH_4$ | 100 | 250 | 130 | 0.25 | 3 |
| | $B_2H_6$ (against $SiH_4$) | 800 ppm | | | | |
| | NO | 4 | | | | |
| | $N_2$ | 4 | | | | |
| | $CH_4$ | 6 | | | | |
| 22204* | $SiH_4$ | 100 | 250 | 150 | 0.35 | 3 |
| | $H_2$ | 100 | | | | |
| | $PH_3$ (against $SiH_4$) | 800 ppm | | | | |
| 22205* | $SiH_4$ | 100 | 250 | 130 | 0.25 | 3 |
| | $PH_3$ (against $SiH_4$) | 800 ppm | | | | |
| | $GeH_4$ | 10 | | | | |
| | NO | 10 | | | | |
| 22206 | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO* | 10 | | | | |
| | NO** | 10→0*** | | | | |

*surface layer followed Table 208(b)
markless case: followed Table 208(a)
*Substrate side 2 μm
**Surface layer side 1 μm
***Constantly changed

TABLE 288

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Photo-conductive layer 1 | 22301 | 22306 | 22311 | 22316 | 22321 | 22326 | 22331 |
| Photo-conductive layer 2 | 22302 | 22307 | 22312 | 22317 | 22322 | 22327 | 22332 |
| Photo-conductive layer 3 | 22303 | 22308 | 22313 | 22318 | 22323 | 22328 | 22233 |
| Photo-conductive layer 5 | 22304 | 22309 | 22314 | 22319 | 22324 | 22329 | 22334 |
| Photo-conductive layer 6 | 22305 | 22310 | 22315 | 22320 | 22325 | 22330 | 22335 |

*surface layer followed Table 6(b)
markless case: followed Table 6(a)

TABLE 289

| Name of layer | Gas used and its flow rate (SCCM) | | Substrate temperature (°C.) | RF power (W) | Inner pressure (Torr) | Layer thickness (μm) |
|---|---|---|---|---|---|---|
| Surface* layer A | $B_2H_6$/He (20%) | 500 | 250 | 100 | 0.40 | 0.5 |
| | $H_2$ | 100 | | | | |
| | $NH_3$ | 300 | | | | |
| | $SiH_4$ (against $B_2H_6 + NH_3$) | 50 ppm | | | | |
| Surface* layer B | $B_2H_6$/He (20%) | 500 | 250 | 100 | 0.40 | 0.5 |
| | $H_2$ | 100 | | | | |
| | $NH_3$ | 300 | | | | |
| | $GeH_4$ (against $B_2H_6 + NH_3$) | 50 ppm | | | | |

*each of surface layers A and B is individually used in accordance with the kind of the lower layer

TABLE 290

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Photo-conductive layer 1 | 22401 | 22407 | 22413 | 22419 | 22425 | 22431 | 22437 |
| Photo-conductive layer 2 | 22402 | 22408 | 22414 | 22420 | 22426 | 22432 | 22438 |
| Photo-conductive layer 3 | 22403 | 22409 | 22415 | 22421 | 22427 | 22433 | 22439 |
| Photo-conductive layer 4 | 22404 | 22410 | 22416 | 22422 | 22428 | 22434 | 22440 |
| Photo-conductive layer 5 | 22405 | 22411 | 22417 | 22423 | 22429 | 22435 | 22441 |
| Photo-conductive layer 6 | 22406 | 22412 | 22418 | 22424 | 22430 | 22436 | 22442 |

*surface layer B was used
markless case: surface layer A was used

TABLE 291

| Name of layer | Gas used and its flow rate (SCCM) | | Substrate temperature (°C.) | RF power (W) | Inner pressure (Torr) | Layer thickness (μm) |
|---|---|---|---|---|---|---|
| Surface* layer A | $B_2H_6$/He (20%) | 500 | 250 | 100 | 0.35 | 0.5 |
| | $NH_3$ | 100 | | | | |
| | $SiH_4$ (against $B_2H_6 + NH_3$) | 100 ppm | | | | |
| | Bias voltage of the cylinder | +100 V | | | | |
| Surface* layer B | $B_2H_6$/He (20%) | 500 | 250 | 100 | 0.35 | 0.5 |
| | $NH_3$ | 100 | | | | |
| | $GeH_4$ (against $B_2H_6 + NH_3$) | 100 ppm | | | | |
| | Bias voltage of the cylinder | +100 V | | | | |

*each of surface layers A and B is individually used in accordance with the kind of the lower layer

TABLE 292

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Photo-conductive layer 1 | 22501 | 22507 | 22513 | 22519 | 22525 | 22531 | 22537 |
| Photo-conductive layer 2 | 22502 | 22508 | 22514 | 22520 | 22526 | 22532 | 22538 |
| Photo-conductive layer 3 | 22503 | 22509 | 22515 | 22521 | 22527 | 22533 | 22539 |
| Photo-conductive layer 4 | 22504 | 22510 | 22516 | 22522 | 22528 | 22534 | 22540 |
| Photo-conductive layer 5 | 22505 | 22511 | 22517 | 22523 | 22529 | 22535 | 22541 |

TABLE 292-continued

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Photo-conductive layer 6 | 22506 | 22512 | 22518 | 22524 | 22530 | 22536 | 22542 |

*surface layer B was used
markless case: surface layer A was used

TABLE 293

| | Photo-conductive Layer 1 | Photo-conductive Layer 2 | Photo-conductive Layer 3 | Photo-conductive Layer 5 | Photo-conductive Layer 6 |
|---|---|---|---|---|---|
| Drum No. | 22601<br>22606* | 22602<br>22607* | 22603<br>22608* | 22604<br>22609* | 22605<br>22610* |

*Surface layer followed Table 272(b)
Markless case: followed Table 272(a)

TABLE 294

| | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| Drum No. | 22701<br>22707* | 22702<br>22708* | 22703<br>22709* | 22704<br>22710* | 22705<br>22711* | 22706<br>22712* |

*surface layer B was used.
markless case: surface layer A was used.

TABLE 295

| | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| Drum No. | 22801<br>22807* | 22802<br>22808* | 22803<br>22809* | 22804<br>22810* | 22805<br>22811* | 22806<br>22812* |

*surface layer B was used.
markless case: surface layer A was used.

TABLE 296

| | Drum No. | |
|---|---|---|
| IR Absorptive Layer 1 | 22901 | 22920* |
| IR Absorptive Layer 2 | 22902 | 22921* |
| IR Absorptive Layer 3 | 22903 | 22922* |
| IR Absorptive Layer 4 | 22904 | 22923* |
| IR Absorptive Layer 5 | 22905 | 22924* |
| IR Absorptive Layer 6 | 22906 | — |
| IR Absorptive Layer 7 | 22907 | — |

TABLE 296-continued

| | Drum No. | |
|---|---|---|
| IR Absorptive Layer 8 | 22908 | — |
| IR Absorptive Layer 9 | 22909 | — |
| IR Absorptive Layer 10 | 22910 | — |
| IR Absorptive Layer 11 | 22911 | — |
| IR Absorptive Layer 12 | 22912 | — |
| IR Absorptive Layer 13 | 22913 | — |
| IR Absorptive Layer 14 | 22914 | — |
| IR Absorptive Layer 15 | 22915 | — |
| IR Absorptive Layer 17 | 22916 | — |
| IR Absorptive Layer 18 | 22917 | 22925* |
| IR Absorptive Layer 19 | 22918 | 22926* |
| IR Absorptive Layer 20 | 22919 | 22927* |

*Surface layer followed Table 274(b)
Markless case: followed 274(a)

TABLE 297

| Drum No. | Photo-conductive layer 1 | Photo-conductive layer 2 | Photo-conductive layer 3 | Photo-conductive layer 5 | Photo-conductive layer 6 |
|---|---|---|---|---|---|
| IR aborptive layer 1 | 23001 | 23021 | 23041 | 23061 | 23081 |
| IR absorptive layer 2 | 23002 | 23022 | 23042 | 23062 | 23082 |
| IR absorptive layer 3 | 23003 | 23023 | 23043 | 23063 | 23083 |
| IR absorptive layer 4 | 23004 | 23024 | 23044 | 23064 | 23084 |
| IR absorptive layer 5 | 23005 | 23025 | 23045 | 23065 | 23085 |
| IR absorptive | 23006 | 23026 | 23046 | 23066 | 23086 |

TABLE 297-continued

| Drum No. | Photo-conductive layer 1 | Photo-conductive layer 2 | Photo-conductive layer 3 | Photo-conductive layer 5 | Photo-conductive layer 6 |
|---|---|---|---|---|---|
| layer 6 | | | | | |
| IR absorptive layer 7 | 23007 | 23027 | 23047 | 23067 | 23087 |
| IR absorptive layer 8 | 23008 | 23028 | 23048 | 23068 | 23088 |
| IR absorptive layer 9 | 23009 | 23029 | 23049 | 23069 | 23089 |
| IR absorptive layer 10 | 23010 | 23030 | 23050 | 23070 | 23090 |
| IR absorptive layer 11* | 23011 | 23031 | 23051 | 23071 | 23091 |
| IR absorptive layer 12* | 23012 | 23032 | 23052 | 23072 | 23092 |
| IR absorptive layer 13* | 23013 | 23033 | 23053 | 23073 | 23093 |
| IR absorptive layer 14* | 23014 | 23034 | 23054 | 23074 | 23094 |
| IR absorptive layer 15* | 23015 | 23035 | 23055 | 23075 | 23095 |
| IR absorptive layer 16* | 23016 | 23036 | 23056 | 23076 | 23096 |
| IR absorptive layer 17* | 23017 | 23037 | 23057 | 23077 | 23097 |
| IR absorptive layer 18 | 23018 | 23038 | 23058 | 23078 | 23098 |
| IR absorptive layer 19 | 23019 | 23039 | 23059 | 23079 | 23099 |
| IR absorptive layer 20 | 23020 | 23040 | 23060 | 23080 | 230100 |

*surface layer followed Table 274(b)
markless case: followed Table 274(a)

TABLE 298

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| IR absorptive layer 1 | 23101 | 23121 | 23141 | 23161 | 23181 | 231101 |
| IR absorptive layer 2 | 23102 | 23122 | 23142 | 23162 | 23182 | 231102 |
| IR absorptive layer 3 | 23103 | 23123 | 23143 | 23163 | 23183 | 231103 |
| IR absorptive layer 4 | 23104 | 23124 | 23144 | 23164 | 23184 | 231104 |
| IR absorptive layer 5 | 23105 | 23125 | 23145 | 23165 | 23185 | 231105 |
| IR absorptive layer 6 | 23106 | 23126 | 23146 | 23166 | 23186 | 231106 |
| IR absorptive layer 7 | 23107 | 23127 | 23147 | 23167 | 23187 | 231107 |
| IR absorptive layer 8 | 23108 | 23128 | 23148 | 23168 | 23188 | 231108 |
| IR absorptive layer 9 | 23109 | 23129 | 23149 | 23169 | 23189 | 231109 |
| IR absorptive layer 10 | 23110 | 23130 | 23150 | 23170 | 23190 | 231110 |
| IR absorptive layer 11* | 23111 | 23131 | 23151 | 23171 | 23191 | 231111 |
| IR absorptive layer 12* | 23112 | 23132 | 23152 | 23172 | 23192 | 231112 |
| IR absorptive layer 13* | 23113 | 23133 | 23153 | 23173 | 23193 | 231113 |
| IR absorptive layer 14* | 23114 | 23134 | 23154 | 23174 | 23194 | 231114 |
| IR absorptive layer 15* | 23115 | 23135 | 23155 | 23175 | 23195 | 231115 |
| IR absorptive layer 16 | 23116 | 23136 | 23156 | 23176 | 23196 | 231116 |
| IR absorptive layer 17* | 23117 | 23137 | 23157 | 23177 | 23197 | 231117 |
| IR absorptive layer 18 | 23118 | 23138 | 23158 | 23178 | 23198 | 231118 |
| IR absorptive layer 19 | 23119 | 23139 | 23159 | 23179 | 23199 | 231119 |
| IR absorptive | 23120 | 23140 | 23160 | 23180 | 231100 | 231120 |

TABLE 298-continued

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| layer 20 | | | | | | |

*surface layer B was used
markless case: surface layer A was used

TABLE 299

| Drum No. | Photo-conductive layer 1 | Photo-conductive layer 2 | Photo-conductive layer 3 | Photo-conductive layer 4 | Photo-conductive layer 5 | Photo-conductive laeyr 6 |
|---|---|---|---|---|---|---|
| IR absorptive layer 1 | 23201 | 23221 | 23241 | 23261 | 23281 | 232101 |
| IR absorptive layer 2 | 23202 | 23222 | 23242 | 23262 | 23282 | 232102 |
| IR absorptive layer 3 | 23203 | 23223 | 23243 | 23263 | 23283 | 232103 |
| IR absorptive layer 4 | 23204 | 23224 | 23244 | 23264 | 23284 | 232104 |
| IR absorptive layer 5 | 23205 | 23225 | 23245 | 23265 | 23285 | 232105 |
| IR absorptive layer 6 | 23206 | 23226 | 23246 | 23266 | 23286 | 232106 |
| IR absorptive layer 7 | 23207 | 23227 | 23247 | 23267 | 23287 | 232107 |
| IR absorptive layer 8 | 23208 | 23228 | 23248 | 23268 | 23288 | 232108 |
| IR absorptive layer 9 | 23209 | 23229 | 23249 | 23269 | 23289 | 232109 |
| IR absorptive layer 10 | 23210 | 23230 | 23250 | 23270 | 23290 | 232110 |
| IR absorptive layer 11* | 23211 | 23231 | 23251 | 23271 | 23291 | 232111 |
| IR absorptive layer 12* | 23212 | 23232 | 23252 | 23272 | 23292 | 232112 |
| IR absorptive layer 13* | 23213 | 23233 | 23253 | 23273 | 23293 | 232113 |
| IR absorptive layer 14* | 23214 | 23234 | 23254 | 23274 | 23294 | 232114 |
| IR absorptive layer 15* | 23215 | 23235 | 23255 | 23275 | 23295 | 232115 |
| IR absorptive layer 16* | 23216 | 23236 | 23256 | 23276 | 23296 | 232116 |
| IR absorptive layer 17* | 23217 | 23237 | 23257 | 23277 | 23297 | 232117 |
| IR absorptive layer 18 | 23218 | 23238 | 23258 | 23278 | 23298 | 232118 |
| IR absorptive layer 19 | 23219 | 23239 | 23259 | 23279 | 23299 | 232119 |
| IR absorptive layer 20 | 23220 | 23240 | 23260 | 23280 | 232100 | 232120 |

*surface layer B was used
markless case: surface layer A was used

TABLE 300

| | Contact Layer 2 | Contact Layer 3 | Contact Layer 4 |
|---|---|---|---|
| Drum No. | 23301<br>23304* | 23302<br>23305* | 23303<br>23306* |

*Surface layer followed Table 276(b)
Markless case: followed Table 276(a)

TABLE 301

| Drum No. | Contact layer 1 | Contact layer 2 | Contact layer 3 | Contact layer 4 |
|---|---|---|---|---|
| Photo-conductive layer 1 | 23401 | 23407* | 23413 | 23419 |
| Photo-conductive layer 2 | 23402 | 23408 | 23414* | 23420 |
| Photo-conductive layer 3 | 23403* | 23409 | 23415 | 23421 |
| Photo-conductive layer 4 | 23404 | 23410 | 23416 | 23422* |
| Photo-conductive layer 5 | 23405 | 23411 | 23417* | 23423 |
| Photo-conductive layer 6 | 23406 | 23412* | 23418 | 23424 |

*surface layer followed Table 276(b)
markless case: followed Table 276(a)

TABLE 302

| Drum No. | Contact layer 1 | Contact layer 2 | Contact layer 3 | Contact layer 4 |
|---|---|---|---|---|
| Photo-conductive layer 1 | 23501 | 23507 | 23513* | 23519 |
| Photo- | 23502 | 23508* | 23514 | 23520 |

TABLE 302-continued

| Drum No. | Contact layer 1 | Contact layer 2 | Contact layer 3 | Contact layer 4 |
|---|---|---|---|---|
| conductive layer 2 | | | | |
| Photo-conductive layer 3 | 23503 | 23509 | 23515 | 23521* |
| Photo-conductive layer 4 | 23504* | 23510 | 23516 | 23522 |
| Photo-conductive layer 5 | 23505 | 23511* | 23517 | 23523 |
| Photo-conductive layer 6 | 23506 | 23512 | 23518* | 23524 |

*surface layer B was used
markless case: surface layer A was used

TABLE 303

| Drum No. | Contact layer 1 | Contact layer 2 | Contact layer 3 | Contact layer 4 |
|---|---|---|---|---|
| Photo-conductive layer 1 | 23601* | 23607 | 23613 | 23619 |
| Photo-conductive layer 2 | 23602 | 23608 | 23614* | 23620 |
| Photo-conductive layer 3 | 23603 | 23609 | 23615 | 23621* |
| Photo-conductive layer 4 | 23604 | 23610* | 23616 | 23622 |
| Photo-conductive layer 5 | 23605 | 23611 | 23617 | 23623* |
| Photo-conductive layer 6 | 23606* | 23612 | 23618 | 23624 |

*surface layer B was used
markless case: surface layer A was used

TABLE 304

| | Drum No. | |
|---|---|---|
| IR absorptive layer 1 | 23701 | 23721 * |
| IR absorptive layer 2 | 23702 | 23722 * |
| IR absorptive layer 3 | 23703 | 23723 * |
| IR absorptive layer 4 | 23704 | 23724 * |
| IR absorptive layer 5 | 23705 | 23726 * |
| IR absorptive layer 6 | 23706 | 23726 * |
| IR absorptive layer 7 | 23707 | 23727 * |
| IR absorptive layer 8 | 23708 | 23728 * |
| IR absorptive layer 9 | 23709 | 23729 * |
| IR absorptive layer 10 | 23710 | 23730 * |
| IR absorptive layer 11 | 23711 | 23731 * |
| IR absorptive layer 12 | 23712 | 23732 * |
| IR absorptive layer 13 | 23713 | 23733 * |
| IR absorptive layer 14 | 23714 | 23734 * |
| IR absorptive layer 15 | 23715 | 23735 * |
| IR absorptive layer 17 | 23717 | 23737 * |
| IR absorptive layer 18 | 23718 | 23738 * |
| IR absorptive layer 19 | 23719 | 23739 * |
| IR absorptive layer 20 | 23720 | 23740 * |

*Charge injection inhibition layer and surface layer followed Table 278(b)
markless case: followed Table 178(a)

TABLE 305

| Drum No. | Photo-conductive layer 4 | Photo-conductive layer 5* | Photo-conductive layer 7 |
|---|---|---|---|
| IR absorptive layer 1 | 23801 | 23821 | 23841 |
| IR absorptive layer 2 | 23802 | 23822 | 23842 |
| IR absorptive layer 3 | 23803 | 23823 | 23843 |
| IR absorptive layer 4 | 23804 | 23824 | 23844 |
| IR absorptive layer 5 | 23805 | 23825 | 23845 |
| IR absorptive layer 6 | 23806 | 23826 | 23846 |
| IR absorptive layer 7 | 23807 | 23827 | 23847 |
| IR absorptive layer 8 | 23808 | 23828 | 23848 |
| IR absorptive layer 9 | 23809 | 23829 | 23849 |
| IR absorptive layer 10 | 23810 | 23830 | 23840 |
| IR absorptive layer 11 | 23811 | 23831 | 23851 |
| IR absorptive layer 12 | 23812 | 23832 | 23852 |
| IR absorptive layer 13 | 23813 | 23833 | 23853 |
| IR absorptive layer 14 | 23814 | 23834 | 23854 |
| IR absorptive layer 15 | 23815 | 23835 | 23855 |
| IR absorptive layer 16 | 23816 | 23836 | 23856 |
| IR absorptive layer 17 | 23817 | 23837 | 23857 |
| IR absorptive layer 18 | 23818 | 23838 | 23858 |
| IR absorptive layer 19 | 23819 | 23839 | 23859 |
| IR absorptive layer 20 | 23820 | 23840 | 23860 |

*: surface layer followed Table 278(b)
markless case: followed Table 278(a)

TABLE 306

| Drum No. | Photo-conductive layer 1 | Photo-conductive layer 4 | Photo-conductive layer 5* | Photo-conductive layer 7 |
|---|---|---|---|---|
| IR absorptive layer 1 | 23901 | 23921 | 23941 | 23961 |
| IR absorptive layer 2 | 23902 | 23922 | 23942 | 23962 |
| IR absorptive layer 3 | 23903 | 23923 | 23943 | 23963 |
| IR absorptive layer 4 | 23904 | 23924 | 23944 | 23964 |
| IR absorptive layer 5 | 23905 | 23925 | 23945 | 23965 |
| IR absorptive layer 6 | 23906 | 23926 | 23946 | 23966 |
| IR absorptive layer 7 | 23907 | 23927 | 23947 | 23967 |

TABLE 306-continued

| Drum No. | Photo-conductive layer 1 | Photo-conductive layer 4 | Photo-conductive layer 5* | Photo-conductive layer 7 |
|---|---|---|---|---|
| IR absorptive layer 8 | 23908 | 23928 | 23948 | 23968 |
| IR absorptive layer 9 | 23909 | 23929 | 23949 | 23969 |
| IR absorptive layer 10 | 23910 | 23930 | 23950 | 23970 |
| IR absorptive layer 11 | 23911 | 23931 | 23951 | 23971 |
| IR absorptive layer 12 | 23912 | 23932 | 23952 | 23972 |
| IR absorptive layer 13 | 23913 | 23933 | 23953 | 23973 |
| IR absorptive layer 14 | 23914 | 23934 | 23954 | 23974 |
| IR absorptive layer 15 | 23915 | 23935 | 23955 | 23975 |
| IR absorptive layer 16 | 23916 | 23936 | 23956 | 23976 |
| IR absorptive layer 17 | 23917 | 23937 | 23957 | 23977 |
| IR absorptive layer 18 | 23918 | 23938 | 23958 | 23978 |
| IR absorptive layer 19 | 23919 | 23939 | 23959 | 23979 |
| IR absorptive layer 20 | 23920 | 23940 | 23960 | 23980 |

*: surface layer B was used
markless case: surface layer A was used

TABLE 307

| Drum No. | Photo-conductive layer 1 | Photo-conductive layer 4 | Photo-conductive layer 5* | Photo-conductive layer 7 |
|---|---|---|---|---|
| IR absorptive layer 1 | 24001 | 24021 | 24041 | 24061 |
| IR absorptive layer 2 | 24002 | 24022 | 24042 | 24062 |

TABLE 307-continued

| Drum No. | Photo-conductive layer 1 | Photo-conductive layer 4 | Photo-conductive layer 5* | Photo-conductive layer 7 |
|---|---|---|---|---|
| IR absorptive layer 3 | 24003 | 24023 | 24043 | 24063 |
| IR absorptive layer 4 | 24004 | 24024 | 24044 | 24064 |
| IR absorptive layer 5 | 24005 | 24025 | 24045 | 24065 |
| IR absorptive layer 6 | 24006 | 24026 | 24046 | 24066 |
| IR absorptive layer 7 | 24007 | 24027 | 24047 | 24067 |
| IR absorptive layer 8 | 24008 | 24028 | 24048 | 24068 |
| IR absorptive layer 9 | 24009 | 24029 | 24049 | 24069 |
| IR absorptive layer 10 | 24010 | 24030 | 24050 | 24070 |
| IR absorptive layer 11 | 24011 | 24031 | 24051 | 24071 |
| IR absorptive layer 12 | 24012 | 24032 | 24052 | 24072 |
| IR absorptive layer 13 | 24013 | 24033 | 24053 | 24073 |
| IR absorptive layer 14 | 24014 | 24034 | 24054 | 24074 |
| IR absorptive layer 15 | 24015 | 24035 | 24055 | 24075 |
| IR absorptive layer 16 | 24016 | 24036 | 24056 | 24076 |
| IR absorptive layer 17 | 24017 | 24037 | 24057 | 24077 |
| IR absorptive layer 18 | 24018 | 24038 | 24058 | 24078 |
| IR absorptive layer 19 | 24019 | 24039 | 24059 | 24079 |
| IR absorptive layer 20 | 24020 | 24040 | 24060 | 24080 |

*: surface layer B was used
markless case: surface layer A was used

TABLE 308

| | Contact Layer 1 | Contact Layer 2 | Contact Layer 3 | Contact Layer 4 | Contact Layer 6 | Contact Layer 7 | Contact Layer 8 |
|---|---|---|---|---|---|---|---|
| Drum No. | 24101 | 24102 | 24103 | 24104 | 24105 | 24106 | 24107 |
| | 24108* | 24109* | 24110* | 24111* | 24112* | 24113* | 24114* |

*Charge injection inhibition layer and surface layer followed Table 280(b)
Markless case: followed Table 280(a)

TABLE 309

| Drum No. | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|
| Contact layer 1 | 24201 | 24209 | 24217 | 24225 | 24233 | 24241 |
| Contact layer 2 | 24202 | 24210 | 24218 | 24226 | 24234 | 24242 |
| Contact layer 3 | 24203 | 24211 | 24219 | 24227 | 24235 | 24243 |
| Contact layer 4 | 24204 | 24212 | 24220 | 24228 | 24236 | 24244 |
| Contact layer 5 | 24205 | 24213 | 24221 | 24229 | 24237 | 24245 |
| Contact layer 6 | 24206 | 24214 | 24222 | 24230 | 24238 | 24246 |
| Contact layer 7 | 24207 | 24215 | 24223 | 24231 | 24239 | 24247 |
| Contact layer 8 | 24208 | 24216 | 24224 | 24232 | 24240 | 24248 |

*surface layer followed Table 280(b)
markless case: followed Table 280(a)

TABLE 310

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibiton layer 7 |
|---|---|---|---|---|---|---|---|
| Contact layer 1 | 24301 | 24309 | 24317 | 24325 | 24333 | 24341 | 24349 |
| Contact layer 2 | 24302 | 24310 | 24318 | 24326 | 24334 | 24342 | 24350 |
| Contact layer 3 | 24303 | 24311 | 24319 | 24327 | 24335 | 24343 | 24351 |
| Contact layer 4 | 24304 | 24312 | 24320 | 24328 | 24336 | 24344 | 24352 |
| Contact layer 5 | 24305 | 24313 | 24321 | 24329 | 24337 | 24345 | 24353 |
| Contact layer 6 | 24306 | 24314 | 24322 | 24330 | 24338 | 24346 | 24354 |
| Contact layer 7 | 24307 | 24315 | 24323 | 24331 | 24339 | 24347 | 24355 |
| Contact layer 8 | 24308 | 24316 | 24324 | 24332 | 24340 | 24348 | 24356 |

*surface layer B was used
markless case: surface layer A was used

TABLE 311

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Contact layer 1 | 24401 | 24409 | 24417 | 24425 | 24433 | 24441 | 24449 |
| Contact layer 2 | 24402 | 24410 | 24418 | 24426 | 24434 | 24442 | 24450 |
| Contact layer 3 | 24403 | 24411 | 24419 | 24427 | 24435 | 24443 | 24451 |
| Contact layer 4 | 24404 | 24412 | 24420 | 24428 | 24436 | 24444 | 24452 |
| Contact layer 5 | 24405 | 24413 | 24421 | 24429 | 24437 | 24445 | 24453 |
| Contact layer 6 | 24406 | 24414 | 24422 | 24430 | 24438 | 24446 | 24454 |
| Contact layer 7 | 24407 | 24415 | 24423 | 24431 | 24439 | 24447 | 24455 |
| Contact layer 8 | 24408 | 24416 | 24424 | 24432 | 24440 | 24448 | 24456 |

*surface layer B was used
markless case: surface layer A was used

TABLE 312

| | Charge injection inhibition layer 4 | Charge injection inhibition layer 6* | Charge injection inhibition layer 7 |
|---|---|---|---|
| Drum No. | 24501 | 24502 | 24503 |

*surface layer followed Table 282 (b)
markless case: followed Table 282 (a)

TABLE 313

| Drum No. | Charge injection inhibition layer 1 | Charge injection inhibition layer 4 | Charge injection inhibition layer 6* | Charge injection inhibition layer 7 |
|---|---|---|---|---|
| Photo-conductive layer 5 | 24601 | 24603 | 24605 | 24607 |
| Photo-conductive layer 6 | 24602 | 24604 | 24606 | 24608 |

*surface layer followed Table 282 (b)
markless case: followed Table 282 (a)

TABLE 314

| Drum No. | Charge injection inhibition layer 1 | Charge injection inhibition layer 4 | Charge injection inhibition layer 6* | Charge injection inhibition layer 7 |
|---|---|---|---|---|
| Photo-conductive layer 4 | 24701 | 24704 | 24707 | 24710 |
| Photo-conductive layer 5 | 24702 | 24705 | 24708 | 24711 |
| Photo-conductive layer 6 | 24703 | 24706 | 24709 | 24712 |

*surface layer B was used
markless case: surface layer A was used

TABLE 315

| Drum No. | Charge injection inhibition layer 1 | Charge injection inhibition layer 4 | Charge injection inhibition layer 6* | Charge injection inhibition layer 7 |
|---|---|---|---|---|
| Photo-conductive layer 4 | 24801 | 24804 | 24807 | 24810 |
| Photo-conductive layer 5 | 24802 | 24805 | 24808 | 24811 |

TABLE 315-continued

| Drum No. | Charge injection inhibition layer 1 | Charge injection inhibition layer 4 | Charge injection inhibition layer 6* | Charge injection inhibition layer 7 |
|---|---|---|---|---|
| Photo-conductive layer 6 | 24803 | 24806 | 24809 | 24812 |

*surface layer B was used
markless case: surface layer A was used

TABLE 316

| Name of layer | Gas used and its flow rate (SCCM) | | Substrate temperature (°C.) | RF power (W) | Inner pressure (Torr) | Layer thickness (μm) |
|---|---|---|---|---|---|---|
| Surface layer A | $B_2H_6$/He (20%) | 500 | 250 | 100 | 0.35 | 0.5 |
| | $NH_3$ | 100 | | | | |
| | $SiH_4$ (against $B_2H_6 + NH_3$) | 100 ppm | | | | |
| Surface layer B | $B_2H_6$/He (20%) | 500 | 250 | 100 | 0.35 | 0.5 |
| | $NH_3$ | 100 | | | | |
| | $GeH_4$ (against $B_2H_6 + NH_3$) | 100 ppm | | | | |

TABLE 317

| Drum No. | Photo-conductive layer 1 | Photo-conductive layer 4 | Photo-conductive layer 5* | Photo-conductive layer 7 |
|---|---|---|---|---|
| IR absorptive layer 1 | 24901 | 24921 | 24941 | 24961 |
| IR absorptive layer 2 | 24902 | 24922 | 24942 | 24962 |
| IR absorptive layer 3 | 24903 | 24923 | 24943 | 24963 |
| IR absorptive layer 4 | 24904 | 24924 | 24944 | 24964 |
| IR absorptive layer 5 | 24905 | 24925 | 24945 | 24965 |
| IR absorptive layer 6 | 24906 | 24926 | 24946 | 24966 |
| IR absorptive layer 7 | 24907 | 24927 | 24947 | 24967 |
| IR absorptive layer 8 | 24908 | 24928 | 24948 | 24968 |
| IR absorptive layer 9 | 24909 | 24929 | 24949 | 24969 |
| IR absorptive layer 10 | 24910 | 24930 | 24950 | 24970 |
| IR absorptive layer 11 | 24911 | 24931 | 24951 | 24971 |
| IR absorptive layer 12 | 24912 | 24932 | 24952 | 24972 |
| IR absorptive layer 13 | 24913 | 24933 | 24953 | 24973 |
| IR absorptive layer 14 | 24914 | 24934 | 24954 | 24974 |
| IR absorptive layer 15 | 24915 | 24935 | 24955 | 24975 |
| IR absorptive layer 16 | 24916 | 24936 | 24956 | 24976 |
| IR absorptive layer 17 | 24917 | 24937 | 24957 | 24977 |
| IR absorptive layer 18 | 24918 | 24938 | 24958 | 24978 |
| IR absorptive layer 19 | 24919 | 24939 | 24959 | 24979 |
| IR absorptive layer 20 | 24920 | 24940 | 24960 | 24980 |

*: surface layer B was used
markless case: surface layer A was used

TABLE 318

| Drum No. | Photo-conductive layer 1 | Photo-conductive layer 4 | Photo-conductive layer 5* | Photo-conductive layer 7 |
|---|---|---|---|---|
| IR absorptive layer 1 | 25001 | 25021 | 25041 | 25061 |
| IR absorptive layer 2 | 25002 | 25022 | 25042 | 25062 |
| IR absorptive layer 3 | 25003 | 25023 | 25043 | 25063 |
| IR absorptive layer 4 | 25004 | 25024 | 25044 | 25064 |
| IR absorptive layer 5 | 25005 | 25025 | 25045 | 25065 |
| IR absorptive layer 6 | 25006 | 25026 | 25046 | 25066 |
| IR absorptive layer 7 | 25007 | 25027 | 25047 | 25067 |
| IR absorptive layer 8 | 25008 | 25028 | 25048 | 25068 |
| IR absorptive layer 9 | 25009 | 25029 | 25049 | 25069 |
| IR absorptive layer 10 | 25010 | 25030 | 25050 | 25070 |
| IR absorptive layer 11 | 25011 | 25031 | 25051 | 25071 |
| IR absorptive layer 12 | 25012 | 25032 | 25052 | 25072 |
| IR absorptive layer 13 | 25013 | 25033 | 25053 | 25073 |
| IR absorptive layer 14 | 25014 | 25034 | 25054 | 25074 |
| IR absorptive layer 15 | 25015 | 25035 | 25055 | 25075 |
| IR absorptive layer 16 | 25016 | 25036 | 25056 | 25076 |
| IR absorptive layer 17 | 25017 | 25037 | 25057 | 25077 |
| IR absorptive layer 18 | 25018 | 25038 | 25058 | 25078 |
| IR absorptive layer 19 | 25019 | 25039 | 25059 | 25079 |
| IR absorptive layer 20 | 25020 | 25040 | 25060 | 25080 |

*: surface layer B was used
markless case: surface layer A was used

TABLE 319

| Drum No. | Photo-conductive layer 1 | Photo-conductive layer 4 | Photo-conductive layer 5* | Photo-conductive layer 7 |
|---|---|---|---|---|
| IR absorptive layer 1 | 25101 | 25121 | 25141 | 25161 |
| IR absorptive layer 2 | 25102 | 25122 | 25142 | 25162 |
| IR absorptive layer 3 | 25103 | 25123 | 25143 | 25163 |
| IR absorptive layer 4 | 25104 | 25124 | 25144 | 25164 |
| IR absorptive layer 5 | 25105 | 25125 | 25145 | 25165 |
| IR absorptive layer 6 | 25106 | 25126 | 25146 | 25166 |
| IR absorptive layer 7 | 25107 | 25127 | 25147 | 25167 |
| IR absorptive layer 8 | 25108 | 25128 | 25148 | 25168 |
| IR absorptive layer 9 | 25109 | 25129 | 25149 | 25169 |
| IR absorptive | 25110 | 25130 | 25150 | 25170 |

TABLE 319-continued

| Drum No. | Photo-conductive layer 1 | Photo-conductive layer 4 | Photo-conductive layer 5* | Photo-conductive layer 7 |
|---|---|---|---|---|
| layer 10 | | | | |
| IR absorptive layer 11 | 25111 | 25131 | 25151 | 25171 |
| IR absorptive layer 12 | 25112 | 25132 | 25152 | 25172 |
| IR absorptive layer 13 | 25113 | 25133 | 25153 | 25173 |
| IR absorptive layer 14 | 25114 | 25134 | 25154 | 25174 |
| IR absorptive layer 15 | 25115 | 25135 | 25155 | 25175 |
| IR absorptive layer 16 | 25116 | 25136 | 25156 | 25176 |
| IR absorptive layer 17 | 25117 | 25137 | 25157 | 25177 |
| IR absorptive layer 18 | 25118 | 25138 | 25158 | 25178 |
| IR absorptive layer 19 | 25119 | 25138 | 25159 | 25179 |
| IR absorptive layer 20 | 25120 | 25140 | 25160 | 25180 |

*: surface layer B was used
markless case: surface layer A was used

TABLE 320

| Drum No. | Photo-conductive layer 1 | Photo-conductive layer 4 | Photo-conductive layer 5* | Photo-conductive layer 7 |
|---|---|---|---|---|
| IR absorptive layer 1 | 25201 | 25221 | 25241 | 25261 |
| IR absorptive layer 2 | 25202 | 25222 | 25242 | 25262 |
| IR absorptive layer 3 | 25203 | 25223 | 25243 | 25263 |
| IR absorptive layer 4 | 25204 | 25224 | 25244 | 25264 |
| IR absorptive layer 5 | 25205 | 25225 | 25245 | 25265 |
| IR absorptive layer 6 | 25206 | 25226 | 25246 | 25266 |
| IR absorptive layer 7 | 25207 | 25227 | 25247 | 25267 |
| IR absorptive layer 8 | 25208 | 25228 | 25248 | 25268 |
| IR absorptive layer 9 | 25209 | 25229 | 25249 | 25268 |
| IR absorptive layer 10 | 25210 | 25230 | 25250 | 25270 |
| IR absorptive layer 11 | 25211 | 25231 | 25251 | 25171 |
| IR absorptive layer 12 | 25212 | 25232 | 25252 | 25272 |
| IR absorptive layer 13 | 25213 | 25233 | 25253 | 25273 |
| IR absorptive layer 14 | 25214 | 25234 | 25254 | 25274 |
| IR absorptive layer 15 | 25215 | 25235 | 25255 | 25275 |
| IR absorptive layer 16 | 25216 | 25236 | 25256 | 25276 |
| IR absorptive layer 17 | 25217 | 25237 | 25257 | 25277 |
| IR absorptive layer 18 | 25218 | 25238 | 25258 | 25278 |
| IR absorptive layer 19 | 25219 | 25239 | 25259 | 25279 |
| IR absorptive layer 20 | 25220 | 25240 | 25260 | 25280 |

*: surface layer B was used
markless case: surface layer A was used

TABLE 321

| Drum No. | Photo-conductive layer 1 | Photo-conductive layer 4 | Photo-conductive layer 5* | Photo-conductive layer 7 |
|---|---|---|---|---|
| IR absorptive layer 1 | 25301 | 25321 | 25341 | 25361 |
| IR absorptive layer 2 | 25302 | 25322 | 25342 | 25362 |
| IR absorptive layer 3 | 25303 | 25323 | 25343 | 25363 |
| IR absorptive layer 4 | 25304 | 25324 | 25344 | 25364 |
| IR absorptive layer 5 | 25305 | 25325 | 25345 | 25365 |
| IR absorptive layer 6 | 25306 | 25326 | 25346 | 25366 |
| IR absorptive layer 7 | 25307 | 25327 | 25347 | 25367 |
| IR absorptive layer 8 | 25308 | 25328 | 25348 | 25368 |
| IR absorptive layer 9 | 25309 | 25329 | 25349 | 25369 |
| IR absorptive layer 10 | 25310 | 25330 | 25350 | 25370 |
| IR absorptive layer 11 | 25311 | 25331 | 25351 | 25371 |
| IR absorptive layer 12 | 25312 | 25332 | 25352 | 25372 |
| IR absorptive layer 13 | 25313 | 25333 | 25353 | 25373 |
| IR absorptive layer 14 | 25314 | 25334 | 25354 | 25374 |
| IR absorptive layer 15 | 25315 | 25335 | 25355 | 25375 |
| IR absorptive layer 16 | 25316 | 25336 | 25356 | 25376 |
| IR absorptive layer 17 | 25317 | 25337 | 25357 | 25377 |
| IR absorptive layer 18 | 25318 | 25338 | 25358 | 25378 |
| IR absorptive layer 19 | 25319 | 25339 | 25359 | 25379 |
| IR absorptive layer 20 | 25320 | 25340 | 25360 | 25380 |

*: surface layer B was used
markless case: surface layer A was used

TABLE 322

| Drum No. | Photo-conductive layer 1 | Photo-conductive layer 4 | Photo-conductive layer 5* | Photo-conductive layer 7 |
|---|---|---|---|---|
| IR absorptive layer 1 | 25401 | 25421 | 25441 | 25461 |
| IR absorptive layer 2 | 25402 | 25422 | 25442 | 25462 |
| IR absorptive layer 3 | 25403 | 25423 | 25443 | 25463 |
| IR absorptive layer 4 | 25404 | 25424 | 25444 | 25464 |
| IR absorptive layer 5 | 25405 | 25425 | 25445 | 25465 |
| IR absorptive layer 6 | 25406 | 25426 | 25446 | 25466 |
| IR absorptive layer 7 | 25407 | 25427 | 25447 | 25467 |
| IR absorptive layer 8 | 25408 | 25428 | 25448 | 25468 |
| IR absorptive layer 9 | 25409 | 25429 | 25449 | 25469 |
| IR absorptive layer 10 | 25410 | 25430 | 25450 | 25470 |
| IR absorptive layer 11 | 25411 | 25431 | 25451 | 25471 |
| IR absorptive layer 12 | 25412 | 25432 | 25452 | 25472 |
| IR absorptive layer 13 | 25413 | 25433 | 25453 | 25473 |
| IR absorptive layer 14 | 25414 | 25434 | 25454 | 25474 |
| IR absorptive | 25415 | 25435 | 25455 | 25475 |

TABLE 322-continued

| Drum No. | Photo-conductive layer 1 | Photo-conductive layer 4 | Photo-conductive layer 5* | Photo-conductive layer 7 |
|---|---|---|---|---|
| layer 15 | | | | |
| IR absorptive layer 16 | 25416 | 25436 | 25456 | 25476 |
| IR absorptive layer 17 | 25417 | 25437 | 25457 | 25477 |
| IR absorptive layer 18 | 25418 | 25438 | 25458 | 25478 |
| IR absorptive layer 19 | 25419 | 25439 | 25459 | 25479 |
| IR absorptive layer 20 | 25420 | 25440 | 25460 | 25480 |

*: surface layer B was used
markless case: surface layer A was used

TABLE 323

| Drum No. | Gas used and its flow rate (SCCM) | | Substrate temperature (°C.) | RF power (W) | Inner pressure (Torr) | Layer thickness (μm) |
|---|---|---|---|---|---|---|
| 25501 | $B_2H_6$/He (20%) | 500 | 250 | 100 | 0.35 | 0.5 |
| | $SiH_4$ (against $B_2H_6 + NH_3$) | 100 ppm | | | | |
| | $NH_3$ | 100 | | | | |
| 25502 | $B_2H_6$/He (20%) | 500 | 250 | 100 | 0.40 | 0.5 |
| | $SiH_4$ (against $B_2H_6 + NH_3$) | 50 ppm | | | | |
| | $H_2$ | 100 | | | | |
| | $NH_3$ | 300 | | | | |
| 25503 | $B_2H_6$/(20%) | 500 | 250 | 100 | 0.35 | 0.5 |
| | $SiH_4$ (against $B_2H_6 + NH_3$) | 100 ppm | | | | |
| | $NH_3$ | 100 | | | | |
| | Bias voltage of the cylinder | +100 V | | | | |

TABLE 324

| Drum No. | Gas used and its flow rate (SCCM) | | Substrate temperature (°C.) | RF power (W) | Inner pressure (Torr) | Layer thickness (μm) |
|---|---|---|---|---|---|---|
| 25601 | $B_2H_6$/He (20%) | 500 | 250 | 100 | 0.35 | 0.5 |
| | $SiH_4$ (against $B_2H_6 + NH_3$) | 100 ppm | | | | |
| | $NH_3$ | 100 | | | | |
| 25602 | $B_2H_6$/He (20%) | 500 | 250 | 100 | 0.40 | 0.5 |
| | $SiH_4$ (against $B_2H_6 + NH_3$) | 50 ppm | | | | |
| | $H_2$ | 100 | | | | |
| | $NH_3$ | 300 | | | | |
| 25603 | $B_2H_6$/He (20%) | 500 | 250 | 100 | 0.35 | 0.5 |
| | $SiH_4$ (against $B_3H_6 + NH_3$) | 100 ppm | | | | |
| | $NH_3$ | 100 | | | | |
| | Bias voltage of the cylinder | +100 V | | | | |

TABLE 325

| Drum No. | Gas used and its flow rate (SCCM) | | Substrate temperature (°C.) | RF power (W) | Inner pressure (Torr) | Layer thickness (μm) |
|---|---|---|---|---|---|---|
| 25701 | $B_2H_6$/He (20%) | 500 | 250 | 100 | 0.35 | 0.5 |
| | $SiH_4$ (against $B_2H_6 + NH_3$) | 100 ppm | | | | |
| | $NH_3$ | 100 | | | | |
| 25702 | $B_2H_6$/He (20%) | 500 | 250 | 100 | 0.40 | 0.5 |
| | $SiH_4$ (against $B_2H_6 + NH_3$) | 50 ppm | | | | |
| | $H_2$ | 100 | | | | |
| | $NH_3$ | 300 | | | | |
| 25703 | $B_2H_6$/He (20%) | 500 | 250 | 100 | 0.35 | 0.5 |
| | $SiH_4$ (against $B_2H_6 + NH_3$) | 100 ppm | | | | |
| | $NH_3$ | 100 | | | | |
| | Bias voltage of the cylinder | +100 V | | | | |

TABLE 326

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |

TABLE 326-continued

| Name of layer | Gas used and its flow rate (SCCM) | | Substrate temperature (°C.) | RF power (W) | Inner pressure (Torr) | Layer thickness (μm) |
|---|---|---|---|---|---|---|
| Inter-mediate layer | $SiH_4$ | 10 | 250 | 150 | 0.35 | 0.3 |
| | $CH_4$ | 400 | | | | |
| Surface layer | $B_2H_6$/He (20%) | 500 | 250 | 100 | 0.35 | 0.5 |
| | $NH_3$ | 100 | | | | |
| | $SiH_4$ (against $B_2H_6$ + $NH_3$) | 100 ppm | | | | |

TABLE 327 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer (lower layer) | $B_2H_6$/Ar (20%) | 500 | 250 | 200 | 0.35 | 0.3 |
| | $NH_3$ | 100 | | | | |
| | $SiH_4$ (against $B_2H_6$ + $NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $SiH_4$ (against $B_2H_6$ + $NH_3$) | 100 ppm | | | | |

TABLE 327 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer (lower layer) | $B_2H_6$/Ar (20%) | 500 | 250 | 200 | 0.35 | 0.3 |
| | $NH_3$ | 100 | | | | |
| | $GeH_4$ (against $B_2H_6$ + $NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $GeH_4$ (against $B_2H_6$ + $NH_3$) | 100 ppm | | | | |

TABLE 328

| Drum No. | Intial electri-fication efficiency | Residual voltage | Ghost | Defective image | Image flow |
|---|---|---|---|---|---|
| (a) | ○ | ◎ | ○ | ◎ | ◎ |
| (b) | ○ | ◎ | ○ | ◎ | ◎ |

TABLE 328-continued

| Drum No. | Increase of defective image | Surface abrasion | Break down voltage | Abrasion resistance | Degree of background fogginess |
|---|---|---|---|---|---|
| (a) | ○ | ○ | ◎ | ◎ | ◎ |
| (b) | ○ | ○ | ◎ | ◎ | ◎ |

◎: Excellent
○ : Good

TABLE 329 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |
| Surface layer (lower layer) | $B_2H_6$ /Ar (20%) | 500 | 250 | 200 | 0.40 | 0.3 |
| | $H_2$ | 100 | | | | |
| | $NH_3$ | 100 | | | | |
| | $SiH_4$ (against $B_2H_6$ + $NH_3$) | 50 ppm | | | | |
| Surface layer (upper layer) | $B_2H_6$/He (20%) | 500 | 250 | 100 | 0.40 | 0.3 |
| | $H_2$ | 100 | | | | |
| | $NH_3$ | 300 | | | | |
| | $SiH_4$ (against $B_2H_6$ + $NH_3$) | 50 ppm | | | | |

TABLE 329 (b)

| Name of layer | Gas used and its flow rate (SCCM) | | Substrate temperture (°C.) | RF power (W) | Inner pressure (Torr) | Layer thickness (μm) |
|---|---|---|---|---|---|---|
| Photo-conductive layer | $SiH_4$ | 200 | 250 | 250 | 0.35 | 20 |
| | $B_2H_6$ (against $SiH_4$) | 100 ppm | | | | |
| | NO | 4 | | | | |

TABLE 329 (b)-continued

| Name of layer | Gas used and its flow rate (SCCM) | | Substrate temperture (°C.) | RF power (W) | Inner pressure (Torr) | Layer thickness (μm) |
|---|---|---|---|---|---|---|
| Surface layer (lower layer) | $B_2H_6$/Ar (20%) | 500 | 250 | 200 | 0.40 | 0.3 |
| | $H_2$ | 100 | | | | |
| | $NH_3$ | 100 | | | | |
| | $GeH_4$ (against $B_2H_6$+ $NH_3$) | 50 ppm | | | | |
| Surface layer (upper layer) | $B_2H_6$He (20%) | 500 | 250 | 200 | 0.40 | 0.3 |
| | $H_2$ | 100 | | | | |
| | $NH_3$ | 300 | | | | |
| | $GeH_4$ (against $B_2H_6$ + $NH_3$) | 50 ppm | | | | |

TABLE 330

| Drum No. | Intial electri-fication efficiency | Residual voltage | Ghost | Defective image | Image flow |
|---|---|---|---|---|---|
| (a) | ○ | ◎ | ○ | ◎ | ◎ |
| (b) | ○ | ◎ | ○ | ◎ | ◎ |

| Drum No. | Increase of defective image | Surface abrasion | Break down voltage | Abrasion resistance | Degree of background fogginess |
|---|---|---|---|---|---|
| (a) | ○ | ○ | ◎ | ◎ | ◎ |
| (b) | ○ | ○ | ◎ | ◎ | ◎ |

◎: Excellent
○: Good

TABLE 331

| Drum No. | Intial electri-fication efficiency | Residual voltage | Ghost | Defective image | Image flow |
|---|---|---|---|---|---|
| (a) | ○ | ◎ | ○ | ◎ | ◎ |
| (b) | ○ | ◎ | ○ | ◎ | ◎ |

| Drum No. | Increase of defective image | Surface abrasion | Break down voltage | Abrasion resistance | Degree of background fogginess |
|---|---|---|---|---|---|
| (a) | ○ | ○ | ◎ | ◎ | ◎ |
| (b) | ○ | ○ | ◎ | ◎ | ◎ |

◎: Excellent
○: Good

TABLE 332 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| | $SiH_4$ (against $B_2H_6$ + $NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $SiH_4$ (against $B_2H_6$ + $NH_3$) | 100 ppm | | | | |

TABLE 332 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $PH_3$ (against $SiH_4$) | 800 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| | $GeH_4$ (against $B_2H_6$ + $NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $GeH_4$ (against $B_2H_6$ + $NH_3$) | 100 ppm | | | | |

TABLE 333

| Drum No. | Intial electri-fication efficiency | Residual voltage | Ghost | Defective image | Image flow |
|---|---|---|---|---|---|
| (a) | ◉ | ◎ | ○ | ◎ | ◉ |
| (b) | ◉ | ◉ | ○ | ◉ | ◎ |

| Drum No. | Increase of defective image | Surface abrasion | Break down voltage | Abrasion resistance | Degree of background fogginess |
|---|---|---|---|---|---|
| (a) | ○ | ○ | ◉ | ◎ | ◉ |
| (b) | ○ | ○ | ◉ | ◉ | ◎ |

◉: Excellent
○: Good

TABLE 335

| Drum No. | Intial electri-fication efficiency | Residual voltage | Ghost | Defective image | Image flow |
|---|---|---|---|---|---|
| (a) | ◉ | ◉ | ○ | ◉ | ◉ |
| (b) | ◉ | ◉ | ○ | ◎ | ◉ |

| Drum No. | Increase of defective image | Surface abrasion | Break down voltage | Abrasion resistance | Degree of background fogginess |
|---|---|---|---|---|---|
| (a) | ○ | ○ | ◎ | ◉ | ◎ |
| (b) | ○ | ○ | ◎ | ◉ | ◉ |

◉: Excellent
○: Good

TABLE 334 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| | $SiH_4$ (against $B_2H_6$ + $NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $SiH_4$ (against $B_2H_6$ +$NH_3$) | 100 ppm | | | | |

TABLE 334 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| | $GeH_4$ (against $B_2H_6$ + $NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $GeH_4$ (against $B_2H_6$ + $NH_3$) | 100 ppm | | | | |

TABLE 336 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| | $SiH_4$ (against $B_2H_6$ + $NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $SiH_4$ (against $B_2H_6$ + $NH_3$) | 100 ppm | | | | |

TABLE 336 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $PH_3$ (against $SiH_4$) | 800 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| | $GeH_4$ (against $B_2H_6 + NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $GeH_4$ (against $B_2H_6 + NH_3$) | 100 ppm | | | | |

TABLE 337

| Drum No. | Intial electrification efficiency | Residual voltage | Ghost | Defective image | Image flow |
|---|---|---|---|---|---|
| (a) | ○ | ◉ | ○ | ◉ | ◉ |
| (b) | ○ | ◉ | ○ | ◉ | ◉ |

| Drum No. | Increase of defective image | Surface abrasion | Break down voltage | Abrasion resistance | Interference fringe | Degree of background fogginess |
|---|---|---|---|---|---|---|
| (a) | ○ | ○ | ◉ | ◉ | ○ | ◉ |
| (b) | ○ | ○ | ◉ | ◉ | ○ | ◉ |

◉: Excellent
○ : Good

TABLE 339

| Drum No. | Intial electrification efficiency | Residual voltage | Ghost | Defective image | Image flow |
|---|---|---|---|---|---|
| (a) | ◉ | ◉ | ○ | ◉ | ◉ |
| (b) | ◉ | ◉ | ○ | ◉ | ◉ |

| Drum No. | Increase of defective image | Surface abrasion | Break down voltage | Abrasion resistance | Degree of background fogginess |
|---|---|---|---|---|---|
| (a) | ○ | ○ | ◉ | ◉ | ◉ |
| (b) | ○ | ○ | ◉ | ◉ | ◉ |

◉: Excellent
○ : Good

TABLE 338(a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 100 | 0.25 | 0.5 |
| | $N_2$ | 100 | | | | |
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| | $SiH_4$ (against $B_2H_6 + NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $SiH_4$ (against $B_2H_6 + NH_3$) | 100 ppm | | | | |

TABLE 338 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 100 | 0.25 | 0.5 |
| | $N_2$ | 100 | | | | |
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| | $GeH_4$ (against $B_2H_6 + NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $GeH_4$ (against $B_2H_6 + NH_3$) | 100 ppm | | | | |

TABLE 340 (a)

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer (lower | $B_2H_6$/Ar (20%) | 500 | 250 | 200 | 0.35 | 0.3 |
| | $NH_3$ | 100 | | | | |
| | $SiH_4$ (against $B_2H_6 + NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $SiH_4$ (against $B_2H_6 + NH_3$) | 100 ppm | | | | |

TABLE 340 (b)

| Name of layer | Gas used and its flow rate (SCCM) | | Substrate temperature (°C.) | RF power (W) | Inner pressure (Torr) | Layer thickness (μm) |
|---|---|---|---|---|---|---|
| IR absorptive layer | $SiH_4$ | 100 | 250 | 150 | 0.35 | 1 |
| | $H_2$ | 100 | | | | |
| | $GeH_4$ | 50 | | | | |
| | $PH_3$ (against $SiH_4$) | 800 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $PH_3$ (against $SiH_4$) | 800 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| | $GeH_4$ (against $B_2H_6 + NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $GeH_4$ (against $B_2H_6 + NH_3$) | 100 ppm | | | | |

TABLE 341

| Drum No. | Intial electri-fication efficiency | Residual voltage | Ghost | Defective image | Image flow |
|---|---|---|---|---|---|
| (a) | ◉ | ◉ | ○ | ◉ | ◉ |
| (b) | ◉ | ◉ | ○ | ◉ | ◉ |

| Drum No. | Increase of defective image | Surface abrasion | Break down voltage | Abrasion resistance | Interference fringe | Degree of background fogginess |
|---|---|---|---|---|---|---|
| (a) | ○ | ○ | ◉ | ◉ | ○ | ◉ |
| (b) | ○ | ○ | ◉ | ◉ | ○ | ◉ |

◉: Excellent
○ : Good

TABLE 342(a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |

TABLE 342(a)-continued

| Name of layer | Gas used and its flow rate (SCCM) | | Substrate temperature (°C.) | RF power (W) | Inner pressure (Torr) | Layer thickness (μm) |
|---|---|---|---|---|---|---|
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| | $SiH_4$ (against $B_2H_6$ + NH 3) | 100 ppm | | | | |
| Surface layer (upper layer) | $B_2H_6$/He (20%) | 500 | 250 | 100 | 0.35 | 0.3 |
| | $NH_3$ | 100 | | | | |
| | $SiH_4$ (against $B_2H_6$ + $NH_3$) | 100 ppm | | | | |

TABLE 342(b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| Charge injection inhibition layer | $SiH_4$ | 100 | 250 | 150 | 0.35 | 3 |
| | $H_2$ | 100 | | | | |
| | $PH_3$ (against $SiH_4$) | 800 ppm | | | | |
| | NO | 10 | | | | |
| Photo-conductive layer | $Si_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| | $GeH_4$ (against $B_2H_6$ + $NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $GeH_4$ (against $B_2H_6$ + $NH_3$) | 100 ppm | | | | |

TABLE 343

| Drum No. | Intial electri-fication efficiency | Residual voltage | Ghost | Defective image | Image flow |
|---|---|---|---|---|---|
| (a) | ◉ | ◉ | ○ | ◉ | ◉ |
| (b) | ◉ | ◉ | ○ | ◉ | ◉ |

TABLE 343-continued

| Drum No. | Increase of defective image | Surface abrasion | Break down voltage | Abrasion resistance | Degree of background fogginess |
|---|---|---|---|---|---|
| (a) | ○ | ○ | ◉ | ◉ | ◉ |
| (b) | ○ | ○ | ◉ | ◉ | ◉ |

◉: Excellent
○: Good

TABLE 344(a)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| IR absorptive layer | $SiH_4$ | 100 | 250 | 150 | 0.35 | 1 |
| | $H_2$ | 100 | | | | |
| | $GeH_4$ | 50 | | | | |
| | $B_2H_6$ (against $SiH_4$) | 1000 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | Hz | 200 | | | | |
| Surface layer (lower layer) | $B_2H_6$/Ar (20%) | 500 | 250 | 200 | 0.35 | 0.3 |
| | $NH_3$ | 100 | | | | |
| | $SiH_4$ (against $B_2H_6$ + $NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $SiH_4$ (against $B_2H_6$+$NH_3$) | 100 ppm | | | | |

TABLE 344(b)

| Name of layer | Gas used and its flow rate (SCCM) | | Substrate temperature (°C.) | RF power (W) | Inner pressure (Torr) | Layer thickness (μm) |
|---|---|---|---|---|---|---|
| Contact layer | $SiH_4$ | 20 | 250 | 50 | 0.05 | 0.5 |
| | $N_2$ | 10 | | | | |
| IR absorptive layer | $SiH_4$ | 100 | 250 | 150 | 0.35 | 1 |
| | $H_2$ | 100 | | | | |
| | $GeH_4$ | 50 | | | | |
| | $PH_3$ (against $SiH_4$) | 800 ppm | | | | |
| | NO | 10 | | | | |
| Charge injection inhibition layer | $SiH_4$ | 100 | 250 | 150 | 0.35 | 3 |
| | $H_2$ | 100 | | | | |
| | $PH_3$ (against $SiH_4$) | 800 ppm | | | | |
| | NO | 10 | | | | |
| Photo-conductive layer | $SiH_4$ | 200 | 250 | 300 | 0.40 | 20 |
| | $H_2$ | 200 | | | | |
| Surface layer (lower layer) | $B_2H_6$/Ar (20%) | 500 | 250 | 200 | 0.35 | 0.3 |
| | $NH_3$ | 100 | | | | |
| | $GeH_4$ (against $B_2H_6 + NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $GeH_4$ (against $B_2H_6 + NH_3$) | 100 ppm | | | | |

TABLE 345

| Drum No. | Intial electri-fication efficiency | Residual voltage | Ghost | Defective image | Image flow |
|---|---|---|---|---|---|
| (a) | ⊙ | ⊙ | ○ | ⊙ | ⊙ |
| (b) | ⊙ | ⊙ | ○ | ⊙ | ⊙ |

| Drum No. | Increase of defective image | Surface abrasion | Break down voltage | Abrasion resistance | Interference fringe | Degree of background fogginess |
|---|---|---|---|---|---|---|
| (a) | ○ | ○ | ⊙ | ⊙ | ○ | ⊙ |
| (b) | ○ | ○ | ⊙ | ⊙ | ○ | ⊙ |

⊙: Excellent
○ : Good

TABLE 346

| Drum No. | Gas used and its flow rate (SCCM) | | Substrate temperature (°C.) | RF power (W) | Inner pressure (Torr) | Layer thickness (μm) |
|---|---|---|---|---|---|---|
| 27101 | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 27102 | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 27103 | $SiH_4$ | 200 | 250 | 300 | 0.40 | 20 |
| | $H_2$ | 200 | | | | |
| 27104 | $SiH_4$ | 200 | 250 | 250 | 0.40 | 20 |
| | Ar | 200 | | | | |
| 27105 | $SiH_4$ | 150 | 250 | 350 | 0.40 | 20 |
| | $SiF_4$ | 50 | | | | |
| | $H_2$ | 200 | | | | |
| 27106* | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 27107* | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 27108* | $SiH_4$ | 200 | 250 | 300 | 0.40 | 20 |
| | $H_2$ | 200 | | | | |
| 27109* | $SiH_4$ | 200 | 250 | 250 | 0.40 | 20 |
| | Ar | 200 | | | | |
| 27110* | $SiH_4$ | 150 | 250 | 350 | 0.40 | 20 |

TABLE 346-continued

| Drum No. | Gas used and its flow rate (SCCM) | | Substrate temperature (°C.) | RF power (W) | Inner pressure (Torr) | Layer thickness (μm) |
|---|---|---|---|---|---|---|
| | $SiF_4$ | 50 | | | | |
| | $H_2$ | 200 | | | | |

*surface layer followed Table 327(b)
markless case: followed Table 327(a)

TABLE 347

| Drum No. | Gas used and its flow rate (SCCM) | | Substrate temperature (°C.) | RF power (W) | Inner pressure (Torr) | Layer thickness (μm) |
|---|---|---|---|---|---|---|
| 27201 | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 27202 | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 27206 | $SiH_4$ | 200 | 250 | 300 | 0.40 | 20 |
| | $H_2$ | 200 | | | | |
| 27204 | $SiH_4$ | 200 | 250 | 250 | 0.40 | 20 |
| | Ar | 200 | | | | |
| 27205 | $SiH_4$ | 150 | 250 | 350 | 0.40 | 20 |
| | $SiF_4$ | 50 | | | | |
| | $H_2$ | 200 | | | | |
| 27206* | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 27207* | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 27208* | $SiH_4$ | 200 | 250 | 300 | 0.40 | 20 |
| | $H_2$ | 200 | | | | |
| 27209* | $SiH_4$ | 200 | 250 | 250 | 0.40 | 20 |
| | Ar | 200 | | | | |
| 27210* | $SiH_4$ | 150 | 250 | 350 | 0.40 | 20 |
| | $SiF_4$ | 50 | | | | |
| | $H_2$ | 200 | | | | |

*surface layer followed Table 329(b)
markless case: followed Table 329(a)

TABLE 348

| Drum No. | Gas used and its flow rate (SCCM) | | Substrate temperature (°C.) | RF power (W) | Inner pressure (Torr) | Layer thickness (μm) |
|---|---|---|---|---|---|---|
| 27301 | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 27302 | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 27303 | $SiH_4$ | 200 | 250 | 300 | 0.40 | 20 |
| | $H_2$ | 200 | | | | |
| 27304 | $SiH_4$ | 200 | 250 | 250 | 0.40 | 20 |
| | Ar | 200 | | | | |
| 27305 | $SiH_4$ | 150 | 250 | 350 | 0.40 | 20 |
| | $SiF_4$ | 50 | | | | |
| | $H_2$ | 200 | | | | |
| 27306* | $SiH_4$ | 200 | 250 | 300 | 0.40 | 20 |
| | He | 200 | | | | |
| | $B_2H_6$ (against $SiH_4$) | 100 ppm | | | | |
| | NO | 4 | | | | |
| 27307* | $SiH_4$ | 150 | 250 | 350 | 0.40 | 20 |
| | $SiF_4$ | 50 | | | | |
| | $H_2$ | 200 | | | | |
| | $B_2H_6$ (against $SiH_4$) | 100 ppm | | | | |
| | NO | 6 | | | | |
| 27308* | $SiH_4$ | 200 | 250 | 300 | 0.40 | 20 |

TABLE 348-continued

| Drum No. | Gas used and its flow rate (SCCM) | | Substrate temperature (°C.) | RF power (W) | Inner pressure (Torr) | Layer thickness (μm) |
|---|---|---|---|---|---|---|
| | $H_2$ | 200 | | | | |
| 27309* | $SiH_4$ | 200 | 250 | 250 | 0.40 | 20 |
| | Ar | 200 | | | | |
| 27310* | $SiH_4$ | 150 | 250 | 350 | 0.40 | 20 |
| | $SiF_4$ | 50 | | | | |
| | $H_2$ | 200 | | | | |

*surface layer followed Table 327(b)
markless case: followed Table 327(a)

TABLE 349

| Drum No. | Gas used and its flow rate (SCCM) | | Substrate temperature (°C.) | RF power (W) | Inner pressure (Torr) | Layer thickness (μm) |
|---|---|---|---|---|---|---|
| 27401 | $SiH_4$ | 100 | 250 | 150 | 0.35 | 3 |
| | $H_2$ | 100 | | | | |
| | $B_2H_6$ (against $SiH_4$) | 1000 ppm | | | | |
| | $GeH_4$ | 10 | | | | |
| | NO | 10 | | | | |
| 27402 | $SiH_4$ | 80 | 250 | 170 | 0.25 | 3 |
| | $SiF_4$ | 20 | | | | |
| | $B_2H_6$ (against $SiH_4$) | 1000 ppm | | | | |
| | $SnH_4$ | 5 | | | | |
| | NO | 5 | | | | |
| 27403 | $SiH_4$ | 100 | 250 | 130 | 0.25 | 3 |
| | $B_2H_6$ (against $SiH_4$) | 800 ppm | | | | |
| | NO | 4 | | | | |
| | $N_2$ | 4 | | | | |
| | $CH_4$ | 6 | | | | |
| 27404* | $SiH_4$ | 100 | 250 | 150 | 0.35 | 3 |
| | $H_2$ | 100 | | | | |
| | $PH_3$ (against $SiH_4$) | 800 ppm | | | | |
| 27405* | $SiH_4$ | 100 | 250 | 130 | 0.25 | 3 |
| | $PH_3$ (against $SiH_4$) | 800 ppm | | | | |
| | $GeH_4$ | 10 | | | | |
| | NO | 10 | | | | |
| 27406 | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO** | 10 | | | | |
| | NO*** | 10→0**** | | | | |

*surface layer followed Table 332(b)
markless case: followed Table 332(a)
**Substrate side 2 μm
***Surface layer side 1 μm
****Constantly changed

TABLE 350

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Photo-conductive layer 1 | 27501 | 27506 | 27511 | 27516 | 27521 | 27526 | 27531 |
| Photo-conductive layer 2 | 27502 | 27507 | 27512 | 27517 | 27522 | 27527 | 27532 |
| Photo-conductive layer 3 | 27503 | 27508 | 28513 | 27518 | 27523 | 27528 | 27533 |
| Photo-conductive layer 5 | 27504 | 27509 | 27514 | 27519 | 27524 | 27529 | 27534 |
| Photo-conductive layer 6 | 27505 | 27510 | 27515 | 27520 | 27525 | 27530 | 27535 |

*surface layer followed Table 332(b)
markless case: followed Table 332(a)

TABLE 351

| Name of layer | | Gas used and its flow rate (SCCM) | | Substrate temperature (°C.) | RF power (W) | Inner pressure (Torr) | Layer thickness (μm) |
|---|---|---|---|---|---|---|---|
| Surface* layer A | Lower layer | $B_2H_6$/Ar (20%) | 500 | 250 | 200 | 0.40 | 0.3 |
| | | $H_2$ | 100 | | | | |
| | | $NH_3$ | 100 | | | | |
| | | $SiH_4$ (against $B_2H_6 + NH_3$) | 50 ppm | | | | |
| | Upper layer | $B_2H_6$/He (20%) | 500 | 250 | 100 | 0.40 | 0.3 |
| | | $H_2$ | 100 | | | | |
| | | $NH_3$ | 300 | | | | |
| | | $SiH_4$ (against $B_2H_6 + NH_3$) | 50 ppm | | | | |
| Surface* layer B | Lower layer | $B_2H_6$/Ar (20%) | 500 | 250 | 200 | 0.40 | 0.3 |
| | | $H_2$ | 100 | | | | |
| | | $NH_3$ | 100 | | | | |
| | | $GeH_4$ (against $B_2H_6 + NH_3$) | 50 ppm | | | | |
| | Upper layer | $B_2H_6$/He (20%) | 500 | 250 | 100 | 0.40 | 0.3 |
| | | $H_2$ | 100 | | | | |
| | | $NH_3$ | 300 | | | | |
| | | $GeH_4$ (against $B_2H_6 + NH_3$) | 50 ppm | | | | |

*each of the surface layers A and B is individually used in accordance with the kind of the lower layer

TABLE 352

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Photo-conductive layer 1 | 27601 | 27607 | 27613 | 27619 | 27625 | 27631 | 27637 |
| Photo-conductive layer 2 | 27602 | 27608 | 27614 | 27620 | 27626 | 27632 | 27638 |
| Photo-conductive layer 3 | 27603 | 27609 | 27615 | 27621 | 27627 | 27633 | 27639 |
| Photo-conductive layer 4 | 27604 | 27610 | 27616 | 27622 | 27628 | 27634 | 27640 |
| Photo-conductive layer 5 | 27605 | 27611 | 27617 | 27623 | 27629 | 27635 | 27641 |
| Photo-conductive layer 6 | 27606 | 27612 | 27618 | 27624 | 27630 | 27636 | 27642 |

*surface layer B was used
markless case: surface layer A was used

TABLE 353

| Name of layer | | Gas used and its flow rate (SCCM) | | Substrate temperature (°C.) | RF power (W) | Inner pressure (Torr) | Layer thickness (μm) |
|---|---|---|---|---|---|---|---|
| Surface* layer A | Lower layer | $B_2H_6$/Ar (20%) | 500 | 250 | 200 | 0.35 | 0.3 |
| | | $NH_3$ | 100 | | | | |
| | | Bias voltage of the cylinder | −150 V | | | | |
| | | $SiH_4$ (against $B_2H_6 + NH_3$) | 100 ppm | | | | |
| | Upper layer | $B_2H_6$/He (20%) | 500 | 250 | 100 | 0.35 | 0.3 |
| | | $NH_3$ | 100 | | | | |
| | | Bias voltage of the cylinder | +100 V | | | | |
| | | $SiH_4$ (against $B_2H_6 + NH_3$) | 100 ppm | | | | |
| Surface* layer B | Lower layer | $B_2H_6$/Ar (20%) | 500 | 250 | 200 | 0.35 | 0.3 |
| | | $NH_3$ | 100 | | | | |
| | | Bias voltage of the cylinder | −150 V | | | | |
| | | $GeH_4$ (against $B_2H_6 + NH_3$) | 100 ppm | | | | |
| | Upper layer | $B_2H_6$/He (20%) | 500 | 250 | 100 | 0.35 | 0.3 |
| | | $NH_3$ | 100 | | | | |
| | | Bias voltage of the cylinder | +100 V | | | | |
| | | $GeH_4$ (against $B_2H_6 + NH_3$) | 100 ppm | | | | |

*each of the surface layers A and B is individually used in accordance with the kind of the lower layer

TABLE 354

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Photo-conductive layer 1 | 27701 | 27707 | 27713 | 27719 | 27725 | 27731 | 27737 |
| Photo-conductive layer 2 | 27702 | 27708 | 27714 | 27720 | 27726 | 27732 | 27738 |
| Photo-conductive layer 3 | 27703 | 27709 | 27715 | 27721 | 27727 | 27733 | 27739 |
| Photo-conductive layer 4 | 27704 | 27710 | 27716 | 27722 | 27728 | 27734 | 27740 |
| Photo-conductive layer 5 | 27705 | 27711 | 27717 | 27723 | 27729 | 27735 | 27741 |
| Photo-conductive layer 6 | 27706 | 27712 | 27718 | 27724 | 27730 | 27736 | 27742 |

*surface layer B was used
markless case: surface layer A was used

TABLE 355

| | Photo-conductive Layer 1 | Photo-conductive Layer 2 | Photo-conductive Layer 3 | Photo-conductive Layer 5 | Photo-conductive Layer 6 |
|---|---|---|---|---|---|
| Drum No. | 27801<br>27806* | 27802<br>27807* | 27803<br>27808* | 27804<br>27809* | 24805<br>27810* |

*Surface layer followed Table 334(b)
Markless case: followed Table 334(a)

TABLE 356

| | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| Drum No. | 27901<br>27907* | 27902<br>27908* | 27903<br>27909* | 27904<br>27910* | 27905<br>27911* | 27906<br>27912* |

*surface layer B was used.
*markless case: surface layer A was used.

TABLE 357

| | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| Drum No. | 28001<br>28007* | 28002<br>28008* | 28003<br>28009* | 28004<br>28010* | 28005<br>28011* | 28006<br>28012* |

*surface layer B was used.
markless case: surface layer A was used.

TABLE 358

| | Drum No. | |
|---|---|---|
| IR Absorptive Layer 1 | 28101 | 28120* |
| IR Absorptive Layer 2 | 28102 | 28121* |
| IR Absorptive Layer 3 | 28103 | 28122* |
| IR Absorptive Layer 4 | 28104 | 28123* |
| IR Absorptive Layer 5 | 28105 | 28124* |
| IR Absorptive Layer 6 | 28106 | — |
| IR Absorptive Layer 7 | 28107 | — |

TABLE 358-continued

| | Drum No. | |
|---|---|---|
| IR Absorptive Layer 8 | 28108 | — |
| IR Absorptive Layer 9 | 28109 | — |
| IR Absorptive Layer 10 | 28110 | — |
| IR Absorptive Layer 11 | 28111 | — |
| IR Absorptive Layer 12 | 28112 | — |
| IR Absorptive Layer 13 | 22813 | — |
| IR Absorptive Layer 14 | 28114 | — |
| IR Absorptive Layer 15 | 28115 | — |
| IR Absorptive Layer 17 | 28116 | — |
| IR Absorptive Layer 18 | 28117 | 28125* |
| IR Absorptive Layer 19 | 28118 | 28126* |
| IR Absorptive Layer 20 | 28119 | 28127* |

*: Surface layer followed Table 336(b)
Markless case: followed 336(a)

TABLE 359

| Drum No. | Photo-conductive layer 1 | Photo-conductive layer 2 | Photo-conductive layer 3 | Photo-conductive layer 5 | Photo-conductive layer 6 |
|---|---|---|---|---|---|
| IR absorptive layer 1 | 28201 | 28221 | 28241 | 28261 | 28281 |
| IR absorptive layer 2 | 28202 | 28222 | 28242 | 28262 | 28282 |
| IR absorptive layer 3 | 28203 | 28223 | 28243 | 28263 | 28283 |
| IR absorptive layer 4 | 28204 | 28224 | 28244 | 28264 | 28284 |
| IR absorptive layer 5 | 28205 | 28225 | 28245 | 28265 | 28285 |
| IR absorptive layer 6 | 28206 | 28226 | 28246 | 28266 | 28286 |
| IR absorptive layer 7 | 28207 | 28227 | 28247 | 28267 | 28287 |
| IR absorptive layer 8 | 28208 | 28228 | 28248 | 28268 | 28288 |
| IR absorptive layer 9 | 28209 | 28229 | 28249 | 28269 | 28289 |
| IR absorptive layer 10 | 28210 | 28230 | 28250 | 28270 | 28290 |
| IR absorptive layer 11* | 28211 | 28231 | 28251 | 28271 | 28291 |
| IR absorptive layer 12* | 28212 | 28232 | 28252 | 28272 | 28292 |
| IR absorptive layer 13* | 28213 | 28233 | 28253 | 28273 | 28293 |
| IR absorptive layer 14* | 28214 | 28234 | 28254 | 28274 | 28294 |
| IR absorptive layer 15* | 28215 | 28235 | 28255 | 28275 | 28295 |
| IR absorptive layer 16 | 28216 | 28036 | 28256 | 28276 | 28296 |
| IR absorptive layer 17* | 28217 | 28237 | 28257 | 28277 | 28297 |
| IR absorptive layer 18 | 28218 | 28238 | 28258 | 28278 | 28298 |
| IR absorptive layer 19 | 28219 | 28239 | 28259 | 28279 | 28299 |
| IR absorptive layer 20 | 28220 | 28240 | 28260 | 28280 | 282100 |

*: surface layer followed Table 336(b)
markless case: followed Table 336(a)

TABLE 360

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| IR absorptive layer 1 | 28301 | 28321 | 28341 | 28361 | 28381 | 283101 |
| IR absorptive layer 2 | 28302 | 28322 | 28342 | 28362 | 28382 | 283102 |
| IR absorptive layer 3 | 28303 | 28323 | 28343 | 28363 | 28383 | 283103 |
| IR absorptive layer 4 | 28304 | 28324 | 28344 | 28364 | 28384 | 283104 |
| IR absorptive layer 5 | 28305 | 28325 | 28345 | 28365 | 28385 | 283105 |
| IR absorptive layer 6 | 28306 | 28326 | 28346 | 28366 | 28386 | 283106 |
| IR absorptive layer 7 | 28307 | 28327 | 28347 | 28367 | 28387 | 283107 |
| IR absorptive layer 8 | 28308 | 28328 | 28348 | 28368 | 28388 | 283108 |
| IR absorptive layer 9 | 28309 | 29329 | 29349 | 29369 | 28389 | 283109 |
| IR absorptive layer 10 | 29310 | 28330 | 28350 | 28370 | 28390 | 283110 |
| IR absorptive layer 11* | 28311 | 28331 | 28351 | 28371 | 28391 | 283111 |
| IR absorptive layer 12* | 28312 | 28332 | 28352 | 28372 | 28392 | 283112 |
| IR absorptive layer 13* | 28313 | 28333 | 28353 | 28373 | 28393 | 283113 |
| IR absorptive layer 14* | 28314 | 28334 | 28354 | 28374 | 28394 | 283114 |
| IR absorptive layer 15* | 28315 | 28335 | 28355 | 28375 | 28395 | 283115 |

TABLE 360-continued

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| IR absorptive layer 16 | 28316 | 28336 | 28356 | 28376 | 28396 | 283116 |
| IR absorptive layer 17* | 28317 | 28337 | 28357 | 28377 | 28397 | 283117 |
| IR absorptive layer 18 | 28318 | 28338 | 28358 | 28378 | 28398 | 283118 |
| IR absorptive layer 19 | 28319 | 28339 | 28359 | 28379 | 28399 | 283119 |
| IR absorptive layer 20 | 28320 | 28340 | 28360 | 28380 | 283100 | 283120 |

*: surface layer B was used
markless case: surface layer A was used

TABLE 361

| Drum No. | Photo-conductive layer 1 | Photo-conductive layer 2 | Photo-conductive layer 3 | Photo-conductive layer 4 | Photo-conductive layer 5 | Photo-conductive layer 6 |
|---|---|---|---|---|---|---|
| IR absorptive layer 1 | 28401 | 28421 | 28441 | 28461 | 28481 | 284101 |
| IR absorptive layer 2 | 28402 | 28422 | 28442 | 28462 | 28482 | 284102 |
| IR absorptive layer 3 | 28403 | 28423 | 28443 | 28463 | 28483 | 284103 |
| IR absorptive layer 4 | 28404 | 28424 | 28444 | 28464 | 28484 | 284104 |
| IR absorptive layer 5 | 28405 | 28425 | 28445 | 28465 | 28485 | 284105 |
| IR absorptive layer 6 | 28406 | 28426 | 28446 | 28466 | 28486 | 284106 |
| IR absorptive layer 7 | 28407 | 28427 | 28447 | 28467 | 28487 | 284107 |
| IR absorptive layer 8 | 28408 | 28428 | 28448 | 28468 | 28488 | 284108 |
| IR absorptive layer 9 | 28409 | 29429 | 29449 | 29469 | 28489 | 284109 |
| IR absorptive layer 10 | 29410 | 28430 | 28450 | 28470 | 28490 | 284110 |
| IR absorptive layer 11* | 28411 | 28431 | 28451 | 28471 | 28491 | 284111 |
| IR absorptive layer 12* | 28412 | 28432 | 28452 | 28472 | 28492 | 284112 |
| IR absorptive layer 13* | 28413 | 28433 | 28453 | 28473 | 28493 | 284113 |
| IR absorptive layer 14* | 28414 | 28434 | 28454 | 28474 | 28494 | 284114 |
| IR absorptive layer 15* | 28415 | 28435 | 28455 | 28475 | 28495 | 284115 |
| IR absorptive layer 16 | 28416 | 28436 | 28456 | 28476 | 28496 | 284116 |
| IR absorptive layer 17* | 28417 | 28437 | 28457 | 28477 | 28497 | 284117 |
| IR absorptive layer 18 | 28418 | 28438 | 28458 | 28478 | 28498 | 284118 |
| IR absorptive layer 19 | 28419 | 28439 | 28459 | 28479 | 28499 | 284119 |
| IR absorptive layer 20 | 28420 | 28440 | 28460 | 28480 | 284100 | 284120 |

*: surface layer B was used
markless case: surface layer A was used

TABLE 362

| | Contact Layer 2 | Contact Layer 3 | Contact Layer 4 |
|---|---|---|---|
| Drum No. | 28501<br>28504* | 28502<br>28405* | 28503<br>28506* |

*Surface layer followed Table 338 (b)
Markless case: followed Table 338 (a)

TABLE 363

| Drum No. | Contact layer 1 | Contact layer 2 | Contact layer 3 | Contact layer 4 |
|---|---|---|---|---|
| Photo-conductive layer 1 | 28601 | 28607* | 28613 | 28619 |
| Photo-conductive layer 2 | 28602 | 28608 | 28614* | 28620 |
| Photo-conductive layer 3 | 28603* | 28609 | 28615 | 28621 |
| Photo-conductive layer 4 | 28604 | 28610 | 28616 | 28622* |

TABLE 363-continued

| Drum No. | Contact layer 1 | Contact layer 2 | Contact layer 3 | Contact layer 4 |
|---|---|---|---|---|
| Photo-conductive layer 5 | 28605 | 28611 | 28617* | 28623 |
| Photo-conductive layer 6 | 28606 | 28612* | 28618 | 28624 |

*surface layer followed Table 338 (b)
markless case: followed Table 338 (a)

TABLE 364

| Drum No. | Contact layer 1 | Contact layer 2 | Contact layer 3 | Contact layer 4 |
|---|---|---|---|---|
| Photo-conductive layer 1 | 28701 | 28707 | 28713* | 28719 |
| Photo-conductive layer 2 | 28702 | 28708* | 28714 | 28720 |
| Photo-conductive layer 3 | 28703 | 28709 | 28715 | 28721* |
| Photo-conductive layer 4 | 28704* | 28710 | 28716 | 28722 |
| Photo-conductive layer 5 | 28705 | 28711* | 28717 | 28723 |
| Photo-conductive layer 6 | 28706 | 28712 | 28718* | 28724 |

TABLE 365

| Drum No. | Contact layer 1 | Contact layer 2 | Contact layer 3 | Contact layer 4 |
|---|---|---|---|---|
| Photo-conductive layer 1 | 28801* | 28807 | 28813 | 28819 |
| Photo-conductive layer 2 | 28802 | 28808 | 28814* | 28820 |
| Photo-conductive layer 3 | 28803 | 28809 | 28815 | 28821* |
| Photo-conductive layer 4 | 28804 | 28810* | 28816 | 28822 |
| Photo-conductive layer 5 | 28805 | 28811 | 28817 | 28823* |
| Photo-conductive layer 6 | 28806* | 28812 | 28818 | 28824 |

*surface layer B was used
markless case: surface layer A was used

TABLE 366

| | Drum No. | |
|---|---|---|
| IR absorptive layer 1 | 28901 | 28921 * |
| IR absorptive layer 2 | 28902 | 28922 * |
| IR absorptive layer 3 | 28903 | 28923 * |
| IR absorptive layer 4 | 28904 | 28924 * |
| IR absorptive layer 5 | 28905 | 28925 * |
| IR absorptive layer 6 | 28906 | 28926 * |
| IR absorptive layer 7 | 28907 | 28927 * |
| IR absorptive layer 8 | 28908 | 28928 * |
| IR absorptive layer 9 | 28909 | 28929 * |
| IR absorptive layer 10 | 28910 | 28930 * |
| IR absorptive layer 11 | 28911 | 28931 * |
| IR absorptive layer 12 | 28912 | 28932 * |
| IR absorptive layer 13 | 28913 | 28933 * |
| IR absorptive layer 14 | 28914 | 28934 * |
| IR absorptive layer 15 | 28915 | 28935 * |
| IR absorptive layer 16 | 28916 | 28936 * |
| IR absorptive layer 17 | 28917 | 28937 * |
| IR absorptive layer 18 | 28918 | 28938 * |
| IR absorptive layer 19 | 28919 | 28939 * |
| IR absorptive layer 20 | 28920 | 28940 * |

*: Charge injection inhibition layer and surface layer followed Table 340(b)
markless case: followed Table 340(a)

TABLE 367

| Drum No. | Photo-conductive layer 4 | Photo-conductive layer 5* | Photo-conductive layer 7 |
|---|---|---|---|
| IR absorptive layer 1 | 29001 | 29021 | 29041 |
| IR absorptive layer 2 | 29002 | 29022 | 29042 |
| IR absorptive layer 3 | 29003 | 29023 | 29043 |
| IR absorptive layer 4 | 29004 | 29024 | 29044 |
| IR absorptive layer 5 | 29005 | 29025 | 29045 |
| IR absorptive layer 6 | 29006 | 29026 | 29046 |
| IR absorptive layer 7 | 29007 | 29027 | 29047 |
| IR absorptive layer 8 | 29008 | 29028 | 29048 |
| IR absorptive layer 9 | 29009 | 29029 | 29049 |
| IR absorptive layer 10 | 29010 | 29030 | 29050 |
| IR absorptive layer 11 | 29011 | 29031 | 29051 |
| IR absorptive layer 12 | 29012 | 29032 | 29052 |
| IR absorptive layer 13 | 29013 | 29033 | 29053 |
| IR absorptive layer 14 | 29014 | 29034 | 29054 |
| IR absorptive layer 15 | 29015 | 29035 | 29055 |
| IR absorptive layer 16 | 29016 | 29036 | 29056 |
| IR absorptive layer 17 | 29017 | 29037 | 29057 |
| IR absorptive layer 18 | 29018 | 29038 | 29058 |
| IR absorptive layer 19 | 29019 | 29039 | 29059 |
| IR absorptive layer 20 | 29020 | 29040 | 29060 |

*: surface layer followed Table 340(b)
markless case: followed Table 340(a)

TABLE 368

| Drum No. | Photo-conductive layer 1 | Photo-conductive layer 4 | Photo-conductive layer 5* | Photo-conductive layer 7 |
|---|---|---|---|---|
| IR absorptive layer 1 | 29101 | 29121 | 29141 | 29161 |
| IR absorptive layer 2 | 29102 | 29122 | 29142 | 29162 |
| IR absorptive layer 3 | 29103 | 29123 | 29143 | 29163 |
| IR absorptive layer 4 | 29104 | 29124 | 29144 | 29164 |
| IR absorptive layer 5 | 29105 | 29125 | 29145 | 29165 |
| IR absorptive layer 6 | 29106 | 29126 | 29146 | 29166 |
| IR absorptive layer 7 | 29107 | 29127 | 29147 | 29167 |
| IR absorptive layer 8 | 29108 | 29128 | 29148 | 29168 |
| IR absorptive layer 9 | 29109 | 29129 | 29149 | 29169 |
| IR absorptive layer 10 | 29110 | 29130 | 29150 | 29170 |
| IR absorptive layer 11 | 29111 | 29131 | 29151 | 29171 |
| IR absorptive layer 12 | 29112 | 29132 | 29152 | 29172 |
| IR absorptive layer 13 | 29113 | 29133 | 29153 | 29173 |
| IR absorptive layer 14 | 29114 | 29134 | 29154 | 29174 |
| IR absorptive layer 15 | 29115 | 29135 | 29155 | 29175 |
| IR absorptive layer 16 | 29116 | 29136 | 29156 | 29176 |
| IR absorptive layer 17 | 29117 | 29137 | 29157 | 29177 |
| IR absorptive layer 18 | 29118 | 29138 | 29158 | 29178 |
| IR absorptive layer 19 | 29119 | 29139 | 29159 | 29179 |
| IR absorptive layer 20 | 29120 | 29140 | 29160 | 29180 |

*: surface layer B was used
markless case: surface layer A was used

TABLE 369

| Drum No. | Photo-conductive layer 1 | Photo-conductive layer 4 | Photo-conductive layer 5* | Photo-conductive layer 7 |
|---|---|---|---|---|
| IR absorptive layer 1 | 29201 | 29221 | 29241 | 29261 |
| IR absorptive layer 2 | 29202 | 29222 | 29242 | 29262 |
| IR absorptive layer 3 | 29203 | 29223 | 29243 | 29263 |
| IR absorptive layer 4 | 29204 | 29224 | 29244 | 29264 |
| IR absorptive layer 5 | 29205 | 29225 | 29245 | 29265 |
| IR absorptive layer 6 | 29206 | 29226 | 29246 | 29266 |
| IR absorptive layer 7 | 29207 | 29227 | 29247 | 29267 |
| IR absorptive layer 8 | 29208 | 29228 | 29248 | 29268 |
| IR absorptive layer 9 | 29209 | 29229 | 29249 | 29269 |
| IR absorptive layer 10 | 29210 | 29230 | 29250 | 29270 |
| IR absorptive layer 11 | 29211 | 29231 | 29251 | 29271 |
| IR absorptive layer 12 | 29212 | 29232 | 29252 | 29272 |
| IR absorptive layer 13 | 29213 | 29233 | 29253 | 29273 |
| IR absorptive layer 14 | 29214 | 29234 | 29254 | 29274 |
| IR absorptive layer 15 | 29215 | 29235 | 29255 | 29275 |
| IR absorptive layer 16 | 29216 | 29236 | 29256 | 29276 |
| IR absorptive layer 17 | 29217 | 29237 | 29257 | 29277 |
| IR absorptive layer 18 | 29218 | 29238 | 29258 | 29278 |
| IR absorptive layer 19 | 29219 | 29239 | 29259 | 29279 |
| IR absorptive layer 20 | 29220 | 29240 | 29260 | 29280 |

*: surface layer B was used
markless case: surface layer A was used

TABLE 370

| | Contact Layer 1 | Contact Layer 2 | Contact Layer 3 | Contact Layer 4 | Contact Layer 6 | Contact Layer 7 | Contact Layer 8 |
|---|---|---|---|---|---|---|---|
| Drum | 29301 | 29302 | 29303 | 29304 | 29305 | 29306 | 29307 |
| No. | 29308* | 29309* | 29310* | 29311* | 29312* | 29313* | 29314* |

*Charge injection inhibition layer andsurface layer followed Table 342 (b)
Markless case: followed Table 342 (a)

TABLE 371

| Drum No. | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|
| Contact layer 1 | 29401 | 29409 | 29417 | 29425 | 29433 | 29441 |
| Contact layer 2 | 29402 | 29410 | 29418 | 29426 | 29434 | 29442 |
| Contact layer 3 | 29403 | 29411 | 29419 | 29427 | 29435 | 29443 |
| Contact layer 4 | 29404 | 29412 | 29420 | 29428 | 29436 | 29444 |
| Contact layer 5 | 29405 | 29413 | 29421 | 29429 | 29437 | 29445 |
| Contact layer 6 | 29406 | 29414 | 29422 | 29430 | 29438 | 29446 |
| Contact layer 7 | 29407 | 29415 | 29423 | 29431 | 29439 | 29447 |
| Contact | 29408 | 29416 | 29424 | 29432 | 29440 | 29448 |

TABLE 371-continued

| Drum No. | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|
| layer 8 | | | | | | |

*surface layer followed Table 342 (b)
markless case: followed Table 342 (a)

TABLE 372

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Contact layer 1 | 29501 | 29509 | 29517 | 29525 | 29533 | 29541 | 29549 |
| Contact layer 2 | 29502 | 29510 | 29518 | 29526 | 29534 | 29542 | 29550 |
| Contact layer 3 | 29503 | 29511 | 29519 | 29527 | 29535 | 29543 | 29551 |
| Contact layer 4 | 29504 | 29512 | 29520 | 29528 | 29536 | 29544 | 29552 |
| Contact layer 5 | 29505 | 29513 | 29521 | 29529 | 29537 | 29545 | 29553 |
| Contact layer 6 | 29506 | 29514 | 29522 | 29530 | 29538 | 29546 | 29554 |
| Contact layer 7 | 29507 | 29515 | 29523 | 29531 | 29539 | 29547 | 29555 |
| Contact layer 8 | 29508 | 29516 | 29524 | 29532 | 29540 | 29548 | 29556 |

*surface layer B was used
markless case: surface layer A was used

TABLE 373

| Drum No. | Charge injection inhibition layer 1 | Charge injection inhibition layer 2 | Charge injection inhibition layer 3 | Charge injection inhibition layer 4 | Charge injection inhibition layer 5* | Charge injection inhibition layer 6* | Charge injection inhibition layer 7 |
|---|---|---|---|---|---|---|---|
| Contact layer 1 | 29601 | 29609 | 29617 | 29625 | 29633 | 29641 | 29649 |
| Contact layer 2 | 29602 | 29610 | 29618 | 29626 | 29634 | 29642 | 29650 |
| Contact layer 3 | 29603 | 29611 | 29619 | 29627 | 29635 | 29643 | 29651 |
| Contact layer 4 | 29604 | 29612 | 29620 | 29628 | 29636 | 29644 | 29652 |
| Contact layer 5 | 29605 | 29613 | 29621 | 29629 | 29637 | 29645 | 29653 |
| Contact layer 6 | 29606 | 29614 | 29622 | 29630 | 29638 | 29646 | 29654 |
| Contact layer 7 | 29607 | 29615 | 29623 | 29631 | 29639 | 29647 | 29655 |
| Contact layer 8 | 29608 | 29616 | 29624 | 29632 | 29640 | 29648 | 29656 |

*surface layer B was used
markless case: surface layer A was used

TABLE 374

| | Charge injection inhibition layer 4 | Charge injection inhibition layer 6* | Charge injection inhibition layer 7 |
|---|---|---|---|
| Drum No. | 29701 | 29702 | 29703 |

*surface layer followed Table 18 (b)
markless case: followed Table 18 (a)

TABLE 375

| Drum No. | Charge injection inhibition layer 1 | Charge injection inhibition layer 4 | Charge injection inhibition layer 6* | Charge injection inhibition layer 7 |
|---|---|---|---|---|
| Photo-conductive | 29801 | 29803 | 29805 | 29807 |

TABLE 375-continued

| Drum No. | Charge injection inhibition layer 1 | Charge injection inhibition layer 4 | Charge injection inhibition layer 6* | Charge injection inhibition layer 7 |
|---|---|---|---|---|
| layer 5 | | | | |
| Photo-conductive layer 6 | 29802 | 29804 | 29806 | 29808 |

*surface layer followed Table 18 (b)
markless case: followed Table 18 (a)

TABLE 376

| Drum No. | Charge injection inhibition layer 1 | Charge injection inhibition layer 4 | Charge injection inhibition layer 6* | Charge injection inhibition layer 7 |
|---|---|---|---|---|
| Photo-conductive layer 4 | 29901 | 29904 | 29907 | 29910 |
| Photo-conductive layer 5 | 29902 | 29905 | 29908 | 29911 |
| Photo-conductive layer 6 | 29903 | 29906 | 29909 | 29912 |

*surface layer B was used
markless case: surface layer A was used

TABLE 377

| Drum No. | Charge injection inhibition layer 1 | Charge injection inhibition layer 4 | Charge injection inhibition layer 6* | Charge injection inhibition layer 7 |
|---|---|---|---|---|
| Photo-conductive layer 4 | 30001 | 30004 | 30007 | 30010 |
| Photo-conductive layer 5 | 30002 | 30005 | 30008 | 30011 |
| Photo-conductive layer 6 | 30003 | 30006 | 30009 | 30012 |

*surface layer B was used
markless case: surface layer A was used

TABLE 378

| Name of layer | | Gas used and its flow rate (SCCM) | | Substrate temperature (°C.) | RF power (W) | Inner pressure (Torr) | Layer thickness (μm) |
|---|---|---|---|---|---|---|---|
| Surface* layer A | Lower layer | $B_2H_6$/Ar (20%) | 500 | 250 | 200 | 0.35 | 0.3 |
| | | $NH_3$ | 100 | | | | |
| | | $SiH_4$(against $B_2H_6 + NH_3$) | 100 ppm | | | | |
| | Upper layer | $B_2H_6$/He (20%) | 500 | 250 | 100 | 0.35 | 0.3 |
| | | $NH_3$ | 300 | | | | |
| | | $SiH_4$(against $B_2H_6 + NH_3$) | 100 ppm | | | | |
| Surface* layer B | Lower layer | $B_2H_6$/Ar (20%) | 500 | 250 | 200 | 0.35 | 0.3 |
| | | $NH_3$ | 100 | | | | |
| | | $GeH_4$(against $B_2H_6 + NH_3$) | 100 ppm | | | | |
| | Upper layer | $B_2H_6$/He (20%) | 500 | 250 | 100 | 0.35 | 0.3 |
| | | $NH_3$ | 100 | | | | |
| | | $GeH_4$(against $B_2H_6 + NH_3$) | 100 ppm | | | | |

*each of the surface layers A and B is individually used in accordance with the kind of the lower layer

TABLE 379

| Drum No. | Photo-conductive layer 1 | Photo-conductive layer 4 | Photo-conductive layer 5* | Photo-conductive layer 7 |
|---|---|---|---|---|
| IR absorptive layer 1 | 30101 | 30121 | 30141 | 30161 |
| IR absorptive layer 2 | 30102 | 30122 | 30142 | 30162 |
| IR absorptive layer 3 | 30103 | 30123 | 30143 | 30163 |
| IR absorptive layer 4 | 30104 | 30124 | 30144 | 30164 |
| IR absorptive layer 5 | 30105 | 30125 | 30145 | 30165 |
| IR absorptive layer 6 | 30106 | 30126 | 30146 | 30166 |
| IR absorptive layer 7 | 30107 | 30127 | 30147 | 30167 |
| IR absorptive layer 8 | 30108 | 30128 | 30148 | 30168 |
| IR absorptive layer 9 | 30109 | 30129 | 30149 | 30169 |
| IR absorptive layer 10 | 30110 | 30130 | 30150 | 30170 |

TABLE 379-continued

| Drum No. | Photo-conductive layer 1 | Photo-conductive layer 4 | Photo-conductive layer 5* | Photo-conductive layer 7 |
|---|---|---|---|---|
| IR absorptive layer 11 | 30111 | 30131 | 30151 | 30171 |
| IR absorptive layer 12 | 30112 | 30132 | 30152 | 30172 |
| IR absorptive layer 13 | 30113 | 30133 | 30153 | 30173 |
| IR absorptive layer 14 | 30114 | 30134 | 30154 | 30174 |
| IR absorptive layer 15 | 30115 | 30135 | 30155 | 30175 |
| IR absorptive layer 16 | 30116 | 30136 | 30156 | 30176 |
| IR absorptive layer 17 | 30117 | 30137 | 30157 | 30177 |
| IR absorptive layer 18 | 30118 | 30138 | 30158 | 30178 |
| IR absorptive layer 19 | 30119 | 30139 | 30159 | 30179 |
| IR absorptive layer 20 | 30120 | 30140 | 30160 | 30180 |

*: surface layer B was used
markless case: surface layer A was used

TABLE 380

| Drum No. | Photo-conductive layer 1 | Photo-conductive layer 4 | Photo-conductive layer 5* | Photo-conductive layer 7 |
|---|---|---|---|---|
| IR absorptive layer 1 | 30201 | 30221 | 30241 | 30261 |
| IR absorptive layer 2 | 30202 | 30222 | 30242 | 30262 |
| IR absorptive layer 3 | 30203 | 30223 | 30243 | 30263 |
| IR absorptive layer 4 | 30204 | 30224 | 30244 | 30264 |
| IR absorptive layer 5 | 30205 | 30225 | 30245 | 30265 |
| IR absorptive layer 6 | 30206 | 30226 | 30246 | 30266 |
| IR absorptive layer 7 | 30207 | 30227 | 30247 | 30267 |
| IR absorptive layer 8 | 30208 | 30228 | 30248 | 30268 |
| IR absorptive layer 9 | 30209 | 30229 | 30249 | 30269 |
| IR absorptive layer 10 | 30210 | 30230 | 30250 | 30270 |
| IR absorptive layer 11 | 30211 | 30231 | 30251 | 30271 |
| IR absorptive layer 12 | 30212 | 30232 | 30252 | 30272 |
| IR absorptive layer 13 | 30213 | 30233 | 30253 | 30273 |
| IR absorptive layer 14 | 30214 | 30234 | 30254 | 30274 |
| IR absorptive | 30215 | 30235 | 30255 | 30275 |

TABLE 380-continued

| Drum No. | Photo-conductive layer 1 | Photo-conductive layer 4 | Photo-conductive layer 5* | Photo-conductive layer 7 |
|---|---|---|---|---|
| layer 15 | | | | |
| IR absorptive layer 16 | 30216 | 30236 | 30256 | 30276 |
| IR absorptive layer 17 | 30217 | 30237 | 30257 | 30277 |
| IR absorptive layer 18 | 30218 | 30238 | 30258 | 30278 |
| IR absorptive layer 19 | 30219 | 30239 | 30259 | 30279 |
| IR absorptive layer 20 | 30220 | 30240 | 30260 | 30280 |

*: surface layer B was used
markless case: surface layer A was used

TABLE 381

| Drum No. | Photo-conductive layer 1 | Photo-conductive layer 4 | Photo-conductive layer 5* | Photo-conductive layer 7 |
|---|---|---|---|---|
| IR absorptive layer 1 | 30301 | 30321 | 30341 | 30361 |
| IR absorptive layer 2 | 30302 | 30322 | 30342 | 30362 |
| IR absorptive layer 3 | 30303 | 30323 | 30343 | 30363 |
| IR absorptive layer 4 | 30304 | 30324 | 30344 | 30364 |
| IR absorptive layer 5 | 30305 | 30325 | 30345 | 30365 |
| IR absorptive layer 6 | 30306 | 30326 | 30346 | 30366 |
| IR absorptive layer 7 | 30307 | 30327 | 30347 | 30367 |
| IR absorptive layer 8 | 30308 | 30328 | 30348 | 30368 |
| IR absorptive layer 9 | 30309 | 30329 | 30349 | 30369 |
| IR absorptive layer 10 | 30310 | 30330 | 30350 | 30370 |
| IR absorptive layer 11 | 30311 | 30331 | 30351 | 30371 |
| IR absorptive layer 12 | 30312 | 30332 | 30352 | 30372 |
| IR absorptive layer 13 | 30313 | 30333 | 30353 | 30373 |
| IR absorptive layer 14 | 30314 | 30334 | 30354 | 30374 |
| IR absorptive layer 15 | 30315 | 30335 | 30355 | 30375 |
| IR absorptive layer 16 | 30316 | 30336 | 30356 | 30376 |
| IR absorptive layer 17 | 30317 | 30337 | 30357 | 30377 |
| IR absorptive layer 18 | 30318 | 30338 | 30358 | 30378 |
| IR absorptive layer 19 | 30319 | 30339 | 30359 | 30379 |
| IR absorptive layer 20 | 30320 | 30340 | 30360 | 30380 |

*: surface layer B was used
markless case: surface layer A was used

TABLE 382

| Drum No. | Photo-conductive layer 1 | Photo-conductive layer 4 | Photo-conductive layer 5* | Photo-conductive layer 7 |
|---|---|---|---|---|
| IR absorptive layer 1 | 30401 | 30421 | 30441 | 30461 |
| IR absorptive layer 2 | 30402 | 30422 | 30442 | 30462 |
| IR absorptive layer 3 | 30403 | 30423 | 30443 | 30463 |
| IR absorptive layer 4 | 30404 | 30424 | 30444 | 30464 |
| IR absorptive | 30405 | 30425 | 30445 | 30465 |

TABLE 382-continued

| Drum No. | Photo-conductive layer 1 | Photo-conductive layer 4 | Photo-conductive layer 5* | Photo-conductive layer 7 |
|---|---|---|---|---|
| layer 5 | | | | |
| IR absorptive layer 6 | 30406 | 30426 | 30446 | 30466 |
| IR absorptive layer 7 | 30407 | 30427 | 30447 | 30467 |
| IR absorptive layer 8 | 30408 | 30428 | 30448 | 30468 |
| IR absorptive layer 9 | 30409 | 30429 | 30449 | 30469 |
| IR absorptive layer 10 | 30410 | 30430 | 30450 | 30470 |
| IR absorptive layer 11 | 30411 | 30431 | 30451 | 30471 |
| IR absorptive layer 12 | 30412 | 30432 | 30452 | 30472 |
| IR absorptive layer 13 | 30413 | 30433 | 30453 | 30473 |
| IR absorptive layer 14 | 30414 | 30434 | 30454 | 30474 |
| IR absorptive layer 15 | 30415 | 30435 | 30455 | 30475 |
| IR absorptive layer 16 | 30416 | 30436 | 30456 | 30476 |
| IR absorptive layer 17 | 30417 | 30437 | 30457 | 30477 |
| IR absorptive layer 18 | 30418 | 30438 | 30458 | 30478 |
| IR absorptive layer 19 | 30419 | 30439 | 30459 | 30479 |
| IR absorptive layer 20 | 30420 | 30440 | 30460 | 30480 |

*: surface layer B was used
markless case: surface layer A was used

TABLE 383

| Drum No. | Photo-conductive layer 1 | Photo-conductive layer 4 | Photo-conductive layer 5* | Photo-conductive layer 7 |
|---|---|---|---|---|
| IR absorptive layer 1 | 30501 | 30521 | 30541 | 30561 |
| IR absorptive layer 2 | 30502 | 30522 | 30542 | 30562 |
| IR absorptive layer 3 | 30503 | 30523 | 30543 | 30563 |
| IR absorptive layer 4 | 30504 | 30524 | 30544 | 30564 |
| IR absorptive layer 5 | 30505 | 30525 | 30545 | 30565 |
| IR absorptive layer 6 | 30506 | 30526 | 30546 | 30566 |
| IR absorptive layer 7 | 30507 | 30527 | 30547 | 30567 |
| IR absorptive layer 8 | 30508 | 30528 | 30548 | 30568 |
| IR absorptive layer 9 | 30509 | 30529 | 30549 | 30569 |
| IR absorptive layer 10 | 30510 | 30530 | 30550 | 30570 |
| IR absorptive layer 11 | 30511 | 30531 | 30551 | 30571 |
| IR absorptive layer 12 | 30512 | 30532 | 30552 | 30572 |
| IR absorptive layer 13 | 30513 | 30533 | 30553 | 30573 |
| IR absorptive layer 14 | 30514 | 30534 | 30554 | 30574 |
| IR absorptive layer 15 | 30515 | 30535 | 30555 | 30575 |
| IR absorptive layer 16 | 30516 | 30536 | 30556 | 30576 |
| IR absorptive layer 17 | 30517 | 30537 | 30557 | 30577 |
| IR absorptive layer 18 | 30518 | 30538 | 30558 | 30578 |
| IR absorptive layer 19 | 30519 | 30539 | 30559 | 30579 |

TABLE 383-continued

| Drum No. | Photo-conductive layer 1 | Photo-conductive layer 4 | Photo-conductive layer 5* | Photo-conductive layer 7 |
|---|---|---|---|---|
| IR absorptive layer 20 | 30520 | 30540 | 30560 | 30580 |

*: surface layer B was used
markless case: surface layer A was used

TABLE 384

| Drum No. | Photo-conductive layer 1 | Photo-conductive layer 4 | Photo-conductive layer 5* | Photo-conductive layer 7 |
|---|---|---|---|---|
| IR absorptive layer 1 | 30601 | 30621 | 30641 | 30661 |
| IR absorptive layer 2 | 30602 | 30622 | 30642 | 30662 |
| IR absorptive layer 3 | 30603 | 30623 | 30643 | 30663 |
| IR absorptive layer 4 | 30604 | 30624 | 30644 | 30664 |
| IR absorptive layer 5 | 30605 | 30625 | 30645 | 30665 |
| IR absorptive layer 6 | 30606 | 30626 | 30646 | 30666 |
| IR absorptive layer 7 | 30607 | 30627 | 30647 | 30667 |
| IR absorptive layer 8 | 30608 | 30628 | 30648 | 30668 |

TABLE 384-continued

| Drum No. | Photo-conductive layer 1 | Photo-conductive layer 4 | Photo-conductive layer 5* | Photo-conductive layer 7 |
|---|---|---|---|---|
| IR absorptive layer 9 | 30609 | 30629 | 30649 | 30669 |
| IR absorptive layer 10 | 30610 | 30630 | 30650 | 30670 |
| IR absorptive layer 11 | 30611 | 30631 | 30651 | 30671 |
| IR absorptive layer 12 | 30612 | 30632 | 30652 | 30672 |
| IR absorptive layer 13 | 30613 | 30633 | 30653 | 30673 |
| IR absorptive layer 14 | 30614 | 30634 | 30654 | 30674 |
| IR absorptive layer 15 | 30615 | 30635 | 30655 | 30675 |
| IR absorptive layer 16 | 30616 | 30636 | 30656 | 30676 |
| IR absorptive layer 17 | 30617 | 30637 | 30657 | 30677 |
| IR absorptive layer 18 | 30618 | 30638 | 30658 | 30678 |
| IR absorptive layer 19 | 30619 | 30639 | 30659 | 30679 |
| IR absorptive layer 20 | 30620 | 30640 | 30660 | 30680 |

*: surface layer B was used
markless case: surface layer A was used

TABLE 385

| Drum No. | | Gas used and its flow rate (SCCM) | | Substrate temperature (°C.) | RF power (W) | Inner pressure (Torr) | Layer thickness (μm) |
|---|---|---|---|---|---|---|---|
| 30701 | Lower layer | $B_2H_6$/Ar (20%) | 500 | 250 | 200 | 0.35 | 0.3 |
| | | $SiH_4$(against $B_2H_6 + NH_3$) | 100 ppm | | | | |
| | | $NH_3$ | 100 | | | | |
| | Upper layer | $B_2H_6$/He (20%) | 500 | 250 | 100 | 0.35 | 0.3 |
| | | $SiH_4$(against $B_2H_6 + NH_3$) | 100 ppm | | | | |
| | | $NH_3$ | 100 | | | | |
| 30702 | Lower layer | $B_2H_6$/Ar (20%) | 500 | 250 | 200 | 0.40 | 0.3 |
| | | $H_2$ | 100 | | | | |
| | | $SiH_4$(against $B_2H_6 + NH_3$) | 50 ppm | | | | |
| | | $NH_3$ | 100 | | | | |
| | Upper layer | $B_2H_6$/He (20%) | 500 | 250 | 100 | 0.40 | 0.3 |
| | | $H_2$ | 100 | | | | |
| | | $SiH_4$(against $B_2H_6 + NH_3$) | 50 ppm | | | | |
| | | $NH_3$ | 300 | | | | |
| 30703 | Lower layer | $B_2H_6$/Ar (20%) | 500 | 250 | 200 | 0.35 | 0.3 |
| | | $SiH_4$(against $B_2H_6 + NH_3$) | 100 ppm | | | | |
| | | $NH_3$ | 100 | | | | |
| | | Bias voltage of the cylinder | −150 V | | | | |
| | Upper layer | $B_2H_6$/He (20%) | 500 | 250 | 100 | 0.35 | 0.3 |
| | | $SiH_4$(against $B_2H_6 + NH_3$) | 100 ppm | | | | |
| | | $NH_3$ | 100 | | | | |
| | | Bias voltage of the cylinder | +100 V | | | | |

TABLE 386

| Drum No. | | Gas used and its flow rate (SCCM) | | Substrate temperature (°C.) | RF power (W) | Inner pressure (Torr) | Layer thickness (μm) |
|---|---|---|---|---|---|---|---|
| 30801 | Lower layer | $B_2H_6$/Ar (20%) | 500 | 250 | 200 | 0.35 | 0.3 |
| | | $SiH_4$(against $B_2H_6 + NH_3$) | 100 ppm | | | | |
| | | $NH_3$ | 100 | | | | |
| | Upper layer | $B_2H_6$/He (20%) | 500 | 250 | 100 | 0.35 | 0.3 |
| | | $SiH_4$(against $B_2H_6 + NH_3$) | 100 ppm | | | | |
| | | $NH_3$ | 100 | | | | |
| 30802 | Lower layer | $B_2H_6$/Ar (20%) | 500 | 250 | 200 | 0.40 | 0.3 |
| | | $H_2$ | 100 | | | | |
| | | $SiH_4$(against $B_2H_6 + NH_3$) | 50 ppm | | | | |
| | | $NH_3$ | 100 | | | | |
| | Upper layer | $B_2H_6$/He (20%) | 500 | 250 | 100 | 0.40 | 0.3 |
| | | $H_2$ | 100 | | | | |
| | | $SiH_4$(against $B_2H_6 + NH_3$) | 50 ppm | | | | |
| | | $NH_3$ | 300 | | | | |

TABLE 386-continued

| Drum No. | | Gas used and its flow rate (SCCM) | | Substrate temperature (°C.) | RF power (W) | Inner pressure (Torr) | Layer thickness (μm) |
|---|---|---|---|---|---|---|---|
| 30803 | Lower layer | $B_2H_6$/Ar (20%) | 500 | 250 | 200 | 0.35 | 0.3 |
| | | $SiH_4$(against $B_2H_6$ + $NH_3$) | 100 ppm | | | | |
| | | $NH_3$ | 100 | | | | |
| | | Bias voltage of the cylinder | −150 V | | | | |
| | Upper layer | $B_2H_6$/He (20%) | 500 | 250 | 100 | 0.35 | 0.3 |
| | | $SiH_4$(against $B_2H_6$ + $NH_3$) | 100 ppm | | | | |
| | | $NH_3$ | 100 | | | | |
| | | Bias voltage of the cylinder | +100 V | | | | |

TABLE 387

| Drum No. | | Gas used and its flow rate (SCCM) | | Substrate temperature (°C.) | RF power (W) | Inner pressure (Torr) | Layer thickness (μm) |
|---|---|---|---|---|---|---|---|
| 30901 | Lower layer | $B_2H_6$/Ar (20%) | 500 | 250 | 200 | 0.35 | 0.3 |
| | | $SiH_4$(against $B_2H_6$ + $NH_3$) | 100 ppm | | | | |
| | | $NH_3$ | 100 | | | | |
| | Upper layer | $B_2H_6$/He (20%) | 500 | 250 | 100 | 0.35 | 0.3 |
| | | $SiH_4$(against $B_2H_6$ + $NH_3$) | 100 ppm | | | | |
| | | $NH_3$ | 100 | | | | |
| 30902 | Lower layer | $B_2H_6$/Ar (20%) | 500 | 250 | 200 | 0.40 | 0.3 |
| | | $H_2$ | 100 | | | | |
| | | $SiH_4$(against $B_2H_6$ + $NH_3$) | 50 ppm | | | | |
| | | $NH_3$ | 100 | | | | |
| | Upper layer | $B_2H_6$/He (20%) | 500 | 250 | 100 | 0.40 | 0.3 |
| | | $H_2$ | 100 | | | | |
| | | $SiH_4$(against $B_2H_6$ + $NH_3$) | 50 ppm | | | | |
| | | $NH_3$ | 300 | | | | |
| 30903 | Lower layer | $B_2H_6$/Ar (20%) | 500 | 250 | 200 | 0.35 | 0.3 |
| | | $SiH_4$(against $B_2H_6$ + $NH_3$) | 100 ppm | | | | |
| | | $NH_3$ | 100 | | | | |
| | | Bias voltage of the cylinder | −150 V | | | | |
| | Upper layer | $B_2H_6$/He (20%) 500 | 250 | 100 | 0.35 | 0.3 | |
| | | $SiH_4$(against $B_2H_6$ + $NH_3$) | 100 ppm | | | | |
| | | $NH_3$ | 100 | | | | |
| | | Bias voltage of the cylinder | +100 V | | | | |

TABLE 388

| Name of layer | Gas used and its flow rate (SCCM) | | Substrate temperature (°C.) | RF power (W) | Inner pressure (Torr) | Layer thickness (μm) |
|---|---|---|---|---|---|---|
| Charge injection inhibition layer | $SiH_4$ | 100 | 250 | 150 | 0.35 | 3 |
| | $H_2$ | 100 | | | | |
| | $B_2H_6$ (against $SiH_4$) | 1000 ppm | | | | |
| | NO | 10 | | | | |
| Photo-conductive layer | $SiH_4$ | 200 | 250 | 300 | 0.40 | 20 |
| | $H_2$ | 200 | | | | |
| Inter-mediate layer | $SiH_4$ | 10 | 250 | 150 | 0.35 | 0.3 |
| | $CH_4$ | 400 | | | | |
| Surface layer (lower layer) | $B_2H_6$/Ar (20%) | 500 | 250 | 200 | 0.35 | 0.3 |
| | $NH_3$ | 100 | | | | |
| | $SiH_4$ (against $B_2H_6$ + $NH_3$) | 100 ppm | | | | |
| Surface layer (upper layer) | $B_2H_6$/He (20%) | 500 | 250 | 100 | 0.35 | 0.3 |
| | $NH_3$ | 100 | | | | |
| | $SiH_4$ (against $B_2H_6$ + $NH_3$) | 100 ppm | | | | |

What we claim is:

1. An improved light receiving member for use in electrophotography comprising a substrate and a light receiving layer having at least a 3 to 100 μm thick photoconductive layer comprising an amorphous material containing silicon atoms as the matrix and at least one kind of atom selected from the group consisting of hydrogen and halogen in a total amount of 1 to 40 atomic % and a 0.003 to 30 μm thick surface layer being disposed in this order from the side of the substrate, characterized in that said surface layer comprises a non-single-crystal material consisting essentially of tetrahedrally bonded boron nitride and at least one kind of atom selected from the group consisting of hydrogen and halogen.

2. The light receiving member according to claim 1, wherein the surface layer contains a p-type dopant selected from the group consisting of Ge, Zn and a mixture thereof in an amount of less than $1\times10^3$ atomic ppm.

3. The light receiving member according to claim 1, wherein the surface layer contains an n-type dopant selected from the group consisting of Si, Sn and a mixture thereof in an amount of less than $1\times10^3$ atomic ppm.

4. The light receiving member according to claim 1, wherein the light receiving layer further contains one or more constituent layers.

5. The light receiving member according to claim 4, wherein the light receiving layer contains a charge injection inhibition layer comprising a non-single-crystal material containing silicon atoms as the matrix, at least one kind of atom selected from group consisting of hydrogen and halogen, and an element selected from the group consisting of Group III and V elements of the Periodic Table.

6. The light receiving member according to claim 4, wherein the light receiving layer contains a long wavelength light absorptive layer comprising a non-single-crystal material containing silicon atoms as the matrix, at least one kind of atom selected from the group consisting of germanium and tin, and at least one kind of atom selected from the group consisting of hydrogen and halogen.

7. The light receiving member according to claim 4, wherein the light receiving layer contains an adhesiveness enhancing contact layer between the photoconductive layer and the substrate or between the photoconductive layer and the layer thereunder, which comprises a non-single-crystal material containing silicon atoms as the matrix, at least one kind of atom selected from the group consisting of oxygen, carbon and nitrogen, and at least one kind of atom selected from the group consisting of hydrogen and halogen.

8. The light receiving member according to claim 4, wherein the light receiving layer contains an intermediate layer between the photoconductive layer and the surface layer, which comprises a non-single-crystal material containing silicon atoms as the matrix, carbon atoms and at least one kind of atom selected from the group consisting of hydrogen and halogen.

9. An improved light receiving member for use in electrophotography comprising a substrate and a light receiving layer having at least a 3 to 100 μm thick photoconductive layer comprising an amorphous material containing silicon atoms as the matrix and at least one kind of atom selected from the group consisting of hydrogen and halogen in a total amount of 1 to 40 atomic % and a 0.003 to 30 μm thick surface layer being disposed in this order from the side of the substrate, characterized in that said surface layer comprises a non-single-crystal material containing tetrahedrally bonded boron nitride and trihedrally bonded boron nitride in mingled state wherein the weight ratio of tetrahedrally bonded boron nitride to trihedrally bonded boron nitride is at least about 1:1 and at least one kind of atom selected from the group consisting of hydrogen and halogen.

10. The light receiving member according to claim 9, wherein the surface layer contains a p-type dopant selected from the group consisting of Ge, Zn and a mixture thereof in an amount of less than $1\times10^3$ atomic ppm.

11. The light receiving member according to claim 9, wherein the surface layer contains an n-type dopant selected from the group consisting of Si, Sn and a mixture thereof in an amount of less than $1\times10^3$ atomic ppm.

12. The light receiving member according to claim 9, wherein the light receiving layer further contains one or more constituent layers.

13. The light receiving member according to claim 12, wherein the light receiving layer contains a charge injection inhibition layer comprising a non-single-crystal material containing silicon atoms as the matrix, at least one kind of atom selected from the group consisting of hydrogen and halogen, and an element selected from the group consisting of Group III and V elements of the Periodic Table.

14. The light receiving member according to claim 12, wherein the light receiving layer contains a long wavelength light absorptive layer comprising a non-single-crystal material containing silicon atoms as the matrix, at least one kind of atom selected from the group consisting of germanium and tin, and at least one kind of atom selected from the group consisting of hydrogen and halogen.

15. The light receiving member according to claim 12, wherein the light receiving layer contains an adhesiveness enhancing contact layer between the photoconductive layer and the substrate or between the photoconductive layer and the layer thereunder, which comprises a non-single-crystal material containing silicon atoms as the matrix, at least one kind of atom selected from the group consisting of oxygen, carbon and nitrogen, and at least one kind of atom selected from the group consisting of hydrogen and halogen.

16. The light receiving member according to claim 12, wherein the light receiving layer contains an intermediate layer between the photoconductive layer and the surface layer, which comprises a non-single-crystal material containing silicon atoms as the matrix, carbon atoms and at least one kind of atom selected from the group consisting of hydrogen and halogen.

17. An improved light receiving member for use in electrophotography comprising a substrate and a light receiving layer having at least a 3 to 100 μm thick photoconductive layer comprising an amorphous material containing silicon atoms as the matrix and at least one kind of atom selected from the group consisting of hydrogen and halogen in a total amount of 1 to 40 atomic % and a 0.003 to 30 μm thick surface layer being disposed in this order from the side of the substrate, characterized in that said surface layer is constituted by a lower layer and an upper layer: said lower layer comprising a non-single-crystal material containing tetrahedrally bonded boron nitride and at least one kind of atom selected from the group consisting of hydrogen and halogen and said upper layer comprising a non-single-crystal material containing tetrahedrally bonded boron nitride and trihedrally bonded boron in mingled state wherein the weight ratio of tetrahedrally bonded boron nitride to trihedrally bonded boron nitride is at least about 1:1 and at least one kind of atom selected from the group consisting of hydrogen and halogen.

18. The light receiving member according to claim 17, wherein the surface layer contains a p-type dopant selected from the group consisting of Ge, Zn and a mixture thereof in an amount of less than $1\times10^3$ atomic ppm.

19. The light receiving member according to claim 17, wherein the surface layer contains an n-type dopant selected from the group consisting of Si, Sn and a mixture thereof in an amount of less than $1\times10^3$ atomic ppm.

20. The light receiving member according to claim 17, wherein the light receiving layer further contains one or more constituent layers.

21. The light receiving member according to claim 20, wherein the light receiving layer contains a charge injection inhibition layer comprising a non-single-crystal material containing silicon atoms as the matrix, at least one kind of atom selected from the group consisting of hydrogen and halogen, and an element selected from the group consisting of Group III and V elements of the Periodic Table.

22. The light receiving member according to claim 20, wherein the light receiving layer contains a long wavelength light absorptive layer comprising a non-single-crystal material containing silicon atoms as the matrix, at least one kind of atom selected from the group consisting of germanium and tin, and at least one kind of atom selected from the group consisting of hydrogen and halogen.

23. The light receiving member according to claim 20, wherein the light receiving layer contains an adhesiveness enhancing contact layer between the photoconductive layer and the substrate or between the photoconductive layer and the substrate or between the photoconductive layer and the layer thereunder, which comprises a non-single-crystal material containing silicon atoms as the matrix, at least one kind of atom selected for the group consisting of oxygen, carbon and nitrogen, and at least one kind of atom selected from the group consisting of hydrogen and halogen.

24. The light receiving member according to claim 20, wherein the light receiving layer contains an intermediate layer between the photoconductive layer and the surface layer, which comprises a non-single-crystal material containing silicon atoms as the matrix, carbon atoms and at least one kind of atom selected from the group consisting of hydrogen and halogen.

25. An electrophotographic process comprising the steps of:

(a) applying an electric field to the light receiving member of claim 1; and (b) applying an electromagnetic wave to said light receiving member thereby forming an electrostatic image.

26. An electrophotographic process comprising the steps of:

(a) applying an electric field to the light receiving member of claim 9; and (b) applying an electromagnetic wave to said light receiving member thereby forming an electrostatic image.

27. An electrophotographic process comprising the comprising the steps of:

(a) applying an electric field to the light receiving member of claim 17; and (b) applying an electromagnetic wave to said light receiving member thereby forming an electrostatic image.

* * * * *

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

IN [57] ABSTRACT

Line 2, "an" should read --a--.
Line 6, "an especial" should read --a special--.
Line 15, "property" should read --property,--.
Line 17, "member" should read --members--.
Line 25, "either" should read --neither--.

COLUMN 1

Line 37, "member" should read --members--.

COLUMN 2

Line 4, "has" should read --have--.
Line 62, "is" should read --it is--.
Line 65, "is" should read --it is--.

COLUMN 3

Line 5, "bring" should read --brings--.
Line 65, "an acknowledge" should read --the knowledge--.

COLUMN 4

Line 22, "kind" should read --kind of--.
Line 52, "having" should be deleted.

--

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 5

Line 29, "which" should read --in which--.
Line 38, "constitutions" should read --constitution--.
Line 39, "which" should read --in which--.
Line 49, "constitutions" should read --constitution--.
Line 50, "which" should read --in which--.
Line 60, "constitutions" should read --constitution--.
Line 61, "which" should read --in which--.

COLUMN 6

Line 2, "constitutions" should read --constitution--.
Line 3, "which" should read --in which--.
Line 13, "constitutions" should read --constitution--.
Line 14, "which" should read --in which--.
Line 24, "constitutions" should read --constitution--.
Line 25, "which" should read --in which--.
Line 35, "constitutions" should read --constitution--.
Line 36, "which" should read --in which--.
Line 47, "constitutions" should read --constitution--.
Line 48, "which" should read --in which--.
Line 51, "photoconducting" should read --photoconductive--.
Line 62, "Ti Pt" should read --Ti, Pt--.

COLUMN 7

Line 7, "Cr,," should read --Cr,--.
Line 36, "to dispose" should read --disposed--.

--

UNITED STATES PATENT AND TRADEMARK OFFICE

CERTIFICATE OF CORRECTION

PATENT NO. :4,845,001

DATED :July 4, 1989

INVENTOR(S) :TETSUYA TAKEI, ET AL.

It is certified that error appears in the above-identified patent and that said Letters Patent is hereby corrected as shown below:

COLUMN 8

Line 21, "atoms" should read --of atom--.
Line 26, "30" should read --to 30--.
Line 38, "to dispose" should read --disposed--.
Line 49, ""A—si(-" should read --"A—Si(- --.

COLUMN 9

Line 13, "to dispose" should read --disposed--.
Line 22, "atom" should read --of atom--.
Line 26, "atom" should read --of atom--.
Line 40, "tp" should read --to--.
Line 66, "kind atom" should read --kind of atom--.

COLUMN 11

Line 7, "haogen" should read --halogen--.
Line 8, "incorporate" should read --incorporated--.
Line 12, "it" should read --its--.
Line 13, "kind" should read --kind of--.
Line 34, "desitred" should read --desired--.
Line 52, "fthe" should read --the--.

COLUMN 12

Line 22, "th" should read --the--.
Line 62, "to dispose" should read --disposed--.

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 13

Lines 38-39, "Non—BH(H,X)" should read --Non—BN(H,X)--.
Line 63, "Non—Bn(H,X)" should read --Non—BN(H,X)--.

COLUMN 15

Line 35, "b," should read --B,--.

COLUMN 16

Line 63, "compunds" should read --compounds--.

COLUMN 17

Line 13, "material" should read --materials--.
Line 30, "silanes are" should read --silanes as--.

COLUMN 19

Line 59, "ozone ($O_2$)," should read --ozone ($O_3$),--.

COLUMN 22

Line 33, "to," should read --to--.
Line 39, "to as" should read --as--.

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 23

Line 19, "usually the" should read --usually be--.
Line 38, "203," should read --202,--.
Line 40, "gas"" should read --gas")--.
Line 62, "and 250." should read --and 250 are closed--.

COLUMN 24

Line 7, "to a" should read --to obtain a--.
Line 25, "in stead" should read --instead--.
Line 26, "holds" should read --fold--.
Line 38, "was" should read --way--.
Line 53, "upon" should be deleted.
Line 67, "fo" should read --of--.

COLUMN 25

Line 40, "cordination" should read --coordination--.
Line 54, "cordination" should read --coordination--.
Line 62, "vias" should read --bias--.

COLUMN 26

Lines 34-35, "evoluted" should read --evaluated--.
Line 38, "wavelengths" should read --wavelength--.
Line 40, "infringe" should read --interference fringe--.
Line 45, "infringe" should read --interference fringe--.

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 27

Line 37, "21,to" should read --21, to--.

COLUMN 28

Line 37, "Table 25," should read --Table 32,--.

COLUMN 30

Line 9, "evluated" should read --evaluated--.
Line 20, "Table 29." should read --Table 47.--.

COLUMN 31

Line 59, "wre" should read --were--.

COLUMN 35

Line 36, "cordination" should read --coordination--.
Line 59, "cordination" should read --coordination--.
Line 62, "nitridde" should read --nitride--.
Line 67, "vias" should read --bias--.

COLUMN 36

Lines 6-7, "and trihedrally bonded boron nitride" should be deleted.
Line 46, "infringe" should read --interference fringe--.
Line 51, "infringe" should read --interference fringe--.

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 40

Line 46, "Table 153." should read --Table 123.--.

COLUMN 44

Line 63, "provided These" should read --provided. These--.

COLUMN 45

Line 28, "of the" should read --on the--.
Line 33, "appearity" should read --appearing--.
Line 49, "cordination" should read --coordination--.

COLUMN 46

Line 1, "cordination" should read --coordination--.
Line 11, "vias" should read --bias--.
Line 12, "vias" should read --bias--.
Line 67, "infringe" should read --interference fringe--.

COLUMN 47

Line 4, "infringe" should read --interference fringe--.

COLUMN 52

Line 20, "The resultant" should read --¶ The resultant--.
Line 68, "51." should read --51,--.

--

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 55

Line 22, "provided These" should read --provided. These--.
Line 45, "For the" should read --The--.
Line 47, "it" should be deleted.
Line 67, "Further" should read --Further,--.

COLUMN 56

Line 9, "cordination" should read --coordination--.
Line 31, "vias" should read --bias--.
Line 52, "a s" should read --as--.
Line 52, "Table 7" should read --Table 209-- (both occurrences).

COLUMN 57

Line 13, "infringe" should read --interference fringe--.
Line 18, "infringe" should read --interference fringe--.

COLUMN 60

Line 50, "44." should read --44,-- and "Table 277" should read --Table 227--.
Line 63, "Table 279," should read --Table 229,--.

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 63

Line 54, "evauated" should read --evaluated--.

COLUMN 65

Line 62, "For the" should read --The--.
Line 64, "it" should be deleted.

COLUMN 66

Line 12, "worm" should read --worn--.
Line 16, "Further" should read --Further,--.
Line 25, "cordination" should read --coordination--.
Line 33, "from" should read --form--.
Line 36, "exceled" should read --excelled--.
Line 40, "Table 276(b)" should read --Table 267(b)--.
Line 42, "therby" should read --thereby--.
Line 47, "cordination" should read --coordination--.
Line 57, "vias" should read --bias--.
Line 66, "samples. It" should read --samples, it--.

COLUMN 67

Line 39, "infringe" should read --interference fringe--.
Line 44, "infringe" should read --interference fringe--.

--

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 68

Line 28, "drum." should read --drums.--.

COLUMN 76

Line 14, "on the" should read --on an--.
Line 17, "kind" should read --kind of--.
Line 19, "For the" should read --The--.
Line 20, "kind" should read --kind of--.
Line 21, "it" should be deleted.
Line 42, "Further" should read --Further,--.
Line 49, "registance" should read --resistance--.
Line 52, "cordination" should read --coordination--.

COLUMN 77

Line 4, "cordination" should read --coordination--.
Line 14, "vias" should read --bias--.
Line 15, "vias" should read --bias--.
Line 62, "Table (b)" should read --Table 336(b)--.

COLUMN 78

Line 2, "infringe" should read --interference fringe--.
Line 7, "infringe" should read --interference fringe--.

COLUMN 84

Line 2, "51." should read --51,--.
Line 63, "Table 353,and" should read --Table 353, and--.

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 86

Line 41, "provided These" should read --provided. These--.

COLUMN 107

TABLE 41, "Ir absorptive" should read --IR absorptive--.

COLUMN 109

TABLE 41-continued, "21400" should read --24100--.
TABLE 42, "No" should read --NO--.

COLUMNS 115-116

TABLE 56, " 80 250 170 0.25 3
20
1000 ppm
5
5
100 250 150 0.35 3 "

should read

-- 80 250 170 0.25 3
20
1000 ppm
5
5
100 250 150 0.35 3 --.

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 115-116

TABLE 56, "Charge injection inhibition layer 4" through "Charge injection inhibition layer 6" and all layer forming conditions should be inserted as follows:

| Name of layer | Gas used and its flow rate (SCCM) | Substrate temperature (℃) | RF power (W) | Inner pressure (Torr) | Layer thickness (μm) |
|---|---|---|---|---|---|
| Charge injection inhibition layer 4 | $SiH_4$ 100<br>$B_2H_6$ (against $SiH_4$) 800ppm<br>NO 4<br>$N_2$ 4<br>$CH_4$ 6 | 250 | 130 | 0.25 | 3 |
| Charge injection inhibition layer 5 | $SiH_4$ 100<br>$H_2$ 100<br>$PH_3$ (against $SiH_4$) 800ppm | 250 | 150 | 0.35 | 3 |
| Charge injection inhibition layer 6 | $SiH_4$ 100<br>$PH_3$ (against $SiH_4$) 800ppm<br>$GeH_4$ 10<br>NO 10 | 250 | 130 | 0.25 | 3 |

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 116

TABLE 59, " Charge injection layer " should read -- Charge injection inhibition layer --.

COLUMN 118

TABLE 59-continued,

" Charge injection layer " should read -- Charge injection inhibition layer --.

COLUMNS 117-118

TABLE 61, "100 250 130 0.25 3
800 ppm
10
10
100 250 150 0.35 3 "

should read

-- 100 250 130 0.25 3
800 ppm
10
10
100 250 150 0.35 3 --.

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMNS 119-120

TABLE 64, "100 250 130 0.25 3
800 ppm
4
4
6
100 250 130 0.25 3
800 ppm
10
10
100 250 150 0.35 3 "

should read

-- 100 250 130 0.25 3
800 ppm
4
4
6
100 250 130 0.25 3.
800 ppm
10
10
100 250 150 0.35 3 --.

COLUMN 120

Line 39, insert --TABLE 68-- as a heading.

--

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 125

TABLE 79, "150 V" should read -- -150 V--.

COLUMN 127

TABLE 88, " Increase defective image " should read -- Increase of defective image -- .
◎ ○

COLUMN 128

TABLE 88-continued,

" Surface abrasion " should read -- Surface abrasion -- .
○

COLUMN 129

TABLE 91, "○: Excellent" should read --◎: Excellent--.

COLUMN 135

TABLE 110, " Photo-conducitve layer 5 " should read -- Photo-conductive layer 5 --.

--

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 135

TABLE 112,

"Photo-layer 1 Photo-layer 2 Photo-layer 3 Photo-layer 4 Photo-layer 5 Photo-layer 6"

should read

--Photo-conductive layer 1 Photo-conductive layer 2 Photo-conductive layer 3 Photo-conductive layer 4 Photo-conductive layer 5 Photo-conductive layer 6--.

COLUMN 138

TABLE 115, "7446 7477" should read --7446 7447--.

COLUMN 145

TABLE 127, "8631 8662" should read --8631 8632--.

COLUMN 152

TABLE 144, "$B_2H_6He$ (20%)" should read --$B_2H_6/He$ (20%)--.

--

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 154

TABLE 148-continued, "fogginess ○ " should read --fogginess ⊙ --.

TABLE 149, "Intial" should read --Initial--.

COLUMN 155

TABLE 151, "Intial" should read --Initial--.

TABLE 152, "$B_2H_6$He (20%)" should read --$B_2H_6$/He (20%)--.

COLUMN 156

TABLE 153, "Intial" should read --Initial--.

TABLE 155, "Intial" should read --Initial--.

COLUMN 157

TABLE 157, "Intial" should read --Initial--.

TABLE 159, "Intial" should read --Initial--.

COLUMN 159

TABLE 161, "Intial" should read --Initial--.

--

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 160

TABLE 163, "

| electrification efficiency | Residual voltage |
|---|---|
| ○ | ⊙ |

"

should read

--

| electrification efficiency | Residual voltage |
|---|---|
| ⊙ | ○ |

--.

COLUMN 166

TABLE 174, "12799 12700" should read --12799 127100--.

COLUMN 167

TABLE 175, "conductve" should read --conductive-- and "18241" should read --12841--.

COLUMN 172

TABLE 183-continued, "absoprtive" should read --absorptive--.

--

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 174

TABLE 192, "(SSCM)" should read --(SCCM)--.

COLUMN 177

TABLE 197, "14929 14990" should read --14929 14930-- and "14975" 14996" should read --14975 14976--.

COLUMN 178

TABLE 198, "15051 15002" should read --15001 15002--.

TABLE 199, "(SSCM)" should read --(SCCM)--.

COLUMN 181

TABLE 204, "Intial" should read --Initial--.

COLUMN 191

TABLE 222, "16702 $SiF_4$" should read --16702 $SiH_4$--.

COLUMN 193

TABLE 224, "16304" should read --16904-- and "16309*" should read --16909*--.

--

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 197

TABLE 230, "17362" should read --17332--.

COLUMN 203

TABLE 241, "18402*" should read --18401*--.

COLUMN 204

TABLE 242, "18524 * 18526 * 18526" should read --18524 * 18525 * 18526--.

COLUMN 223

TABLE 280(b), "inhibition PH 3" should read --inhibition $PH_3$--.

COLUMN 230

TABLE 288, "22233" should read --22333--.

COLUMN 235

TABLE 297-continued, "layer 16*" should read --layer 16--.

--

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 237

TABLE 299, "layer 16*" should read --layer 16--.

COLUMN 239

| | | |
|---|---|---|
| TABLE 304, "23724 | should | --23724 |
| * | read | * |
| 23726 | | 23725 |
| * | | * |
| 23726" | | 23726--. |

COLUMN 240

| | | |
|---|---|---|
| TABLE 305, "23849 | should | --23849 |
| | read | |
| 23840 | | 23850 |
| 23851" | | 23851--. |

COLUMN 247

| | | |
|---|---|---|
| TABLE 320, "25268 | should | --25268 |
| | read | |
| 25268" | | 25269-- |

and "25171" should read --25271--.

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 249

TABLE 324, "$B_3H_6$" should read --$B_2H_6$--.

COLUMN 251

TABLE 328, "Intial" should read --Initial--.

COLUMN 253

TABLE 329(b)-continued, "$B_2H_6He$" should read --$B_2H_6/He$--.
TABLE 330, "Intial" should read --Initial--.

COLUMN 254

TABLE 331, "Intial" should read --Initial--.

COLUMN 255

TABLE 333, "Intial" should read --Initial--.

COLUMN 256

TABLE 335, "Intial" should read --Initial--.

COLUMN 257

TABLE 337, "Intial" should read --Initial--.

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 258

TABLE 339, "Intial" should read --Initial--.

COLUMN 259

TABLE 340(a), "(lower" should read --(lower layer)--.

TABLE 341, "Intial" should read --Initial--.

COLUMN 261

TABLE 342(a)-continued, "$NH_3$)" should read --$NH_3$)--.

TABLE 343, "Intial" should read --Initial--.

TABLE 344(a), "Hz" should read --$H_2$--.

COLUMN 263

TABLE 345, "Intial" should read --Initial--.

COLUMN 265

TABLE 347, "27206 27204" should read --27203 27204--.

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMN 271

TABLE 356, "*markless" should read --markless--.

COLUMN 272

TABLE 358, "22813" should read --28113--.

COLUMN 273

TABLE 359, "28036" should read --28236--.
TABLE 360, "29310" should read --28310--;
"29329" should read --28329--;
"29349" should read --28349--;
"29369" should read --28369--.

COLUMN 275

TABLE 361, "29410" should read --28410--;
"29429" should read --28429--;
"29449" should read --28449--;
"29469" should read --28469--.
TABLE 362, "28405*" should read --28505*--.

COLUMN 280

TABLE 370, "andsurface" should read --and surface--.

UNITED STATES PATENT AND TRADEMARK OFFICE

CERTIFICATE OF CORRECTION

PATENT NO. : 4,845,001

DATED : July 4, 1989

INVENTOR(S) : TETSUYA TAKEI, ET AL.

It is certified that error appears in the above-identified patent and that said Letters Patent is hereby corrected as shown below:

COLUMNS 289-290

TABLE 387,

"$B_2H_6$/He (20%) 500 250 100 0.35 0.3"

should read

--$B_2H_6$/He (20%) 500 250 100 0.35 0.3--.

COLUMN 290

Line 59, "non-sig-" should read --non-sin- --.
Line 60, "nle-crystal" should read --gle-crystal--.

COLUMN 291

Line 13, "group" should read --the group--.

COLUMN 293

Line 26, "substrate or between the" should be deleted.
Line 27, "photoconductive layer and the" should be deleted.

--

UNITED STATES PATENT AND TRADEMARK OFFICE

CERTIFICATE OF CORRECTION

PATENT NO. :4,845,001

DATED :July 4, 1989

INVENTOR(S) :TETSUYA TAKEI, ET AL.

It is certified that error appears in the above-identified patent and that said Letters Patent is hereby corrected as shown below:

COLUMN 294

Line 25, "comprising the" should be deleted.

Signed and Sealed this

Thirty-first Day of March, 1992

*Attest:*

HARRY F. MANBECK, JR.

*Attesting Officer*

*Commissioner of Patents and Trademarks*